US005501927A

United States Patent [19]

Imai et al.

[11] Patent Number: 5,501,927

[45] Date of Patent: Mar. 26, 1996

[54] ELECTROPHOTOGRAPHIC PHOTORECEPTORS

[75] Inventors: Akira Imai; Toru Ishii; Akihiko Tokida; Yutaka Akasaki, all of Kanagawa, Japan

[73] Assignee: Fuji Xerox Co., Ltd., Tokyo, Japan

[21] Appl. No.: 80,132

[22] Filed: Jun. 23, 1993

Related U.S. Application Data

[63] Continuation of Ser. No. 692,297, Apr. 26, 1991, abandoned.

[30] Foreign Application Priority Data

| | | | |
|---|---|---|---|
| Apr. 27, 1990 | [JP] | Japan | 2-110203 |
| Apr. 27, 1990 | [JP] | Japan | 2-110204 |
| Apr. 27, 1990 | [JP] | Japan | 2-110205 |
| Apr. 27, 1990 | [JP] | Japan | 2-110206 |
| Apr. 27, 1990 | [JP] | Japan | 2-110207 |
| Apr. 27, 1990 | [JP] | Japan | 2-110208 |

[51] Int. Cl.[6] ..... G03G 5/06

[52] U.S. Cl. ..... 430/78; 430/79

[58] Field of Search ..... 430/59, 76, 78, 430/83, 58, 79, 82

[56] References Cited

U.S. PATENT DOCUMENTS 4,299,896 11/1981 Hashimoto et al. ..... 430/58

(List continued on next page.)

FOREIGN PATENT DOCUMENTS 60-29108 2/1979 Japan .

(List continued on next page.)

OTHER PUBLICATIONS

*Organic Chemistry,* Morrison & Boyd, pp. 229, 837–838.

*Primary Examiner*—Christopher D. Rodee
*Attorney, Agent, or Firm*—Finnegan, Henderson, Farabow, Garrett & Dunner

[57] ABSTRACT

An electrophotographic photoreceptor including a light-sensitive layer containing a bisazo or trisazo compound represented by formula (I-1), (II-1), (III,1), (IV-1), (V-1) or (VI-1):

(I-1)

(II-1)

(Abstract continued on next page.)

-continued
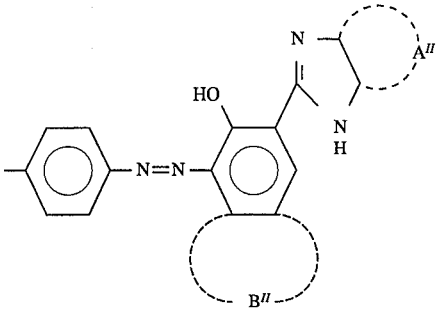
(III-1)
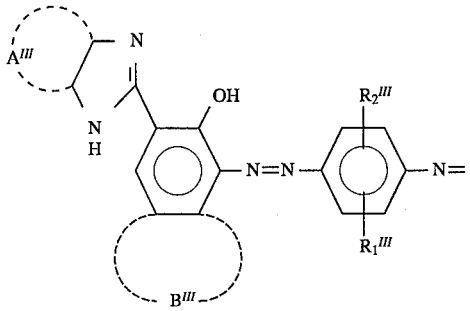
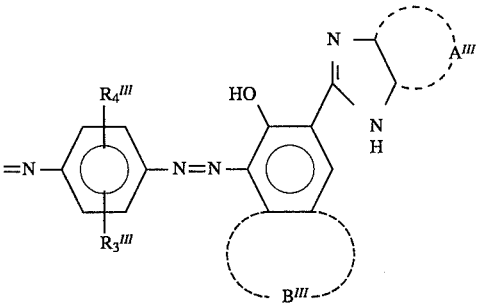
(IV-1)
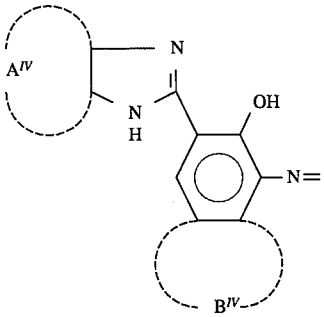
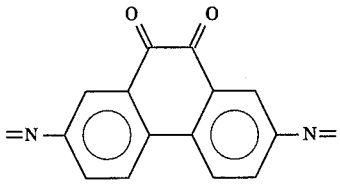
-continued
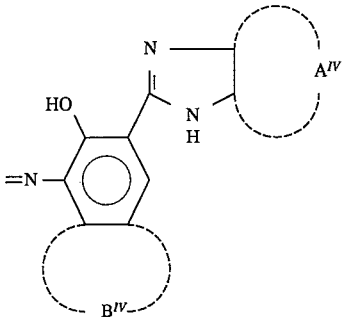
(V-1)
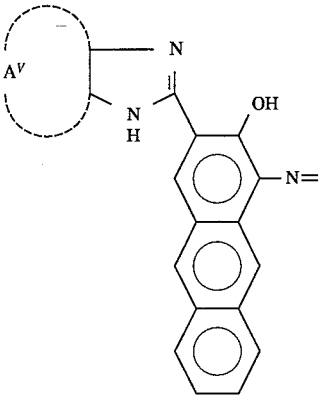
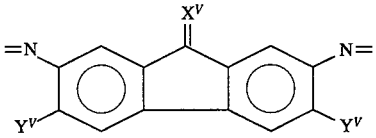
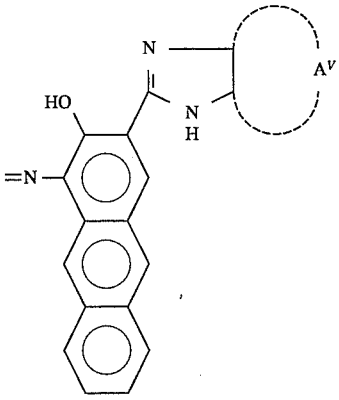
(VI-1)
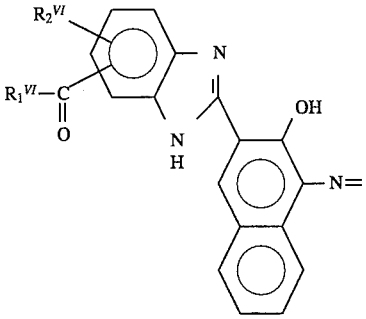

-continued
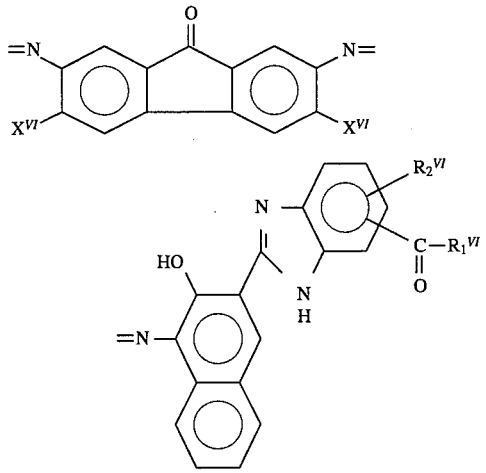
17 Claims, No Drawings
U.S. PATENT DOCUMENTS
| | | | |
|---|---|---|---|
| 4,314,015 | 2/1982 | Hashimoto et al. | 430/58 |
| 4,343,882 | 8/1982 | Hashimoto | 430/58 |
| 4,515,881 | 5/1985 | Sawada et al. | 430/58 |
| 4,687,721 | 8/1987 | Emoto et al. | 430/58 |
| 4,743,523 | 5/1988 | Yamashita et al. | 430/58 |
| 4,820,600 | 4/1989 | Akasaki et al. | 430/76 |
| 4,956,255 | 9/1990 | Uedo | 430/59 |
FOREIGN PATENT DOCUMENTS
| | | | |
|---|---|---|---|
| 56-143437 | 11/1981 | Japan . | |
| 57-116345 | 7/1982 | Japan . | |
| 58-194035 | 11/1983 | Japan . | |
| 60-29109 | 7/1985 | Japan . | |
| 60-189759 | 9/1985 | Japan . | |
| 60-196770 | 10/1985 | Japan . | |
| 61-23155 | 1/1986 | Japan . | |
| 61-129653 | 6/1986 | Japan . | |
| 61-228453 | 10/1986 | Japan . | |
| 62-139564 | 6/1987 | Japan . | |
| 63-44663 | 2/1988 | Japan . | |
| 63-38945 | 2/1988 | Japan . | |
| 63-36256 | 2/1988 | Japan | 430/76 |
| 63-113466 | 5/1988 | Japan | 430/76 |

ELECTROPHOTOGRAPHIC PHOTORECEPTORS

This application is a continuation of application Ser. No. 07/692,297, filed Apr. 26, 1991, now abandoned.

FIELD OF THE INVENTION

The present invention relates to electrophotographic photoreceptors, more particularly to electrophotographic photoreceptors comprising light-sensitive layers containing specific bisazo or trisazo pigments.

BACKGROUND OF THE INVENTION

Light-sensitive materials extensively used in electrophotography include inorganic photoconductive materials such as amorphous selenium, selenium alloys, cadmium sulfide and zinc oxide, and organic photoconductive materials typified by polyvinyl carbazole and derivatives thereof. Organic photoconductive materials have the advantage that they are superior to inorganic photoconductive materials with respect to transparency, film-forming property, flexibility and production rate.

An electrophotographic photoreceptors containing various azo pigments in light-sensitive layers have been recently proposed in, for example, JP-B-60-29108 (the term "JP-B" as used herein means an "examined Japanese patent publication"), JP-B-60-29109, JP-A-60-189759 (the term "JP-A" as used herein means an "unexamined published Japanese patent application), JP-A-61-23155, JP-A-62-139564, JP-A-63-44663, JP-A-61-228453, JP-A-57-116345, JP-A-56-143437, JP-A-61-129653, JP-A-58-194035, JP-A-60-196770 and JP-A-63-38945).

However, the performance of electrophotographic photoreceptors using the so far proposed azo pigments is not completely satisfactory with respect to photosensitivity, chargeability and durability.

Further, those photoreceptors cannot be used satisfactorily with printers and other equipment that employ a semiconductor laser as a light source.

SUMMARY OF THE INVENTION

An object of the present invention is to provide electrophotographic photoreceptors that use azo pigments and that yet exhibit high sensitivity and durability.

Another object of the present invention is to provide electrophotographic photoreceptors that have high sensitivity to a wide variety of light sources including semiconductor lasers.

These objects of the present invention can be achieved by an electrophotographic photoreceptor comprising a light-sensitive layer containing a bisazo or trisazo compound represented by formula (I-1), (II-1), (III-1), (IV-1), (V-1) or (VI-1):

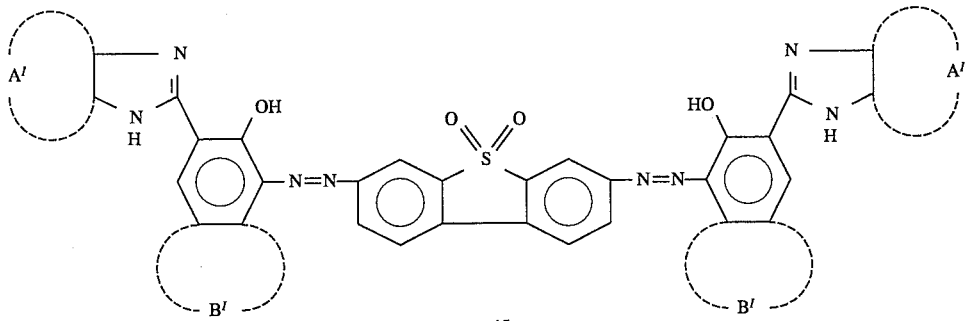

(I-1)

wherein $A^I$ represents the atomic group necessary to form an aromatic ring or hereto ring which may be substituted; and $B^I$ represents the atomic group necessary to form a naphthalene ring or a carbazole ring which may be substituted;

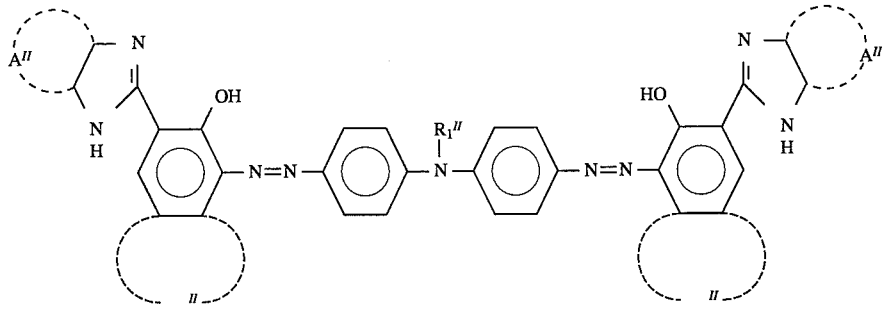

(II-1)

wherein $A^{II}$ represents the atomic group necessary to form an aromatic ring or hetero ring which may be substituted; $B^{II}$ represents the atomic group necessary to form a naphthalene ring or a carbazole ring which may be substituted; and $R_1^{II}$ represents a hydrogen atom, an alkyl group, an aryl group which may be substituted or a benzyl group;

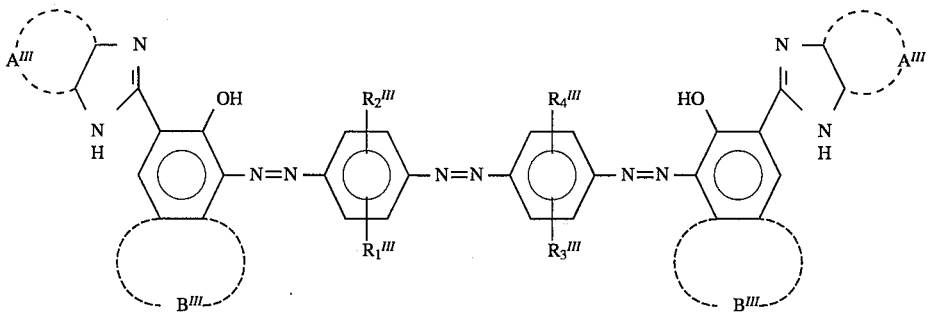

(III-1)

wherein $A^{III}$ represents the atomic group necessary to form an aromatic ring or hetero ring which may be substituted; $B^{III}$ represents the atomic group necessary to form a benzene ring, a naphthalene ring or a carbazole ring which may be substituted; $R_1^{III}$, $R_2^{III}$, $R_3^{III}$ and $R_4^{III}$ each represents a hydrogen atom, a halogen atom, an alkyl group or an alkoxy group, or $R_1^{III}$ and $R_2^{III}$ or $R_3^{III}$ and $R_4^{III}$ respectively represent the atomic groups necessary to form, in combination with each other, a naphthalene ring taken together with the benzene ring;

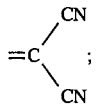

$Y^V$ represents a hydrogen atom or a halogen atom; and $A^V$ represents the atomic group necessary to form an aromatic ring or hetero ring which may be substituted;

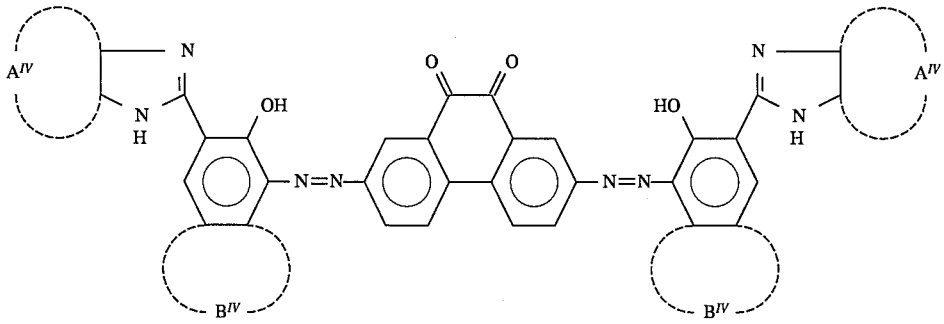

(IV-1)

wherein $A^{IV}$ represents the atomic group necessary to form an aromatic ring or hereto ring which may be substituted; and $B^{IV}$ represents the atomic group necessary to form a naphthalene ring or a carbazole ring which may be substituted;

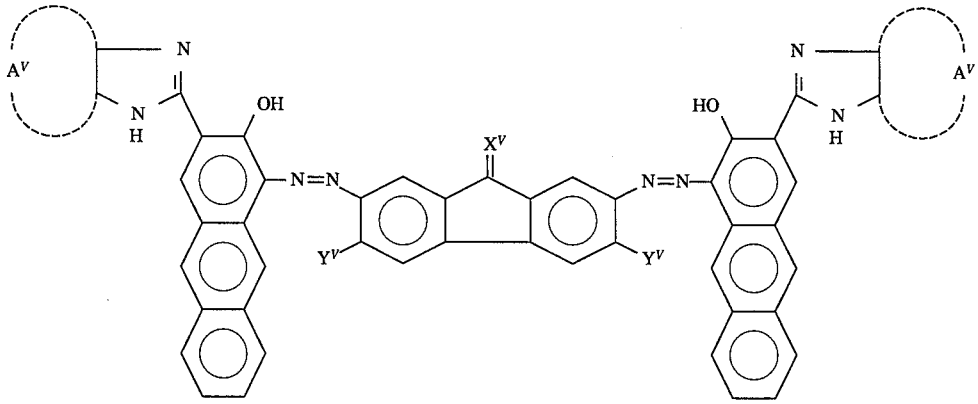

(V-1)

wherein $X^V$ represents an oxygen atom or a group

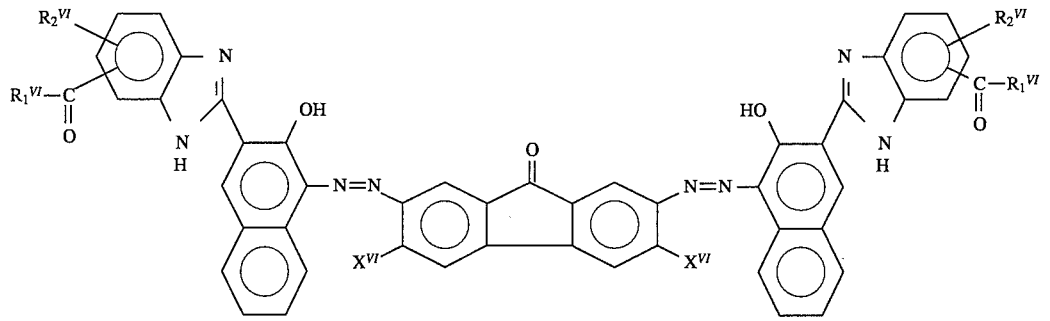

(VI-1)

wherein $X^{VI}$ represents a hydrogen atom or a halogen atom; $R_1^{VI}$ represents an alkyl group or aryl group which may be substituted; $R_2^{VI}$ represents a hydrogen atom, a halogen atom, an alkyl group, an aryl group, an alkoxy group, an acyl group or a nitro group, or $R_1^{VI}$ and $R_2^{VI}$ may combine with each other to form a monocyclic or polycyclic hydrocarbon ring which may be substituted.

DETAILED DESCRIPTION OF THE INVENTION

The six types of azo pigments to be used in the present invention are described hereinafter in detail.

The electrophotographic photoreceptor according to the first aspect of the present invention may comprise an electroconductive substrate having a light-sensitive layer containing as an azo pigment a bisazo compound represented by formula (I-1):

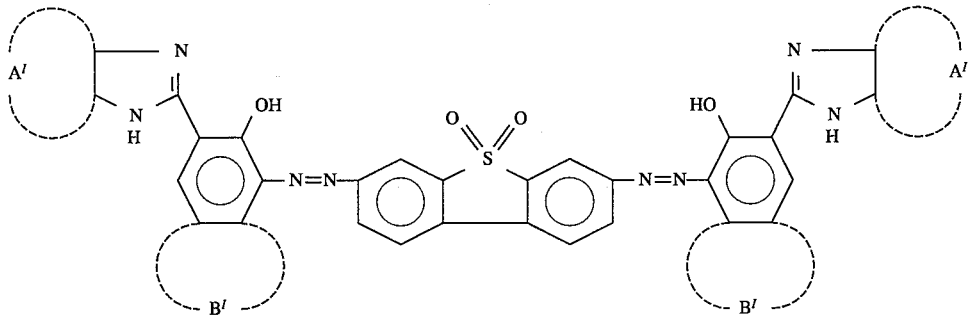

(I-1)

wherein $A^I$ represents the atomic group necessary to form an aromatic ring or hetero ring which may be substituted; and $B^I$ represents the atomic group necessary to form a naphthalene ring or a carbazole ring which may be substituted.

The first aspect of the present invention is described below in detail.

To further describe the bisazo compound represented by formula (I-1) which is used in the electrophotographic photoreceptor of the present invention, $A^I$ in the formula (I-1) represents the atomic group necessary to form an aromatic ring or a hetero ring which may be substituted. Considering materials characteristics and the ease of synthesis, a substituted or unsubstituted benzene ring is preferred.

In the case of a substituted benzene ring, examples of the substituents include a halogen atom, an alkyl group, an alkenyl group, an aralkyl group, an aryl group, an alkoxy group, an acyl group, a nitro group, a cyano group, a trifluoromethyl group or a β-dicyano-α-phenylvinyl group. Considering materials characteristics and the ease of synthesis, a fluorine atom, a chlorine atom, a bromine atom, a methyl group, an ethyl group, a methoxy group, an acetyl group, a benzoyl group which may be substituted and a nitro group are preferred.

In the formula (I-1), $B^I$ represents the atomic group necessary to form a naphthalene ring or a carbazole ring which may be substituted. If $B^I$ forms a substituted carbazole ring, examples of the substituents include a halogen atom, an alkyl group, an alkoxy group and a nitro group. Considering materials characteristics and the ease of synthesis, a chlorine atom, a bromine atom, a methyl group, a methoxy group and a nitro group are preferred.

Preferred examples of the bisazo compound represented by formula (I-1) which can be used in the present invention are compounds represented by formulas (I-2) and (I-3):

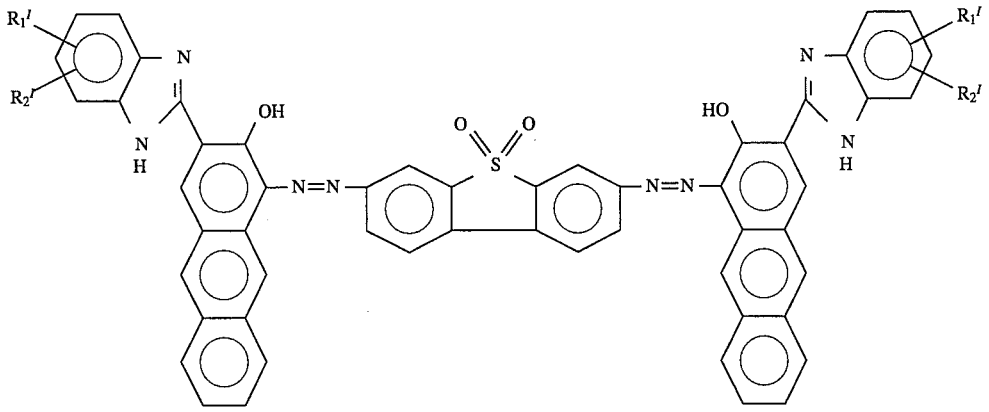

(I-2)

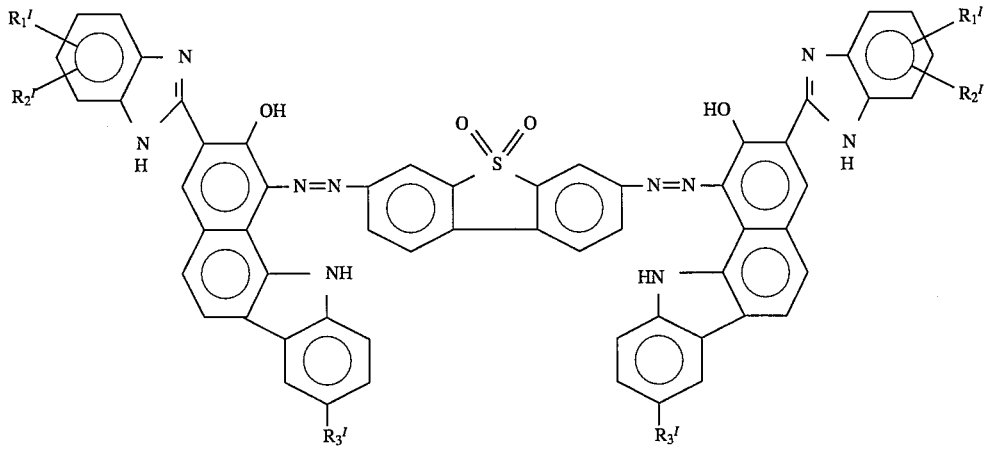

(I-3)

wherein $R_1^I$ and $R_2^I$ each represents a hydrogen atom, a halogen atom, an alkyl group (preferably having 1 to 4 carbon atoms), an alkenyl group, an aralkyl group, an aryl group, an alkoxy group, an acyl group, a nitro group, a cyano group, a trifluoromethyl group or a β-dicyano-α-phenylvinyl group (among these, a hydrogen atom, a methyl group, an ethyl group, a fluorine atom, a chlorine atom, a bromine atom, an iodine atom, a methoxy group, an acetyl group, a benzoyl group and a nitro group are preferred), or $R_1^I$ and $R_2^I$ represent atomic groups which, in combination with each other, form a monocyclic or polycyclic hydrocarbon ring which may be substituted; and $R_3^I$ represents a hydrogen atom, a halogen atom, an alkyl group (preferably having 1 to 4 carbon atoms), an alkoxy group or a nitro group (among these, a hydrogen atom, a methyl group, a methoxy group, a fluorine atom, a chlorine atom, a bromine atom and a nitro atom are preferred).

Specific examples of the bisazo compound (I-1) which may be used in the present invention are listed below but are by no means intended to limit the scope of the present invention.

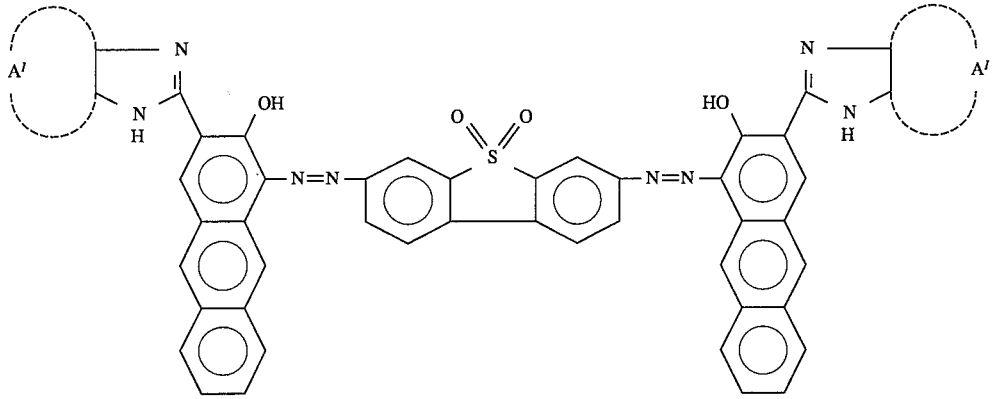
| Compound No. I- | $A^I$ | Compound No. I- | $A^I$ |
|---|---|---|---|
| 1 | 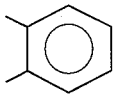 | 10 | 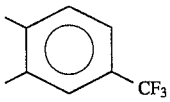 |
| 2 | 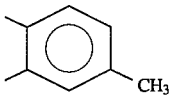 | 11 | 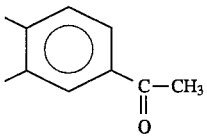 |
| 3 | 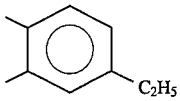 | 12 | 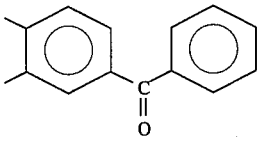 |
| 4 | 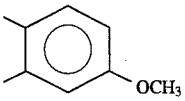 | 13 | 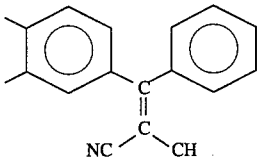 |
| 5 | 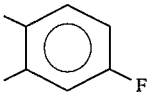 | 14 | 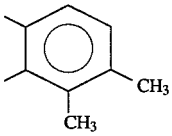 |
| 6 | 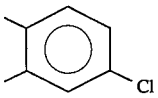 | 15 | 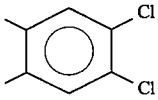 |
| 7 | 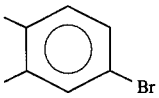 | 16 | 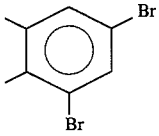 |
| 8 | 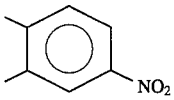 | 17 | 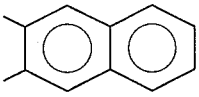 |

-continued
| | | | |
|---|---|---|---|
| 9 | 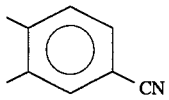 | 18 | 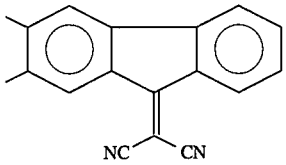 |
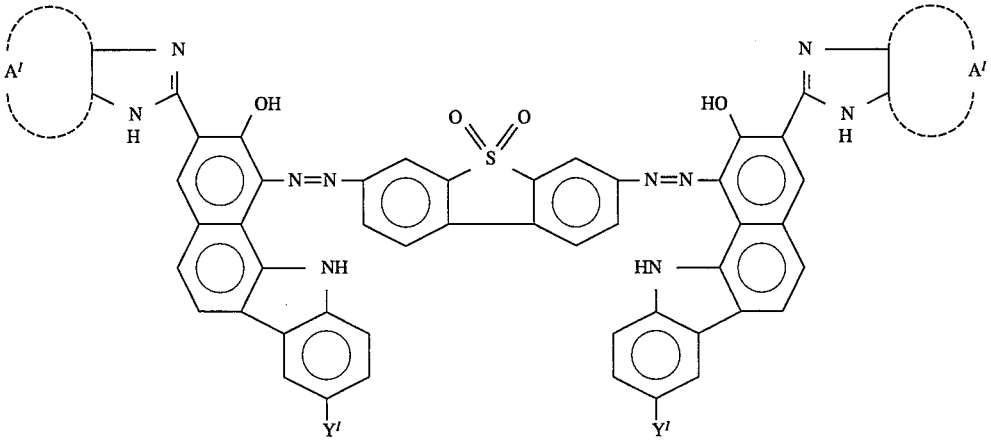
| Compound No. I- | $A^I$ | $Y^I$ | Compound No. I- | $A^I$ | $Y^I$ |
|---|---|---|---|---|---|
| 19 | 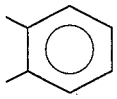 | H | 42 | 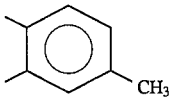 | $OCH_3$ |
| 20 | 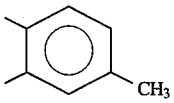 | H | 43 | 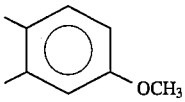 | $OCH_3$ |
| 21 | 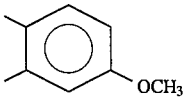 | H | 44 | 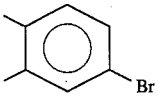 | $OCH_3$ |
| 22 | 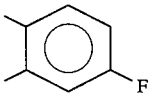 | H | 45 | 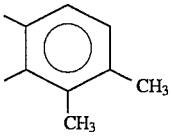 | $OCH_3$ |
| 23 | 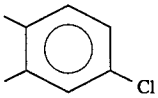 | H | 46 | 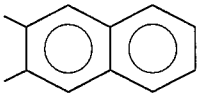 | $OCH_3$ |
| 24 | 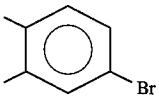 | H | 47 | 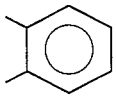 | Cl |
| 25 | 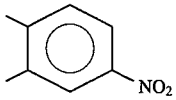 | H | 48 | 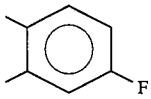 | Cl |
| 26 | 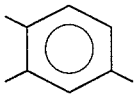 | H | 49 | 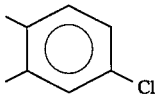 | Cl |

-continued
| | | | | | |
|---|---|---|---|---|---|
| 27 | 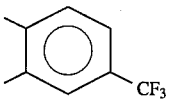 | H | 50 | 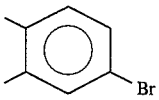 | Cl |
| 28 | 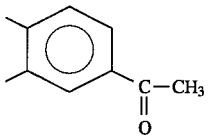 | H | 51 | 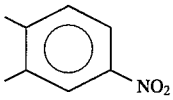 | Cl |
| 29 | 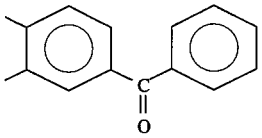 | H | 52 | 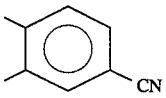 | Cl |
| 30 | 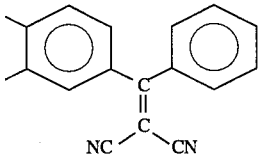 | H | 53 | 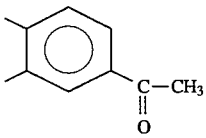 | Cl |
| 31 | 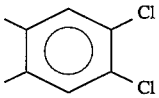 | H | 54 | 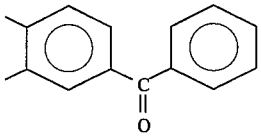 | Cl |
| 32 | 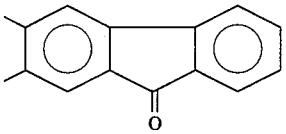 | H | 55 | 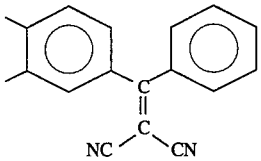 | Cl |
| 33 | 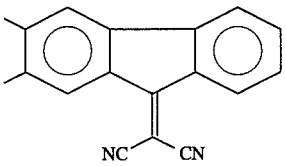 | H | 56 | 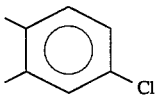 | Br |
| 34 | 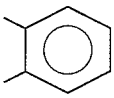 | $CH_3$ | 57 | 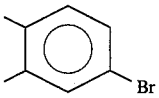 | Br |
| 35 | 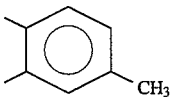 | $CH_3$ | 58 | 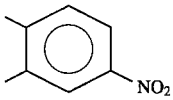 | Br |
| 36 | 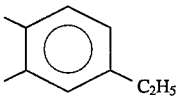 | $CH_3$ | 59 | 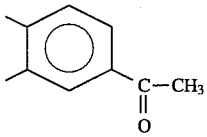 | Br |
| 37 | 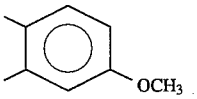 | $CH_3$ | 60 | 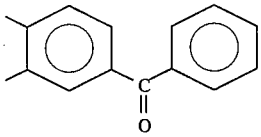 | Br |

-continued

| | | | | | |
|---|---|---|---|---|---|
| 38 | 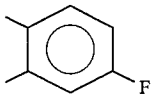 | $CH_3$ | 61 | 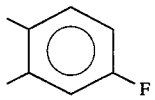 | Br |
| 39 | 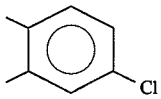 | $CH_3$ | 62 | 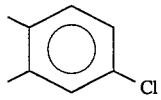 | $NO_2$ |
| 40 | 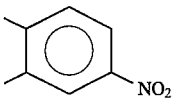 | $CH_3$ | 63 | 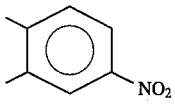 | $NO_2$ |
| 41 | 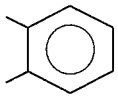 | $OCH_3$ | 64 | 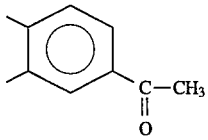 | $NO_2$ |
| | | | 65 | 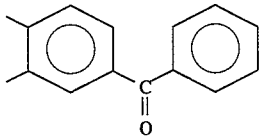 | $NO_2$ |

Bisazo compounds of the formula (I-1) for use in the first aspect of the present invention can be synthesized by known methods. For example, 2,7-diaminodibenzothiophene- 9,9-dioxide is tetrazotized in the usual manner to obtain a tetrazonium salt, which is isolated in a suitable form such as a borofluoride or hexafluorophosphate and subjected to coupling with a compound represented by the following formula (I-4) in an appropriate solvent (e.g. N, N-dimethylformamide, N-methylpyrrolidone or dimethyl sulfoxide) in the presence of a base such as sodium acetate or triethylamine:

(I-4)

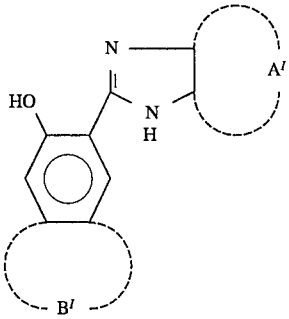

(where $A^I$ and $B^I$ have the same meanings as defined in the above formula ( I-1)).

Typical examples of the synthesis of bisazo compounds (I-1) to be used in the first aspect of the present invention are described below.

Synthesis Example I-1 (synthesis of Compound No. I-1)

2,7-Diaminodibenzothiophene-9,9-dioxide (12.3 g, 0.05 mol) is dispersed in 200 ml of 6 N-HCl. Thereafter, a solution having 7.6 g (0.11 mol) of sodium nitrite dissolved in 20 ml of water is added dropwise to the dispersion at 0°–5° C. under cooling with ice over a period of 10 min. After the dropwise addition, the mixture is subjected to continued stirring at the same temperature for about 20 min and the insoluble matter is filtered off. To the filtrate, 50 ml of 42 wt % borofluoric acid is added and the resulting precipitate is recovered by filtration, washed with ice water, alcohol and then ether, and dried under reduced pressure at room temperature to obtain dibenzothiophene-9,9-dioxide-2,7-bisdiazonium bistetrafluoroborate in an amount of 20.2 g (yield: 91%).

Subsequently, 3.41 g (0.11 mol) of 3-(2'-benzimidazolyl)-2-hydroxyanthracene is dissolved in 500 ml of N,N-dimethylformamide and the solution is cooled to about 0° C. Thereafter, 2.22 g (0.005 mol) of the previously prepared tetrazonium salt is dissolved in the cooled solution. To the stirred solution, a solution having 1.7 ml (0.012 mol) of triethylamine diluted with 10 ml of N,N-dimethylformamide is added dropwise over a period of about 5 min. After the dropwise addition, stirring is continued at room temperature for about 1 hour and the resulting precipitate is recovered by filtration. The recovered precipitating cake is dispersed in 500 ml of N,N-dimethylformamide and, following 1 hour-stirring at about 80° C., the precipitate is again separated by filtration.

These procedures are repeated 5 times and the resulting precipitate is washed first with water, then with acetone, and dried to obtain a bisazo compound (Compound No. I-1) in an amount of 3.63 g (yield: 82%). m.p.: 350° C. or more.

Elemental analysis for $C_{54}H_{32}N_8O_4S$

| | Cal'd | Found |
|---|---|---|
| C (%) | 72.96 | 72.71 |
| H (%) | 3.63 | 3.50 |
| N (%) | 12.61 | 12.46 |

IR absorption spectrum (KBr tablet)

1600 $cm^{-1}$ (C=N)

Synthesis Example I-2 (synthesis of Compound No. I-23)

A reaction and a post-treatment are performed in the same manner as in Synthesis Example I-1 except that 4.21 g (0.011 ml) of 3-(5"-chloro-2"-benzimidazolyl)-2-hydroxy-1',2'-benzocarbazole is used as the coupling component. As a result, a bisazo compound (Compound No. I-23) is obtained as a dark brown powder in an amount of 3.49 g (yield: 67%). m.p.: 350° C. or more.

| Elemental analysis for $C_{58}H_{32}N_{10}O_4Cl_2S$ | | |
|---|---|---|
| | Cal'd | Found |
| C (%) | 67.25 | 66.92 |
| H (%) | 3.11 | 2.99 |
| N (%) | 13.52 | 13.38 |

IR absorption spectrum (KBr tablet)

1600 $cm^{-1}$ (C=N)

The electrophotographic photoreceptor according to the second aspect of the present invention may comprise an electroconductive substrate having a light-sensitive layer containing as an azo pigment a bisazo compound represented by formula (II-1):

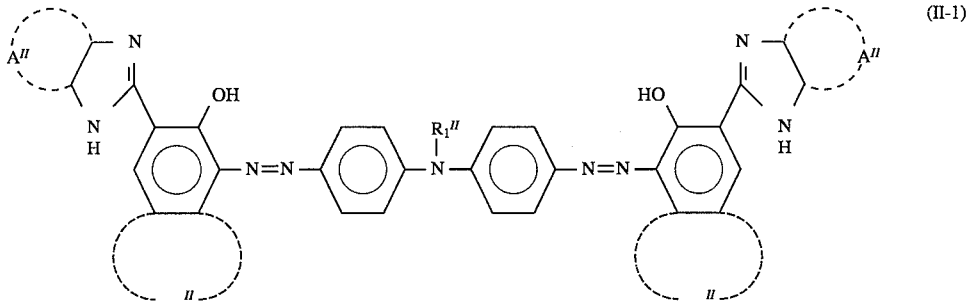

(II-1)

wherein $A^{II}$ represents the atomic group necessary to form an aromatic ring or hetero ring which may be substituted; $B^{II}$ represents the atomic group necessary to form a naphthalene ring or a carbazole ring which may be substituted; and $R_1^{II}$ represents a hydrogen atom, an alkyl group, an aryl group which may be substituted or a benzyl group.

The second aspect of the present invention is described below in detail.

To further describe the bisazo compound represented by formula (II-1) which is used in the electrophotographic photoreceptor of the present invention, $A^{II}$ in the formula (II-1) represents the atomic group necessary to form an aromatic ring or hetero ring which may be substituted. Considering materials characteristics and the ease of synthesis, a substituted or unsubstituted benzene ring is preferred.

In the case of a substituted benzene ring, examples of the substituents include a halogen atom, an alkyl group, an alkenyl group, an aralkyl group, an aryl group, an alkoxy group, an acyl group, a nitro group, a cyano group, a trifluoromethyl group or a β-dicyano-α-phenylvinyl group. Considering materials characteristics and the ease of synthesis, a fluorine atom, a chlorine atom, a bromine atom, a methyl group, an ethyl group, a methoxy group, an acetyl group, a benzoyl group which may be substituted and a nitro group are preferred.

In the formula (II-1), $B^{II}$ represents the atomic group necessary to form a naphthalene ring or a carbazole ring which may be substituted. If $B^{II}$ forms a substituted carbazole ring, examples of the substituents include a halogen atom, an alkyl group, an alkoxy group and a nitro group. Considering materials characteristics and the ease of synthesis, a chlorine atom, a bromine atom, a methyl group, a methoxy group and a nitro group are preferred.

In the formula (II-1), $R_1^{II}$ represents a hydrogen atom, an alkyl group, an aryl group which may be substituted or a benzyl group. Considering materials characteristics and the ease of synthesis, alkyl groups having 1 to 4 carbon atoms and a benzyl group are preferred, with a methyl group being most preferred.

Preferred examples of the bisazo compound represented by formula (II-1) which can be used in the present invention are represented by formulas (II-2) and (II-3):

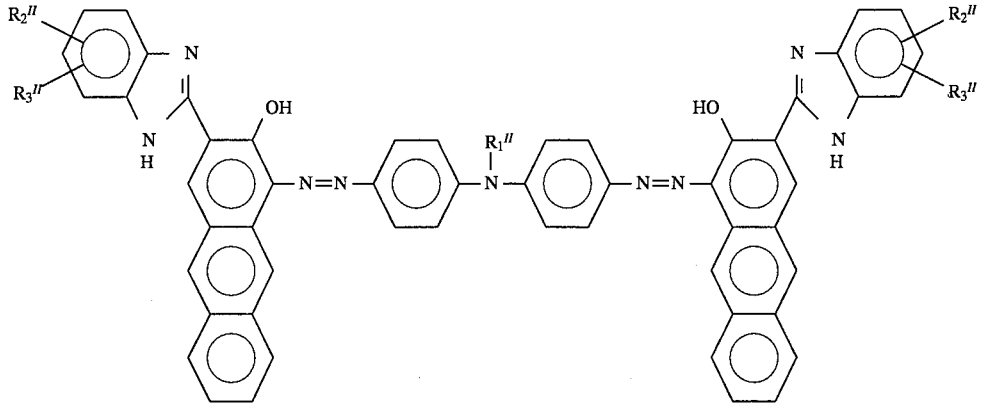

(II-2)

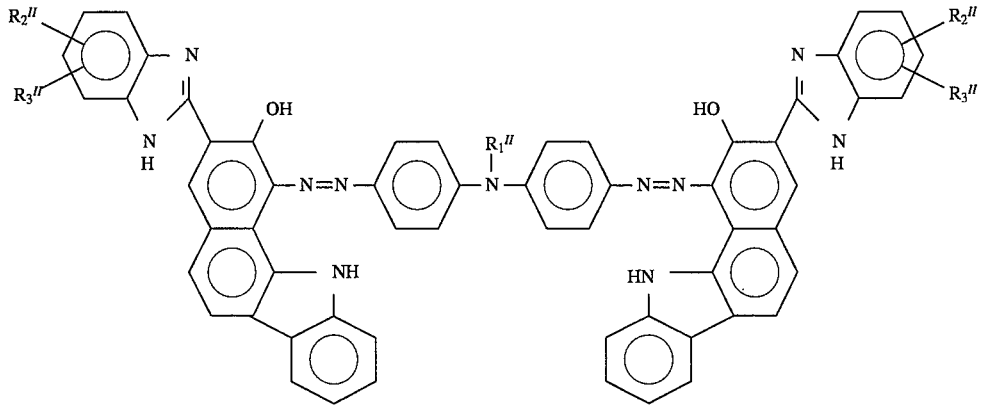

(II-3)

wherein $R_1^{II}$ represents a hydrogen atom, an alkyl group (preferably having 1 to 4 carbon atoms), an aryl group which may be substituted or a benzyl group (among these, an alkyl group and a benzyl group are preferred); $R_2^{II}$ and $R_3^{II}$ each represents a hydrogen atom, a halogen atom, an alkyl group (preferably having 1 to 4 carbon atoms), an alkenyl group, an aralkyl group, an aryl group, an alkoxy group, an acyl group, a nitro group, a cyano group, a trifluoromethyl group or a β-dicyano-α-phenylvinyl group (among these, a hydrogen atom, a fluorine atom, a bromine atom, an acetyl group, a benzoyl group and a nitro group are preferred), or $R_2^{II}$ and $R_3^{II}$ represent atomic groups which, in combination with each other, form a monocyclic or polycyclic hydrocarbon ring which may be substituted.

Specific examples of the bisazo compound (II-1) which may be used in the present invention are listed below but are by no means intended to limit the scope of the present invention.

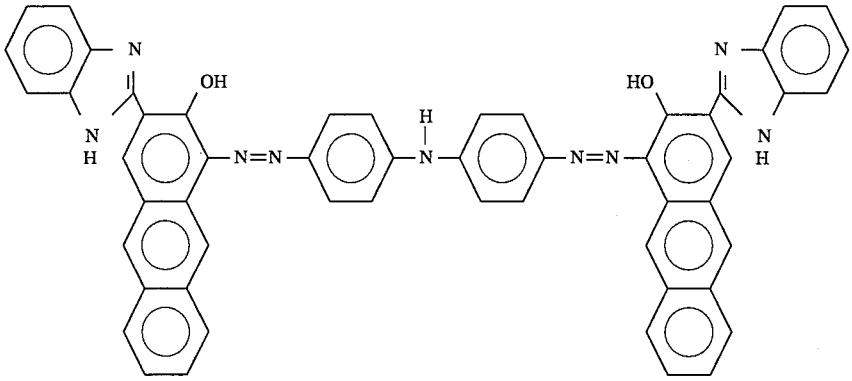

II-1

-continued
II-2
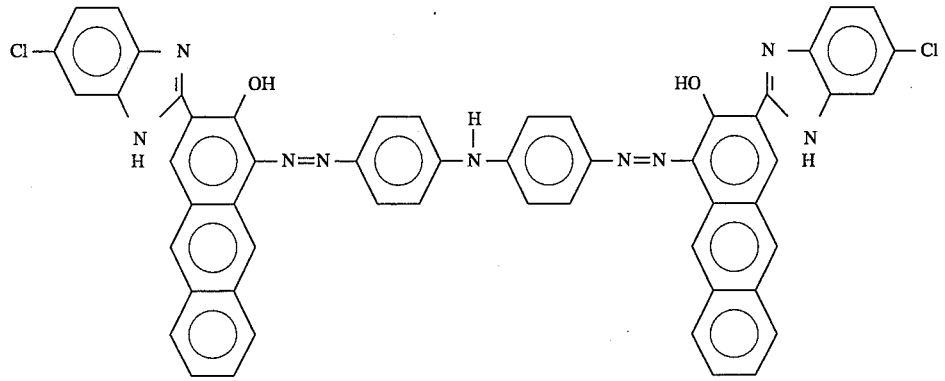
II-3
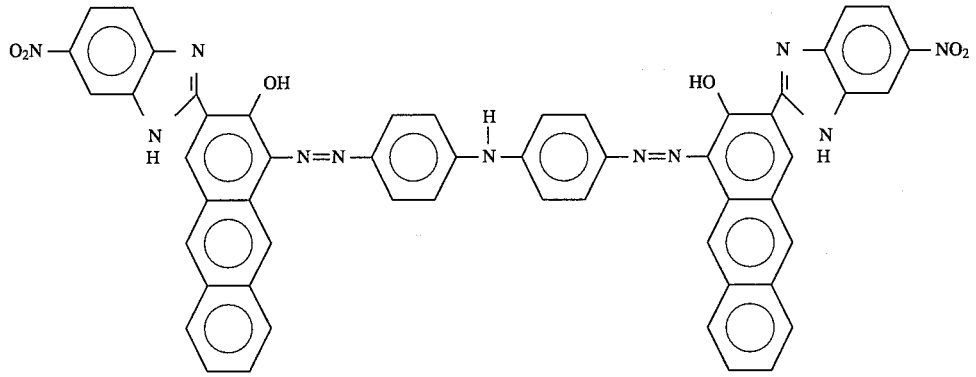
II-4
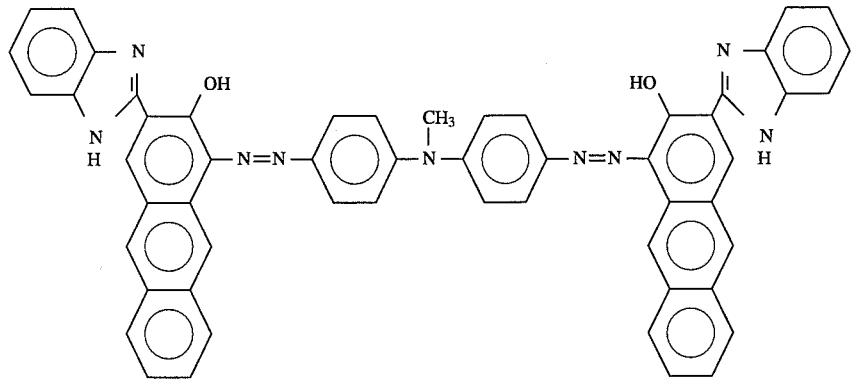
II-5
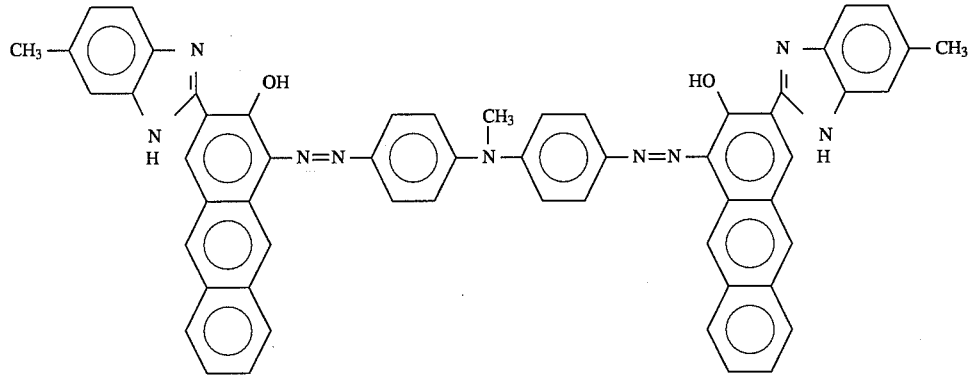

-continued
II-6
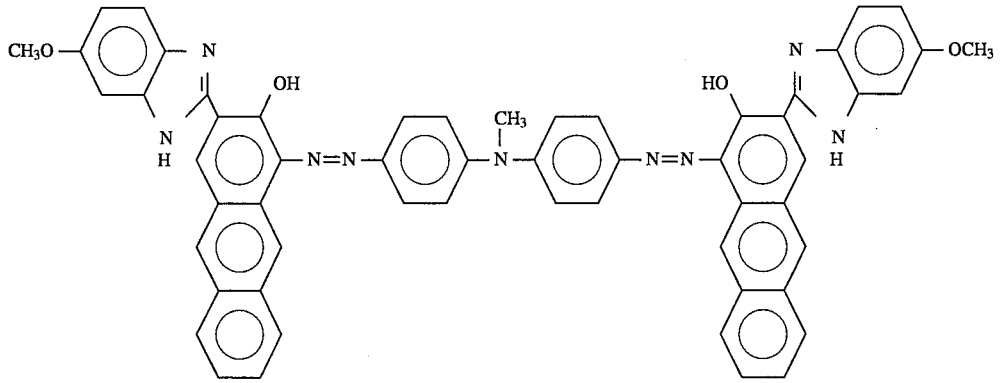
II-7
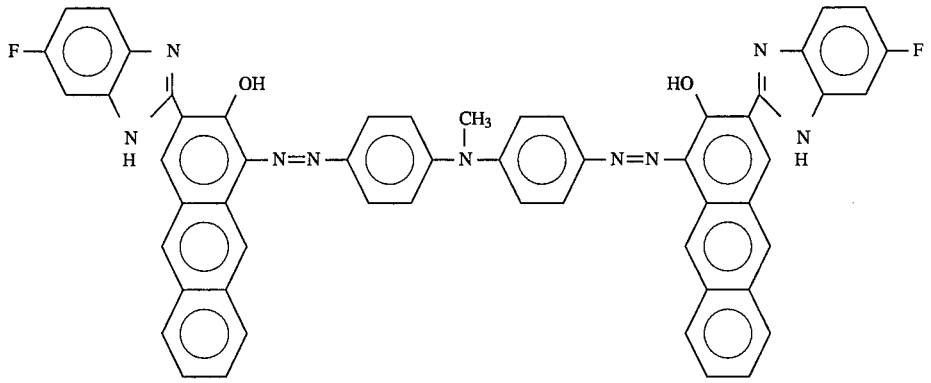
II-8
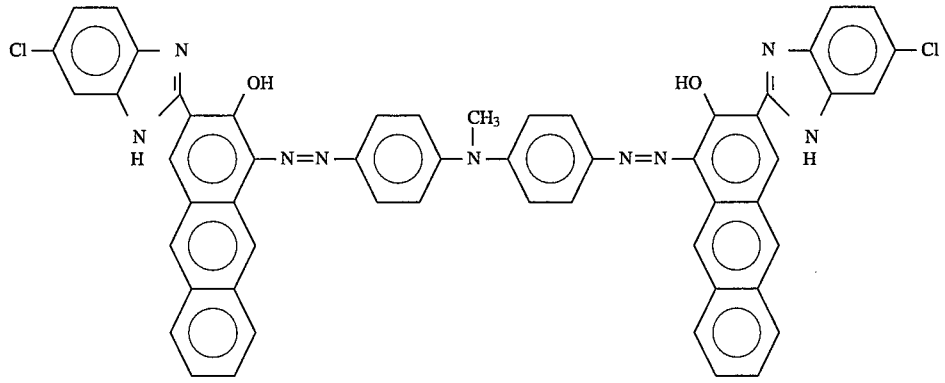
II-9
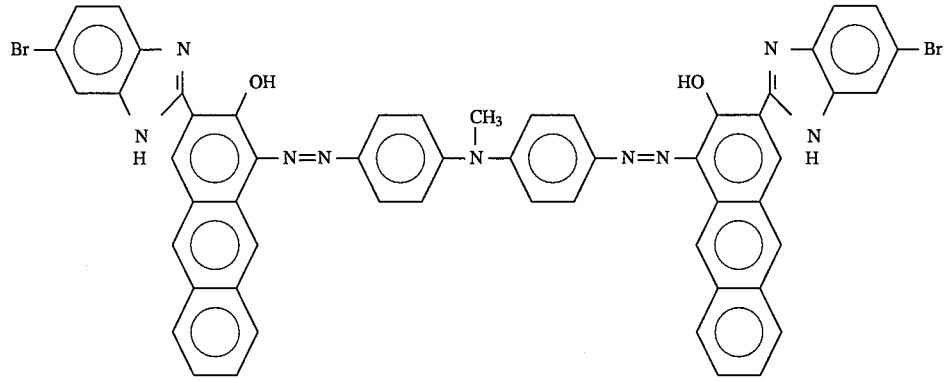

-continued
II-10
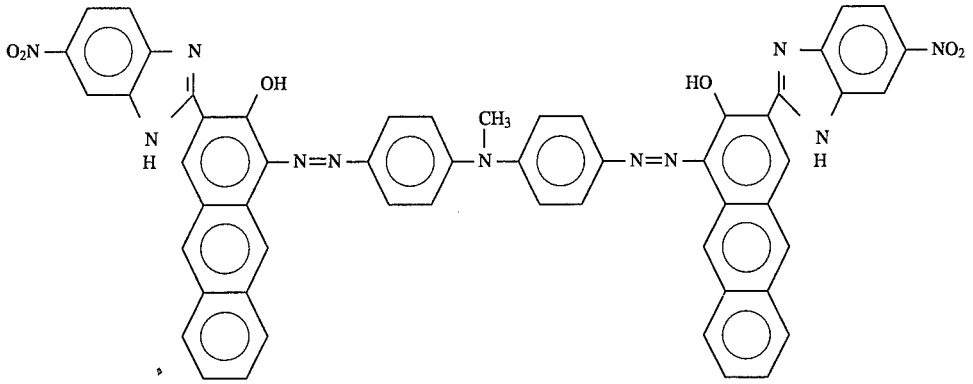
II-11
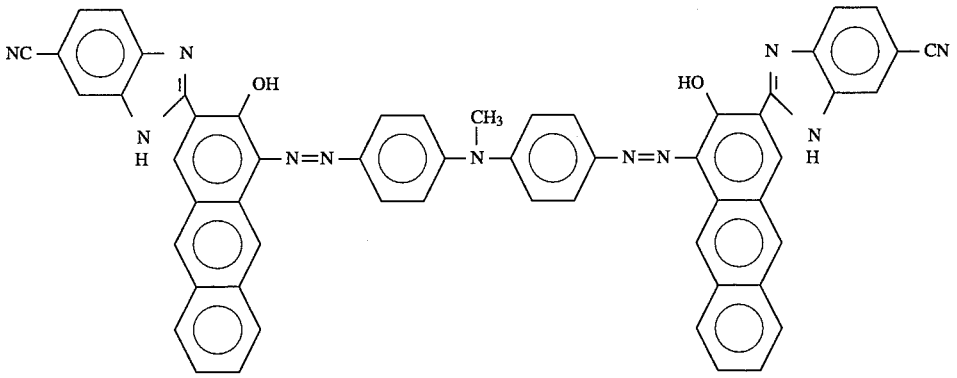
II-12
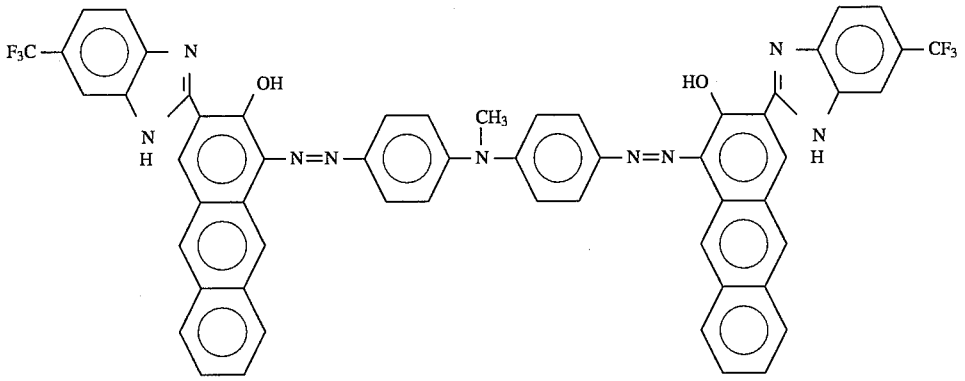
II-13
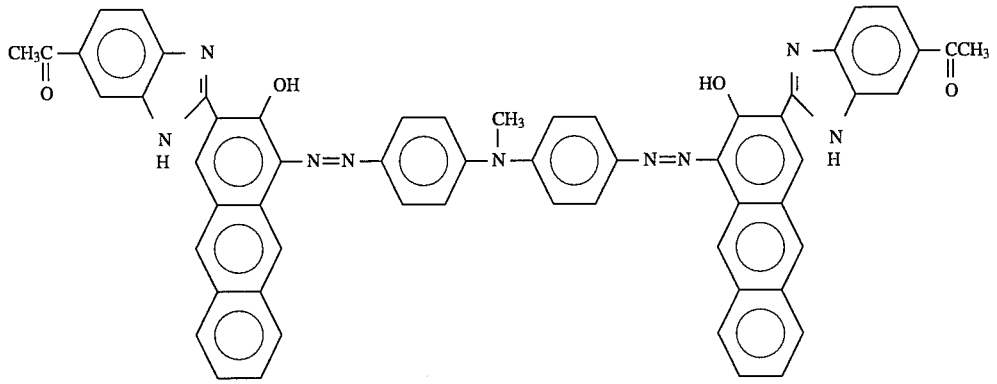

-continued
II-14
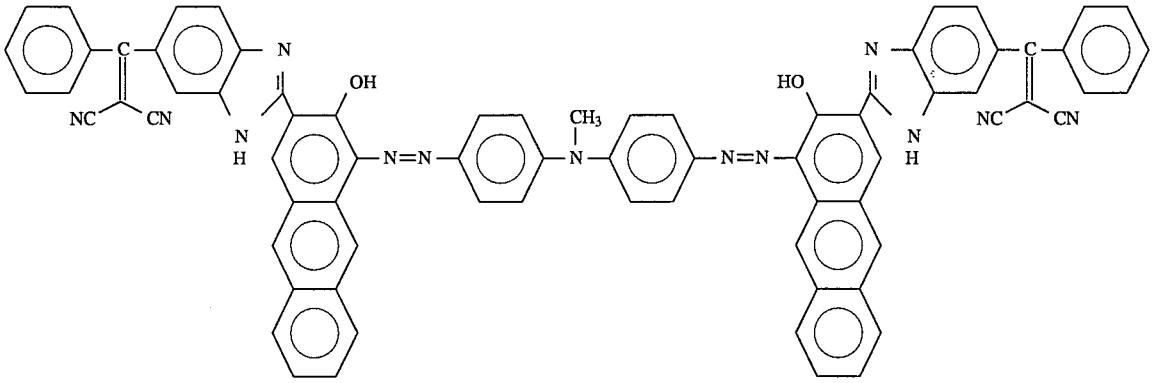
II-15
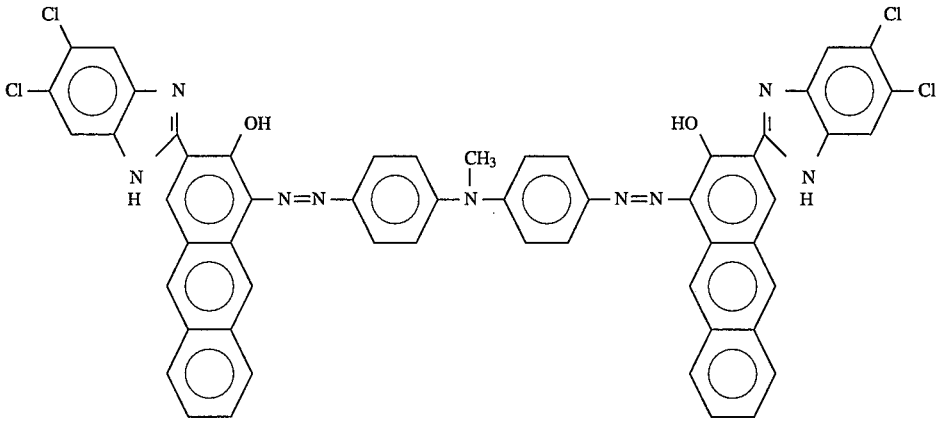
II-16
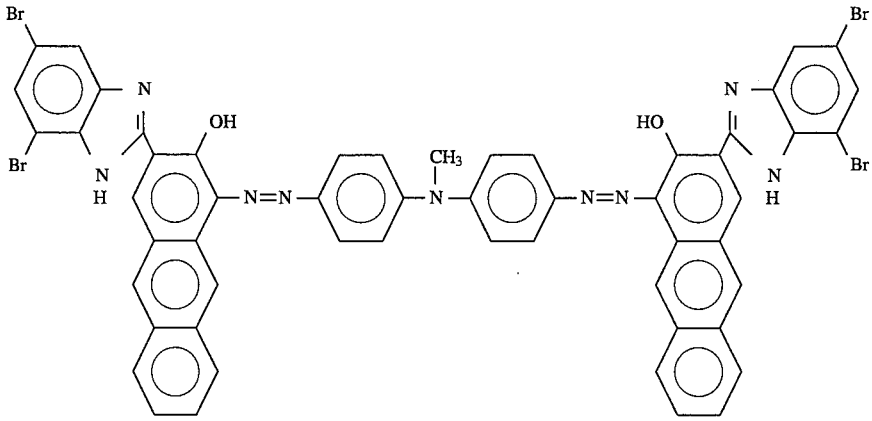
II-17
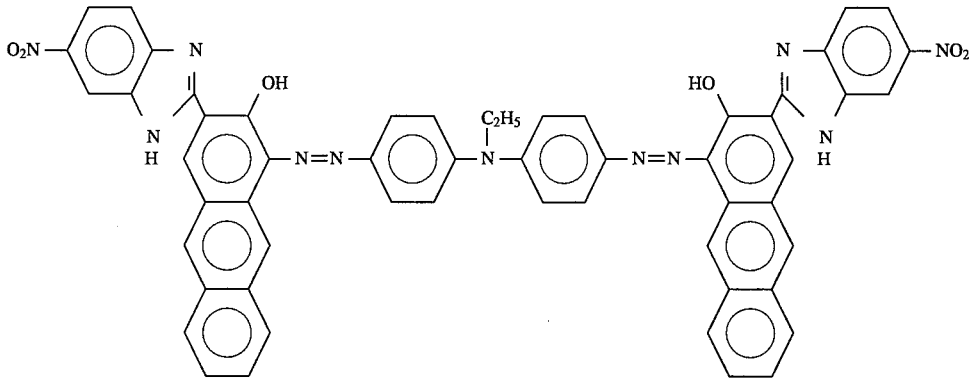

-continued
II-18
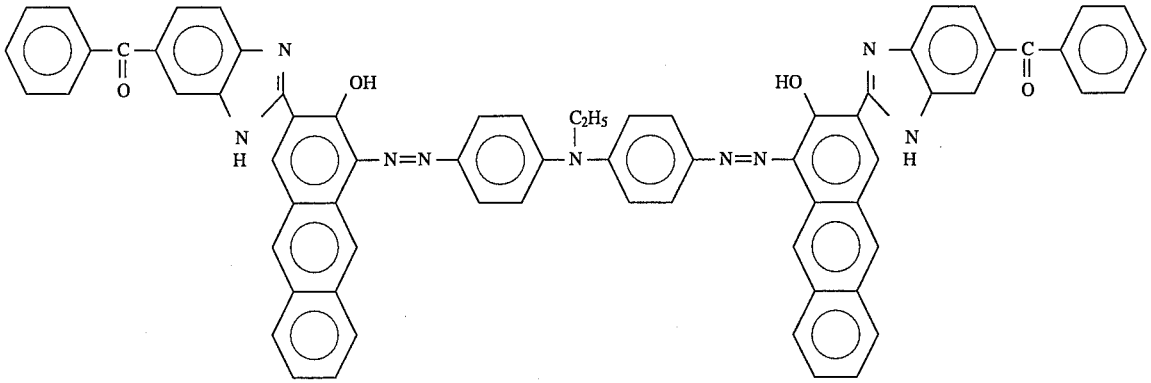
II-19
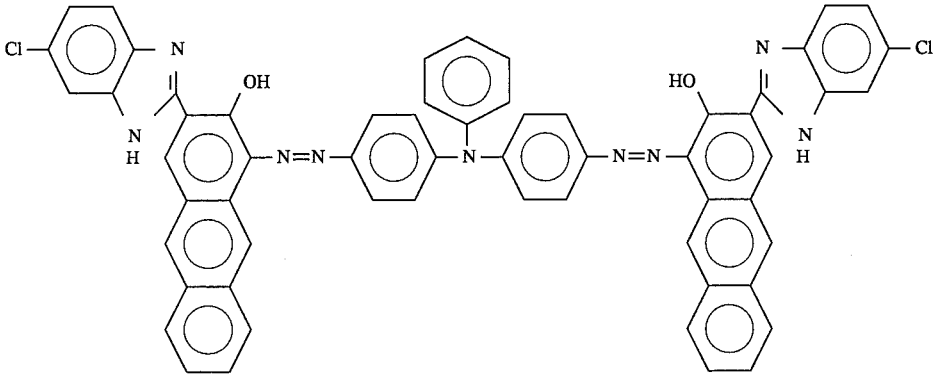
II-20
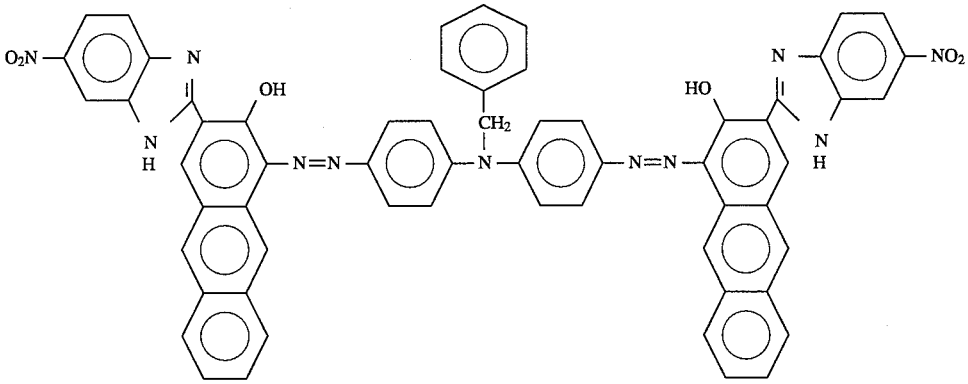
II-21
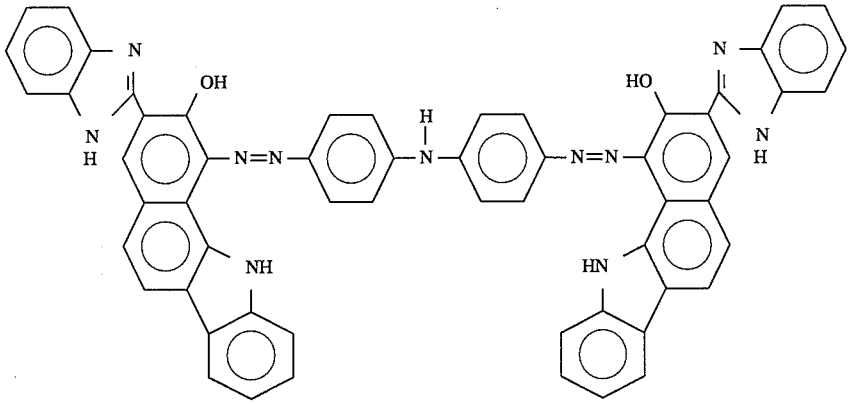

-continued
II-22
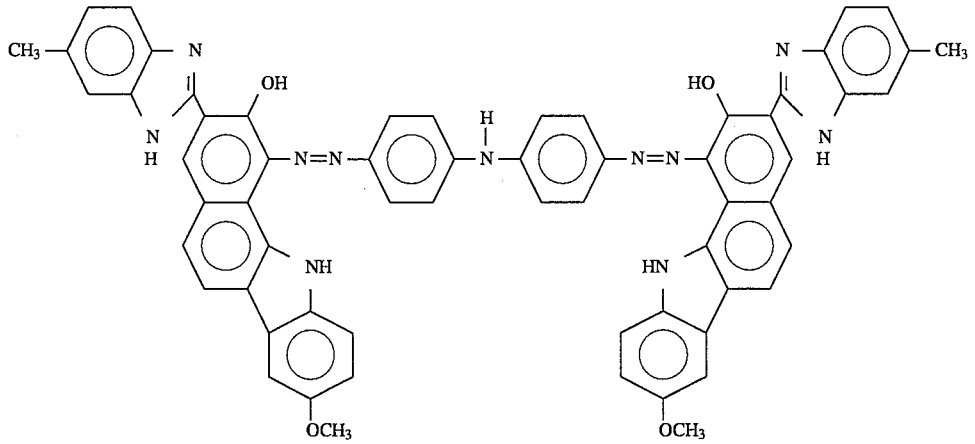
II-23
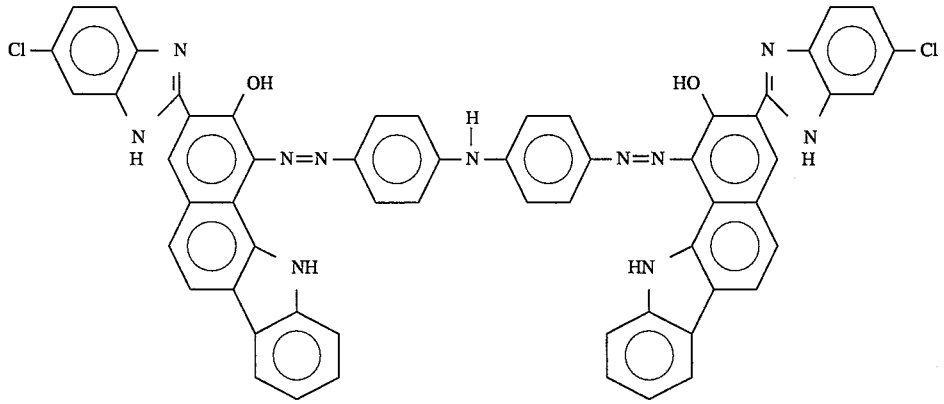
II-24
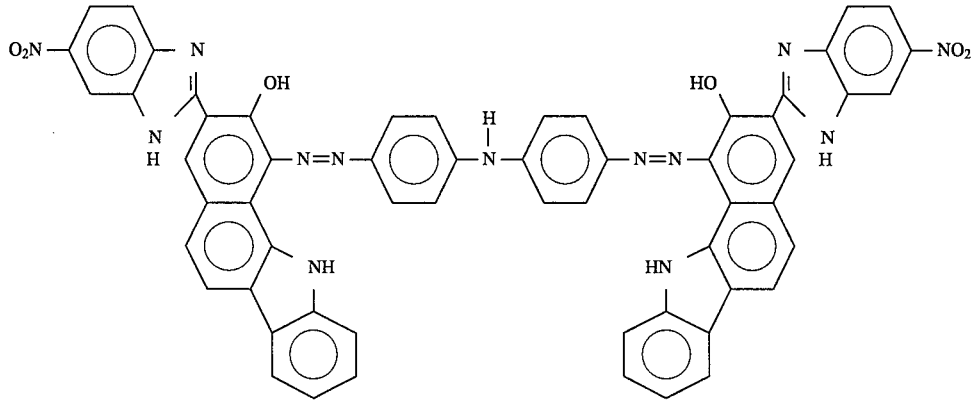
II-25
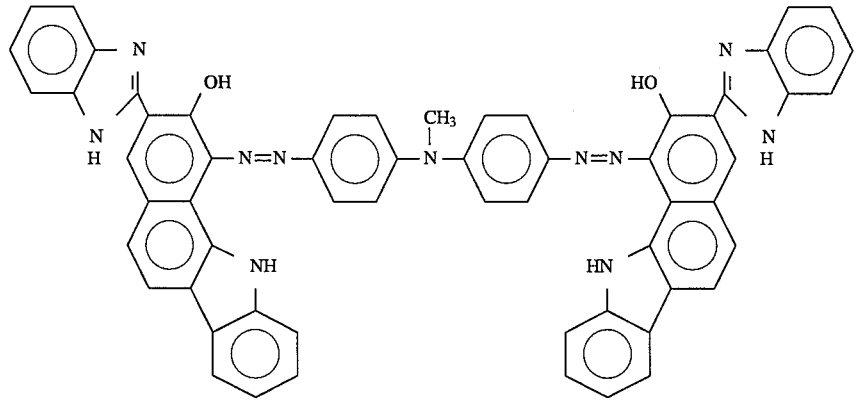

-continued
II-26
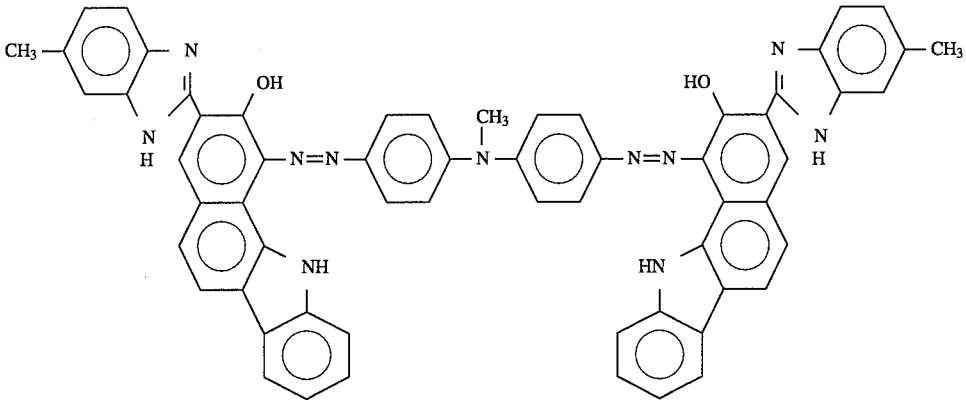
II-27
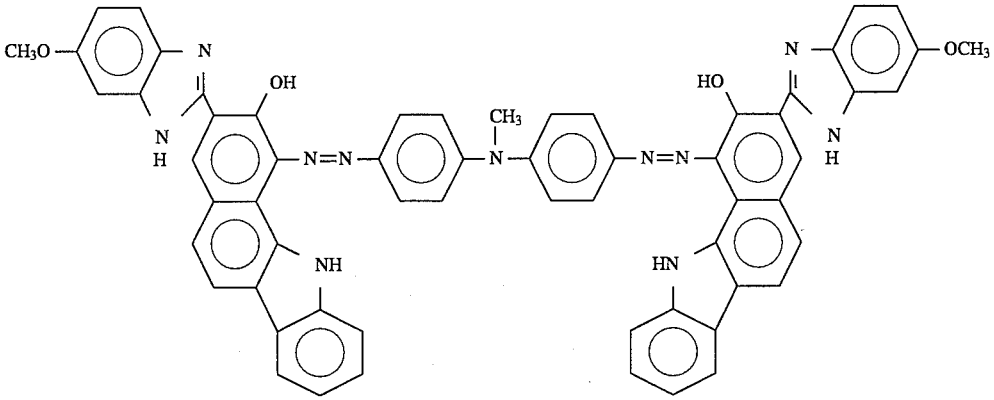
II-28
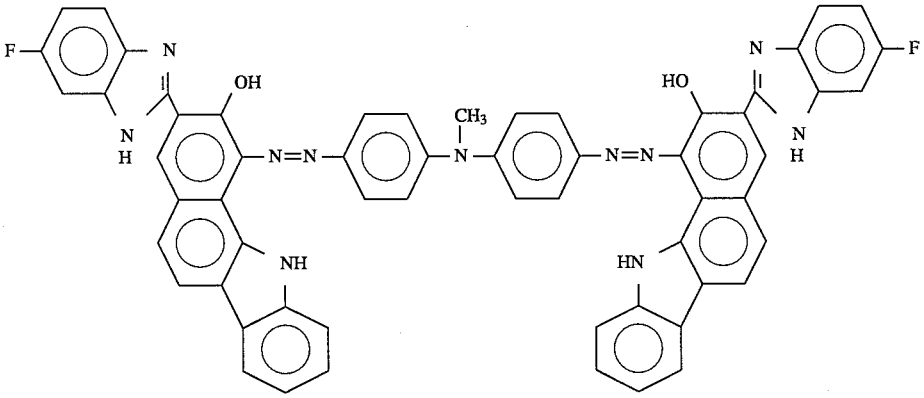
II-29
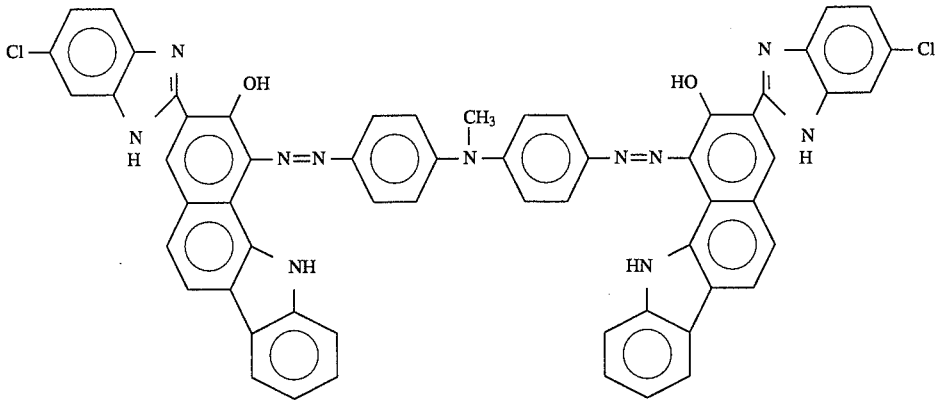

-continued
II-30
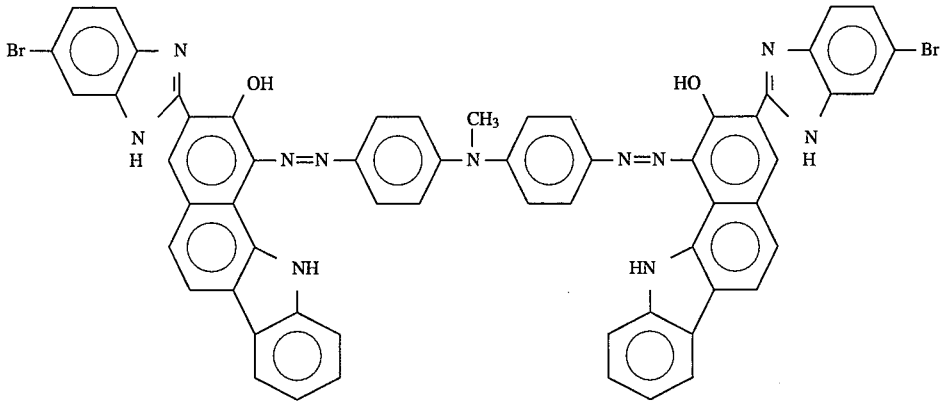
II-31
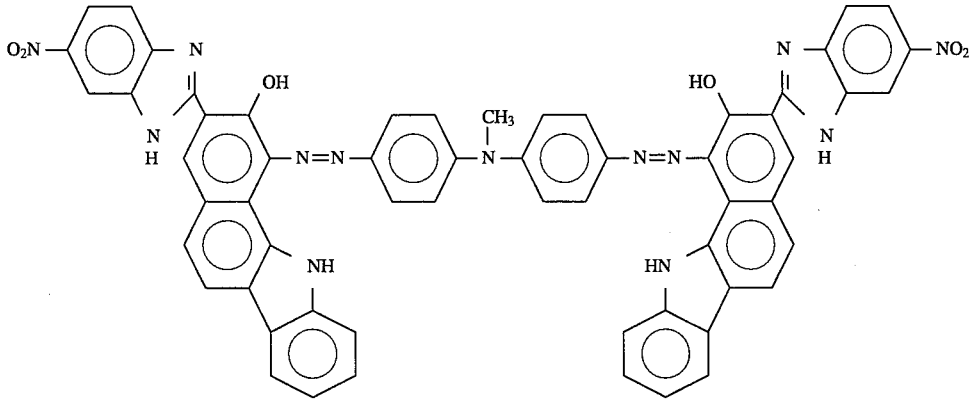
II-32
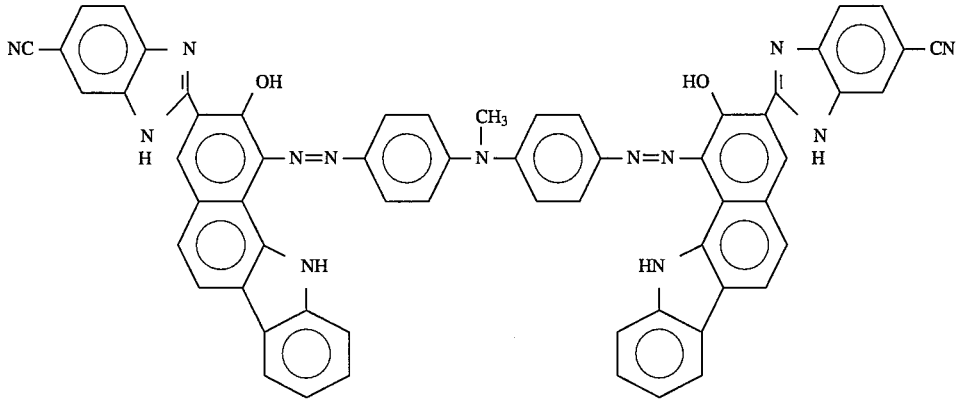
II-33
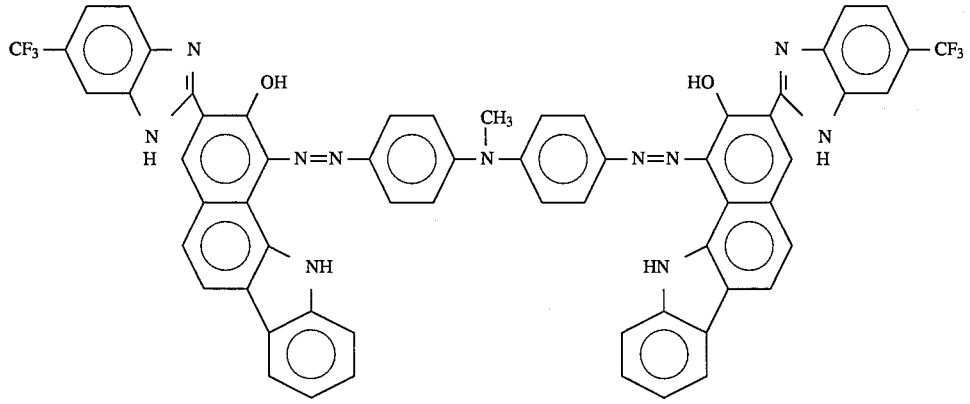

-continued
II-34
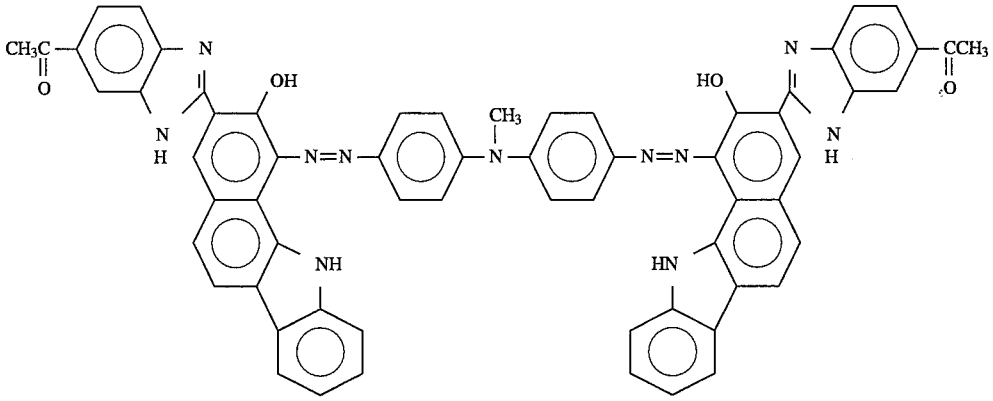
II-35
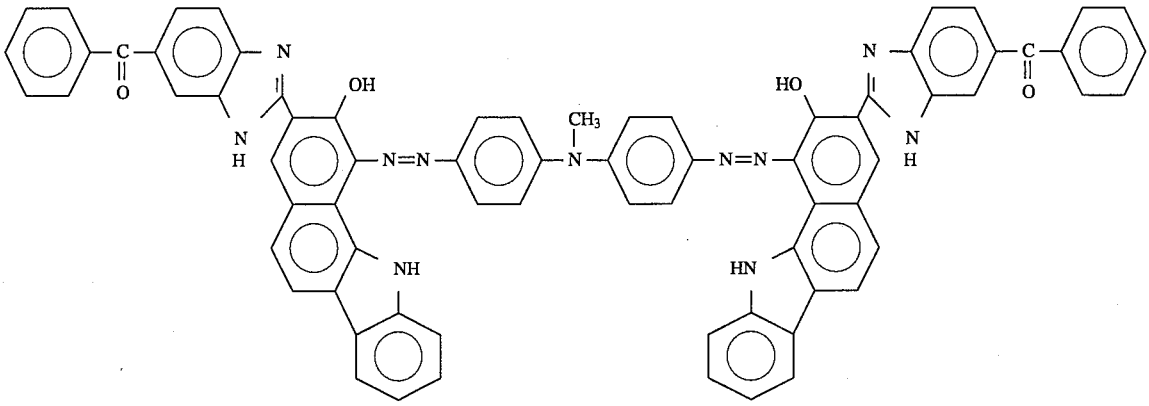
II-36
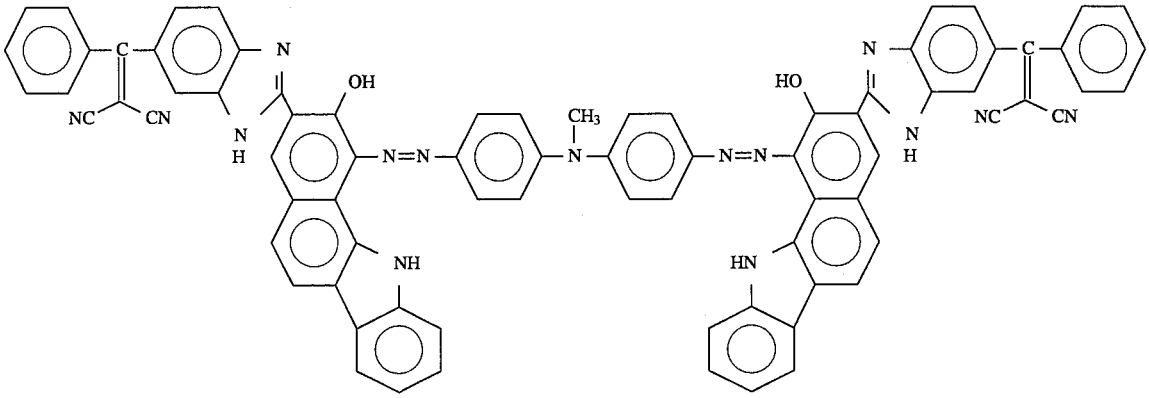

-continued
II-37
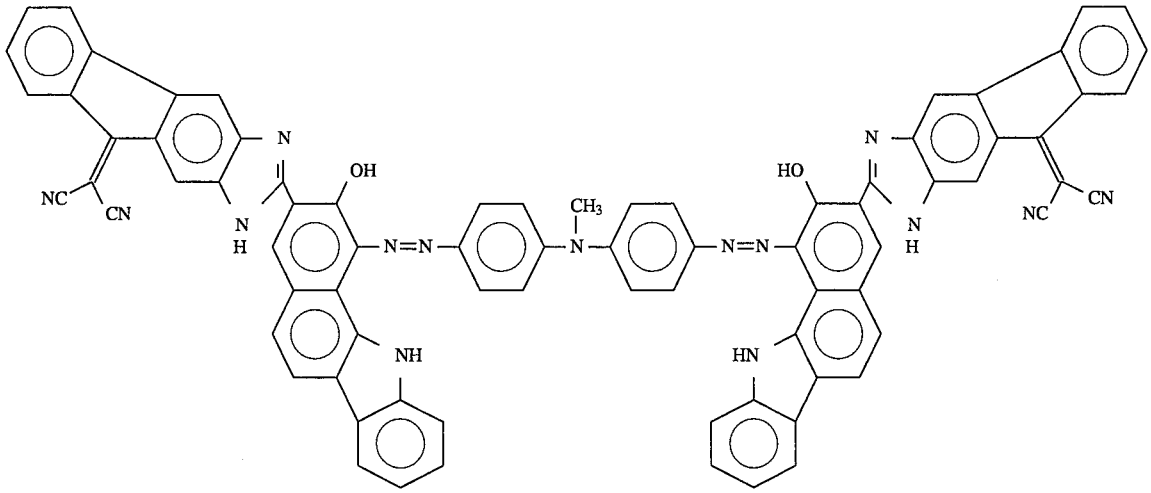
II-38
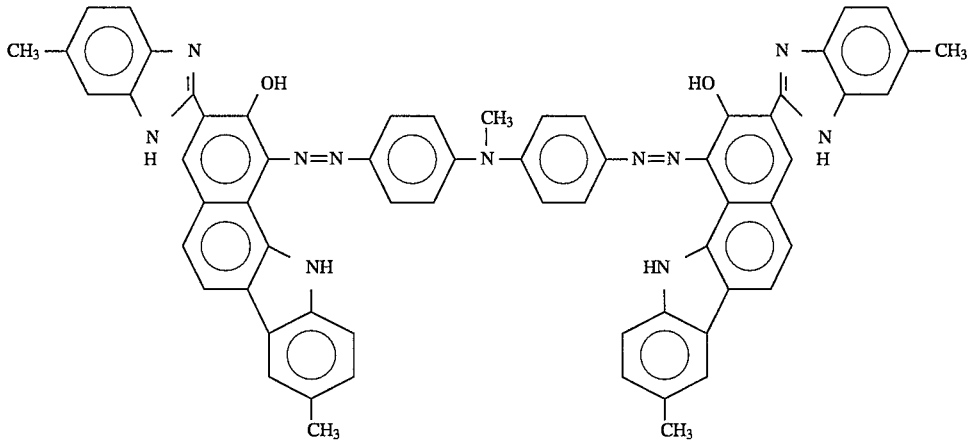
II-39
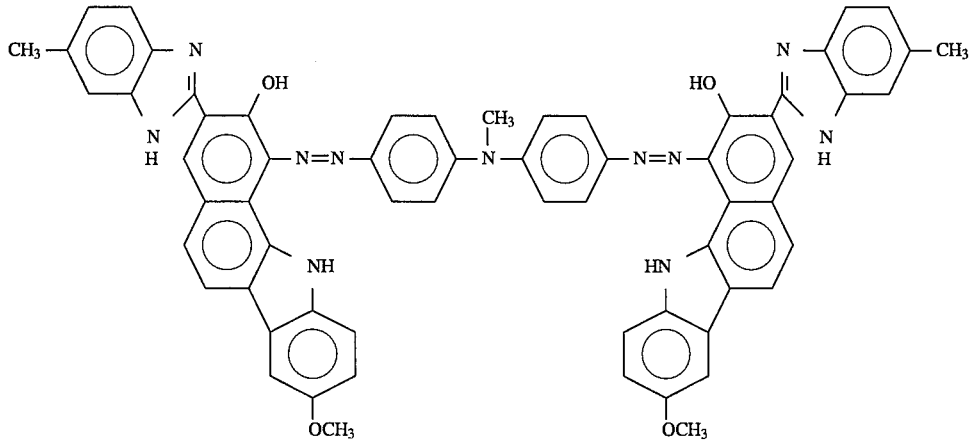

-continued
II-40
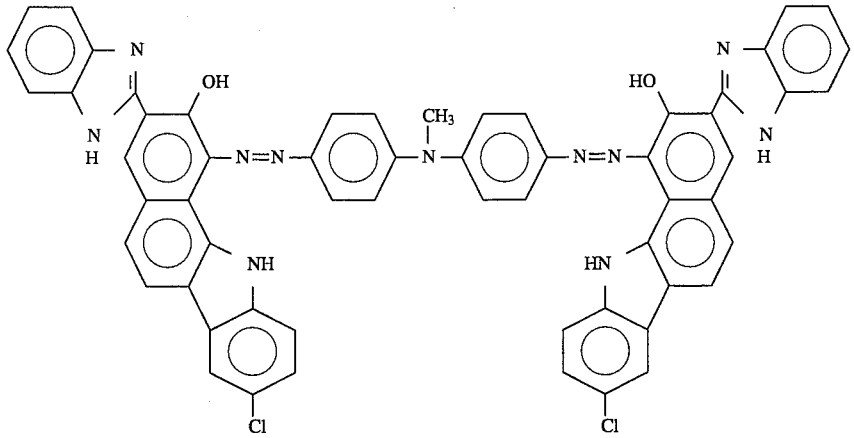
II-41
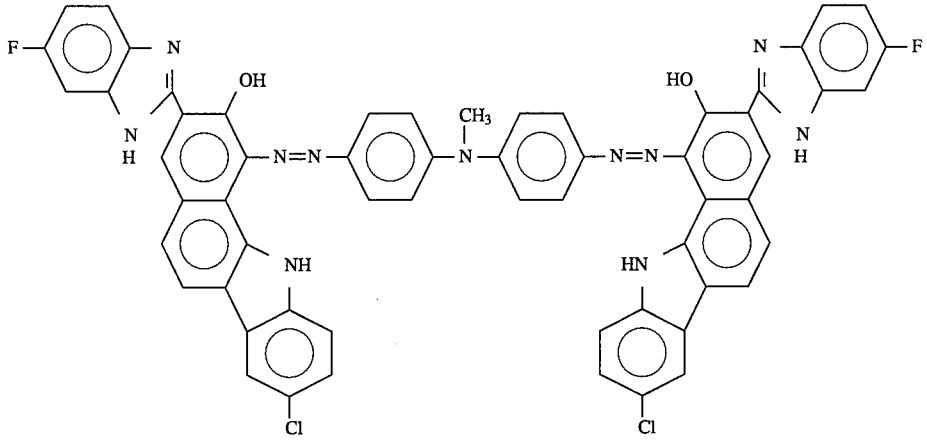
II-42
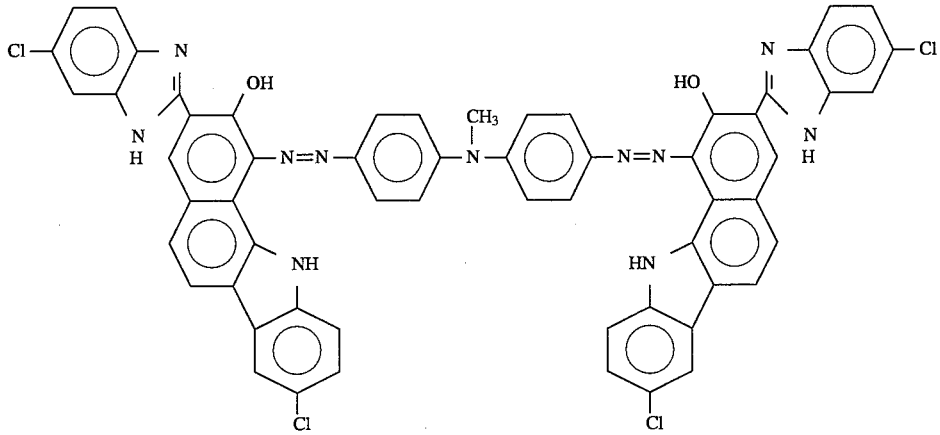

-continued
II-43
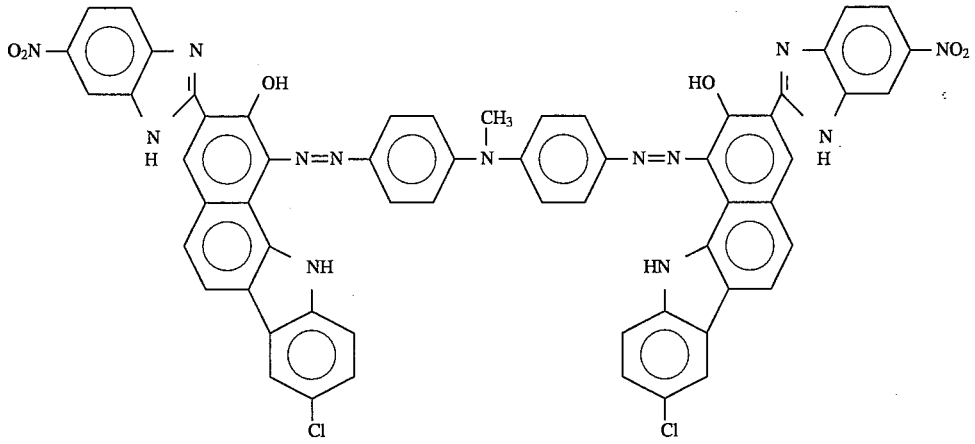
II-44
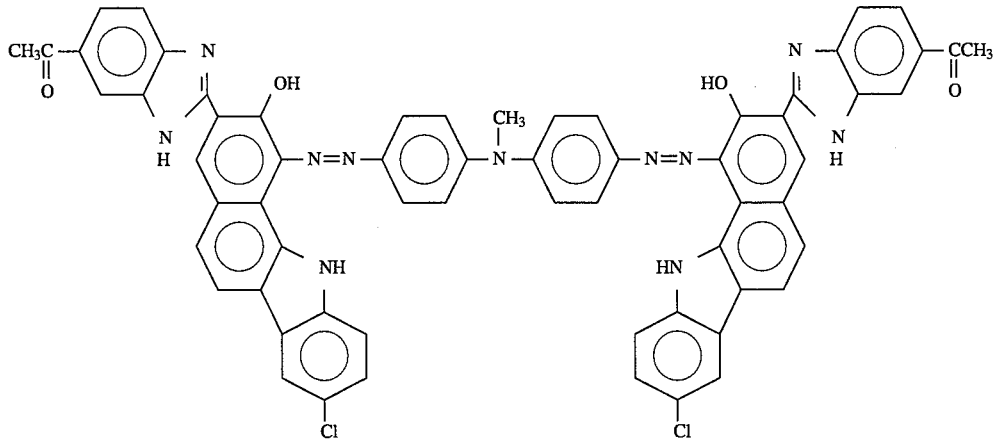
II-45
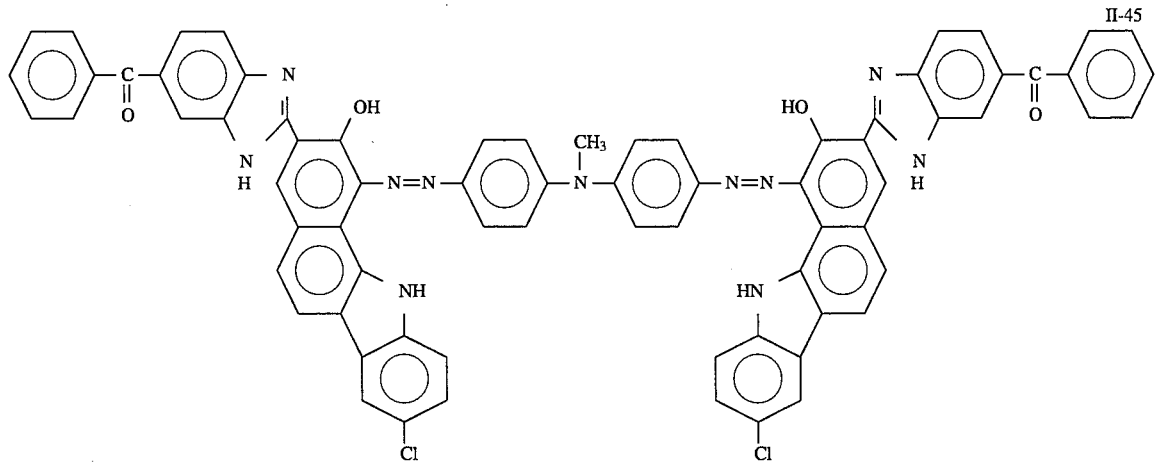

-continued
II-46
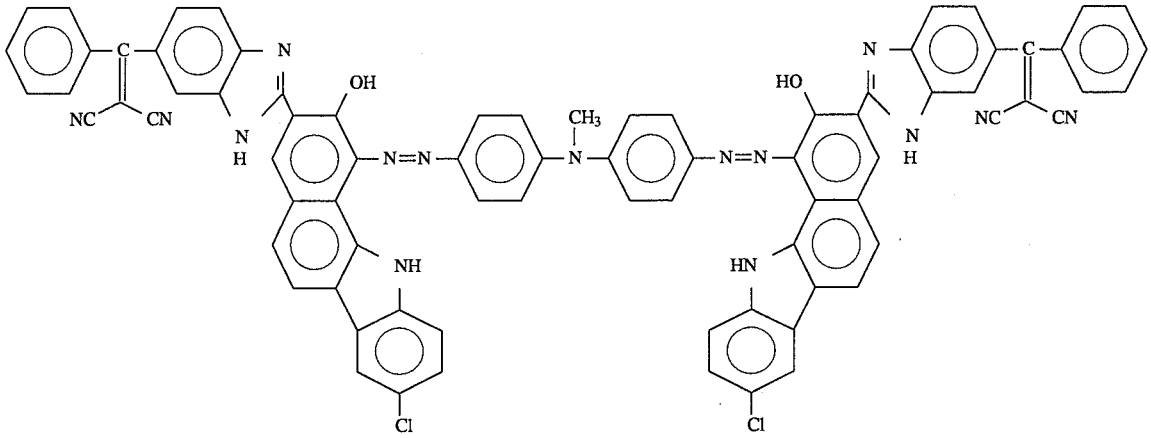
II-47
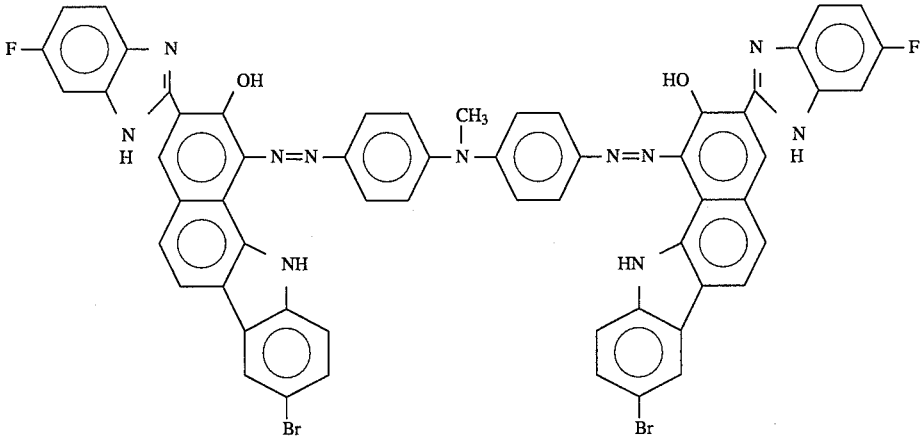
II-48
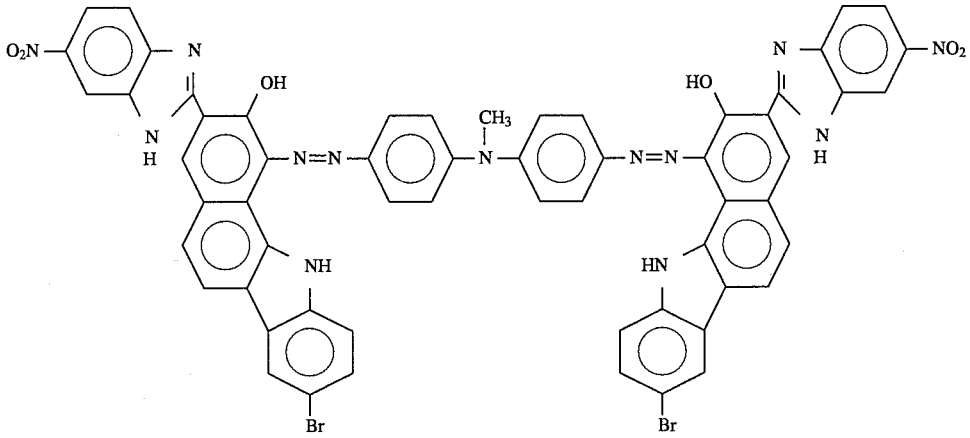

-continued
II-49
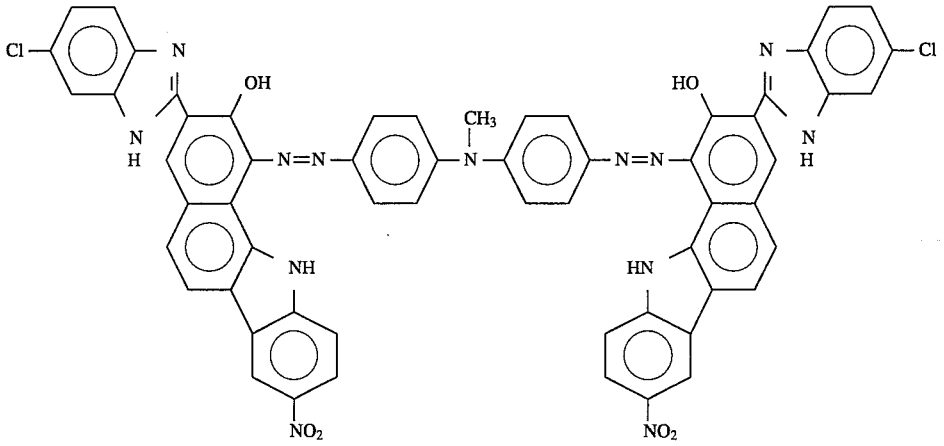
II-50
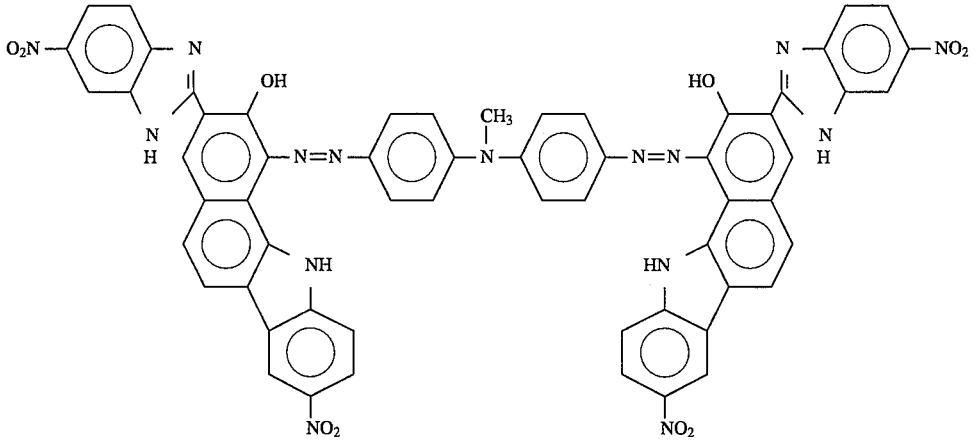
II-51
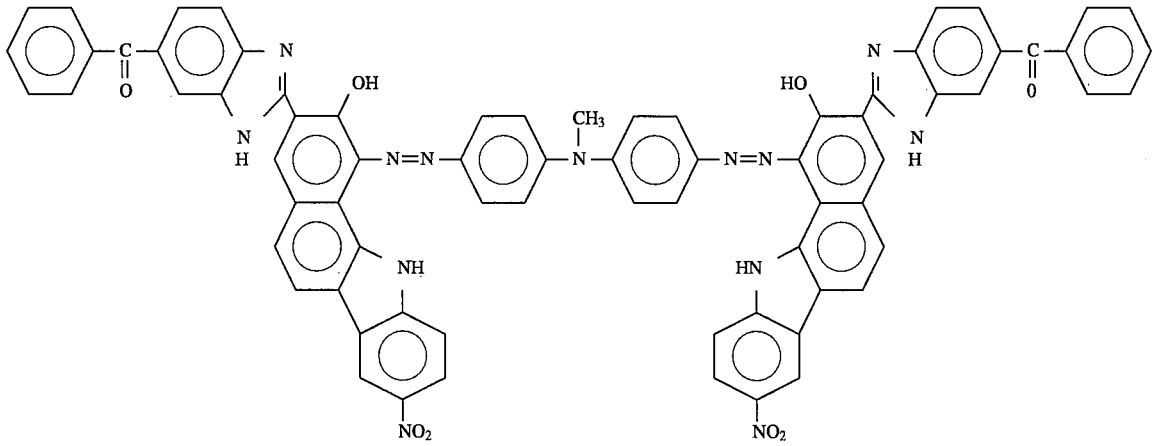

-continued
II-52
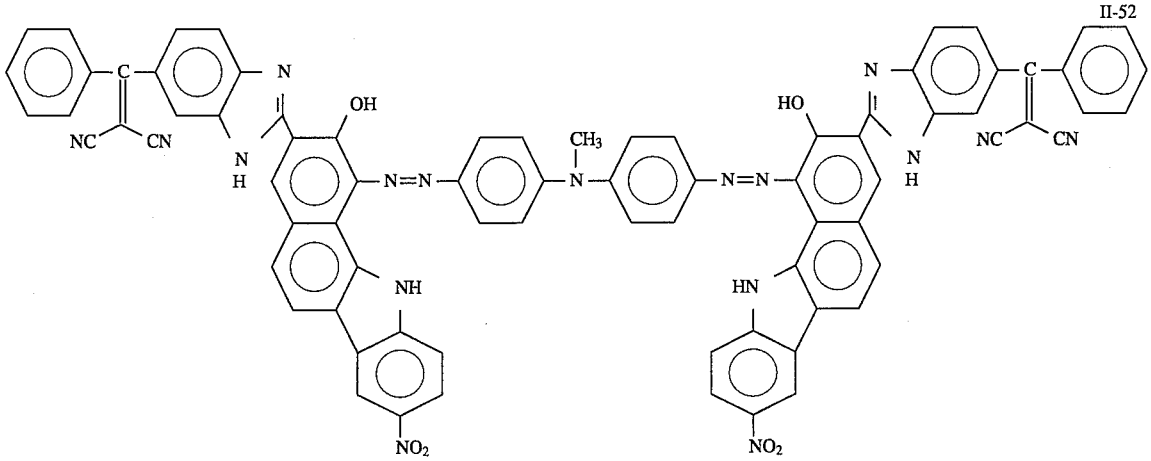
II-53
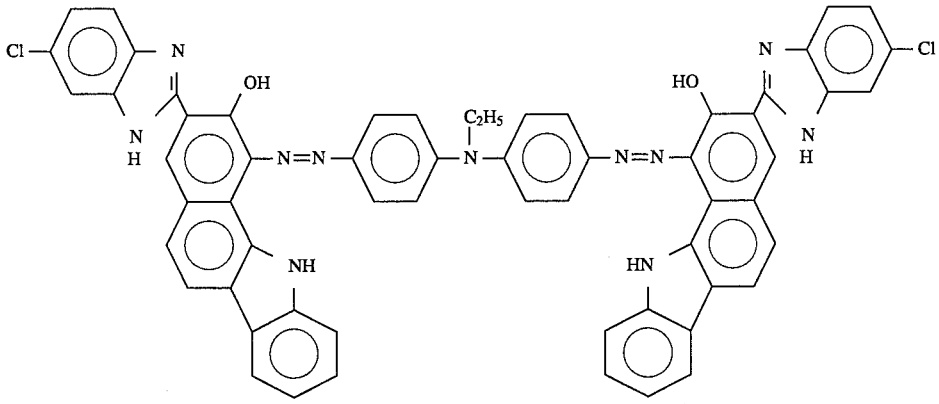
II-54
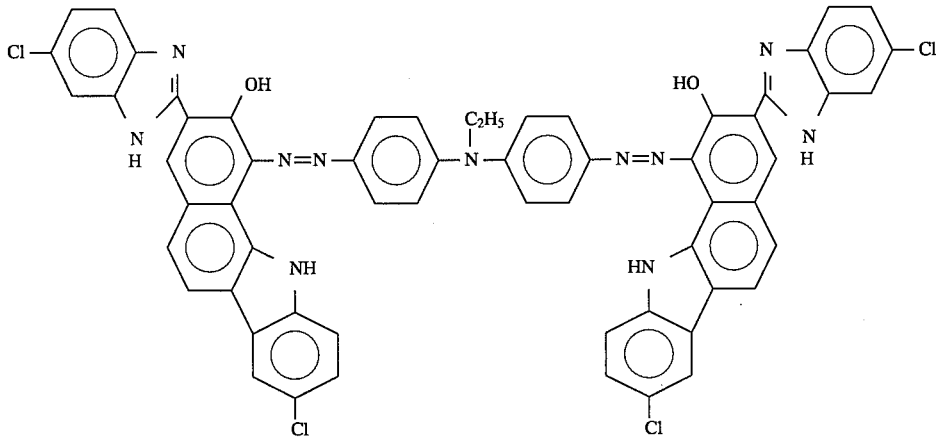

-continued
II-55
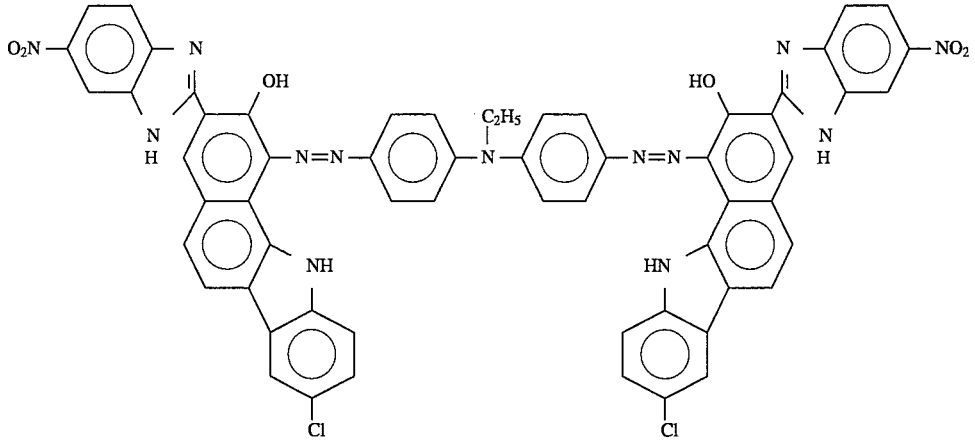
II-56
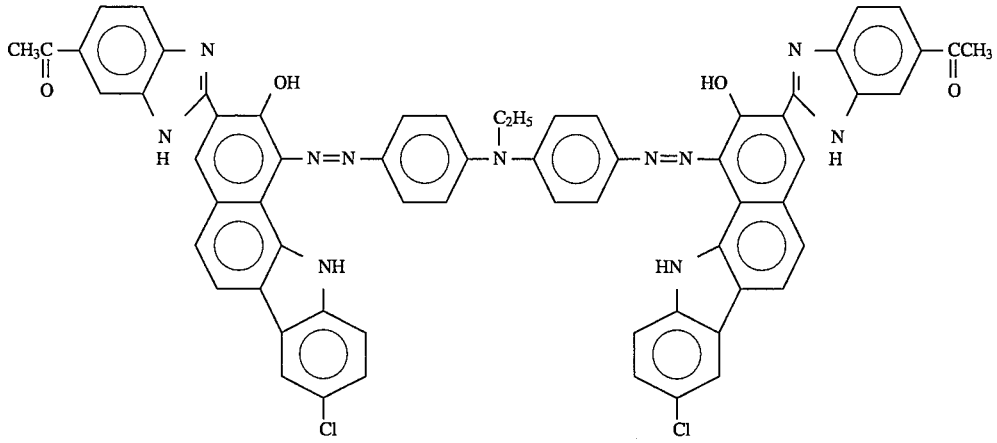
II-57
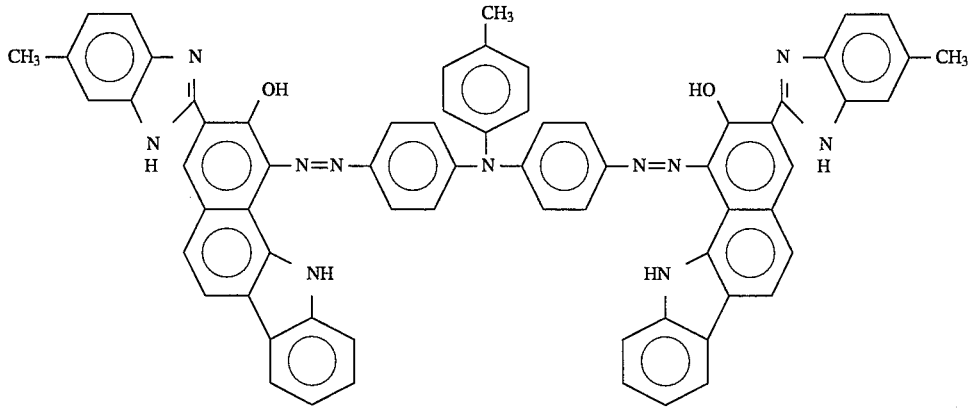
II-58
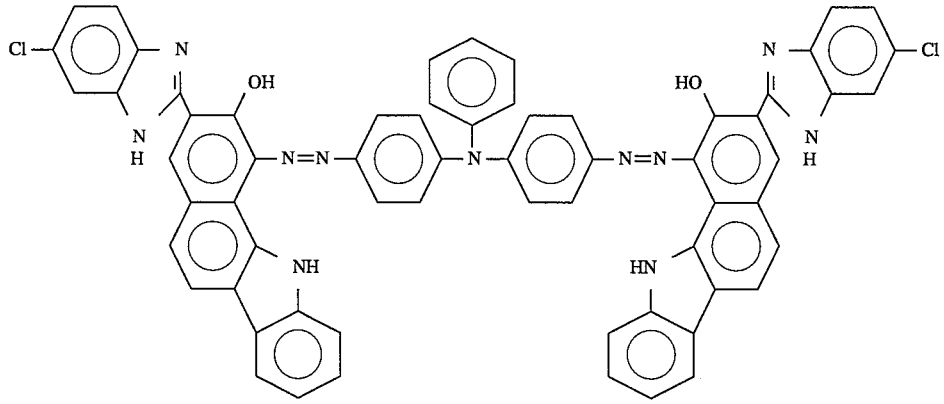

-continued

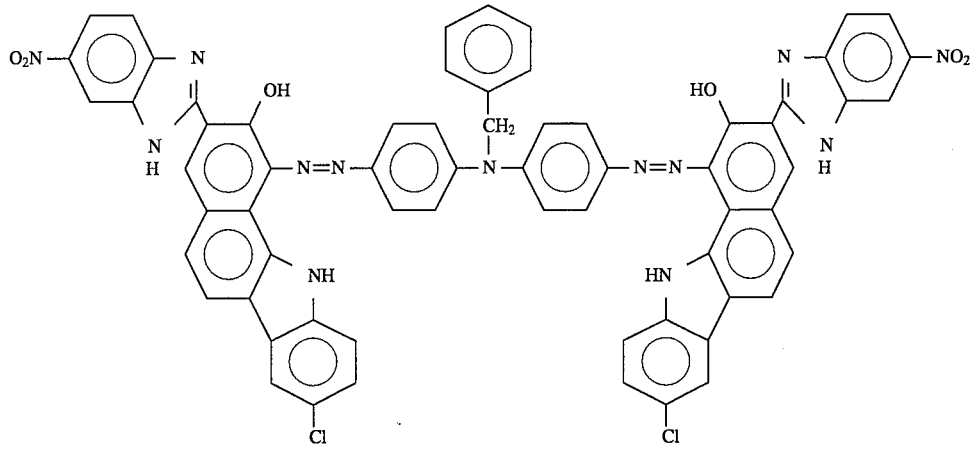

II-59

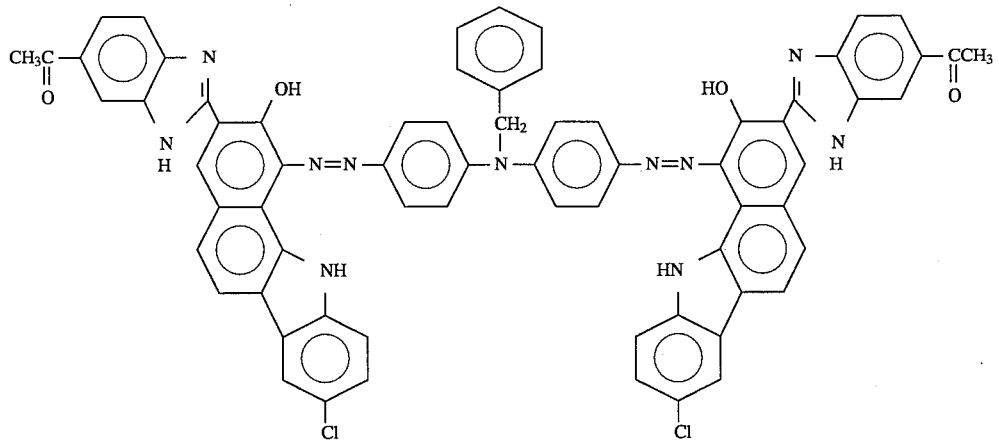

II-60

Bisazo compounds of the formula ((II-1) for use in the second aspect of the present invention can be synthesized by the following method. A compound represented by the following formula (II-4):

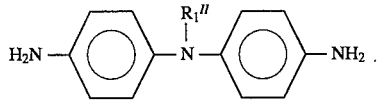

(II-4)

(where $R_1^{II}$ has the same meaning as defined in the above formula (II-1)) is tetrazotized in the usual manner to obtain a tetrazonium salt, which is isolated in a suitable form such as a borofluoride or hexafluorophosphate and subjected to coupling with a compound represented by the following formula (II-5) in an appropriate solvent (e.g. N,N-dimethylformamide, N-methylpyrrolidone or dimethyl sulfoxide) in the presence of a base such as sodium acetate or triethylamine:

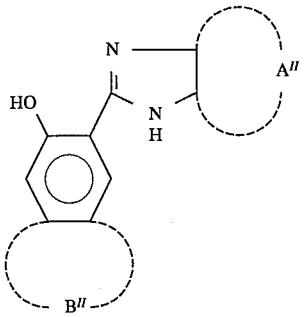

(II-5)

(where $A^{II}$ and $B^{II}$ have the same meanings as defined in the above formula (II-1)).

Typical examples of the synthesis of bisazo compounds (II-1) to be used in the second aspect of the present invention are described below.

Synthesis Example II-1 (synthesis of Compound No. II-10)

N-Methyl-4,4'-diaminodiphenylamine (10.7 g, 0.05 mol) is dispersed in 50 ml of concentrated HCl. Thereafter, a solution having 7.6 g (0.11 mol) of sodium nitrite dissolved in 20 ml of water is added dropwise to the dispersion at 0°–5° C. under cooling with ice over a period of 10 min. After the dropwise addition, the mixture is subjected to continued stirring at the same temperature for about 20 min and the insoluble matter is filtered off. To the filtrate, 20 g (0.12 ml) of ammonium hexafluorophosphate is added and the resulting precipitate is recovered by filtration, washed with ice water, alcohol and then ether, and dried under reduced pressure at room temperature to obtain N-methyl-diphenyl-amine-4,4'-bisdiazonium bishexafluorophosphate in an amount of 19.8 g (yield: 75%).

Subsequently, 3.91 g (0.11 mol) of 3-(5'-nitro-2'-benzimidazolyl)-2-hydroxyanthracene is dissolved in 1,000 ml of N,N-dimethylformamide and the solution is cooled to about 0° C. Thereafter, 2.64 g (0.005 mol) of the previously prepared tetrazonium salt is dissolved in the cooled solution. To the stirred solution, a solution having 1.7 ml (0.012 mol) of triethylamine diluted with 10 ml of N,N-dimethylformamide is added dropwise over a period of about 5 min. After the dropwise addition, stirring is continued at room temperature for about 1 hour and the resulting precipitate is recovered by filtration. The recovered precipitating cake is dispersed in 500 ml of N,N-dimethylformamide and, following 1 hour-stirring at about 80° C., the precipitate is again separated by filtration. These procedures are repeated 5 times and the resulting precipitate is washed first with water, then with acetone, and dried to obtain a bisazo compound (Compound No. II-10) in an amount of 4.10 g (yield: 87%). m.p.: 350° C. or more.

| Elemental analysis for $C_{55}H_{35}N_{11}O_6$ | | |
|---|---|---|
| | Cal'd | Found |
| C (%) | 67.83 | 69.56 |
| H (%) | 3.73 | 3.61 |
| N (%) | 16.29 | 16.12 |

IR absorption spectrum (KBr tablet).

1600 $cm^{-1}$ (C=N)

Synthesis Example II-2 (synthesis of Compound No. II-43)

A reaction and a post-treatment are performed in the same manner as in Synthesis Example II-1 except that 4.29 g (0.011 ml) of 3-(5"-chloro-2"-benzimidazolyl)-2-hydroxy-8-chloro-1',2'-benzocarbazole is used as the coupling component and that a mixture of N,N-dimethylformamide (500 ml) and dimethyl sulfoxide (150 ml) is used as the reaction solvent. As a result, a bisazo compound (Compound No. II-43) is obtained as a dark brown powder in an amount of 3.48 g (yield: 64%). m.p.: 350° C. or more.

| Elemental analysis for $C_{59}H_{35}N_{13}O_6Cl$ | | |
|---|---|---|
| | Cal'd | Found |
| C (%) | 64.84 | 64.52 |
| H (%) | 3.28 | 3.09 |
| N (%) | 16.66 | 16.48 |

IR absorption spectrum (KBr tablet)

1600 $cm^{-1}$ (C=N)

The electrophotographic photoreceptor according to the third aspect of the present invention may comprise an electroconductive substrate having a light-sensitive layer containing as an azo pigment a trisazo compound represented by formula (III-1):

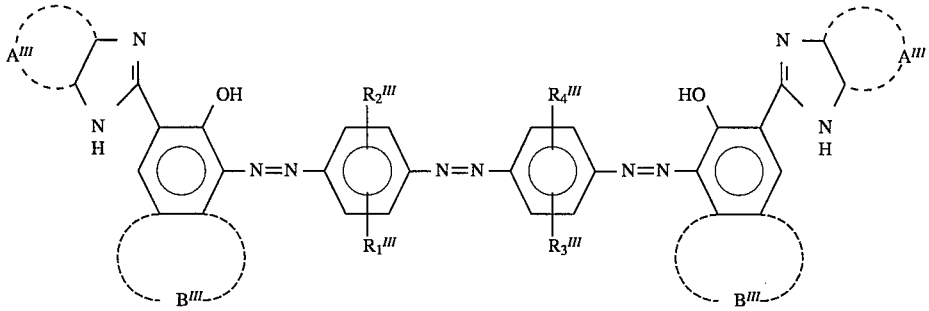

(III-1)

wherein $A^{III}$ represents the atomic group necessary to form an aromatic ring or hetero ring which may be substituted; $B^{III}$ represents the atomic group necessary to form a benzene ring, a naphthalene ring or a carbazole ring which may be substituted; $R_1^{III}$, $R_2^{III}$, $R_3^{III}$ and $R_4^{III}$ each represents a hydrogen atom, a halogen atom, an alkyl group or an alkoxy group, or $R_1^{III}$ and $R_2^{III}$ or $R_3^{III}$ and $R_4^{III}$ respectively represent the atomic groups necessary to form, in combination with each other, a naphthalene ring taken together with the benzene ring.

The third aspect of the present invention is described below in detail.

To further describe the trisazo compound represented by formula (III-1) which is used in the electrophotographic photoreceptor of the present invention, $A^{III}$ in the formula (III-1) represents the atomic group necessary to form an aromatic ring or hetero ring which may be substituted. Considering materials characteristics and the ease of synthesis, a substituted or unsubstituted benzene ring is preferred.

In the case of a substituted benzene ring, examples of the substituents include a halogen atom, an alkyl group, an alkenyl group, an aralkyl group, an aryl group, an alkoxy group, an acyl group, a nitro group, a cyano group, a trifluoromethyl group or a β-dicyano-α-phenylvinyl group. Considering materials characteristics and the ease of synthesis, a fluorine atom, a chlorine atom, a bromine atom, a methyl group, an ethyl group, a methoxy group, an acetyl group, a benzoyl group which may be substituted and a nitro group are preferred.

In the formula (III-1), $B^{III}$ represents the atomic group necessary to form a benzene ring, a naphthalene ring or a carbazole ring which may be substituted. If $B^{III}$ forms a substituted carbazole ring, examples of the substituents include a halogen atom, an alkyl group, an alkoxy group and a nitro group. Considering materials characteristics and the ease of synthesis, a chlorine atom, a bromine atom, a methyl group, a methoxy group and a nitro group are preferred.

In the formula (III-1), $R_1^{III}$, $R_2^{III}$, $R_3^{III}$ and $R_4^{III}$ each represents a hydrogen atom, a halogen atom, an alkyl group or an alkoxy group, or $R_1^{III}$ and $R_2^{III}$ or $R_3^{III}$ and $R_4^{III}$ respectively represent the atomic groups necessary to form, in combination with each other, a naphthalene ring taken together with the benzene ring. Considering materials characteristics and the ease of synthesis, a hydrogen atom, a methyl group and a methoxy group are preferred.

Preferred examples of the trisazo compound represented by formula (III-1) which can be used in the present invention are represented by the following formulas (III-2), (III-3) and (III-4):

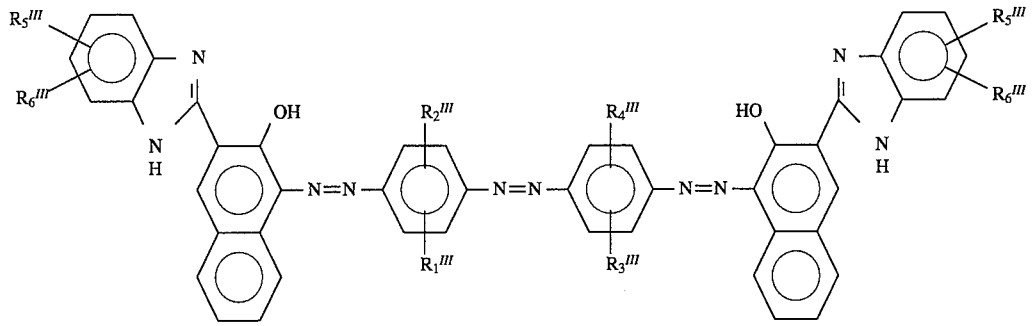

(III-2)

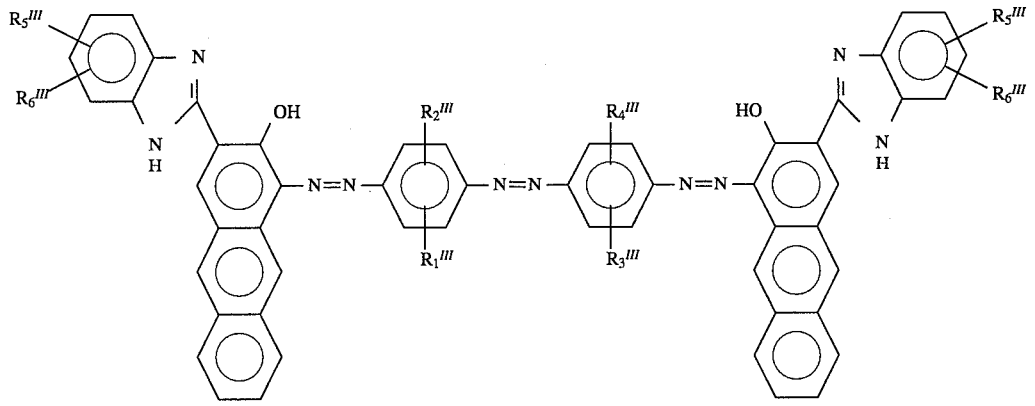

(III-3)

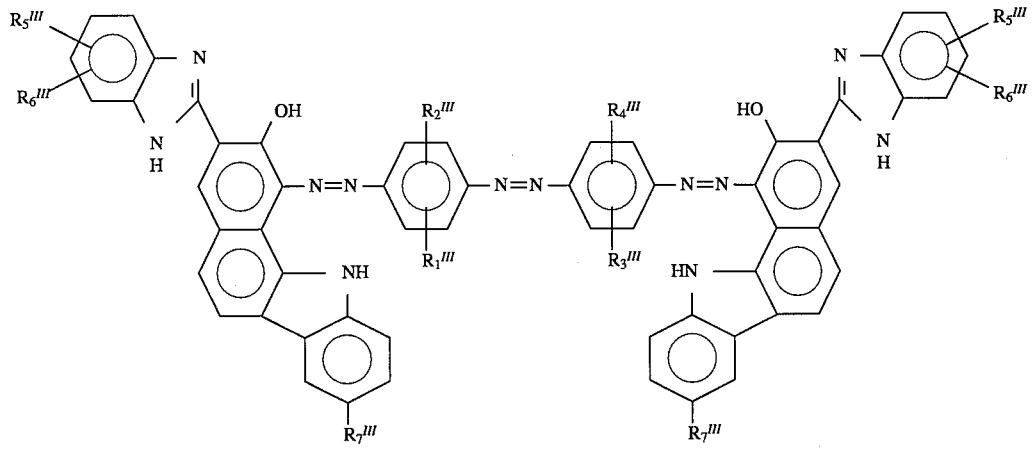

(III-4)

wherein $R_1^{III}$, $R_2^{III}$, $R_3^{III}$ and $R_4^{III}$ each represents a hydrogen atom, a halogen atom, an alkyl group, an alkoxy group or an alkenyl group (among these, a hydrogen atom, a methyl group and a methoxy group are preferred), or $R_1^{III}$ and $R_2^{III}$ or $R_3^{III}$ and $R_4^{III}$ respectively represent the atomic groups necessary to form, in combination with each other, a naphthalene ring taken together with the benzene ring; $R_5^{III}$ and $R_6^{III}$ each independently represents a hydrogen atom, a halogen atom, an alkyl group, an alkenyl group, an aralkyl group, an aryl group, an alkoxy group, an acyl group, a nitro group, a cyano group, a trifluoromethyl group or a β-dicyano-α-phenylvinyl group, or $R_5^{III}$ and $R_6^{III}$ respectively represent the atomic groups necessary to form, in combination with each other, a monocyclic or polycyclic hydrocarbon ring which may be substituted; and $R_7^{III}$ represents a hydrogen atom, a halogen atom, an alkyl group, an alkoxy group or a nitro group (among these, a hydrogen atom, a methyl group, a methoxy group, a fluorine atom, a chlorine atom, a bromine atom and a nitro group are preferred).

Specific examples of the trisazo compound (III-1) which may be used in the present invention are listed below but are by no means intended to limit the scope of the present invention.

III-1
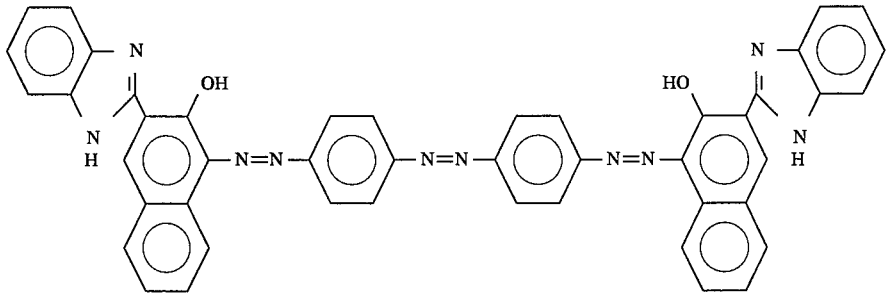
III-2
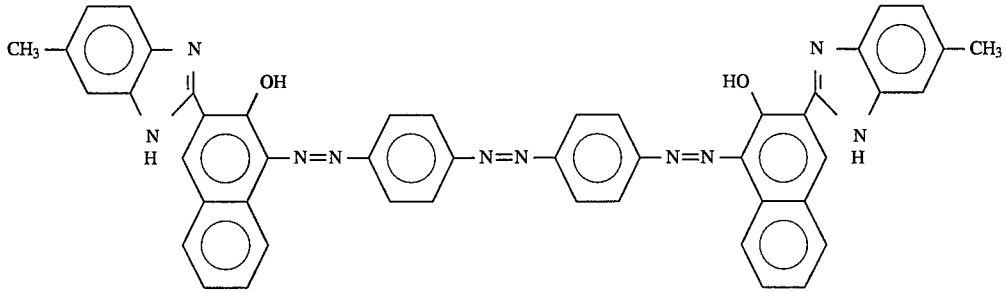
III-3
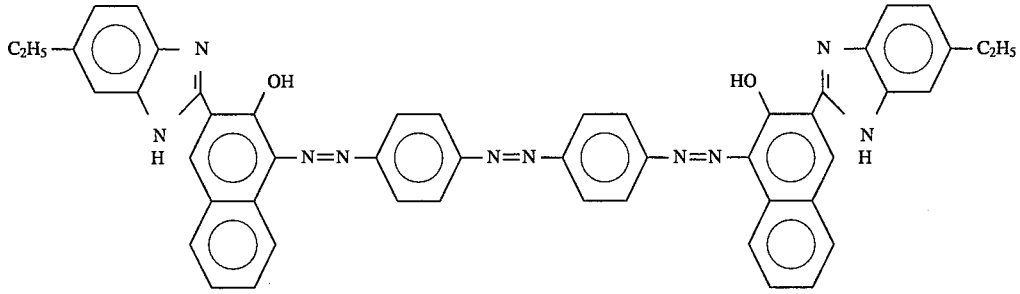
III-4
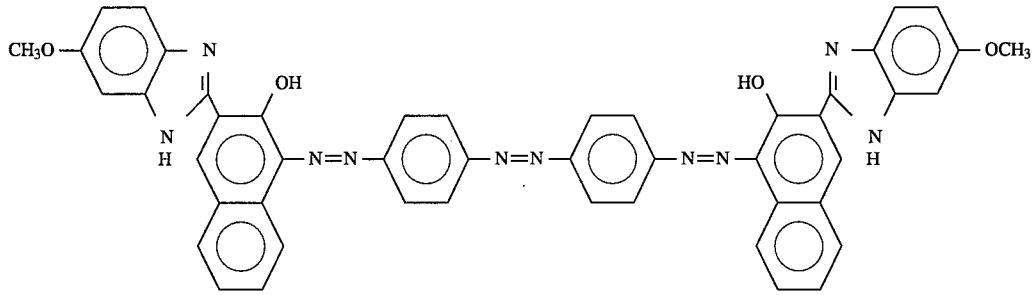
III-5
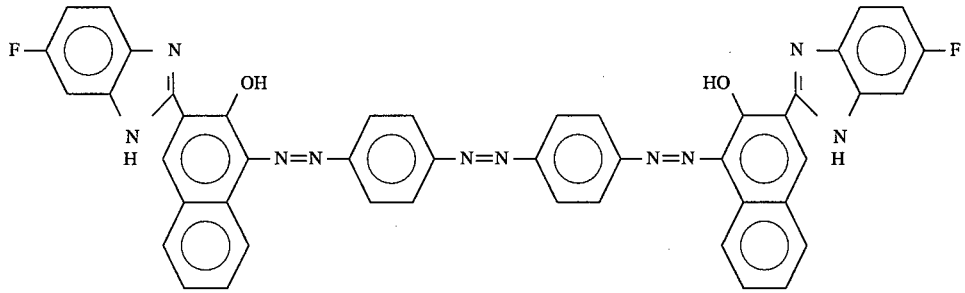

-continued
III-6
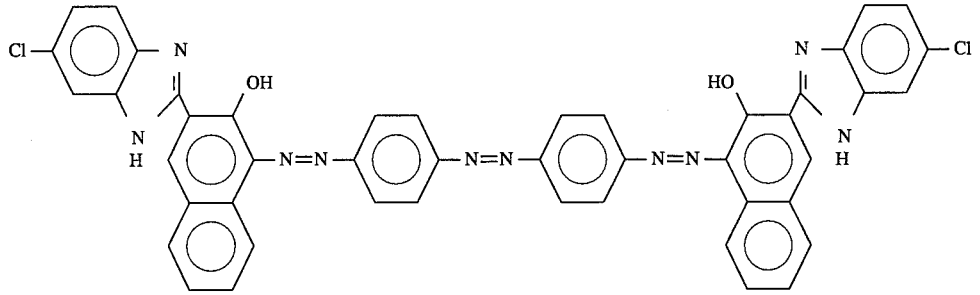
III-7
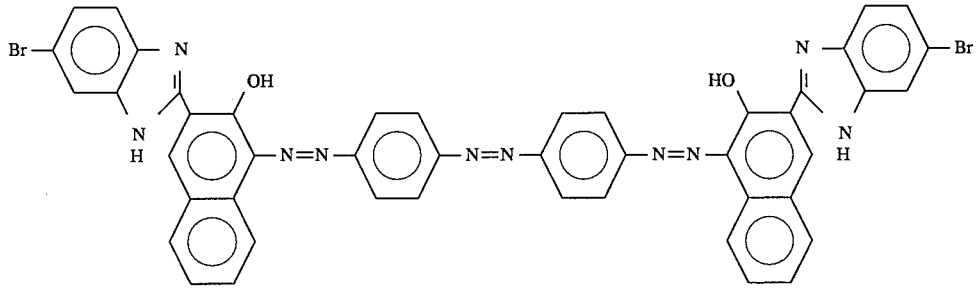
III-8
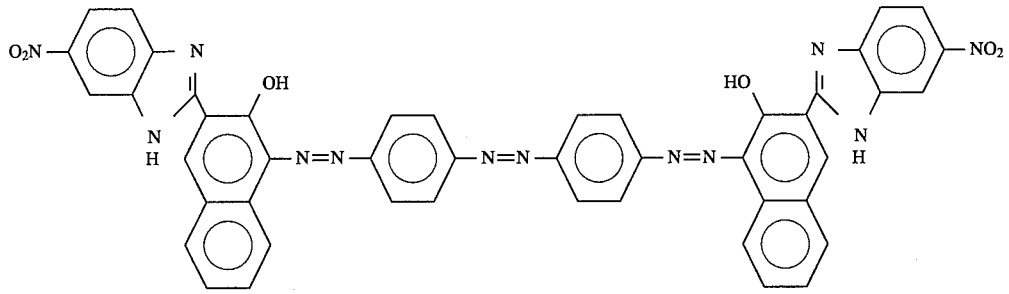
III-9
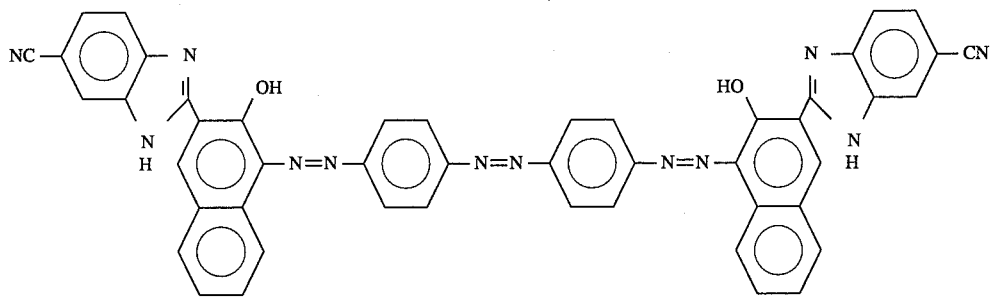
III-10
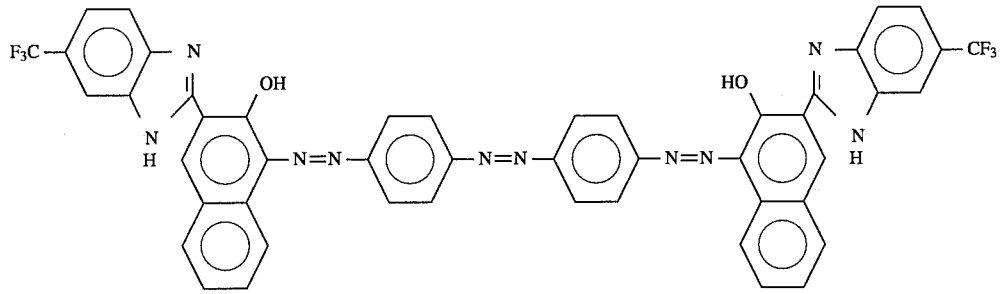

-continued
III-11
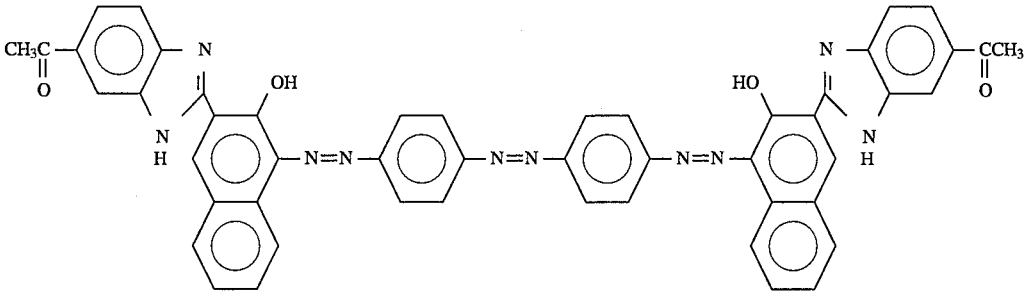
III-12
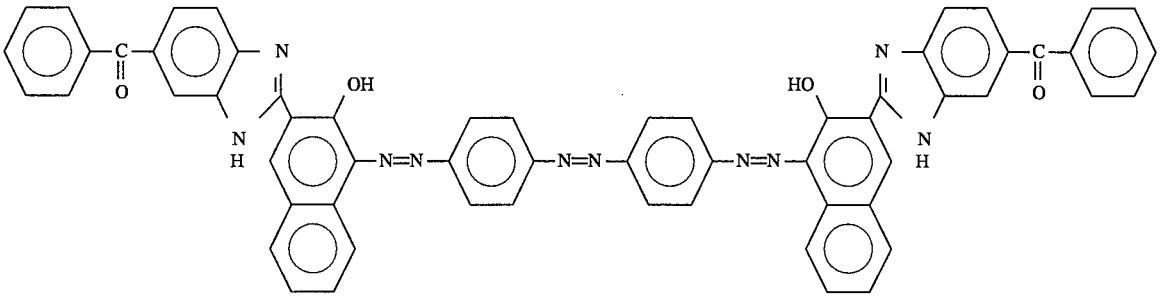
III-13
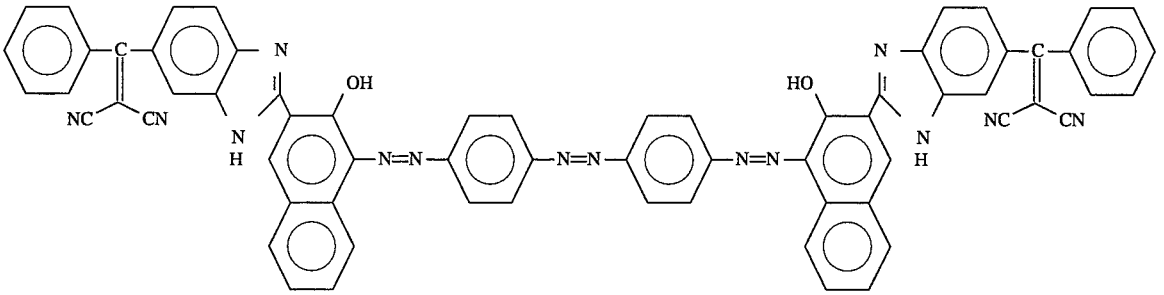
III-14
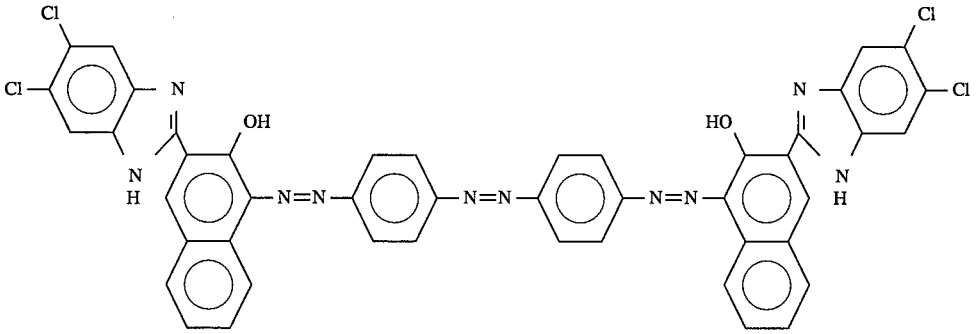
III-15
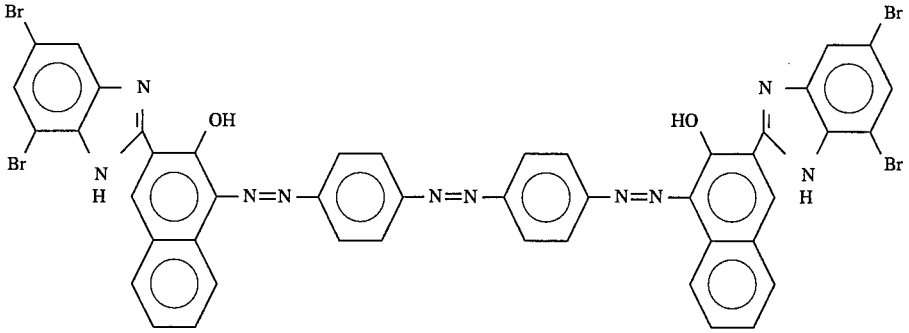

-continued
III-16
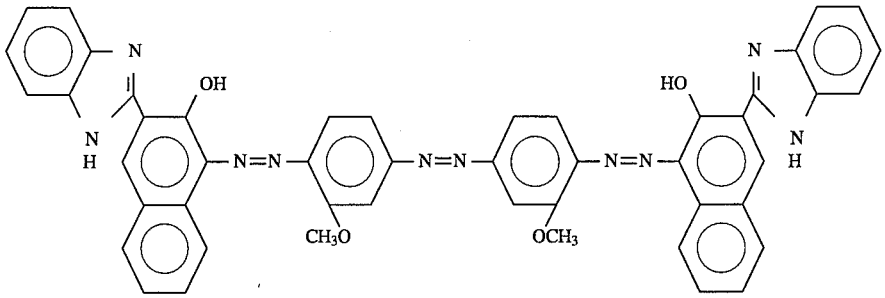
III-17
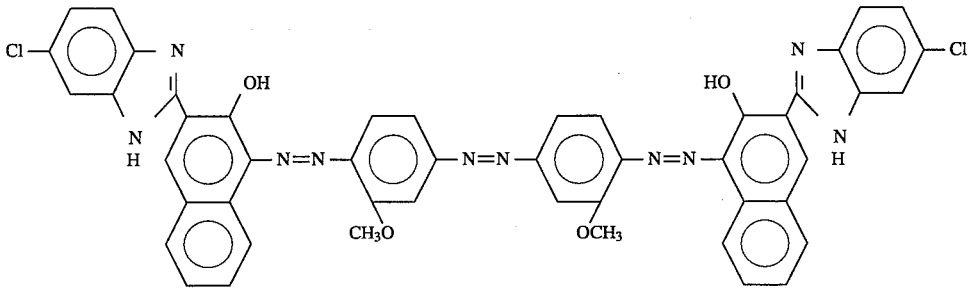
III-18
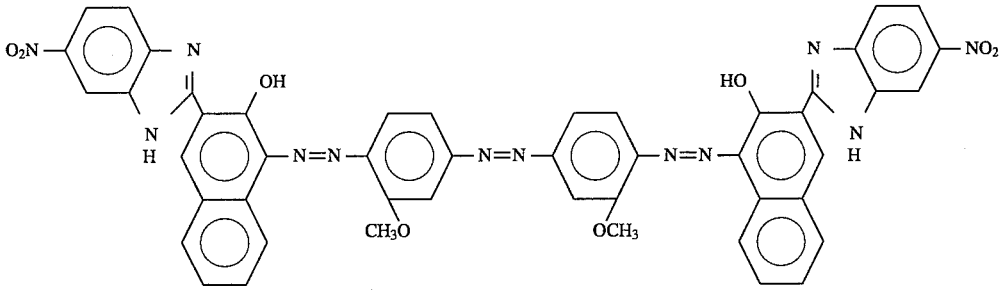
III-19
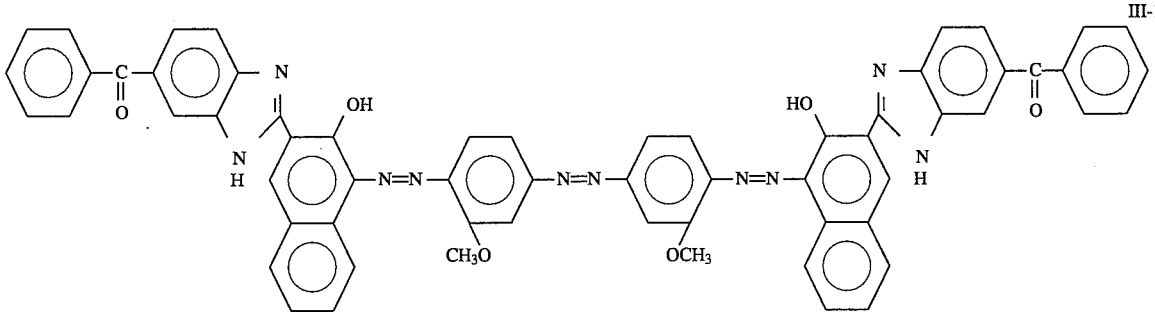
III-20
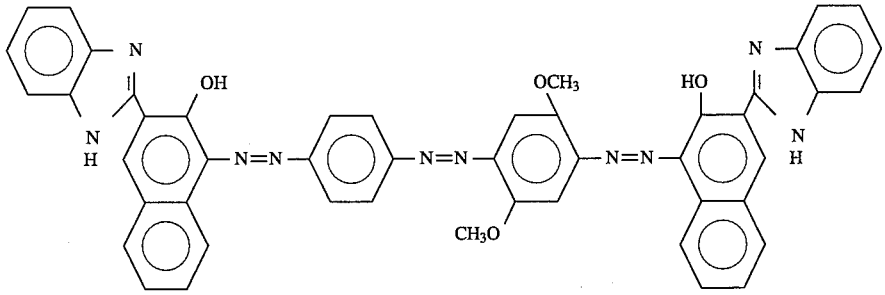

-continued
III-21
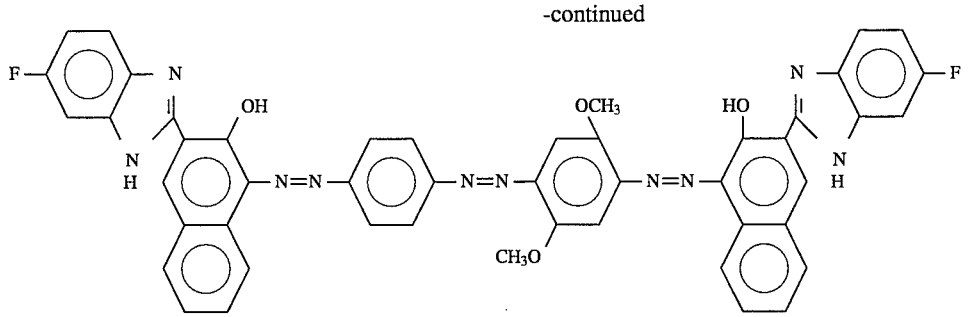
III-22
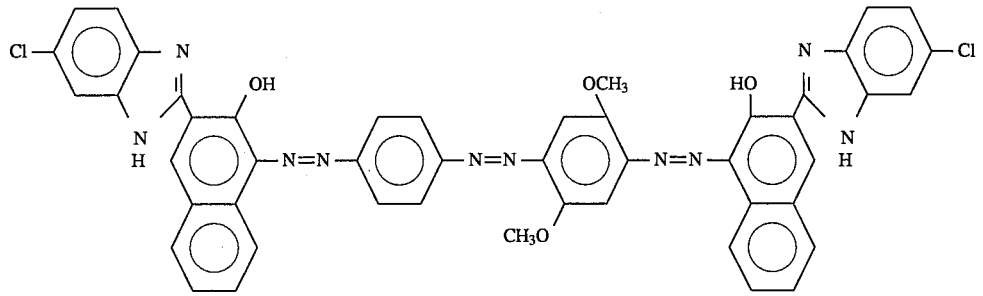
III-23
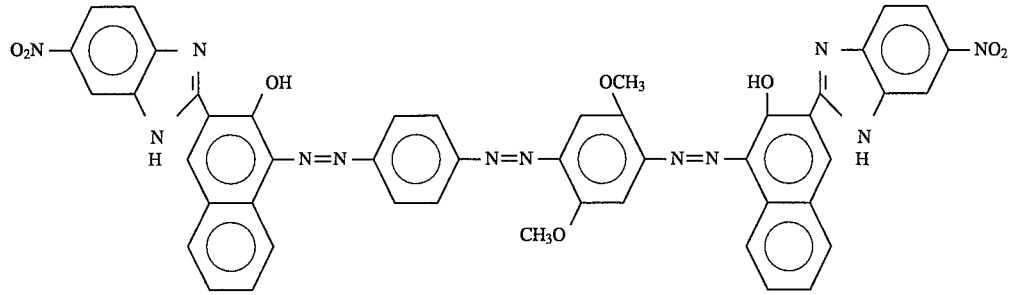
III-24
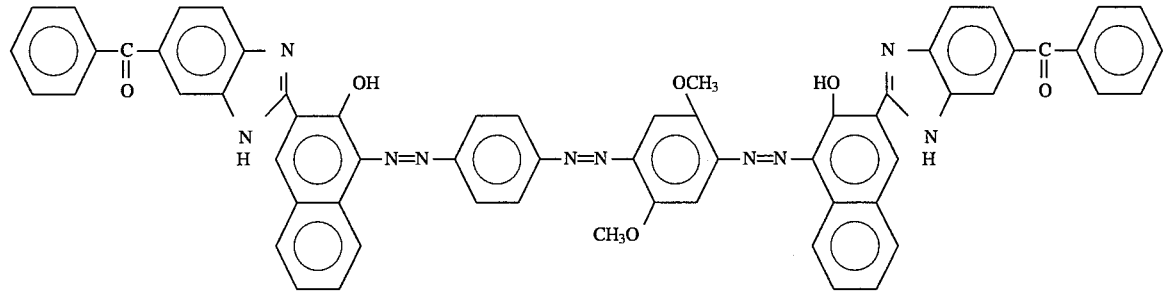
III-25
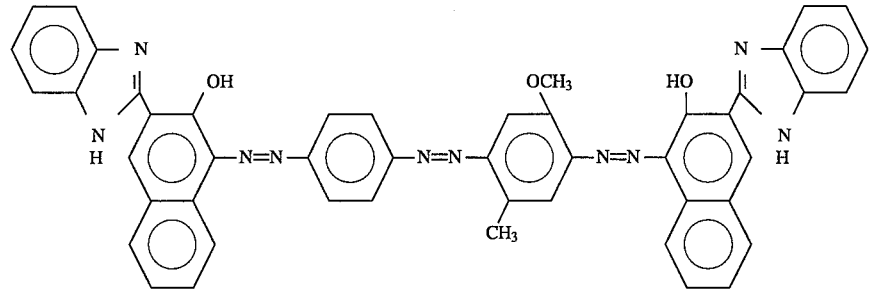

-continued
III-26
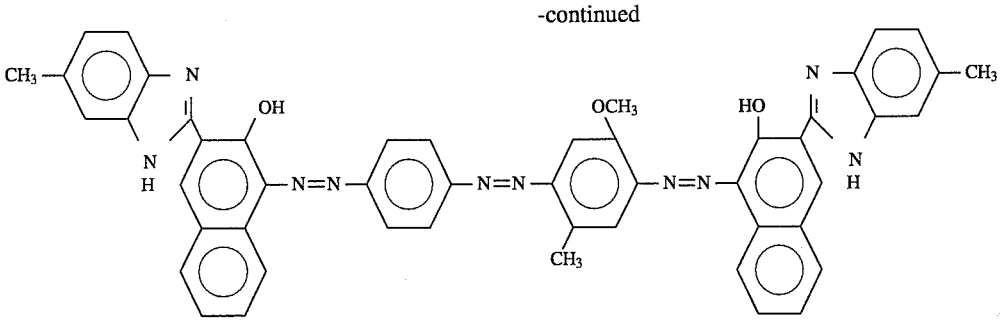
III-27
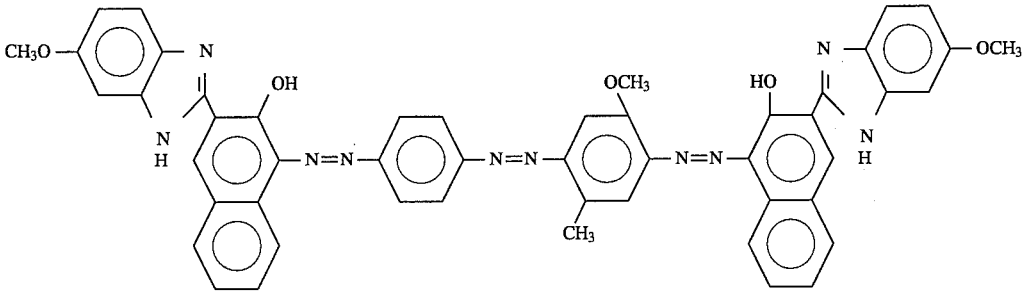
III-28
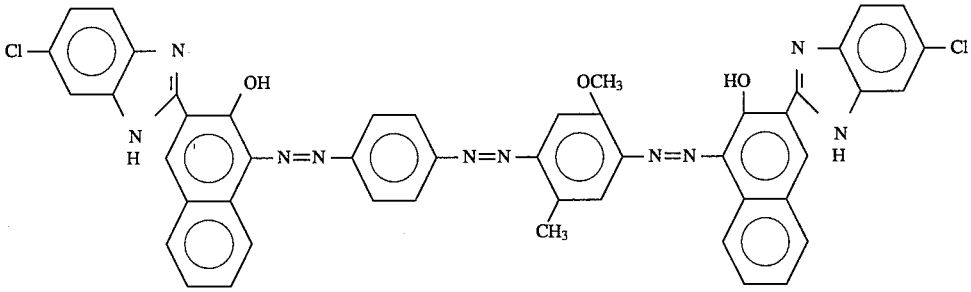
III-29
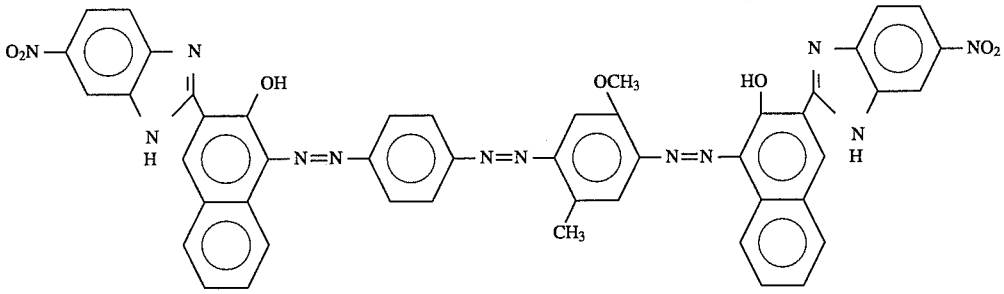
III-30
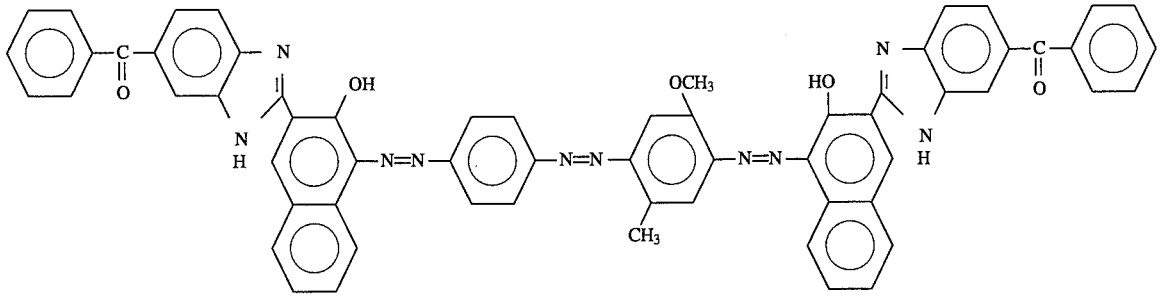

-continued
III-31
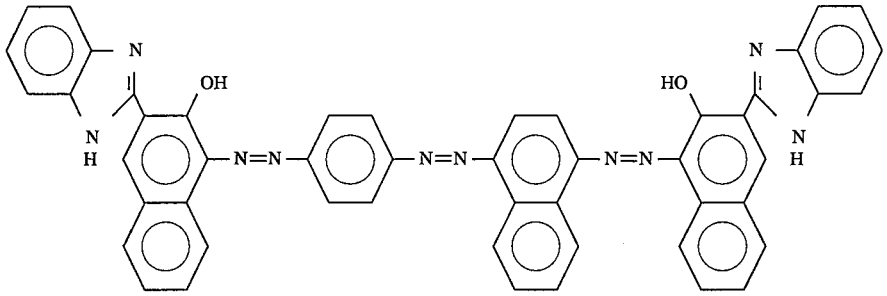
III-32
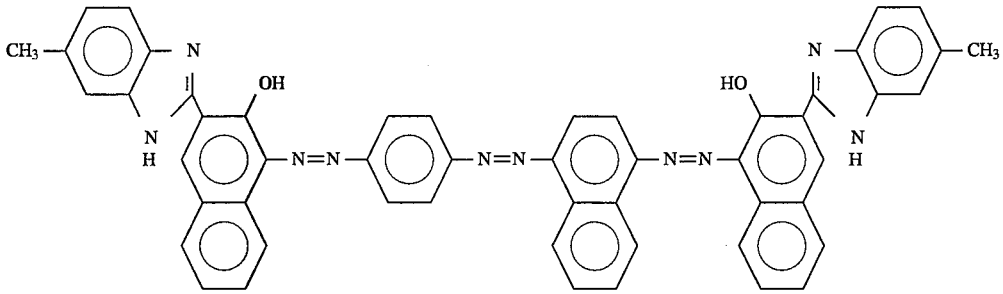
III-33
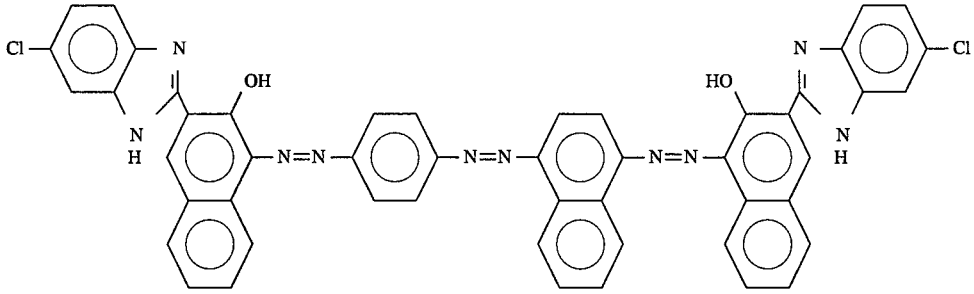
III-34
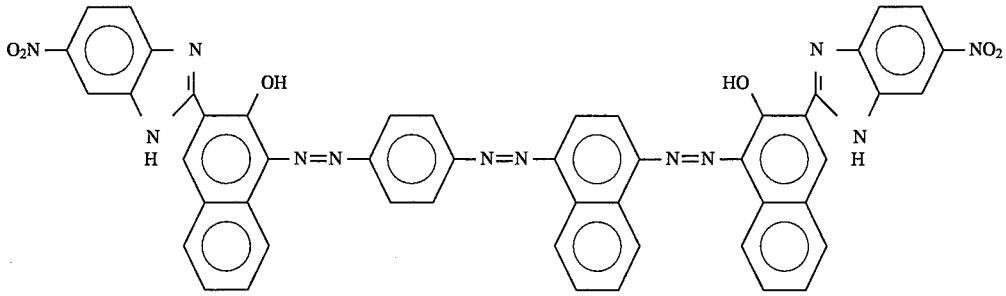
III-35
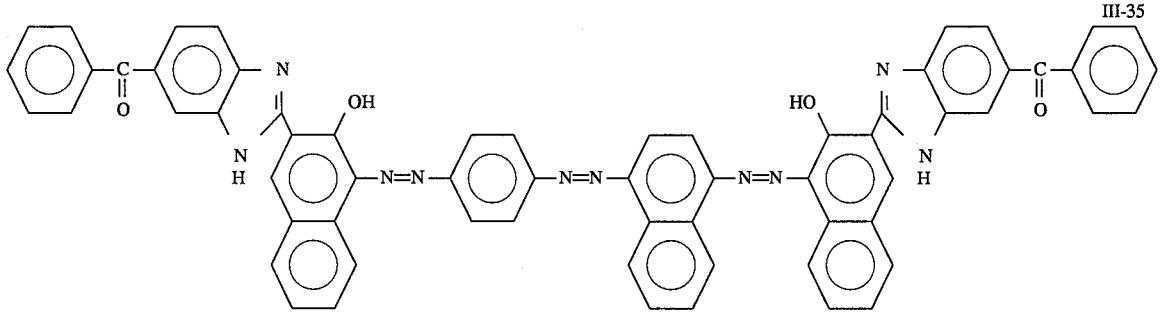

-continued
III-36
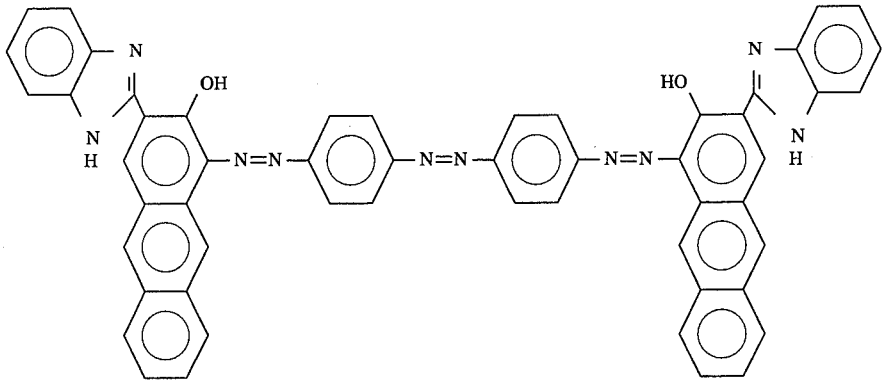
III-37
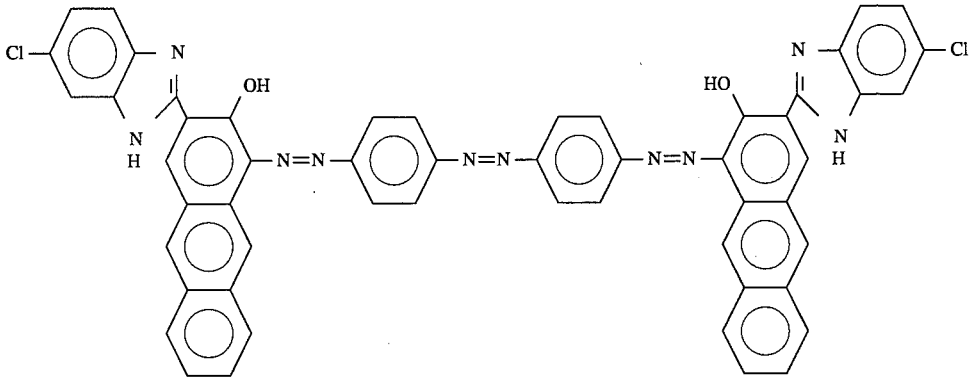
III-38
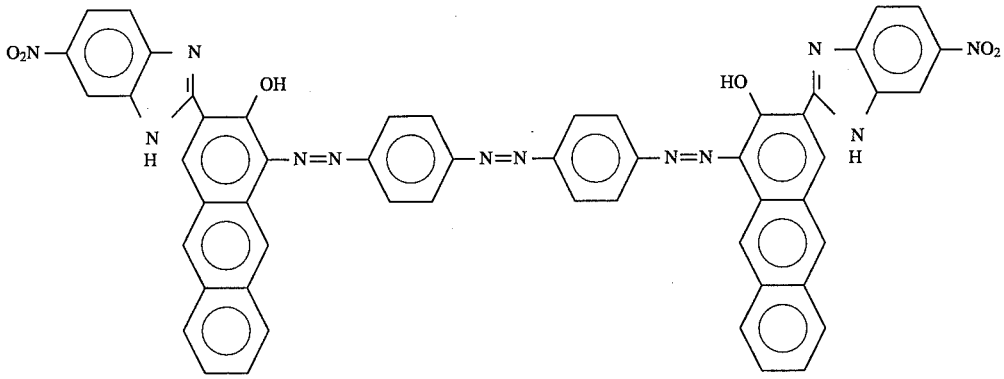
III-39
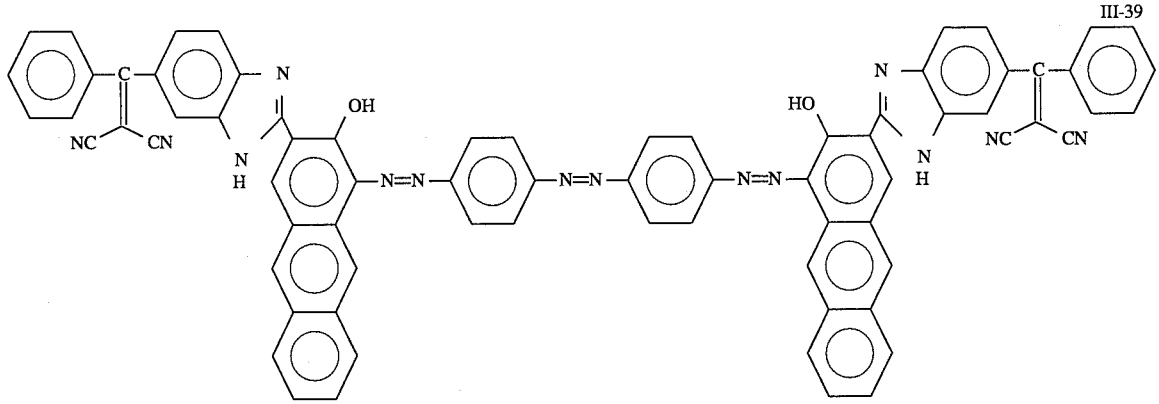

-continued
III-40
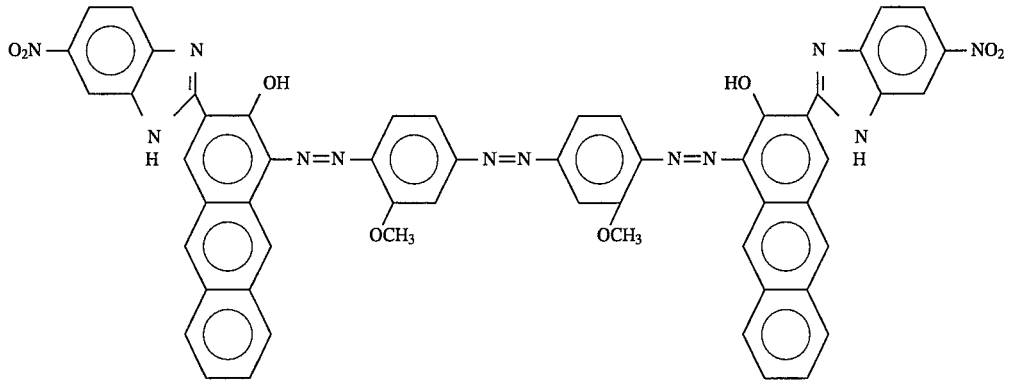
III-41
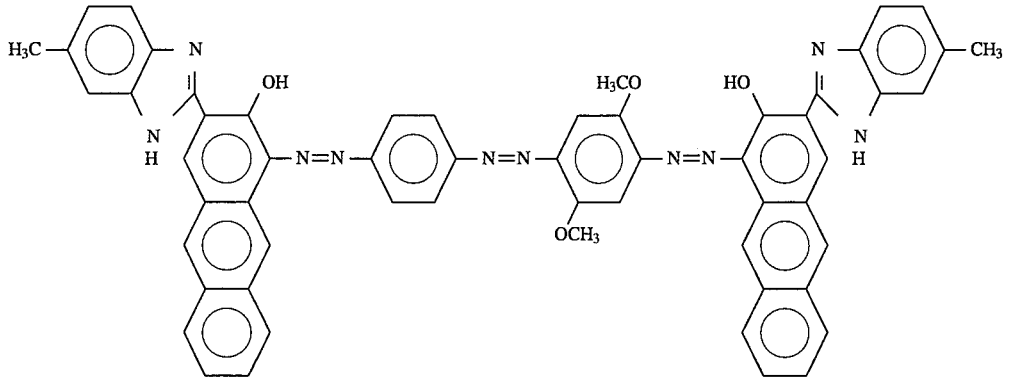
III-42
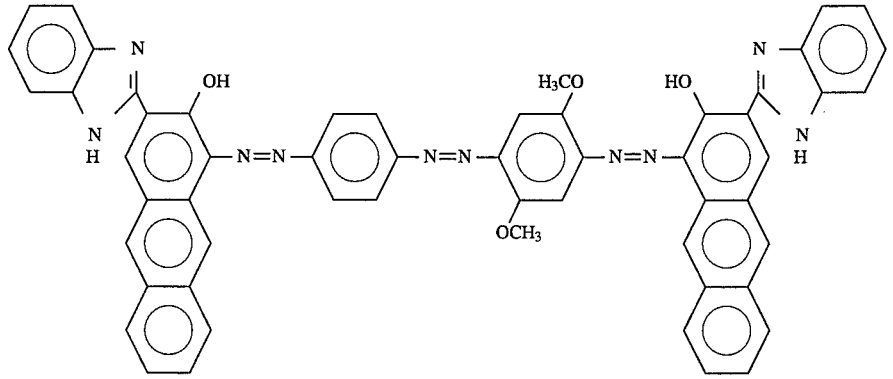
III-43
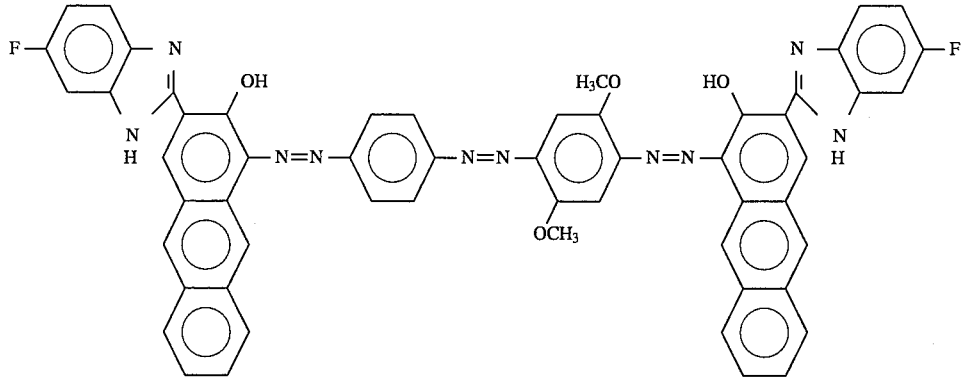

-continued
III-44
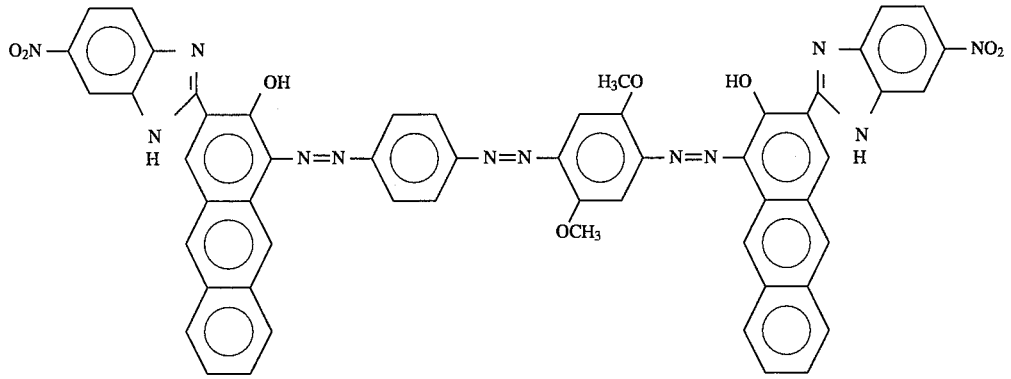
III-45
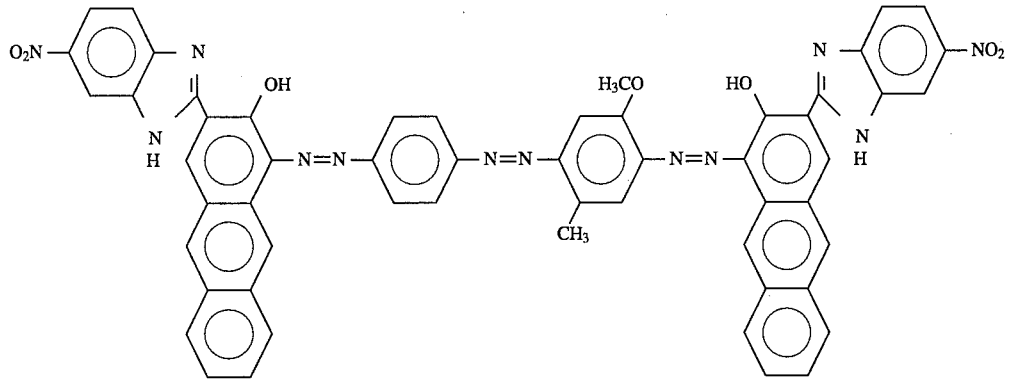
III-46
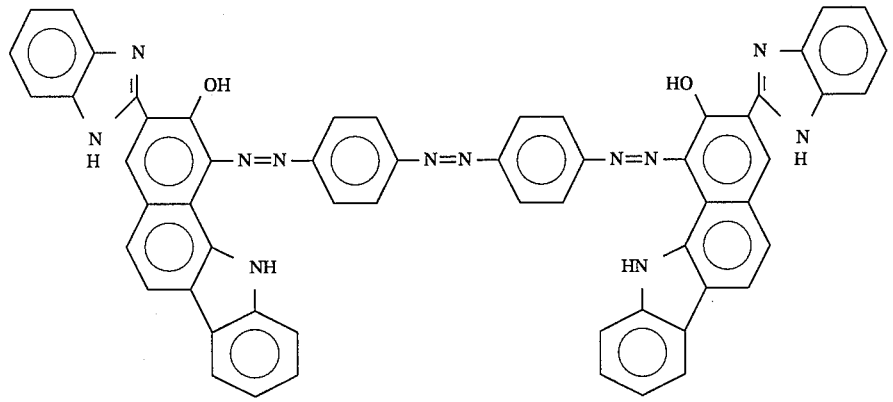
III-47
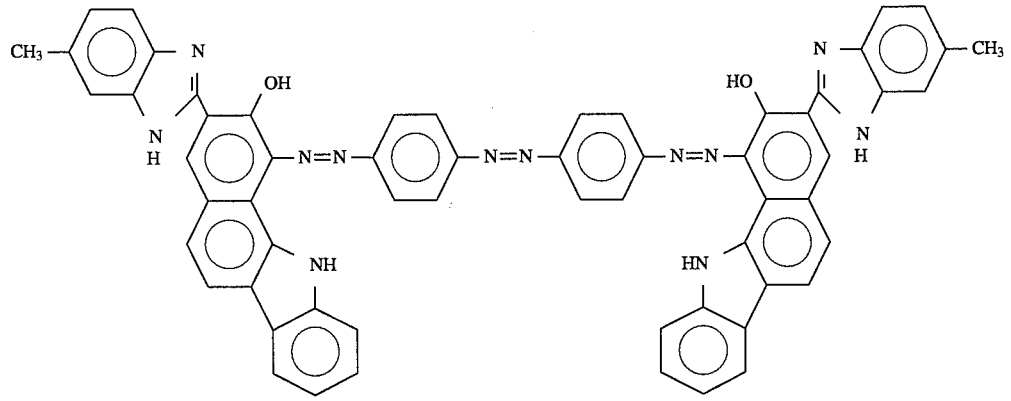

-continued
III-48
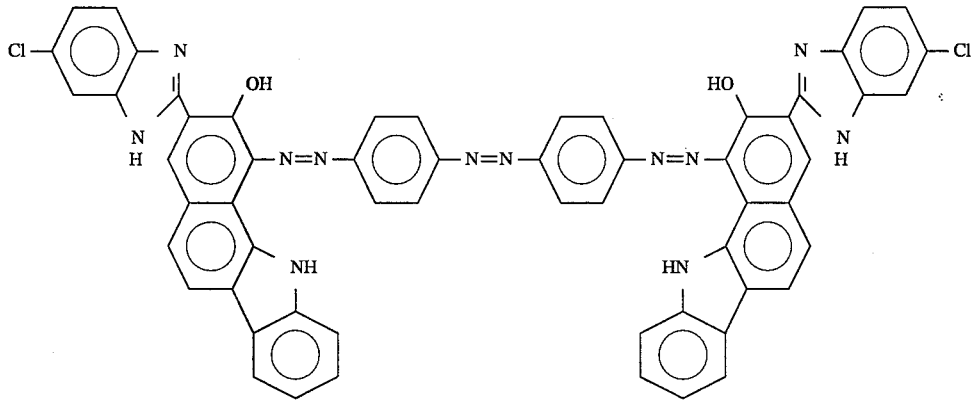
III-49
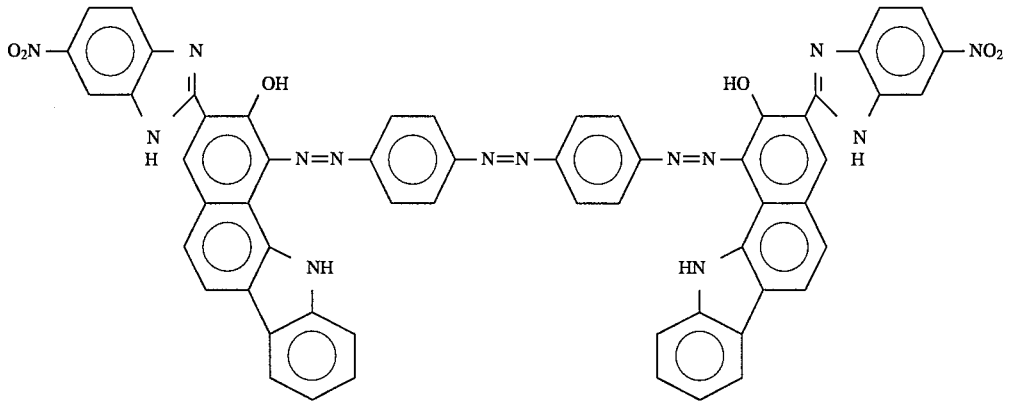
III-50
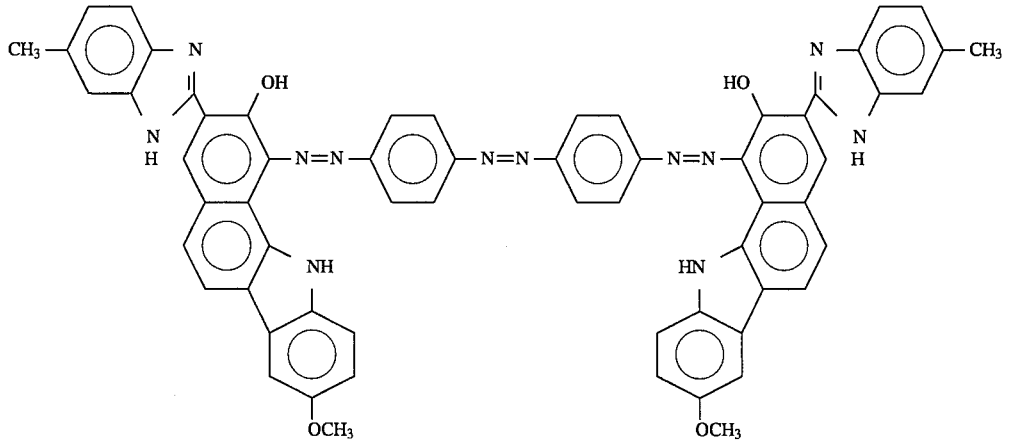

-continued
III-51
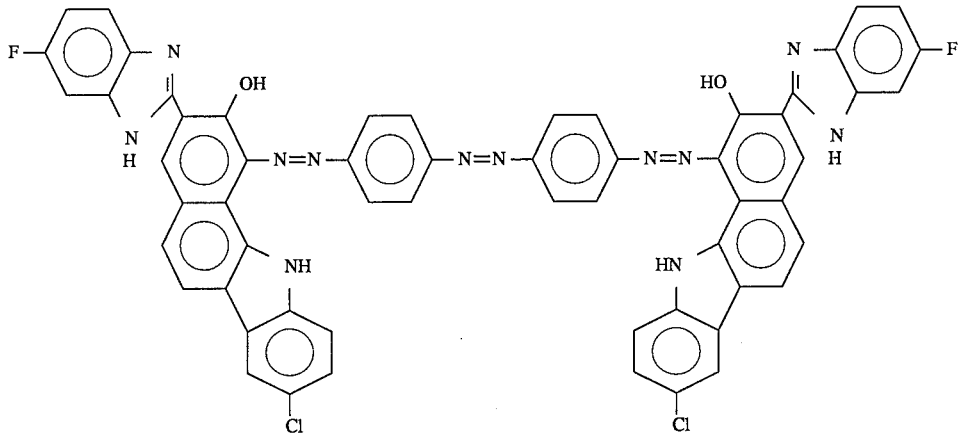
III-52
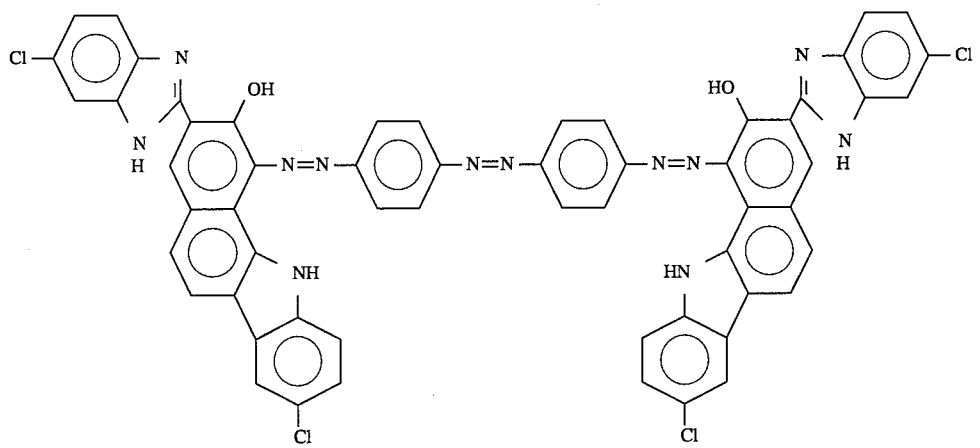
III-53
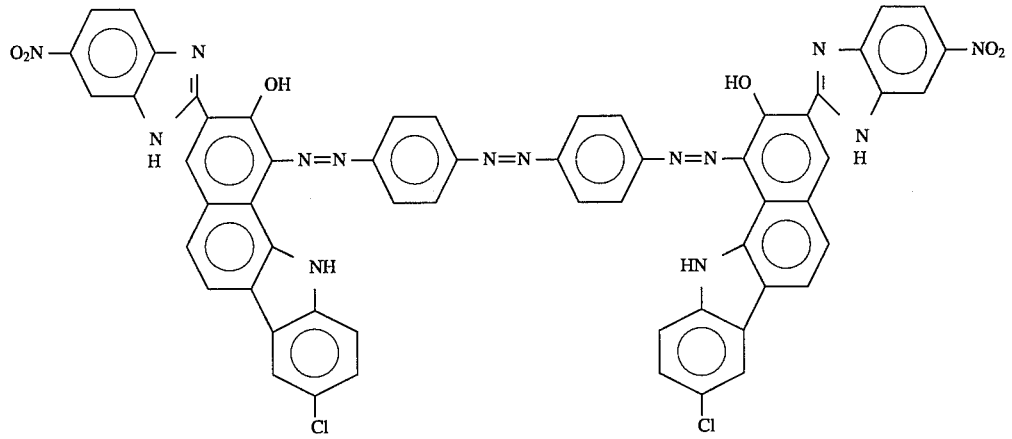

-continued
III-54
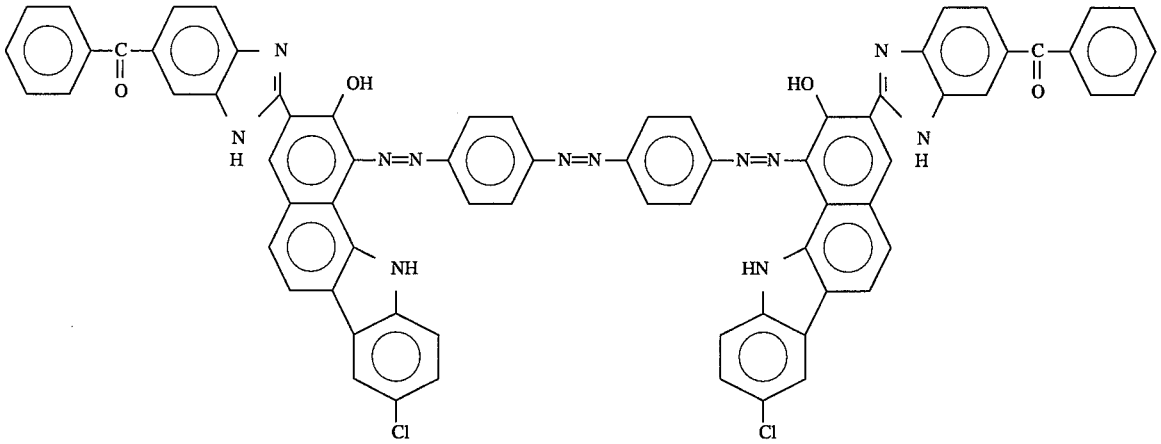
III-55
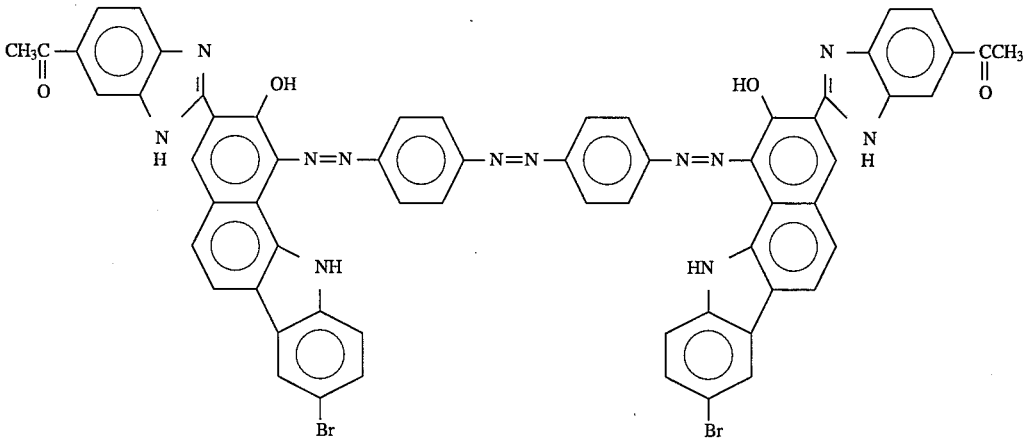
III-56
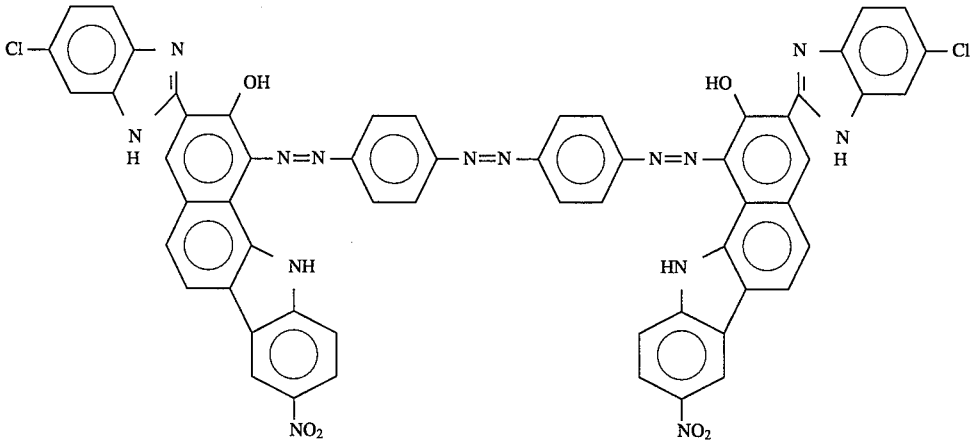

-continued
III-57
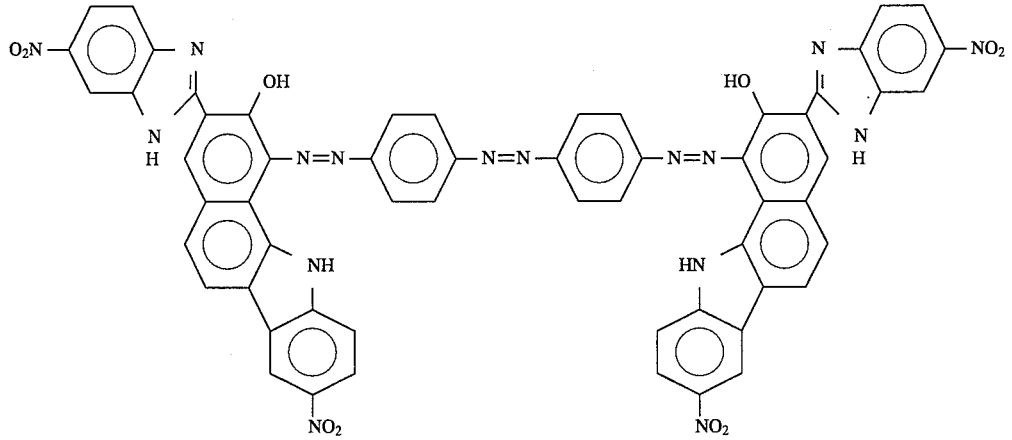
III-58
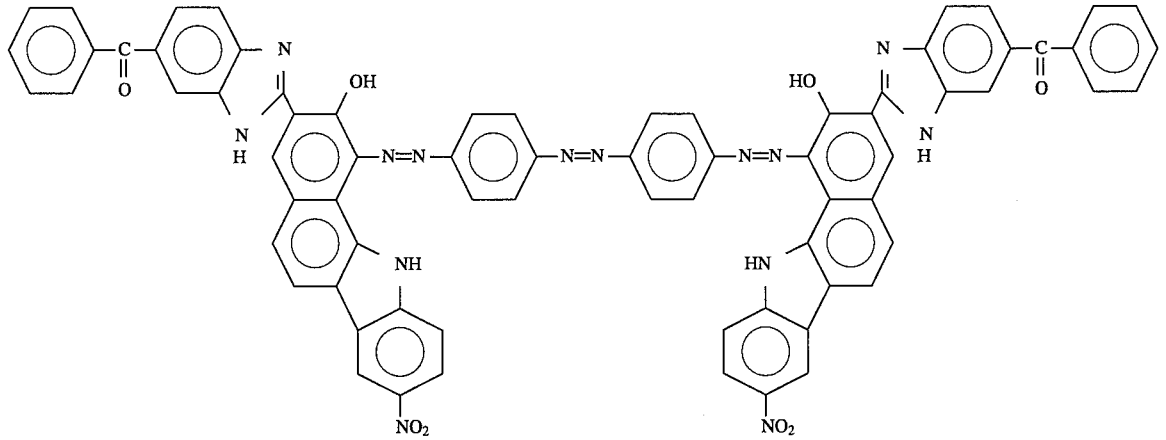
III-59
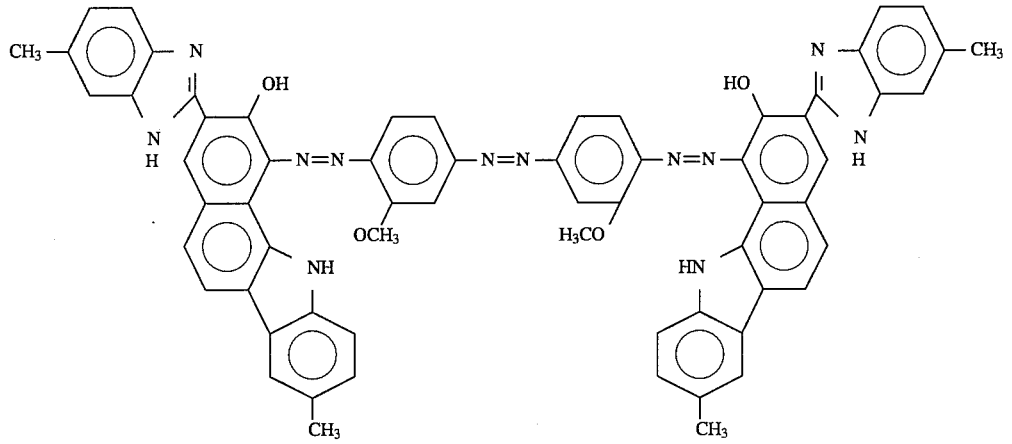

-continued
III-60
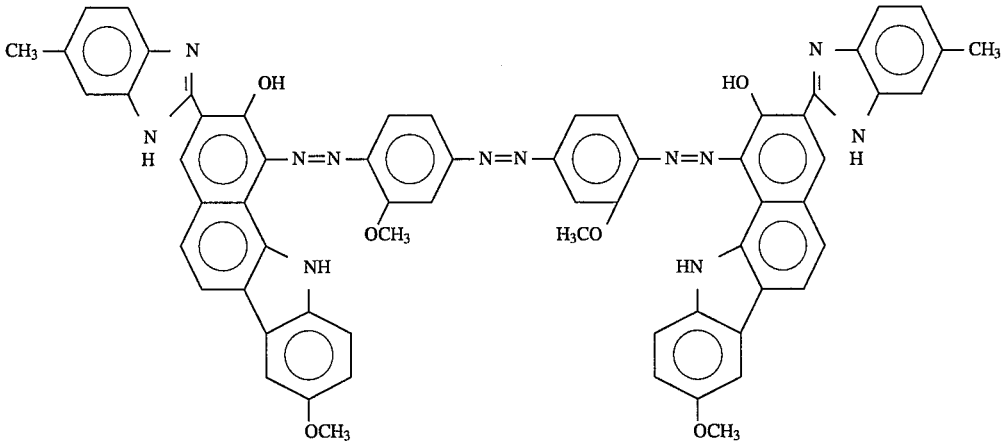
III-61
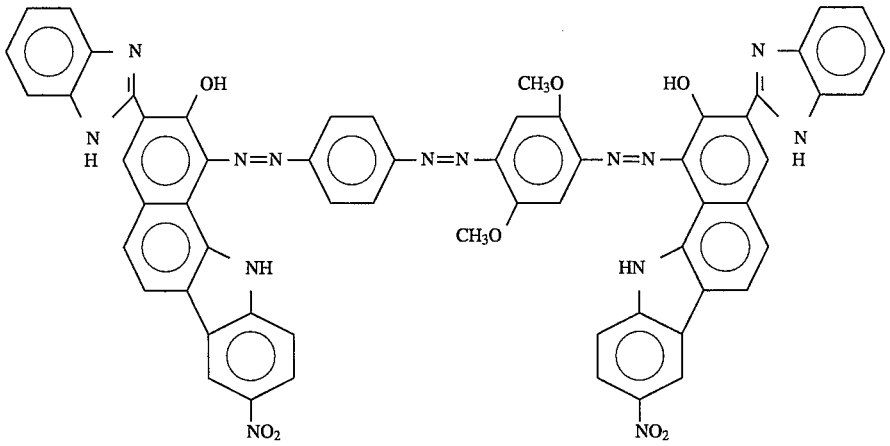
III-62
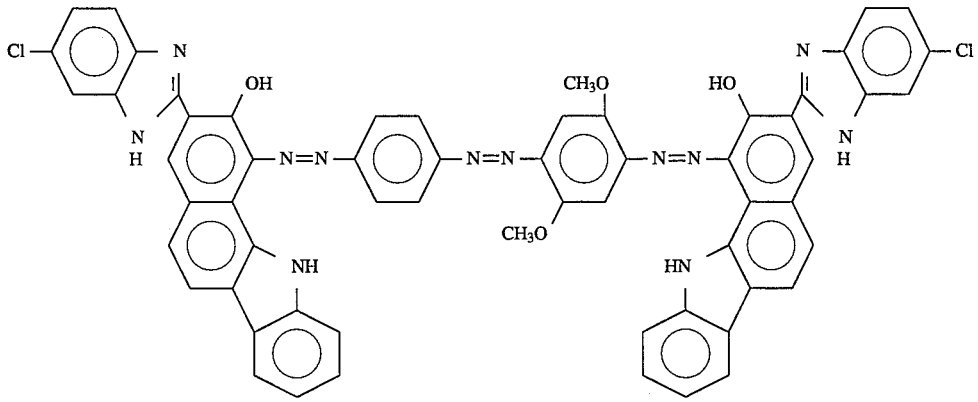

-continued
III-63
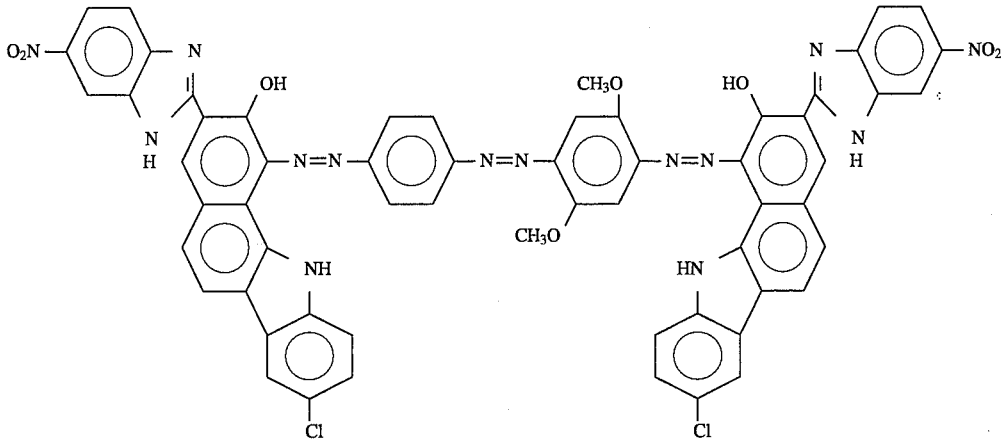
III-64
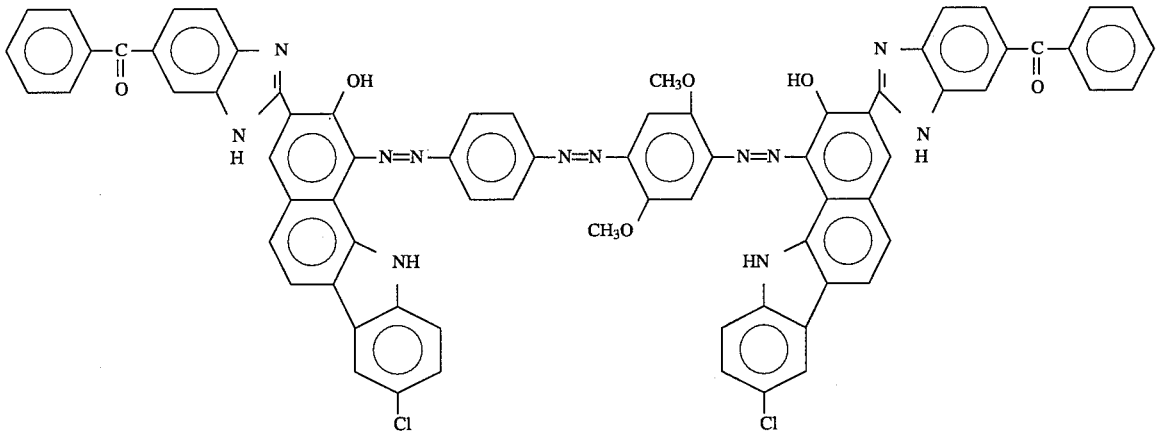
III-65
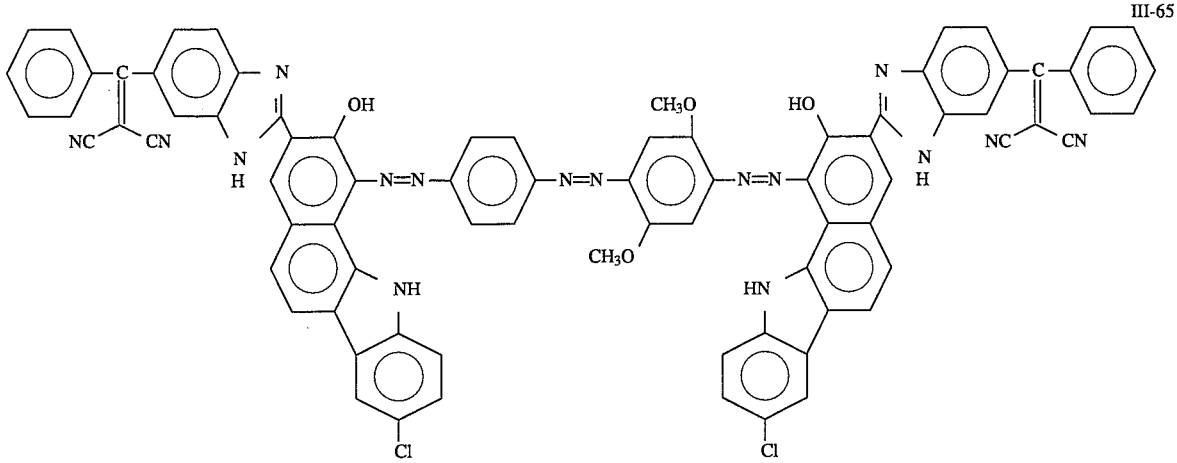

-continued
III-66
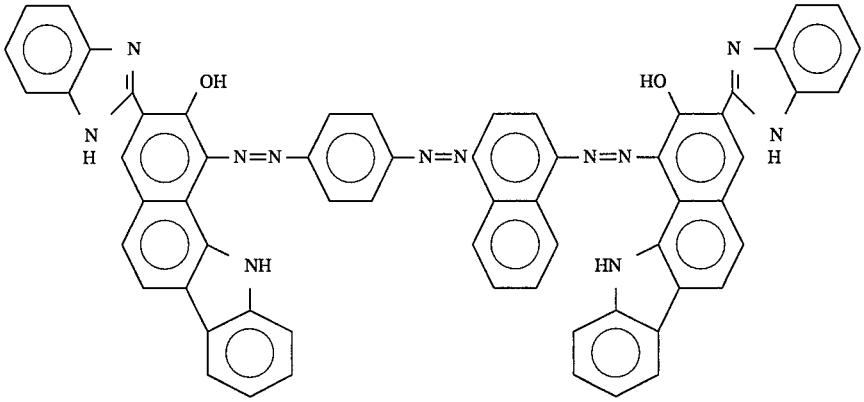
III-67
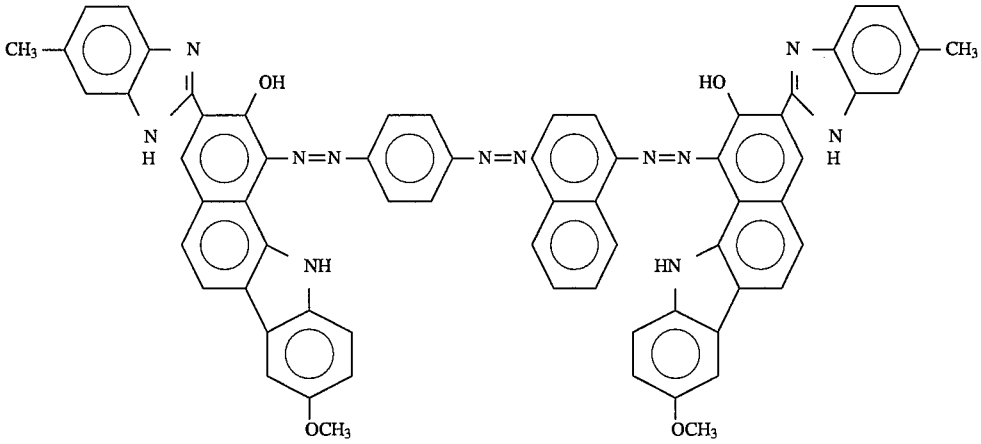
III-68
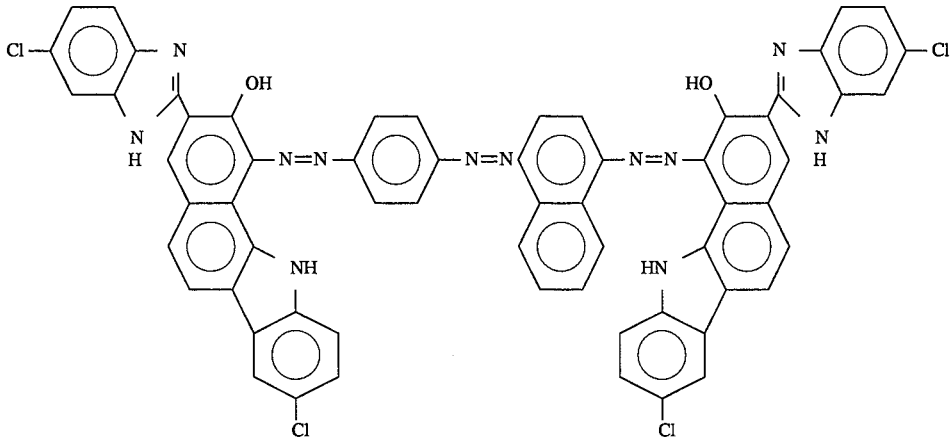

-continued

III-69

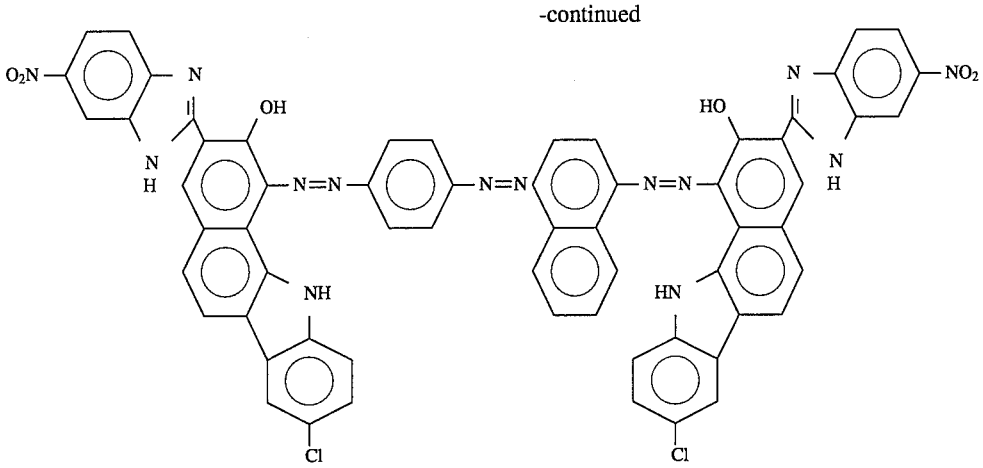

III-70

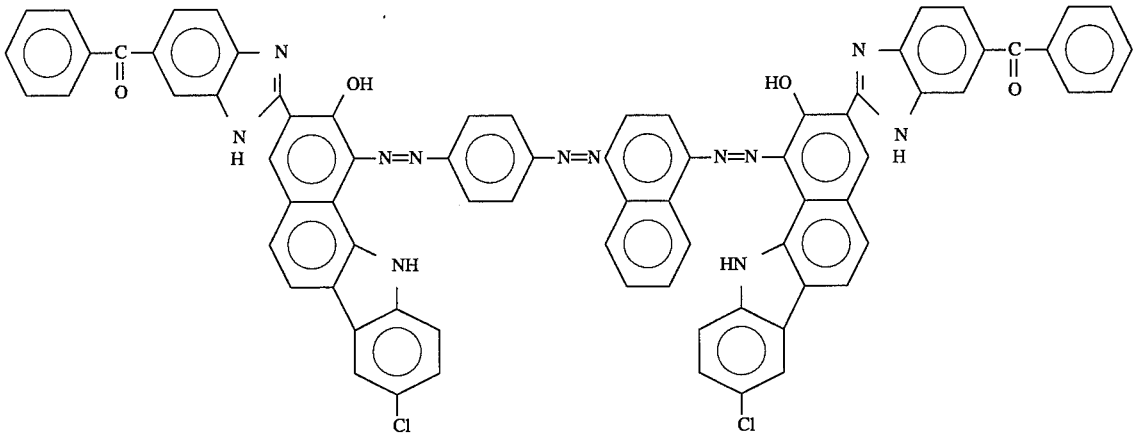

Trisazo compounds of the formula (III-1) for use in the third aspect of the present invention can be synthesized by the following method. A compound represented by the following formula (III-5):

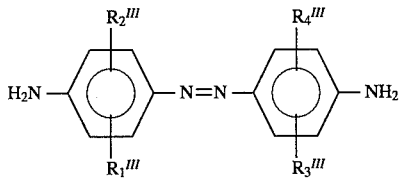

(III-5)

(where $R_1^{III}$, $R_2^{III}$, $R_3^{III}$ and $R_4^{III}$ have the same meanings as defined in the above formula (III-1)) is tetrazotized in the usual manner to obtain a tetrazonium salt, which is isolated in a suitable form such as a borofluoride or hexafluorophosphate and subjected to coupling with a compound represented by the following formula (III-6) in an appropriate solvent (e.g. N,N-dimethylformamide, N-methylpyrrolidone or dimethyl sulfoxide) in the presence of a base such as sodium acetate or triethylamine:

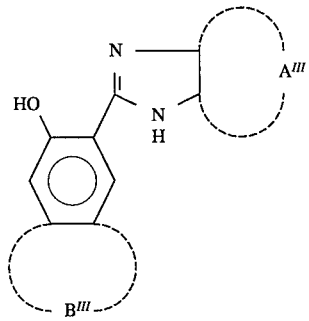

(III-6)

(where $A^{III}$ and $B^{III}$ have the same meanings as defined in the above formula (III-1)).

Typical examples of the synthesis of trisazo compounds (III-1) to be used in the third aspect of the present invention are described below.

Synthesis Example III-1 (synthesis of Compound No. III-1)

4,4'-Diaminoazobenzene (10.6 g, 0.05 mol) is dispersed in 500 ml of 6 N-HCl. Thereafter, a solution having 7.6 g (0.11 mol) of sodium nitrite dissolved in 20 ml of water is added dropwise to the dispersion at 0°–5° C. under cooling with ice over a period of 10 min. After the dropwise addition, the mixture is subjected to continued stirring at the same temperature for about 20 min and the insoluble matter is filtered off. To the filtrate, 50 ml of 42 wt % borofluoric acid is added and the resulting precipitate is recovered by filtration, washed with ice water, alcohol and then ether, and dried under reduced pressure at room temperature to obtain azobenzene-4,4'-bisdiazonium bistetrafluoroborate in an amount of 17.4 g (yield 85%).

Subsequently, 2.86 g (0.11 mol) of 3-(2'- benzimidazolyl)-2-naphthol is dissolved in N,N-dimethylformamide and the solution is cooled to about 0° C. Thereafter, 2.05 g (0.005 mol) of the previously prepared tetrazonium salt is dissolved in the cooled solution. To the stirred solution, a solution having 1.7 ml (0.012 mol) of triethylamine diluted with 10 ml of N,N-dimethylformamide is added dropwise over a period of 5 min. After the dropwise addition, stirring is continued at room temperature for about 5 min and the resulting precipitate is recovered by filtration. The recovered precipitating cake is dispersed in 250 ml of N,N-dimethylformamide and, following 1 hour-stirring at about 80° C., the precipitate is again separated by filtration. These procedures are repeated 4 times and the resulting precipitate is washed first with water, then with acetone, and dried to obtain a trisazo compound (Compound No. III-1) in an amount of 3.36 g (yield: 89%). m.p.: 350° C. or more.

| Elemental analysis for $C_{46}H_{30}N_{10}O_2$ | | |
|---|---|---|
| | Cal'd | Found |
| C (%) | 73.20 | 73.01 |
| H (%) | 4.01 | 3.88 |
| N (%) | 18.56 | 18.42 |

IR absorption spectrum (KBr tab.)
1600 $cm^{-1}$ (C=N)

Synthesis Example III-2 (synthesis of Compound No. III-48)

A reaction and a post-treatment are performed in the same manner as in Synthesis Example III-1 except that 4.21 g (0.011 ml) of 3-(5"-chloro-2"-benzimidazolyl)-2-hydroxy-1,2'-benzocarbazole is used as the coupling component and that amount of the reaction solvent is increased to 500 ml. As a result, a trisazo compound (Compound No. III-48) is obtained as a dark brown powder in an amount of 3.57 g (yield: 71% ). m.p.: 350° C. or more.

| Elemental analysis for $V_{58}H_{34}N_{12}O_2Cl_2$ | | |
|---|---|---|
| | Cal'd | Found |
| C (%) | 69.53 | 69.08 |
| H (%) | 3.42 | 3.34 |
| N (%) | 16.78 | 16.50 |

IR absorption spectrum (KBr tablet)
1600 $cm^{-1}$ (C=N)

The electrophotographic photoreceptor according to the fourth aspect of the present invention may comprise an electroconductive substrate having a light-sensitive layer containing as an azo pigment a bisazo compound represented by the following formula (IV-1):

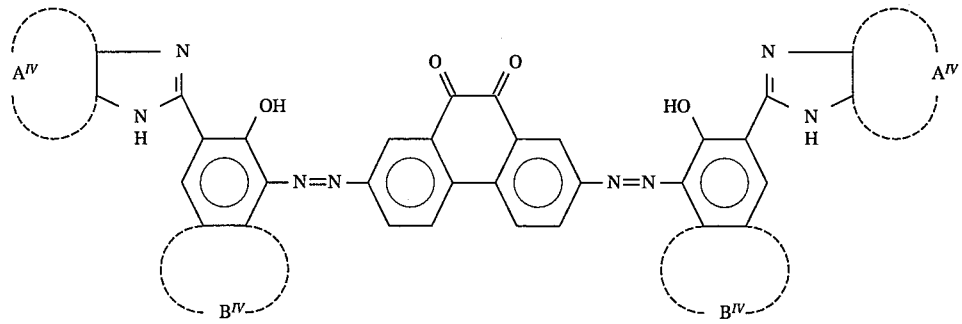

(IV-1)

wherein $A^{IV}$ represents the atomic necessary to form an aromatic ring or hetero ring which may be substituted; and $B^{IV}$ represents the atomic group necessary to form a naphthalene ring or a carbazole ring which may be substituted.

The fourth aspect of the present invention is described below in detail.

To further describe the bisazo compound represented by the formula (IV-1) which is used in the electrophotographic photoreceptor of the present invention, $A^{IV}$ in the formula (IV-1) represents the atomic group necessary to form an aromatic ring or hetero ring which may be substituted. Considering materials characteristics and the ease of synthesis, a substituted or unsubstituted benzene ring is preferred.

In the case of a substituted benzene ring, examples of the substituents include a halogen atom, an alkyl group, an alkenyl group, an aralkyl group, an aryl group, an alkoxy group, an acyl group, a nitro group, a cyano group, a trifluoromethyl group or a β-dicyano-α-phenylvinyl group. Considering materials characteristics and the ease of synthesis, a fluorine atom, a chlorine atom, a bromine atom, a methyl group, an ethyl group, a methoxy group, an acetyl group, a benzoyl group which may be substituted, and a nitro group are preferred.

In the formula (IV-1), $B^{IV}$ represents the atomic group necessary to form a naphthalene ring or a carbazole ring which may be substituted. If $B^{IV}$ forms a substituted carbazole ring, examples of the substituents include a halogen atom, an alkyl group, an alkoxy group or a nitro group. Considering materials characteristics and the ease of synthesis, a chlorine atom, a bromine atom, a methyl group, a methoxy group and a nitro group are preferred.

Preferred examples of the bisazo compound represented by formula (IV-1) which can be used in the present invention are represented by formulas (IV-2) and (IV-3):

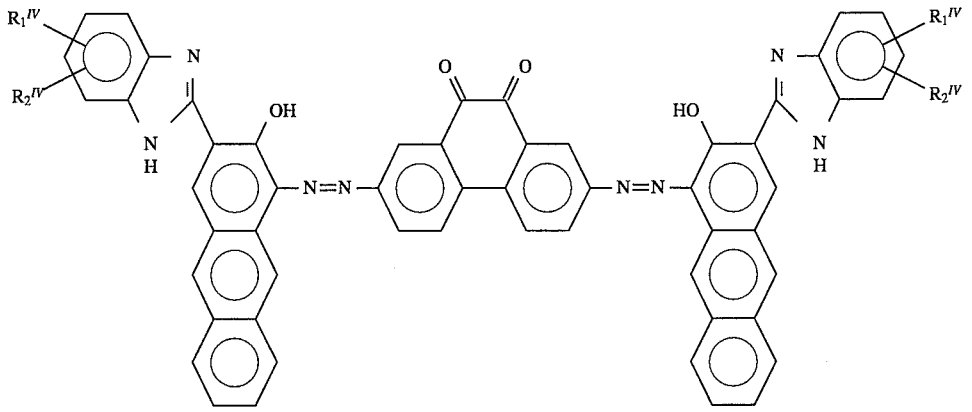

(IV-2)

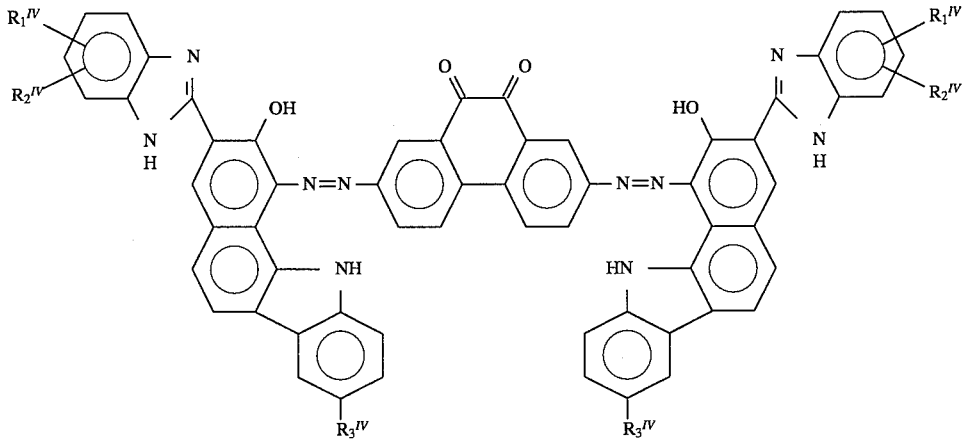

(IV-3)

wherein $R_1^{IV}$ and $R_2^{IV}$ each represents a hydrogen atom, a halogen atom, an alkyl group, an alkenyl group, an aralkyl group, an aryl group, an alkoxy group, an acyl group, a nitro group, a cyano group, a trifluoromethyl group or a β-dicyano-α-phenylvinyl group (among these, a hydrogen atom, a methyl group, an ethyl group, a fluorine atom, a chlorine atom, a bromine atom, an iodine atom, a methoxy group, an acetyl group, a benzoyl group and a nitro group are preferred), or $R_1^{IV}$ and $R_2^{IV}$ respectively represent atomic groups which, in combination with each other, form a monocyclic or polycyclic hydrocarbon ring which may be substituted; and $R_3^{IV}$ represents a hydrogen atom, a halogen atom, an alkyl group, an alkoxy group or a nitro group (among these, a hydrogen atom, a methyl group, a methoxy group, a fluorine atom, a chlorine atom, a bromine atom and a nitro group).

Specific examples of the bisazo compound (IV-1) which may be used in the present invention are listed below but are by no means intended to limit the scope of the present invention.

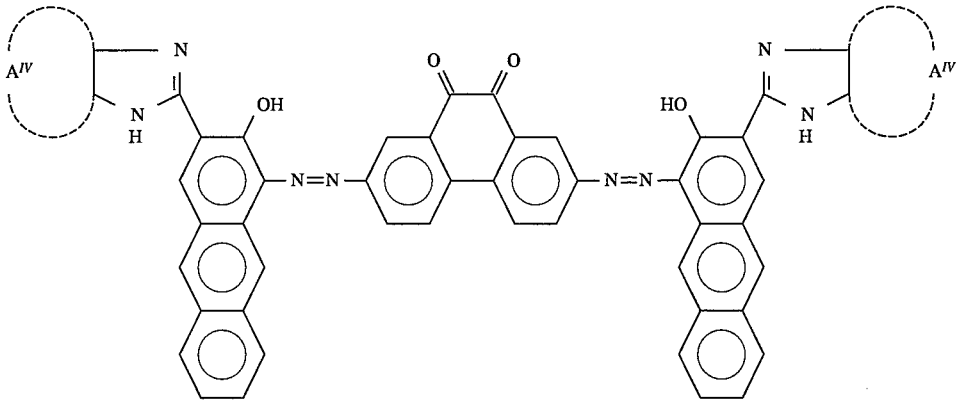
| Compound No. IV- | $A^{IV}$ | Compound No. IV- | $A^{IV}$ |
|---|---|---|---|
| 1 | 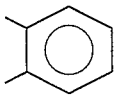 | 12 | 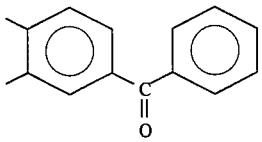 |
| 2 | 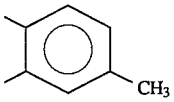 | 13 | 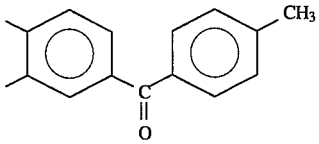 |
| 3 | 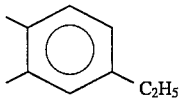 | 14 | 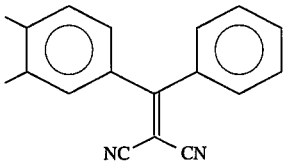 |
| 4 | 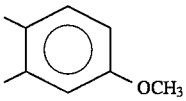 | 15 | 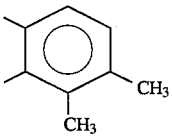 |
| 5 | 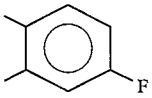 | 16 | 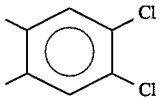 |
| 6 | 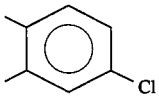 | 17 | 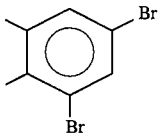 |
| 7 | 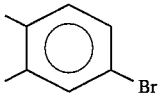 | 18 | 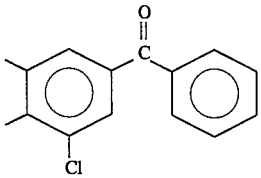 |

-continued
| | | | |
|---|---|---|---|
| 8 | 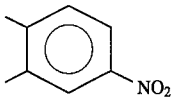 | 19 | 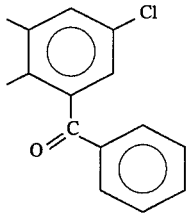 |
| 9 | 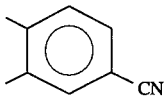 | 20 | 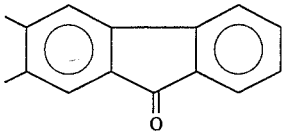 |
| 10 | 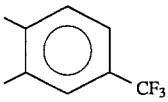 | 21 | 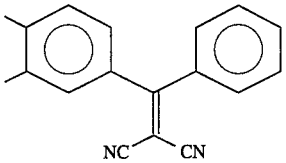 |
| 11 | 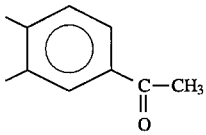 | 22 | 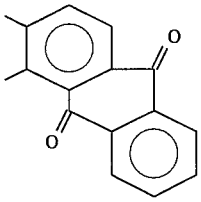 |
| | | 23 | 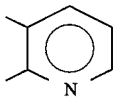 |
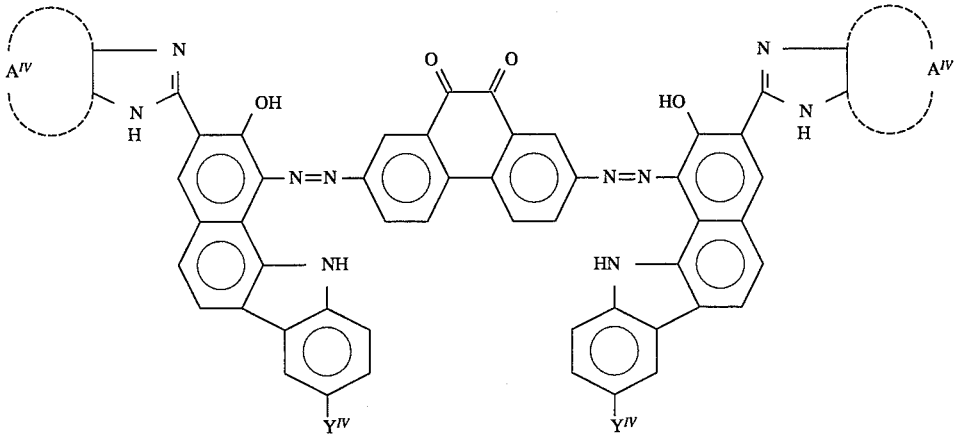
| Compound No. IV- | $A^{IV}$ | $Y^{IV}$ | Compound No. IV- | $A^{IV}$ | $Y^{IV}$ |
|---|---|---|---|---|---|
| 24 | 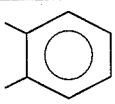 | H | 57 | 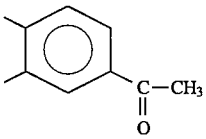 | Cl |
| 25 | 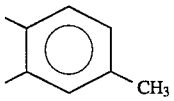 | H | 58 | 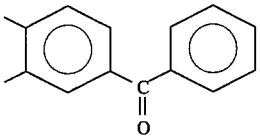 | Cl |

-continued
| | | | | | |
|---|---|---|---|---|---|
| 26 | 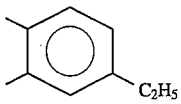 | H | 59 | 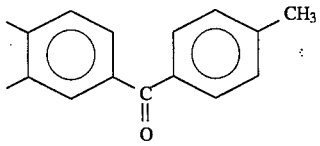 | Cl |
| 27 | 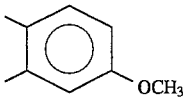 | H | 60 | 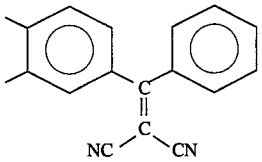 | Cl |
| 28 | 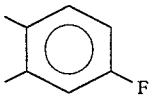 | H | 61 | 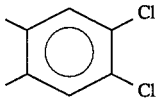 | Cl |
| 29 | 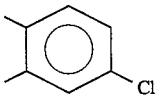 | H | 62 | 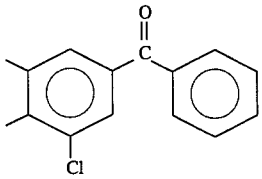 | Cl |
| 30 | 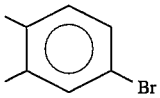 | H | 63 | 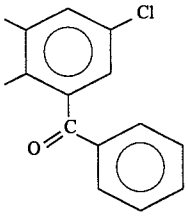 | Cl |
| 31 | 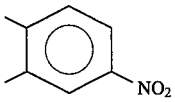 | H | 64 | 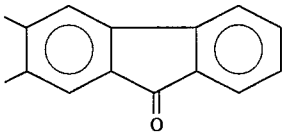 | Cl |
| 32 | 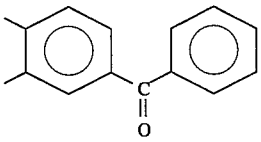 | H | 65 | 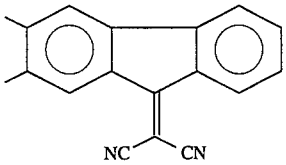 | Cl |
| 33 | 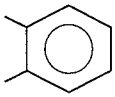 | $CH_3$ | 66 | 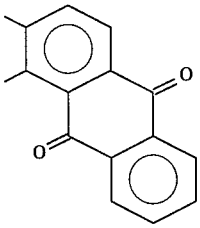 | Cl |
| 34 | 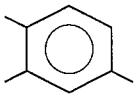 | $CH_3$ | 67 | 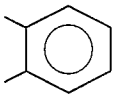 | Br |
| 35 | 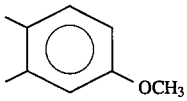 | $CH_3$ | 68 | 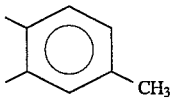 | Br |

-continued
| | | | | | |
|---|---|---|---|---|---|
| 36 | 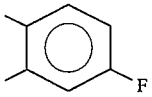 | $CH_3$ | 69 | 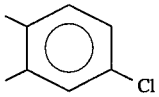 | Br |
| 37 | 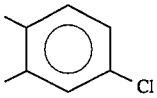 | $CH_3$ | 70 | 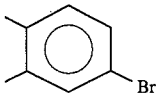 | Br |
| 38 | 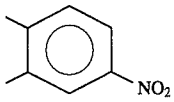 | $CH_3$ | 71 | 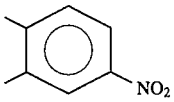 | Br |
| 39 | 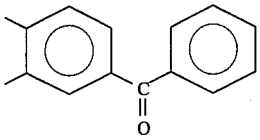 | $CH_3$ | 72 | 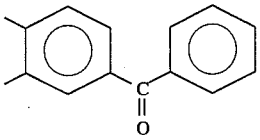 | Br |
| 40 | 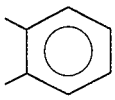 | $OCH_3$ | 73 | 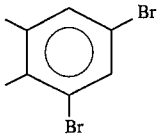 | Br |
| 41 | 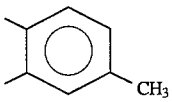 | $OCH_3$ | 74 | 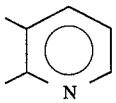 | Br |
| 42 | 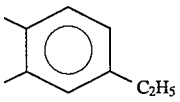 | $OCH_3$ | 75 | 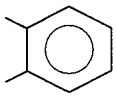 | $NO_2$ |
| 43 | 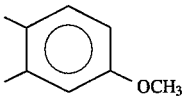 | $OCH_3$ | 76 | 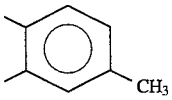 | $NO_2$ |
| 44 | 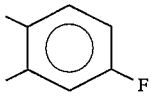 | $OCH_3$ | 77 | 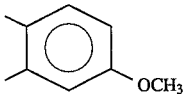 | $NO_2$ |
| 45 | 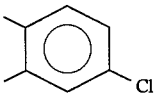 | $OCH_3$ | 78 | 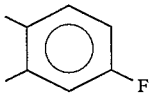 | $NO_2$ |
| 46 | 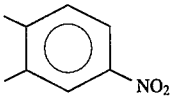 | $OCH_3$ | 79 | 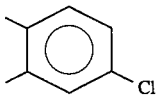 | $NO_2$ |
| 47 | 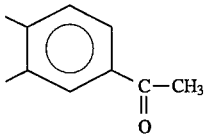 | $OCH_3$ | 80 | 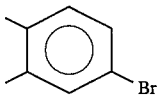 | $NO_2$ |
| 48 | 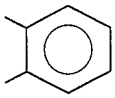 | Cl | 81 | 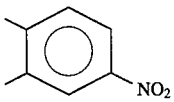 | $NO_2$ |
| 49 | 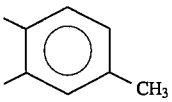 | Cl | 82 | 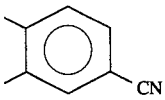 | $NO_2$ |

-continued

| | | | | | |
|---|---|---|---|---|---|
| 50 | 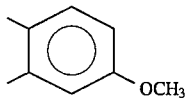 | Cl | 83 | 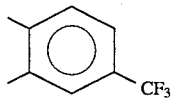 | $NO_2$ |
| 51 | 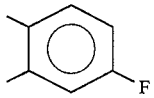 | Cl | 84 | 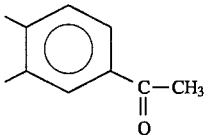 | $NO_2$ |
| 52 | 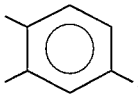 | Cl | 85 | 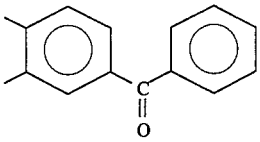 | $NO_2$ |
| 53 | 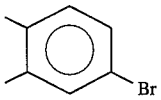 | Cl | 86 | 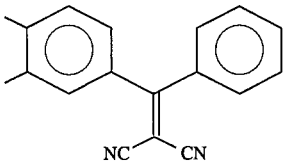 | $NO_2$ |
| 54 | 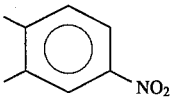 | Cl | 87 | 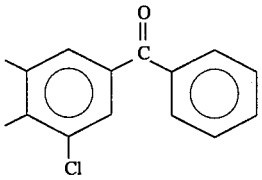 | $NO_2$ |
| 55 | 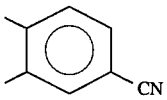 | Cl | 88 | 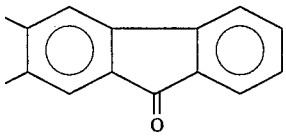 | $NO_2$ |
| 56 | 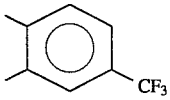 | Cl | 89 | 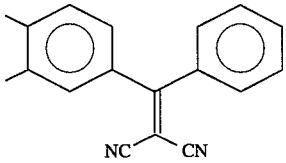 | $NO_2$ |
| | | | 90 | 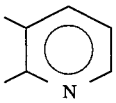 | $NO_2$ |

Bisazo compounds of the formula (IV-1) for use in the fourth aspect of the present invention can be synthesized by known methods. For example, 2,7-diamino-9,10-phenanthrenequinone is tetrazotized in the usual manner to obtain a tetrazonium salt which is isolated in a suitable form such as a borofluoride or hexafluorophosphate and subjected to coupling with a compound represented by the following formula (IV-4) in an appropriate solvent (e.g. N,N-dimethylformamide, N-methylpyrrolidone or dimethyl sulfoxide) in the presence of a base such as sodium acetate or triethylamine:

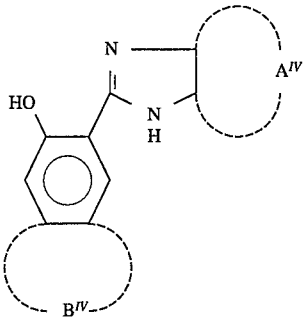

(IV-4)

(where $A^{IV}$ and $B^{IV}$ have the same meanings as defined in the above formula ( IV-1)).

Typical examples of the synthesis of bisazo compounds (IV-1) to be used in the fourth aspect of the present invention are described below.

Synthesis Example IV-1 (synthesis of Compound No. IV-1)

2,7-Diamino-9,10-phenanthrenequinone (11.9 g, 0.05 mol) is dispersed in 200 ml of 6 N HCl. Thereafter, a solution having 7.6 g (0.11 mol) of sodium nitrite dissolved in 20 ml of water is added dropwise to the dispersion at 0°–5° C. under cooling with ice over a period of 10 min. After the dropwise addition, the mixture is subjected to continued stirring at the same temperature for about 20 min and the unreacted matter is filtered off. To the filtrate, 20 g (0.12 mol) of ammonium hexafluorophosphate is added and the resulting precipitate is recovered by filtration, washed with ice water, alcohol and then ether, and dried under reduced pressure at room temperature to obtain 9,10-phenanthrenequinone-2,7-bisdiazonium bishexafluorophosphate in an amount of 17.1 g (yield: 62%).

Subsequently, 3.41 g (0.11 mol) of 3-(2'-benzimidazolyl)-2-hydroxyanthracene is dissolved in 500 ml of N,N-dimethylformamide and the solution is cooled to about 0° C. Thereafter, 2.76 g (0.005 mol) of the previously prepared tetrazonium salt is dissolved in the cooled solution. To the stirred solution, a solution having 1.7 ml (0.012 mol) of triethylamine diluted with 10 ml of N,N-dimethylformamide is added dropwise over a period of about 5 min. After the dropwise addition, stirring is continued at room temperature for 1 hour and the resulting precipitate is recovered by filtration. The recovered precipitating cake is dispersed in 500 ml of N,N-dimethylformamide and, following 1 hour-stirring at about 80° C., the precipitate is again separated by filtration. These procedures are repeated 5 times and the resulting precipitate is washed first with water, then with acetone, and dried to obtain a bisazo compound (Compound No. IV-1) in an amount of 3.79 g (yield: 86%). m.p.: 350° C. or more.

Elemental analysis for $C_{56}H_{32}N_8O_4$

| | Cal'd | Found |
|---|---|---|
| C (%) | 76.35 | 75.99 |
| H (%) | 3.66 | 3.58 |
| N (%) | 12.72 | 12.65 |

IR absorption spectrum (KBr tablet)

1670 $cm^{-1}$ (C=O)

1600 $cm^{-1}$ (C=N)

Synthesis Example IV-2 (synthesis of Compound No. IV-29)

A reaction and a post-treatment are performed in the same manner as in Synthesis Example IV-1except that 4.21 g (0.011 ml) of 3-(5"-chloro-2"-benzimidazolyl)-2-hydroxy-1',2'-benzocarbazole is used as the coupling component. As a result, a bisazo compound (Compound No. IV-29) is obtained as a dark brown powder in an amount of 3.38 g (yield: 66%). m.p.: 350° C. or more.

Elemental analysis for $C_{60}H_{32}N_{10}O_4Cl_2$

| | Cal'd | Found |
|---|---|---|
| C (%) | 70.11 | 69.68 |
| H (%) | 3.14 | 3.24 |
| N (%) | 13.63 | 13.76 |

IR absorption spectrum (KBr tablet)

1660 $cm^{-1}$ (C=O)

1600 $cm^{-1}$ (C=N)

The electrophotographic photoreceptor according to the fifth aspect of the present invention may comprise an electroconductive substrate having a light-sensitive layer containing as an azo pigment a bisazo compound represented by formula (V-1):

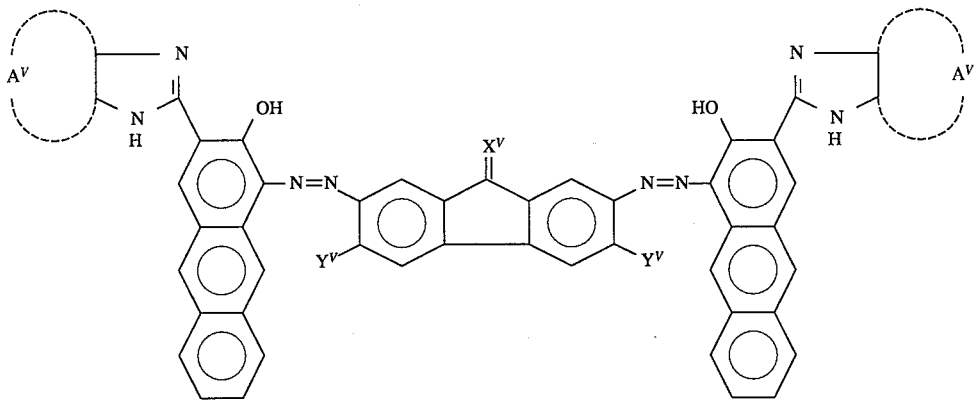

(V-1)

wherein $X^V$ represents an oxygen atom or a group

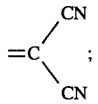

$Y^V$ represents a hydrogen atom or a halogen atom; and $A^V$ represents the atomic group necessary to form an aromatic ring or hetero ring which may be substituted.

The fifth aspect of the present invention is described below in detail.

To further describe the bisazo compound represented by formula (V-1) which is used in the electrophotographic photoreceptor of the present invention, $X^V$ represents an oxygen atom or a group

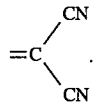

In the formula (V-1), $Y^V$ represents a hydrogen atom or a halogen atom. Considering materials characteristics and the rase of synthesis, a hydrogen atom, a chlorine atom and a bromine atom are preferred.

In the formula (V-1), $A^V$ represents the atomic group necessary to form an aromatic ring or hetero ring which may be substituted. Considering materials characteristics and the ease of synthesis, a substituted or unsubstituted benzene ring is preferred.

In the case of a substituted benzene ring, examples of the substituents include a halogen atom, an alkyl group, an alkenyl group, an aralkyl group, an aryl group, an alkoxy group, an acyl group, a nitro group, a cyano group, a trifluoromethyl group or a β-dicyano-α-phenylvinyl group. Considering materials characteristics and the ease of synthesis, a fluorine atom, a chlorine atom, a bromine atom, a methyl group, an ethyl group, a methoxy group, an acetyl group, a benzoyl group which may be substituted, and a nitro group are preferred.

Preferred examples of the bisazo compound represented by formula (V-1) which can be used in the present invention are represented by formulas (V-2), (V-3), (V-4) and (V-5):

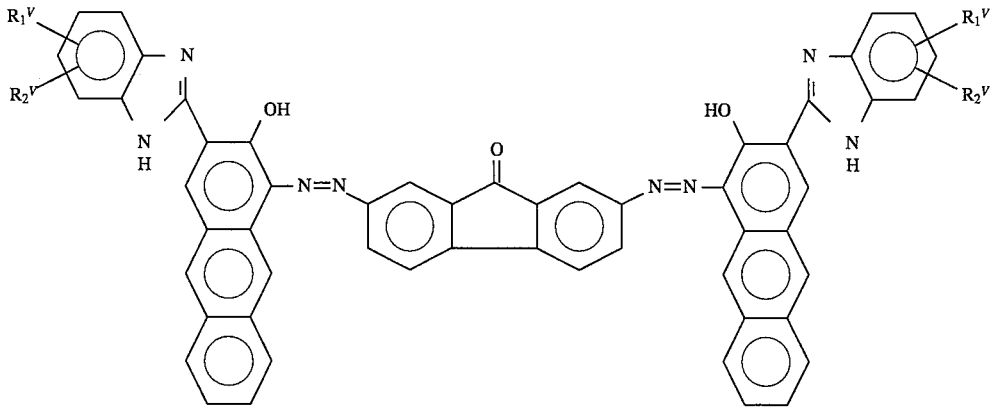

(V-2)

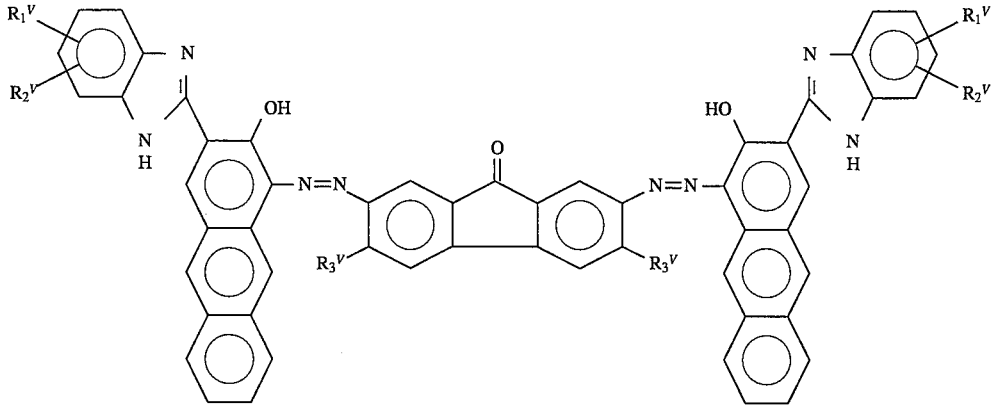

(V-3)

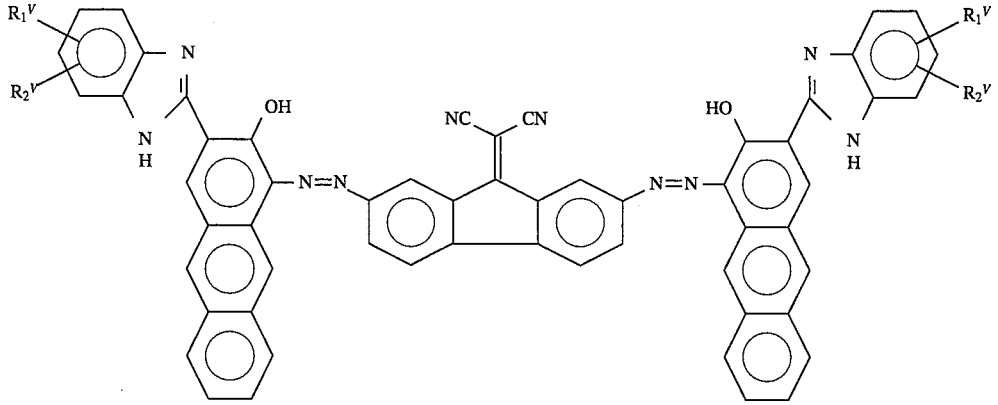

(V-4)

-continued

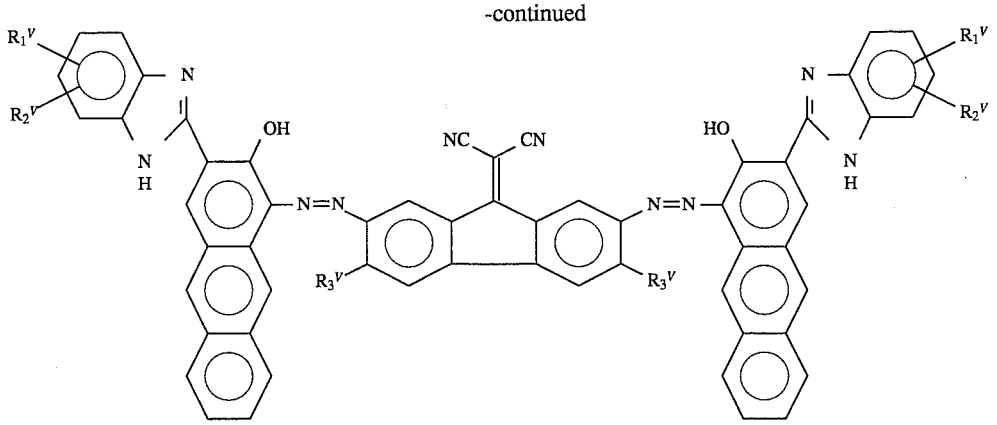

(V-5)

wherein $R_1^V$ and $R_2^V$ each represents a hydrogen atom, a halogen atom, an alkyl group, an alkenyl group, an aralkyl group, an aryl group, an alkoxy group, an acyl group, a nitro group, a cyano group, a trifluoromethyl group or a β-dicyano-α-phenylvinyl group (among these, a hydrogen atom, a fluorine atom, a chlorine atom, a bromine atom, an acetyl group, a substituted benzoyl group and a nitro group are preferred), or $R_1^V$ and $R_2^V$ respectively represent atomic groups that, in combination with each other, form a monocyclic or polycyclic hydrocarbon ring which may be substituted; and $R_3^V$ represents a hydrogen atom or a halogen atom (among these, a hydrogen atom, a fluorine atom, a chlorine atom and a bromine atom are preferred).

Specific examples of the bisazo compound (V-1) which may be used in the present invention are listed below but are by no means intended to limit the scope of the present invention.

(V-1)

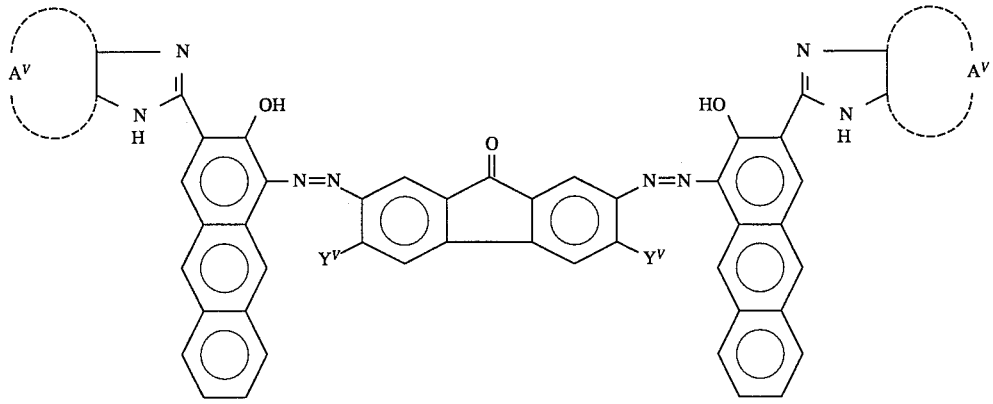

| Compound No. V- | $Y^v$ | $A^v$ | Compound No. V- | $Y^v$ | $A^v$ |
|---|---|---|---|---|---|
| 1 | H | 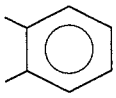 | 25 | Cl | 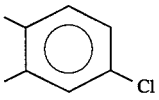 |
| 2 | H | 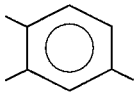 | 26 | Cl | 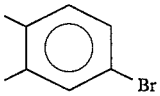 |
| 3 | H | 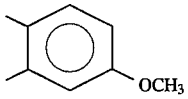 | 27 | Cl | 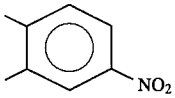 |
| 4 | H | 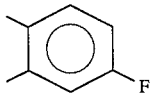 | 28 | Cl | 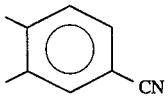 |

-continued
| | | | | | |
|---|---|---|---|---|---|
| 5 | H | 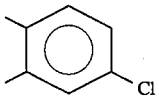 | 29 | Cl | 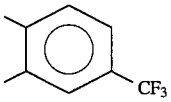 |
| 6 | H | 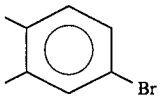 | 30 | Cl | 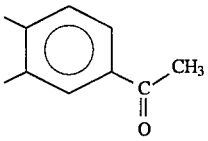 |
| 7 | H | 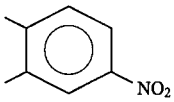 | 31 | Cl | 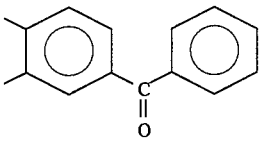 |
| 8 | H | 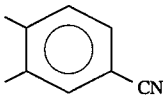 | 32 | Cl | 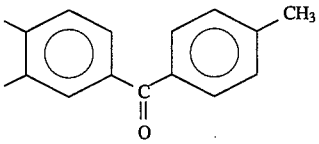 |
| 9 | H | 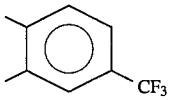 | 33 | Cl | 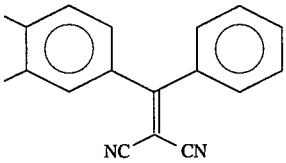 |
| 10 | H | 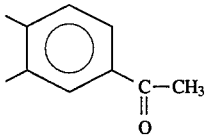 | 34 | Cl | 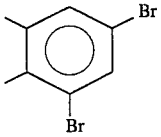 |
| 11 | H | 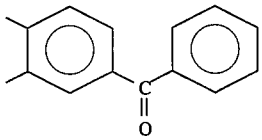 | 35 | Cl | 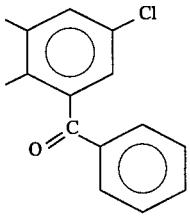 |
| 12 | H | 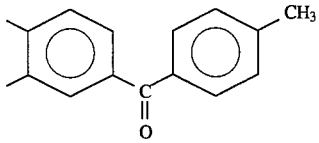 | 36 | Cl | 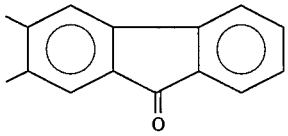 |
| 13 | H | 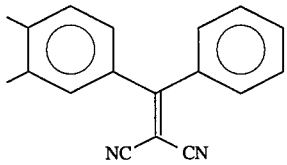 | 37 | Cl | 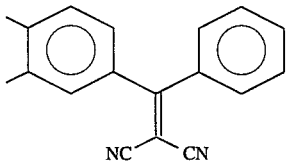 |
| 14 | H | 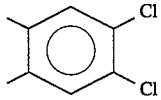 | 38 | Cl | 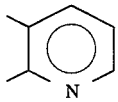 |

-continued
| | | | | | |
|---|---|---|---|---|---|
| 15 | H | 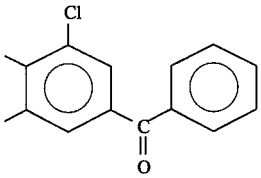 | 39 | Br | 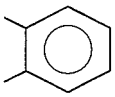 |
| 16 | H | 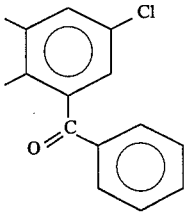 | 40 | Br | 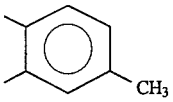 |
| 17 | H | 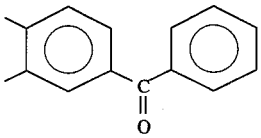 | 41 | Br | 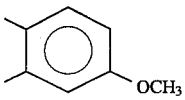 |
| 18 | H | 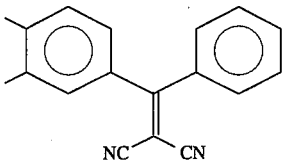 | 42 | Br | 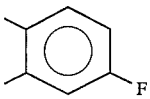 |
| 19 | H | 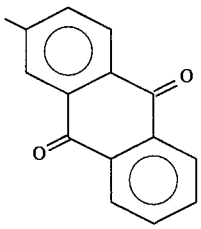 | 43 | Br | 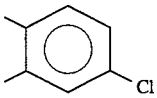 |
| 20 | H | 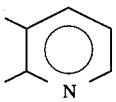 | 44 | Br | 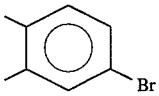 |
| 21 | Cl | 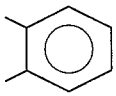 | 45 | Br | 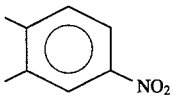 |
| 22 | Cl | 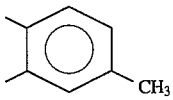 | 46 | Br | 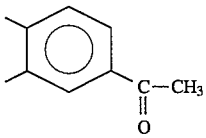 |
| 23 | Cl | 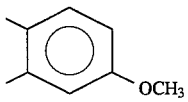 | 47 | Br | 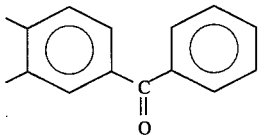 |
| 24 | Cl | 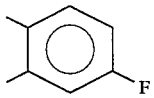 | 48 | Br | 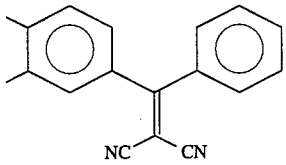 |

-continued
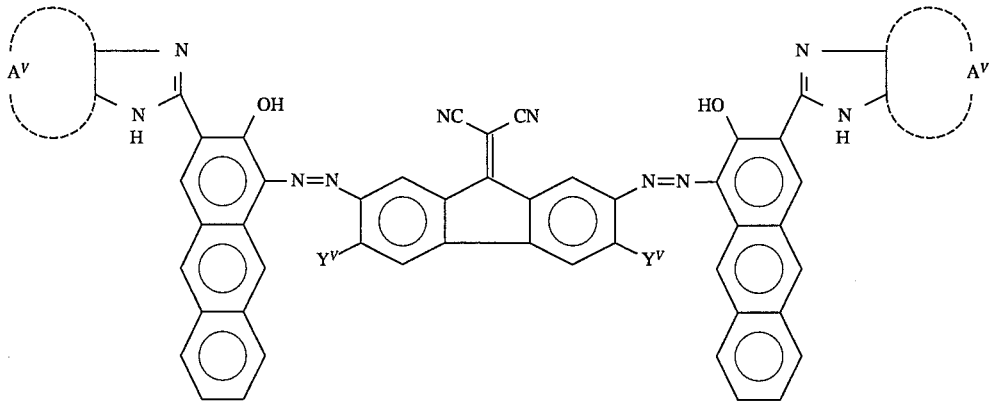
| Compound No. V- | $Y^V$ | $A^V$ | Compound No. V- | $Y^V$ | $A^V$ |
|---|---|---|---|---|---|
| 49 | H | 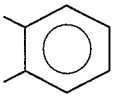 | 67 | Cl | 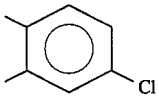 |
| 50 | H | 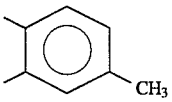 | 68 | Cl | 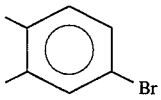 |
| 51 | H | 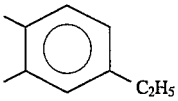 | 69 | Cl | 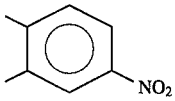 |
| 52 | H | 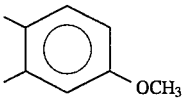 | 70 | Cl | 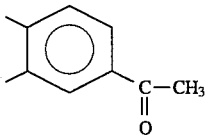 |
| 53 | H | 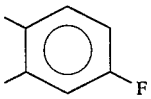 | 71 | Cl | 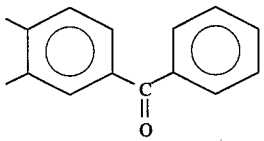 |
| 54 | H | 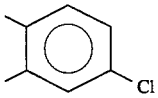 | 72 | Cl | 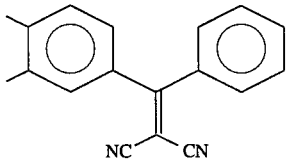 |
| 55 | H | 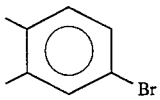 | 73 | Cl | 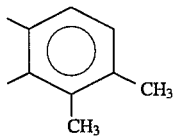 |
| 56 | H | 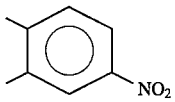 | 74 | Cl | 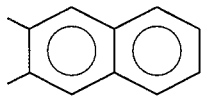 |

-continued

| | | | | | |
|---|---|---|---|---|---|
| 57 | H | 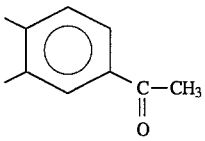 | 75 | Cl | 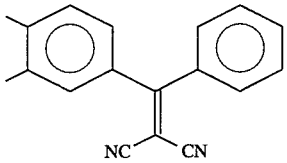 |
| 58 | H | 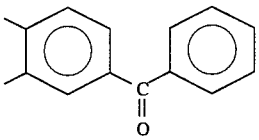 | 76 | Br | 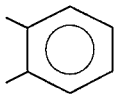 |
| 59 | H | 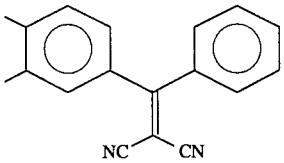 | 77 | Br | 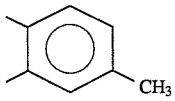 |
| 60 | H | 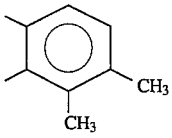 | 78 | Br | 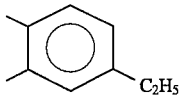 |
| 61 | H | 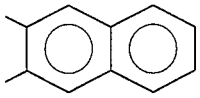 | 79 | Br | 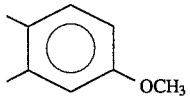 |
| 62 | Cl | 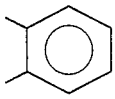 | 80 | Br | 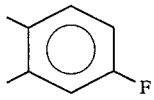 |
| 63 | Cl | 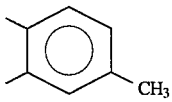 | 81 | Br | 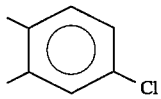 |
| 64 | Cl | 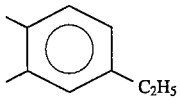 | 82 | Br | 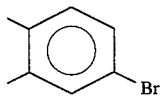 |
| 65 | Cl | 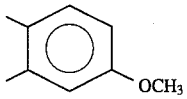 | 83 | Br | 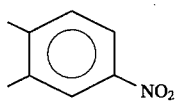 |
| 66 | Cl | 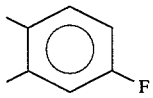 | 84 | Br | 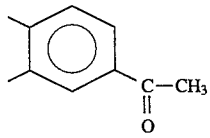 |

Bisazo compounds of the formula (V-1) for use in the present invention can be synthesized by the following method. A compound represented by the following formula (V-6):

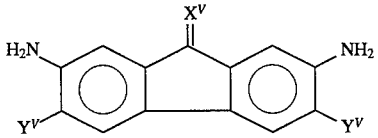

(V-6)

(where $X^V$ and $Y^V$ have the same meanings as defined in the above formula (V-1)) is tetrazotized in the usual manner to obtain a tetrazonium salt, which is isolated in a suitable form such as a borofluoride or hexafluorophosphte and subjected to coupling with a compound represented by the following formula (V-7) in an appropriate solvent (e.g. N,N-dimethylformamide, N-methylpyrrolidone or dimethyl sulfoxide) in the presence of a base such as sodium acetate or triethylamine:

(V-7)

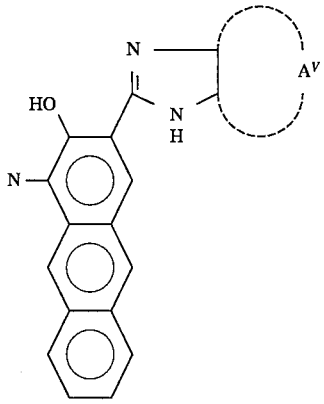

(where $A^V$ has the same meaning as defined in the above formula (V-1)).

Typical examples of the synthesis of bisazo compounds (V-1) to be used in the fifth aspect of the present invention are described below.

Synthesis Example V-1 (synthesis of Compound No. V-7)

2,7-Diamino-9-fluorenone (10.5 g, 0.05 mol) is dispersed in 500 ml of 6 N-HCl. Thereafter, a solution having 7.6 g (0.11 mol) of sodium nitrite dissolved in 20 ml of water is added dropwise to the dispersion at 0°–5° C. under cooling with ice over a period of 10 min. After the dropwise addition, the mixture is subjected to continued stirring at the same temperature for about 20 min and the insoluble matter is filtered off. To the filtrate, 50 ml of 42 wt % borofluoric acid is added and the resulting precipitate is recovered by filtration, washed with ice water, alcohol and then ether, and dried under reduced pressure at room temperature to obtain 9-fluorenone-2,7-bisdiazonium bistetrafluoroborate in an amount of 14.7 g (yield: 72%).

Subsequently, 3.91 g (0.011 mol) of 3-(5'-nitro- 2'-benzimidazolyl)-2-hydroxyanthracene is dissolved in 1,000 ml of N,N-dimethylformamide and the solution is cooled to about 0° C. Thereafter, 2.04 g (0.005 mol) of the previously prepared tetrazonium salt is dissolved in the cooled solution. To the stirred solution, a solution having 1.7 ml (0.012 mol) of triethylamine diluted with 10 ml of N,N-dimethylformamide is added dropwise over a period of about 5 min. After the dropwise addition, stirring is continued at room temperature for about 1 hour and the resulting precipitate is recovered by filtration. The recovered precipitating cake is dispersed in 500 ml of N,N-dimethylformamide and, following 1 hour-stirring at about 80° C., the precipitate is again separated by filtration. These procedures are repeated 5 times and the resulting precipitate is washed first with water, then with acetone, and dried to obtain a bisazo compound (Compound No. V-7) in an amount of 4.31 g (yield: 91%). m.p.: 350° C. or more.

| Elemental analysis for $C_{35}H_{30}N_{10}O_7$ | | |
|---|---|---|
| | Cal'd | Found |
| C (%) | 70.06 | 69.68 |
| H (%) | 3.21 | 3.08 |
| N (%) | 14.85 | 14.49 |

IR absorption spectrum (KBr tablet)

1710 $cm^{-1}$ (C=O)

1600 $cm^{-1}$ (C=N)

Synthesis Example V-2(synthesis of Compound No. V-62)

2,7-Diamino-3,6-dichloro-9-fluorene (27.9 g, 0.1 mol) and malonitrile (7.9 g, 0.12 mol) are dissolved in 500 ml of pyridine and the solution is stirred under reflux (115° C.) for about 1 hour. After cooling by standing, the resulting precipitate is separated by filtration, washed with alcohol and dried to obtain a gray crystal of 2,7-diamino-3,6-dichloro-9-dicyanomethylene fluorene in an amount of 29.6 g (yield: 90%). m.p.: 336°–338° C.

| Elemental analysis for $C_{16}H_8N_4Cl_2$ | | |
|---|---|---|
| | Cal'd | Found |
| C (%) | 58.74 | 58.63 |
| H (%) | 2.46 | 2.33 |
| N (%) | 17.12 | 17.31 |

IR absorption spectrum (KBr tablet)

2220 $cm^{-1}$ (C=N)

A portion (16.4 g, 0.05 mol) of the obtained 2,7-diamino-3,6-dichloro-9-dicyanomethylene fluorene is dispersed in 500 ml of 6 N-sulfuric acid. Thereafter, a solution having 7.6 g (0.11 mol) of sodium nitrite dissolved in 20 ml of water is added dropwise to the dispersion at 0°–5° C. under cooling with ice over a period of 10 min. After the dropwise addition, the mixture is subjected to continued stirring at the same temperature for about 20 min and the insoluble matter is filtered off. To the filtrate, 20 g (0.12 mol) of ammonium hexafluorophosphate is added and the resulting precipitate is recovered by filtration, washed with ice water, alcohol and then ether, and dried under reduced pressure at room temperature to obtain a yellow crystal of 3,6-dichloro-9-dicyanomethylene-2,7-bisdiazonium bishexafluorophosphate in an amount of 20.5 g (yield: 64%).

Subsequently, 3.41 g (0.011 mol) of 3-(2'-benzimidazolyl)-2-hydroxyanthracene is dissolved in 500 ml of N,N-dimethylformamide and the solution is cooled to about 0° C. Thereafter, 3.21 g (0.005 mol) of the previously prepared tetrazonium salt is dissolved in the cooled solution. To the stirred solution, a solution having 1.7 ml (0.012 mol) of triethylamine diluted with 10 ml of N,N-dimethylformamide is added dropwise over a period of about 10 min. After the dropwise addition, a post-treatment is performed in the same manner as in Synthesis Example V-1 to obtain a bisazo compound (Compound No. V-62) in an amount of 3.97 g (yield: 82%). m.p.: 350° C. or more.

| Elemental analysis for $C_{38}H_{30}N_{10}O_2Cl_2$ | | |
|---|---|---|
| | Cal'd | Found |
| C (%) | 71.83 | 71.40 |
| H (%) | 3.12 | 2.96 |
| N (%) | 14.44 | 14.28 |

IR absorption spectrum (KBr tab.)

1600 $cm^{-1}$ (C=N)

The electrophotographic photoreceptor according to the sixth aspect of the present invention may comprise an electroconductive support which is overlaid with a light-sensitive layer containing as an azo pigment a bisazo compound represented by formula (VI-1):

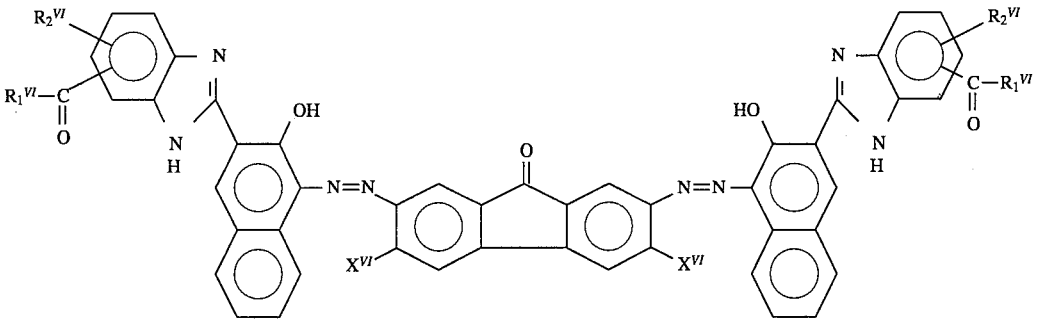

(VI-1)

wherein $X^{VI}$ represents a hydrogen atom or a halogen atom; $R_1^{VI}$ represents an alkyl group or aryl group which may be substituted; $R_2^{VI}$ represents a hydrogen atom, a halogen atom, an alkyl group, an aryl group, an alkoxy group, an acyl group or a nitro group, or $R_1^{VI}$ and $R_2^{VI}$ may combine with each other to form a monocyclic or polycyclic hydrocarbon ring which may be substituted.

The sixth aspect of the present invention is described below in detail.

To further describe the bisazo compound represented by formula (VI-1) which is used in the electrophotographic photoreceptor of the present invention, $X^{VI}$ represents a hydrogen atom or a halogen atom.

In the formula (VI-1), $R_1^{VI}$ represents an alkyl group or aryl group which may be substituted. Considering materials characteristics and the ease of synthesis, a methyl group or a substituted or unsubstituted phenyl group is preferred.

In the formula (VI-1), $R_2^{VI}$ represents a hydrogen atom, an alkyl group, an aryl group, an alkoxy group, an acyl group or a nitro group, and it may combine with $R_1^{VI}$ to form a monocyclic or polycyclic hydrocarbon ring which may be substituted. Considering materials characteristics and the ease of synthesis, a hydrogen atom, a halogen atom, a methyl group and a methoxy group are preferred, with a hydrogen atom being particularly preferred.

Preferred examples of the bisazo compound represented by formula (VI-1) which can be used in the present invention are represented by formulas (VI-2) and (VI-3):

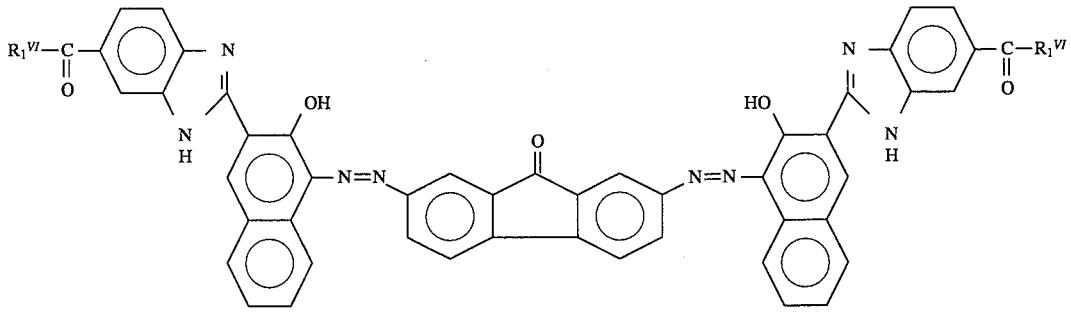

(VI-2)

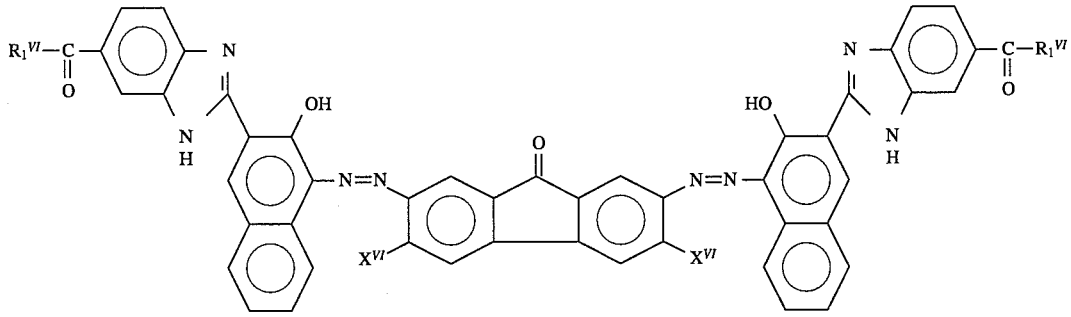

(VI-3)

wherein $X^{VI}$ represents a chlorine atom or a bromine atom; and $R_1^{VI}$ represents a methyl group or a phenyl group which may be substituted (among these, a methyl group, a phenyl group, a p-tolyl group, a p-fluorophenyl group, p-chlorophenyl group and p-bromophenyl group).

Specific examples of the bisazo compound (VI-1) which may be used in the present invention are listed below but are by no means intended to limit the scope of the present invention.

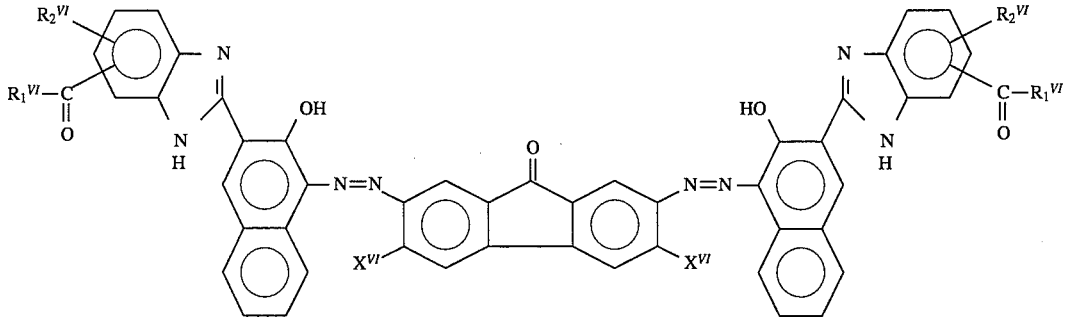
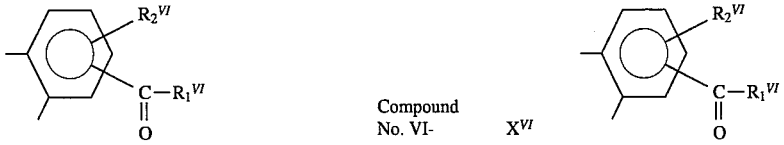
| Compound No. VI- | $X^{VI}$ | | Compound No. VI- | $X^{VI}$ | |
|---|---|---|---|---|---|
| 1 | H | 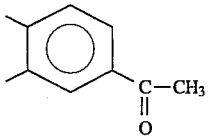 | 16 | Cl | 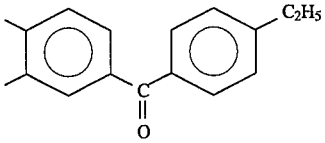 |
| 2 | H | 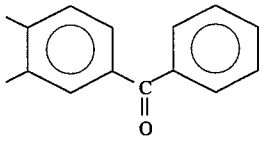 | 17 | Cl | 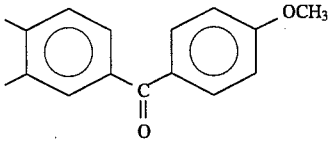 |
| 3 | H | 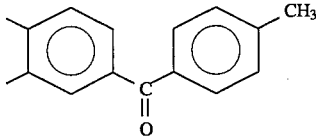 | 18 | Cl | 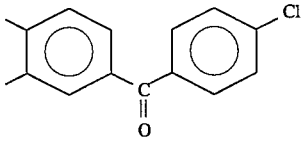 |
| 4 | H | 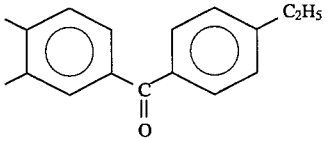 | 19 | Cl | 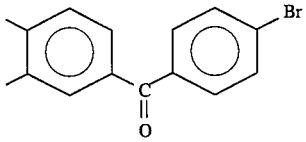 |
| 5 | H | 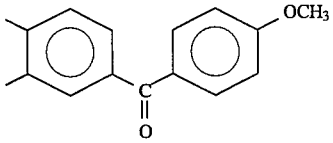 | 20 | Cl | 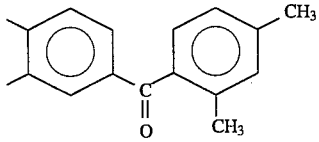 |
| 6 | H | 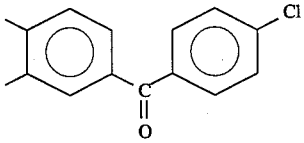 | 21 | Cl | 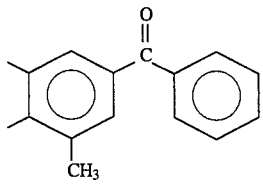 |
| 7 | H | 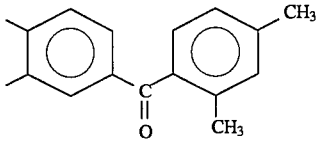 | 22 | Cl | 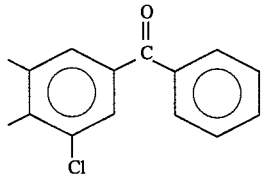 |

-continued
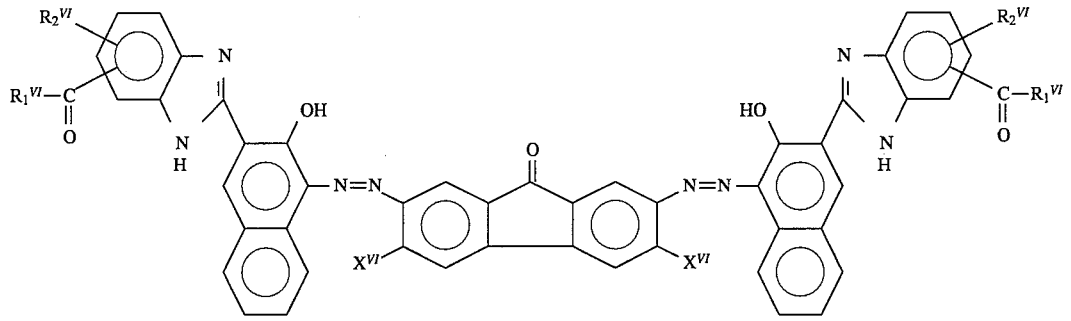
| Compound No. VI- | $X^{VI}$ | | Compound No. VI- | $X^{VI}$ | |
|---|---|---|---|---|---|
| 8 | H | 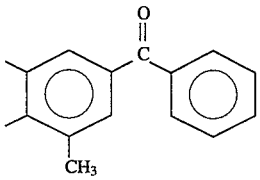 | 23 | Cl | 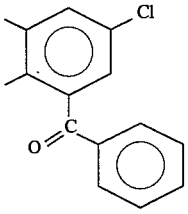 |
| 9 | H | 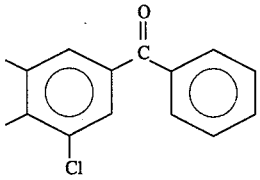 | 24 | Cl | 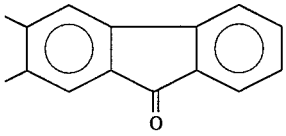 |
| 10 | H | 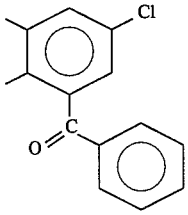 | 25 | Cl | 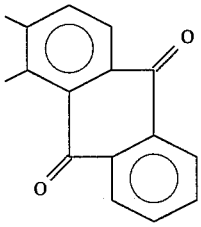 |
| 11 | H | 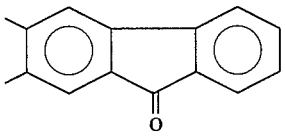 | 26 | Br | 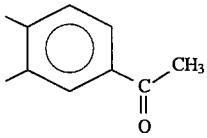 |
| 12 | H | 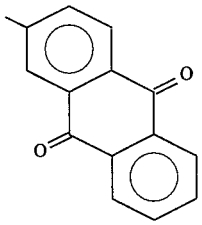 | 27 | Br | 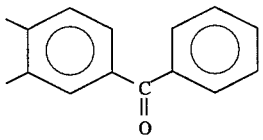 |
| 13 | Cl | 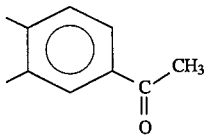 | 28 | Br | 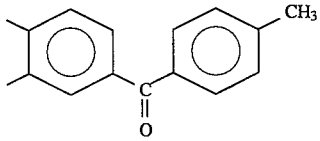 |

-continued

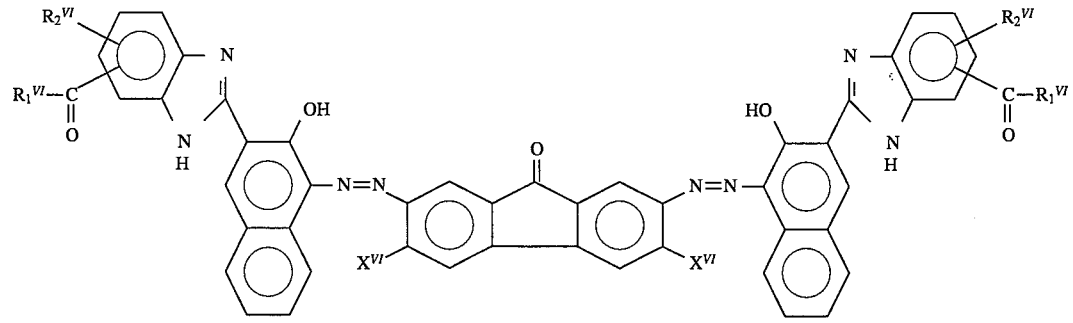

| Compound No. VI- | $X^{VI}$ | | Compound No. VI- | $X^{VI}$ | |
|---|---|---|---|---|---|
| 14 | Cl | 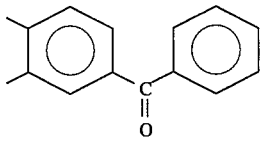 | 29 | Br | 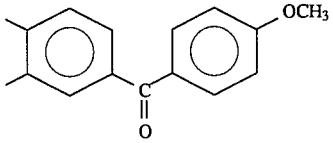 |
| 15 | Cl | 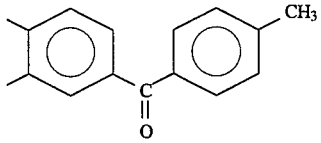 | 30 | Br | 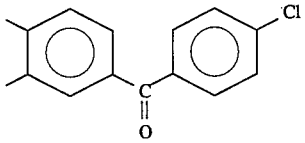 |

Bisazo compounds of the formula (VI-1) for use in the present invention can be synthesized by the following method. 2,7-Diamino-9-fluorenone or 2,7-diamino-3,6-dihalogeno-9-fluorenone prepared by a known method is tetrazotized in the usual manner, which is isolated in a suitable form such as borofluoride or hexafluorophosphate and subjected to coupling with a compound represented by the following formula (IV-4) in an appropriate solvent (e.g., N,N-dimethylformamide, N-methylpyrrolidone or dimethyl sulfoxide) in the presence of a base such as sodium acetate or triethylamine:

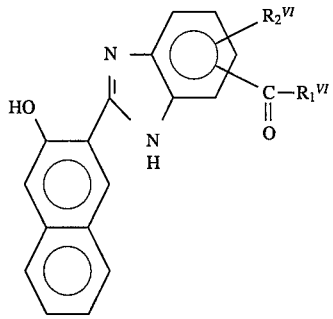

(VI-4)

(where $R_1^{VI}$ and $R_2^{VI}$ have the same meanings as defined in the above formula (VI-1)).

The compound represented by the formula (IV-4) can be synthesized by a suitable method that comprises condensing an o-phenylenediamine derivative of the following formula (VI-5):

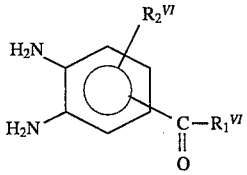

(VI-5)

with 2-hydroxy-3-naphthoic acid in an inert solvent such as toluene or chlorobenzene or a basic solvent such as pyridine or N,N-dimethylaniline in the presence of a condensing agent such as phosphorus oxychloride.

Typical examples of the synthesis of bisazo compounds (VI-1) to be used in the sixth aspect of the present invention are described below.

Synthesis Example VI-1 (synthesis of Compound No. VI-2).

Dry pyridine (50 ml) is added to 3,6-diaminobenzophenone (21.1 g, 0.1 mol) and 2-hydroxy-3-naphthoic acid (22.6 g, 0.12 mol) and the mixture is heated at about 50° C. to form a brown paste. Thereafter, 9.3 ml (0.1 mol) of phosphorus oxychloride is added dropwise at 60° C. or below. The resulting mixture is stirred for 3 continuous hours under reflux (115° C.) and then poured into 500 ml of ice water. The resulting precipitate is recovered by filtration, washed first with a 5 wt % aqueous solution of sodium acetate, then with water, and dried to obtain a yellow crude product in an amount of 35.8 g. The crude product is recrystallized from 200 ml of pyridine to obtain the coupling component, 3-(5'-benzoyl-2'-benzimidazolyl)-2-naphthol in an amount of 25.0 (yield: 69%). m.p.: 303°–305° C.

| Elemental analysis for $C_{24}H_{16}N_2O_2$ | | |
|---|---|---|
| | Cal'd | Found |
| C (%) | 79.11 | 79.20 |
| H (%) | 4.43 | 4.60 |
| N (%) | 7.69 | 7.68 |

IR absorption spectrum (KBr tablet)

3230 $cm^{-1}$ (N—H)

1640 $cm^{-1}$ (C=O)

In a separate step, 10.5 g (0.05 mol) of 2,7-diamino-9-fluorenone is dispersed in 500 ml of 6 N-HCl. Thereafter, a solution having 7.6 g (0.11 mol) of sodium nitrite dissolved in 20 ml of water is added dropwise to the dispersion at 0°–5° C. under cooling with ice over a period of about 10 min. After the dropwise addition, the mixture is subjected to continued stirring at the same temperature for about 20 min and the insoluble matter is filtered off. To the filtrate, 50 ml of 42 wt % borofluoric acid is added and the resulting precipitate is recovered by filtration, washed with ice water, alcohol and then ether, and dried under reduced pressure at room temperature to obtain 9-fluorenone-2,7-bisdiazonium bistetrafluoroborate in an amount of 14.7 g (yield: 72%).

Subsequently, 4.01 g (0.011 mol) of the previously obtained 3-(5'-benzoyl-2'-benzimidazolyl)-2-naphthol is dissolved in 250 ml of N,N-dimethylformamide and the solution is cooled to ca. 0° C. Thereafter, 2.04 g (0.005 mol) of the tetrazonium salt just described above is dissolved in the cooled solution. To the stirred solution, a solution having 1.7 ml (0.012 mol) of triethylamine diluted with 10 ml of N,N-dimethylformamide is added dropwise over a period of about 5 min. After the dropwise addition, stirring is continued at room temperature for about 1 hour and the resulting precipitate is recovered by filtration. The recovered precipitating cake is dispersed in 250 ml of N,N-dimethylformamide and, following 1 hour-stirring at about 80° C., the precipitate is again separated by filtration. These procedures are repeated 4 times and the resulting precipitate is washed first with water, then with acetone, and dried to obtain a dark brown powder of bisazo compound (Compound No. VI-2) in an amount of 4.50 g (yield: 94%). m.p.: 350° C. or more.

| Elemental analysis for $C_{61}H_{36}N_8O_5$ | | |
|---|---|---|
| | Cal'd | Found |
| C (%) | 76.24 | 75.92 |
| H (%) | 3.78 | 3.58 |
| N (%) | 11.66 | 11.35 |

IR absorption spectrum (KBr tablet)

1720 $cm^{-1}$ (C=O)

1620 $cm^{-1}$ (C=O)

Each of the bisazo or trisazo compounds (I-1) to (VI-1) described above is incorporated in a light-sensitive layer on the electrophotoconductive substrate of the electrophotographic photoreceptor of the present invention. The light-sensitive layer may be of a single-layered structure or of a multi-layered structure which is functionally separated into a charge generation layer and a charge transport layer.

The electrophotographic photoreceptors of the present invention can be classified as the following three major types: (1) a photoreceptor comprising an electroconductive substrate having a light-sensitive layer containing one of the bisazo or trisazo compounds of the formulas (I-1) to (VI-1) dispersed in a binder resin containing a charge transport material; (2) a photoreceptor comprising an electroconductive substrate having a light-sensitive layer containing one of the bisazo or trisazo compound (I-1) to (VI-1) and a charge transfer complex dispersed in a binder resin; and (3) a photoreceptor comprising an electroconductive substrate having a charge generation layer containing one of the bisazo or trisazo compounds (I-1) to (VI-1) and a charge transporting layer containing a charge transporting material.

Various electroconductive substrates can be used in the photoreceptors of the present invention and they include metal sheets, metal drums or metal foils made of aluminum, nickel, chromium, stainless steel, etc., plastic films laminated with thin films of metals and other conductive materials, and paper or plastic films coated or impregnated with conductivity imparting agents.

When the bisazo or trisazo compounds of the formulas (I-1) to (IV-1) are dispersed in binder resins to form the light-sensitive layer over the conductive substrate, those bisazo or trisazo compounds are dispersed as fine particles having a particle size of not larger than 3 μm, preferably not larger than 0.3 μm, in amounts of preferably from 20 wt % to 90 wt % (particularly preferably from 50 to 90 wt %) of the light-sensitive layer.

Various binder resins can be used as media in which the bisazo or trisazo compounds are dispersed and they include polystyrene, silicone resins, polycarbonates, acrylic resins, methacrylic resin, polyesters, vinyl polymers (e.g., polyvinyl butyral), celluloses (e.g., cellulose esters and cellulose ether), and alkyd resins.

The charge transporting materials that can be used in the electrophotographic photoreceptors of the present invention include, but are not limited to, the following:

Pyrazolines

1)

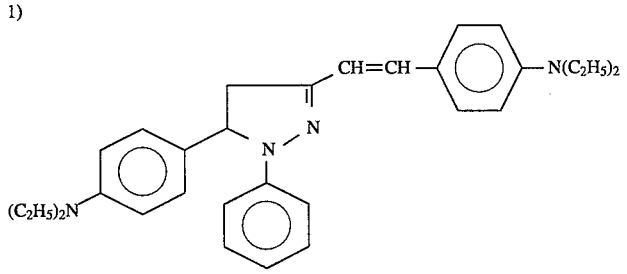

-continued
2)
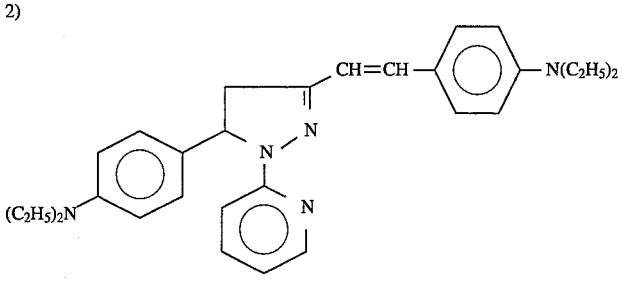
Hydrazones
1)
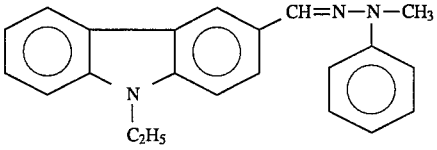
2)
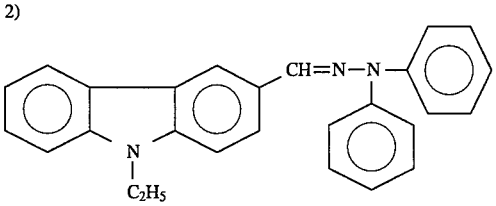
3)
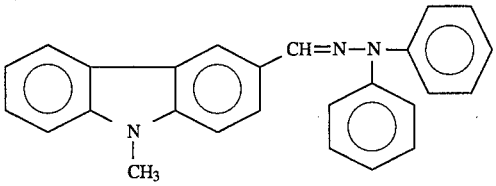
4)
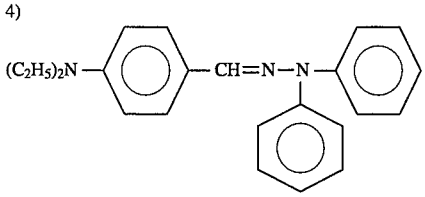
5)
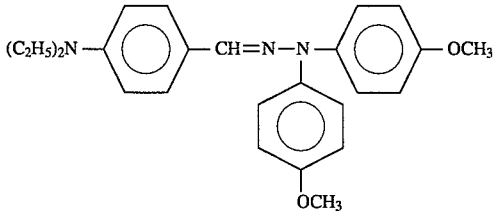
6)
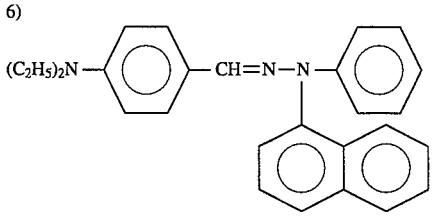

-continued
7)
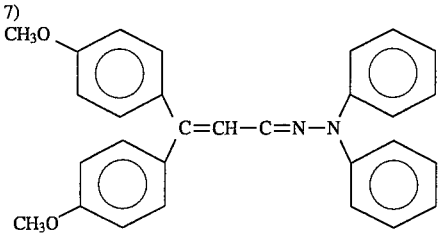
8)
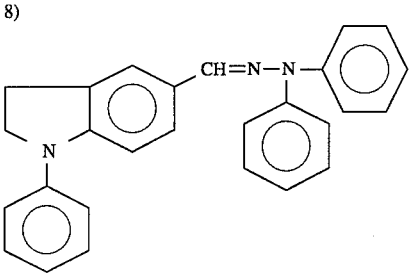
9)
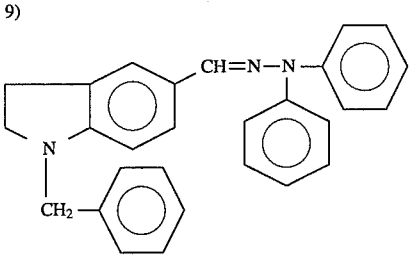
10)
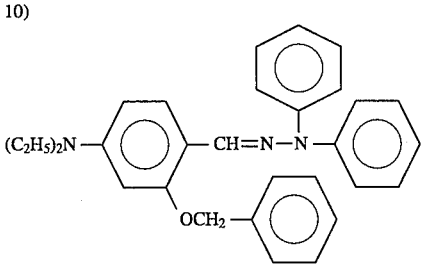
11)
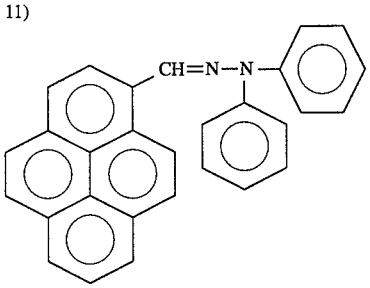
12)
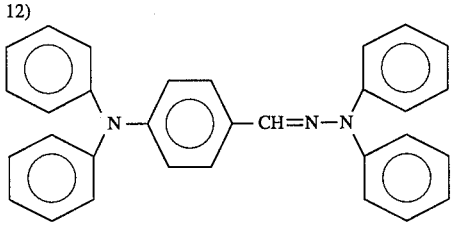

-continued
13)
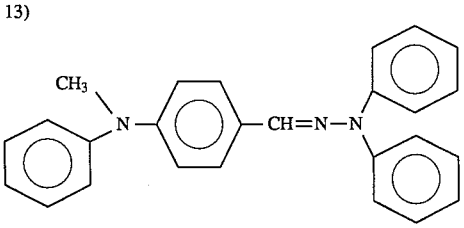
14)
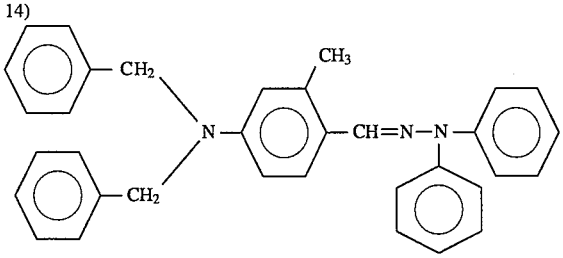
Oxazoles
1)
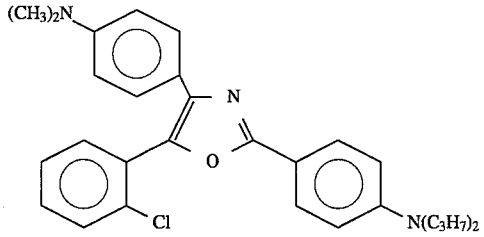
2)
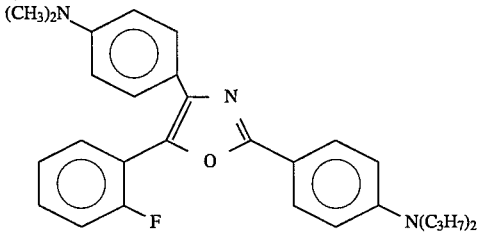
3)
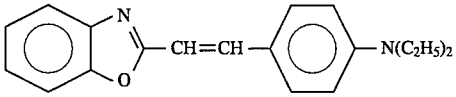
Oxadiazoles
1)
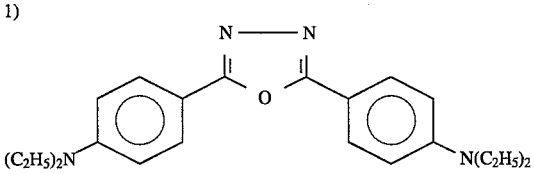
2)
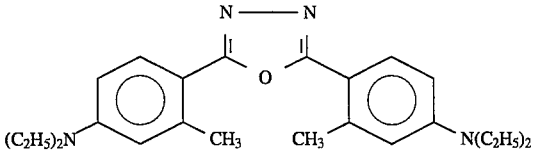

-continued
3)
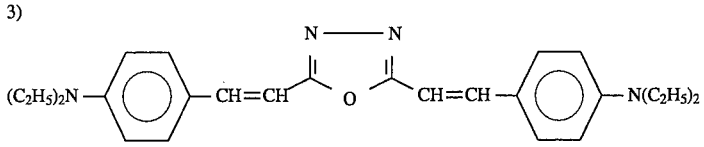
Aryalkanes
1)
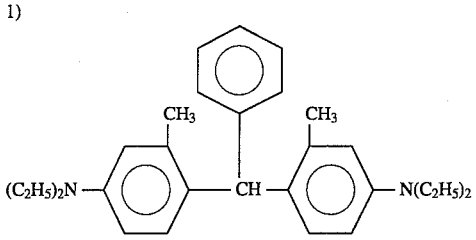
2)
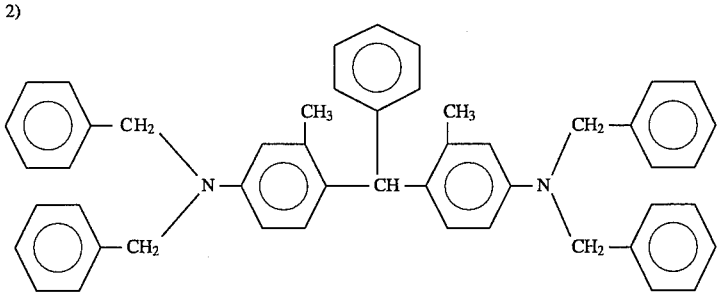
3)
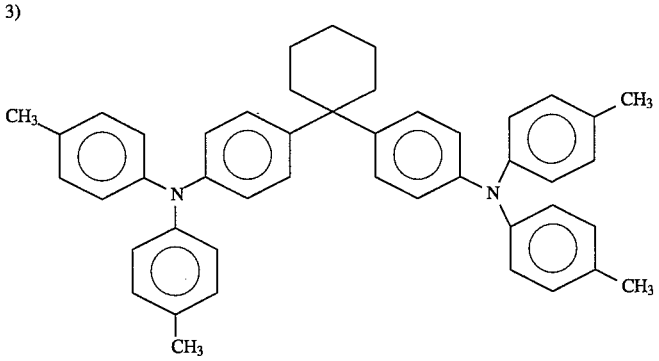
Triphenylamines
1)
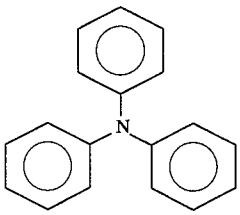
2)
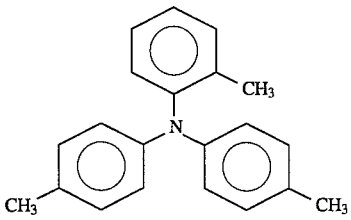
3)
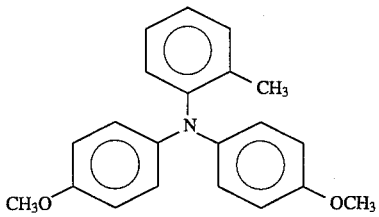
4)
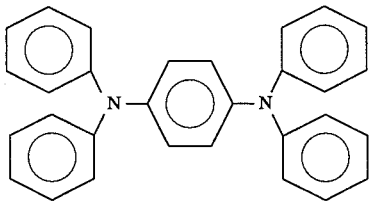

-continued
Aryl-substituted ethylenes
1)
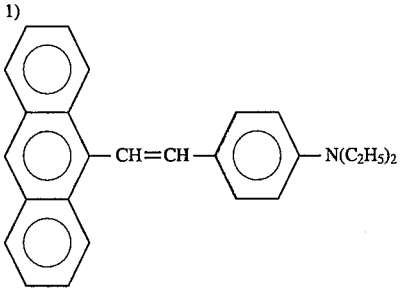
2)
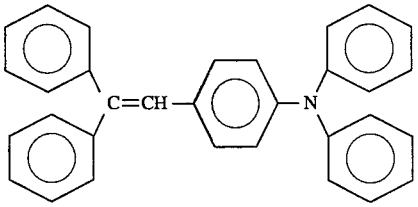
3)
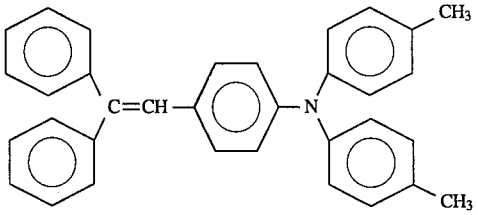
4)
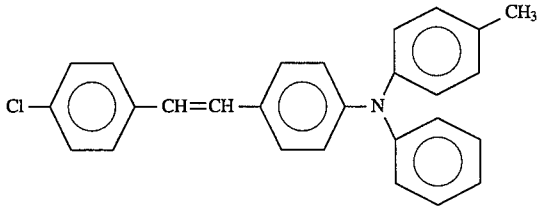
5)
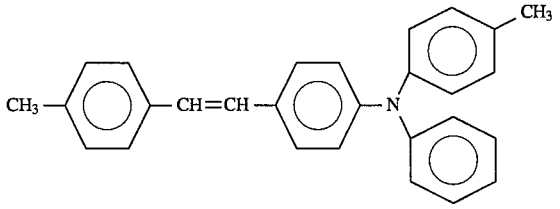
6)
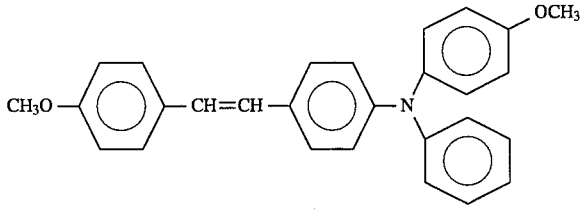

-continued
7)
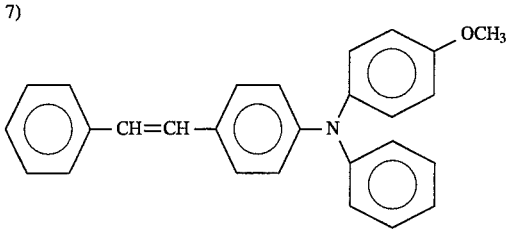
8)
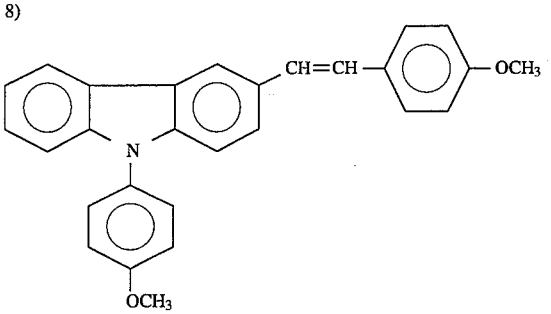
9)
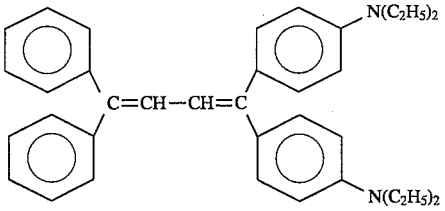
10)
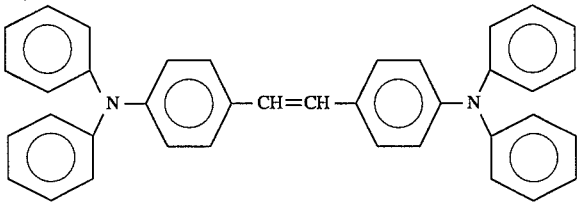
11)
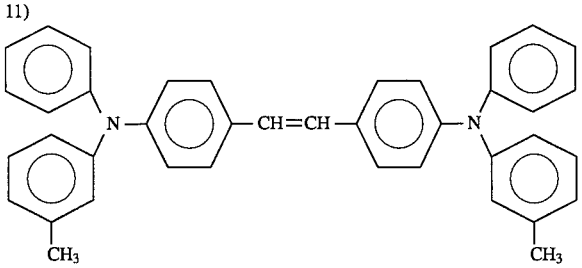
12)
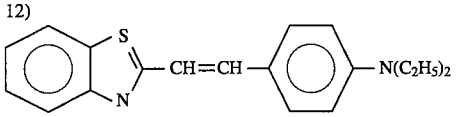

-continued
13)
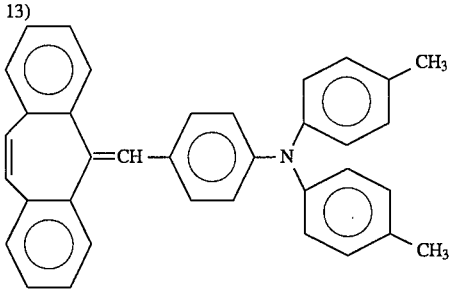
Benzidines
1)
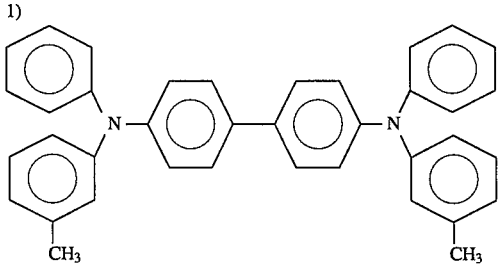
2)
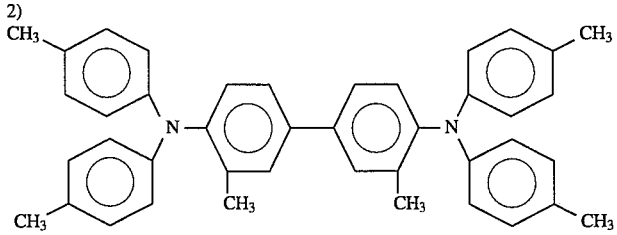
3)
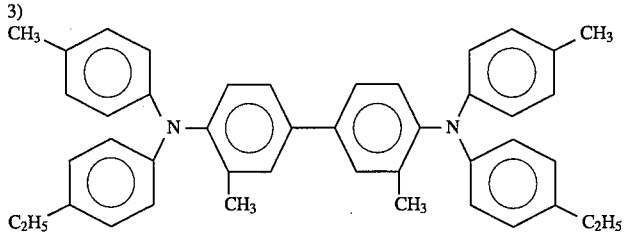
4)
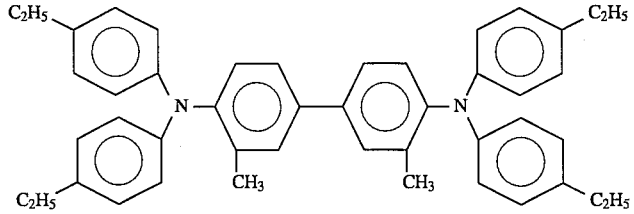
5)
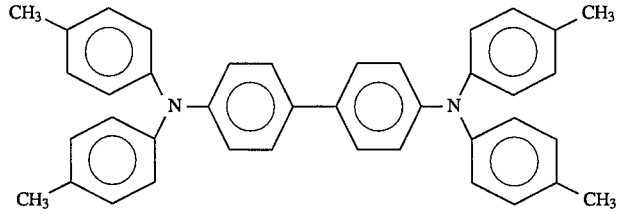

-continued
6)
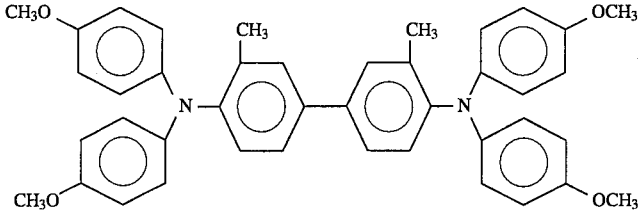
7)
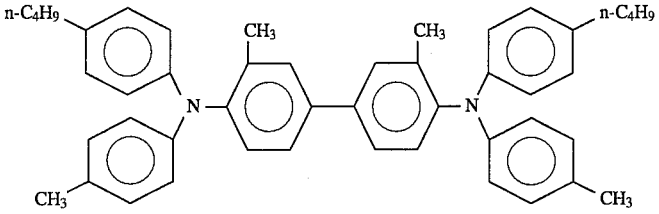
8)
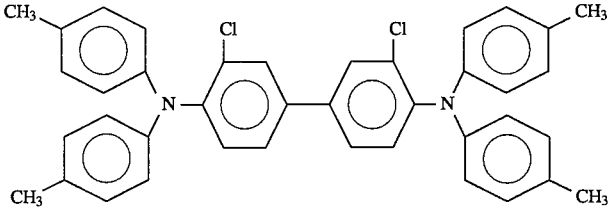
9)
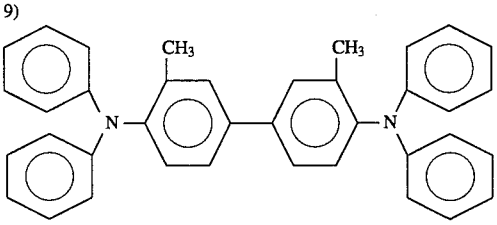
10)
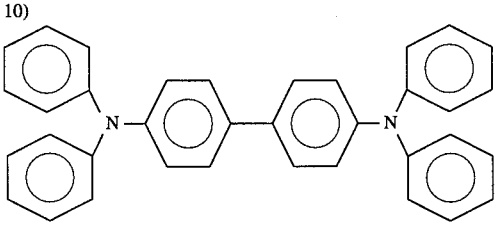
11)
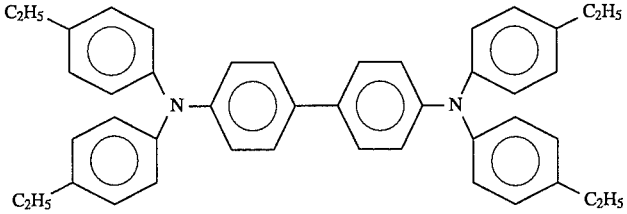
12)
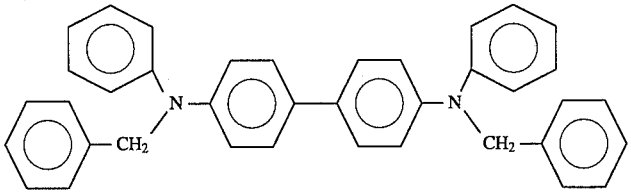

-continued
13)
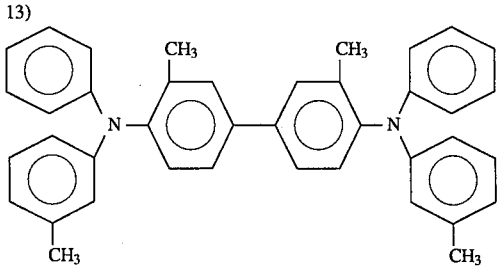
14)
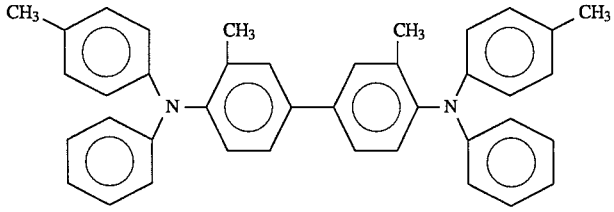
15)
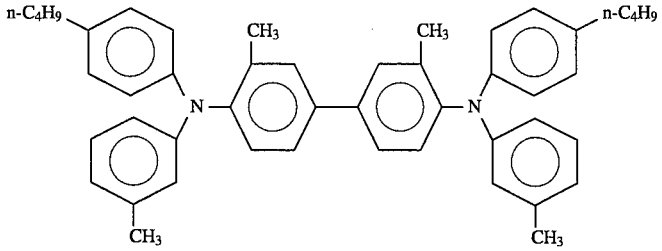
16)
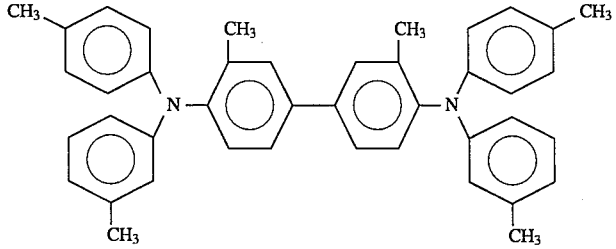
17)
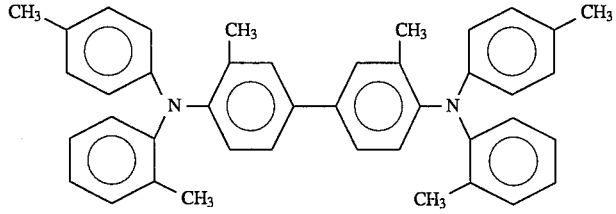
18)
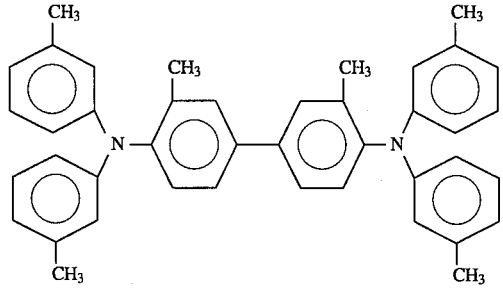

-continued
19)
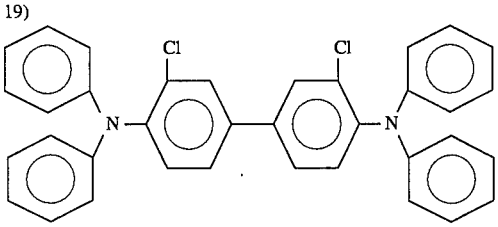
20)
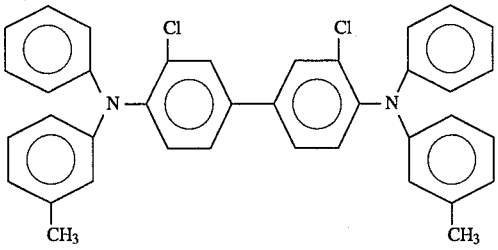
21)
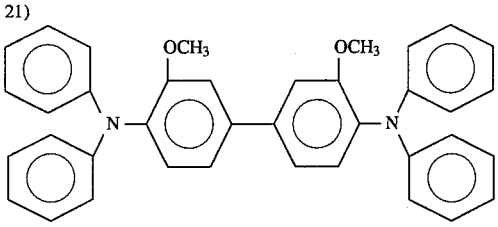
22)
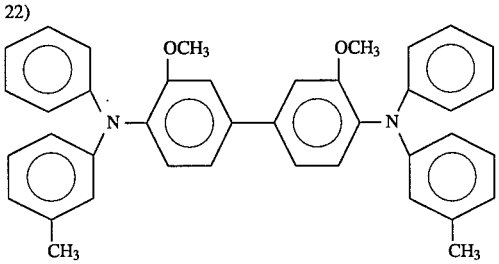
23)
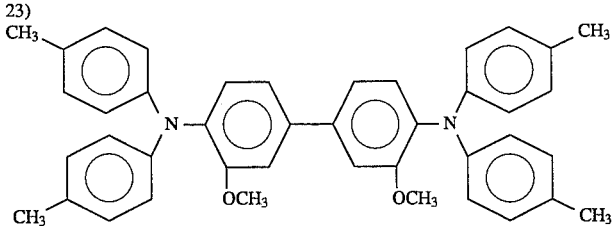
Bicarbazyls
1)
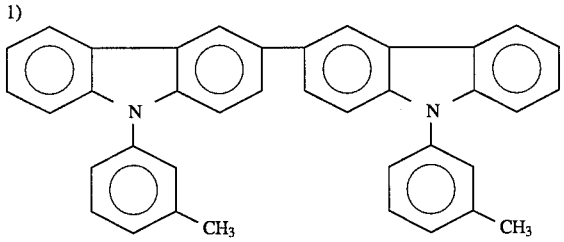

-continued
2)
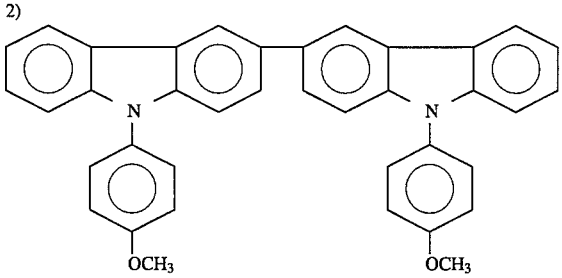
3)
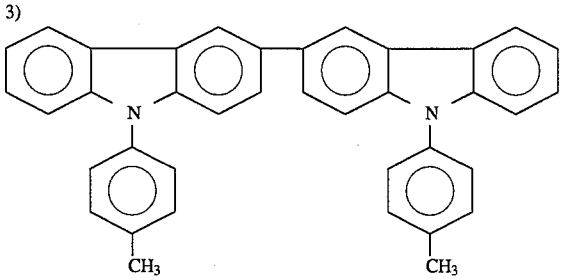
4)
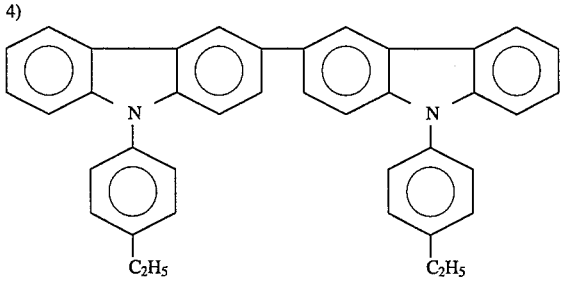
5)
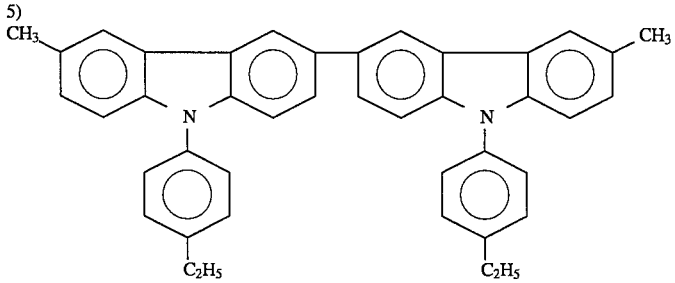
6)
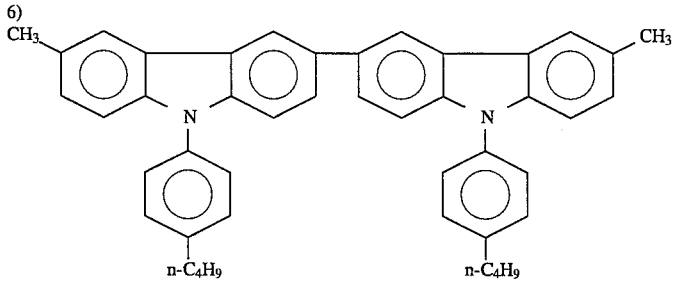
7)
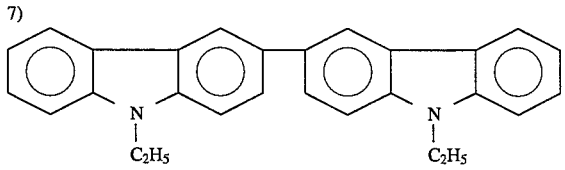

The compounds listed above are incapable of forming films by themselves and, hence, are used in combination with film-forming resins when it is necessary to form a charge transporting layer. Examples of resins that can be used for this purpose include polycarbonates, polyacrylates, polyesters, polystyrene, styrene-acrylonitrile copolymers, polysulfones, polymethacrylic acid esters, and styrene-methacrylate ester copolymers. Among these, polcarbonates are preferred.

When the light-sensitive layer in the photoreceptor of the present invention has a multi-double-layered structure which is functionally separated, the charge transporting layer may provide on the charge generating layer or vice versa. The charge generating layer has a thickness of generally 0.05 to 5 μm and preferably 0.1 to 0.5 μm, and the charge transporting layer has a thickness of generally 5 to 50 μm and preferably 10 to 30 μm.

When the light-sensitive layer has a single layered structure which is not functionally separated, the light-sensitive layer preferably has a thickness of 10 to 20 μm.

In the photoreceptor of the present invention, a charge blocking layer is preferably provided between the light-sensitive layer and the conductive substrate. The charge blocking layer preferably has a thickness of 0.05 to 0.5 μm.

The following examples are provided for the purpose of further illustrating the present invention but are in no way to be taken as limiting.

EXAMPLE I-1

One part by weight of a polyvinylbutyral resin (BLX, the trade name of Sekisui Chemical Co., Ltd.) was dissolved in 40 parts by weight of cyclohexanone. The solution was mixed with 4 parts by weight of Compound No. I-1, which was thoroughly dispersed with a paint shaker. The resulting dispersion was coated onto an aluminum sheet with an applicator and dried to form a charge generating layer, which had a dry thickness of 0.2 μm.

A homogeneous solution was prepared from 1 part by weight of N,N'-diphenyl-N,N'-bis(3-methylphenyl)-(1,1'-biphenyl)-4,4'-diamine, 1 part by weight of a polycarbonate resin (PANLITE, the trade name of Teijin Ltd.) and 8 parts by weight of tetrahydrofuran. The solution was coated onto the charge generating layer with a bar coater and dried to form a charge transporting layer, which had a dry thickness of 20 μm.

The thus obtained electrophotographic photoreceptor was evaluated with respect to its characteristics in the following manner using a paper analyzer (an electrostatic copying paper testing machine) (SP-428 of Kawaguchi Electric Works Co., Ltd.): the photoreceptor was corona-charged to a negative voltage of −6 kV and left to stand in the dark place for 2 seconds. Then, the surface potential, $V_{po}$ (volts), of the photoreceptor was measured. Subsequently, the photoreceptor was exposed to light using a tungsten lamp until the surface illumination reached 5 lux. The time required for the surface potential to decrease to one half of $V_{po}$ was determined and the amount of exposure, $E_{1/2}$ (lux-sec) was calculated.

The same measurement was repeated 20 more times. The results are shown in Table I-1 below.

TABLE I-1

| | No. of runs | |
|---|---|---|
| | 1 | 20 |
| $V_{po}$ (volt) | 805 | 795 |
| $E_{1/2}$ (lux · sec) | 2.2 | 2.2 |

EXAMPLES I-2 to I-10

Additional samples of photoreceptor were prepared in the same manner as in Example I-1 except that in place of Compound No. I-1, Compound Nos. I-6, I-8, I-12, I-20, I-23, I-25, I-48, I-51 and I-54 were used (respectively corresponding to Examples I-2 to I-10). The characteristics of these samples were evaluated in the same manner as in Example I-1. The results are shown in Table I-2 below.

TABLE I-2

| | After the first run | | After 20 runs | |
|---|---|---|---|---|
| Example | $V_{po}$ (volt) | $E_{1/2}$ (lux · sec) | $V_{po}$ (volt) | $E_{1/2}$ (lux · sec) |
| I-2 | 830 | 1.7 | 810 | 1.7 |
| I-3 | 825 | 1.5 | 810 | 1.5 |
| I-4 | 800 | 1.4 | 790 | 1.4 |
| I-5 | 795 | 1.8 | 780 | 1.8 |
| I-6 | 840 | 1.5 | 820 | 1.5 |
| I-7 | 770 | 1.4 | 755 | 1.4 |
| I-8 | 850 | 1.5 | 830 | 1.5 |
| I-9 | 775 | 1.1 | 760 | 1.1 |
| I-10 | 840 | 1.2 | 820 | 1.2 |

Comparative Examples I-1 to I-5

Comparative samples of photoreceptor were prepared in the same manner as in Example I-1 except that in place of Compound No. I-1, Compounds having the following structural formulas (1), (2), (3), (4) and (5) were used (respectively corresponding to Comparative Examples I-1, I-2, I-3, I-4and I-5). The characteristics of these samples were evaluated in the same manner as in Example I-1. The results are shown in Table I-3.

(1)
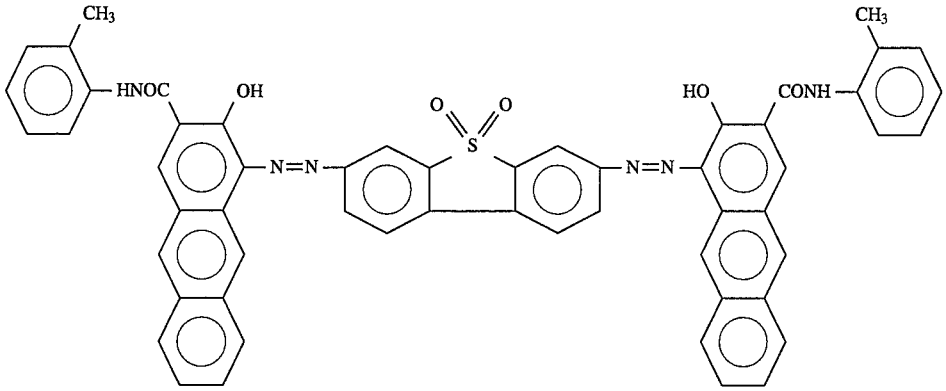
(2)
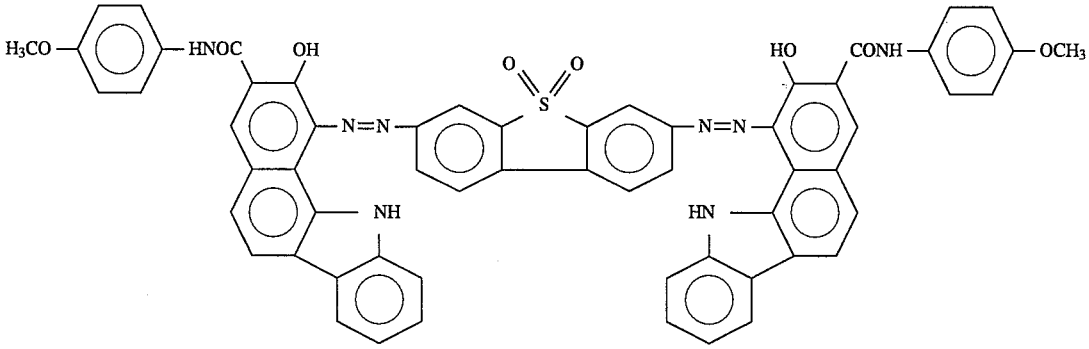
(3)
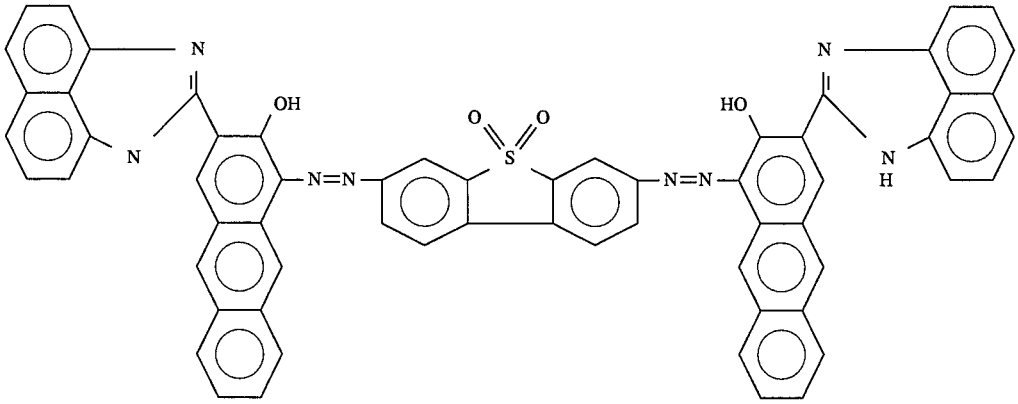

-continued
(4)
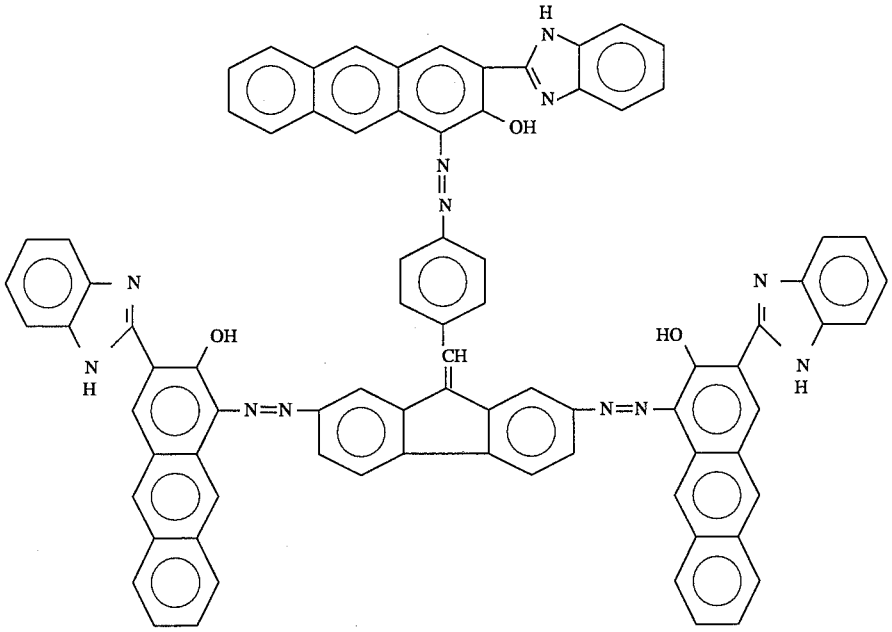
(5)
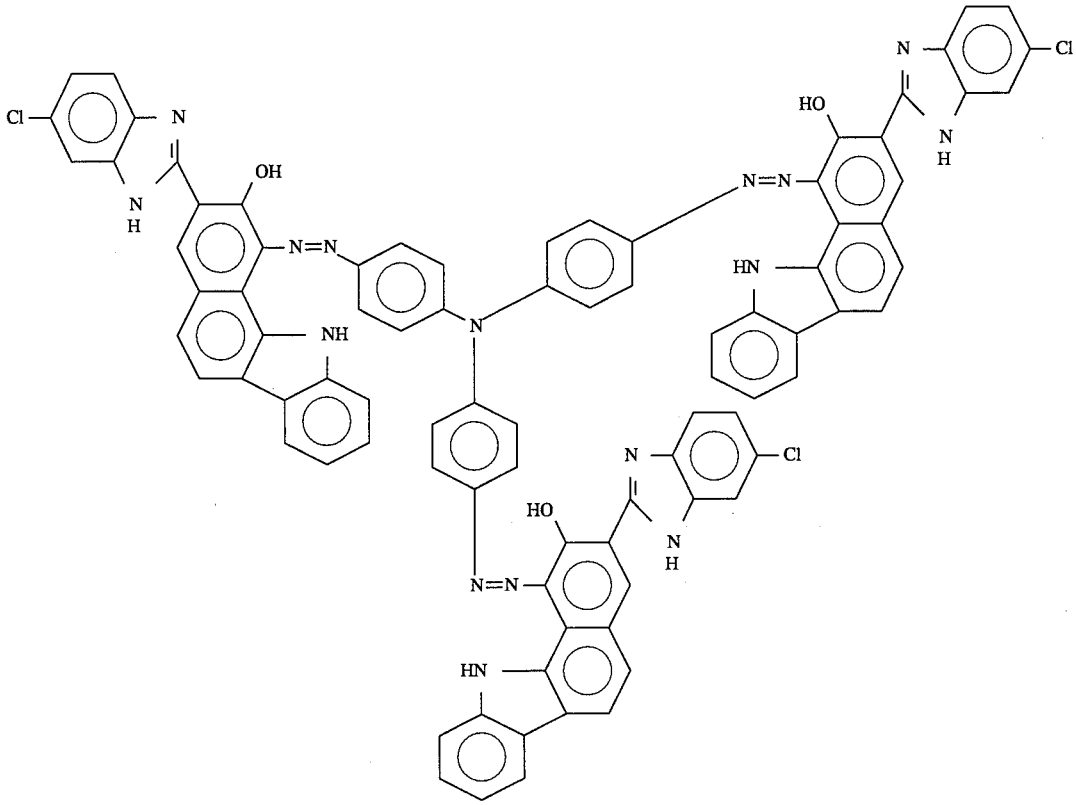
TABLE I-3
| Comparative Example | After the first run $V_{po}$ (volt) | After the first run $E_{1/2}$ (lux · sec) | After 20 runs $V_{po}$ (volt) | After 20 runs $E_{1/2}$ (lux · sec) |
|---|---|---|---|---|
| I-1 | 830 | 5.7 | 810 | 5.5 |
| I-2 | 800 | 7.6 | 770 | 7.3 |
| I-3 | 760 | 5.1 | 720 | 4.7 |
| I-4 | 720 | 10.8 | 640 | 9.5 |
TABLE I-3-continued
| Comparative Example | After the first run $V_{po}$ (volt) | After the first run $E_{1/2}$ (lux · sec) | After 20 runs $V_{po}$ (volt) | After 20 runs $E_{1/2}$ (lux · sec) |
|---|---|---|---|---|
| I-5 | 745 | 4.2 | 700 | 3.8 |

As is apparent from the results of Tables I-1, I-2 and I-3, use of the bisazo compounds represented by formula (I-1) exhibits better electrophotographic characteristics than use of the conventional azo pigments.

The electrophotographic photoreceptor of the present invention which uses these bisazo compounds in the light-sensitive layer has higher sensitivity and durability than photoreceptors that use conventional organic photoconductive materials.

Example II-1

One part by weight of a polyvinyl butyral resin (BLX, the trade name of Sekisui Chemical Co., Ltd.) was dissolved in 40 parts by weight of cyclohexanone. The solution was mixed with 4 parts by weight of Compound No. II-10, which was thoroughly dispersed with a paint shaker. The resulting dispersion was coated onto an aluminum sheet with an applicator and dried to form a charge generating layer, which had a dry thickness of 0.2 μm.

A homogeneous solution was prepared from 1 part by weight of N,N'-diphenyl-N,N'-bis(3-methylphenyl)-(1,1'-biphenyl)-4,4'-diamine, 1 part by weight of a polycarbonate resin (PANLITE, the trade name of Teijin Ltd.) and 8 parts by weight of tetrahydrofuran. The solution was coated onto the charge generating layer with a bar coater and dried to form a charge transporting layer, which had a dry thickness of 20 μm.

The thus obtained electrophotographic photoreceptor was evaluated with respect to its characteristics in the same manner as in Example I-1 using a paper analyzer (SP-428 of Kawaguchi Electric Works Co., Ltd.).

The results are shown in Table II-1 below.

TABLE II-1

| | No. of runs | |
|---|---|---|
| | 1 | 20 |
| $V_{po}$ (volt) | 840 | 825 |
| $E_{1/2}$ (lux · sec) | 1.5 | 1.5 |

EXAMPLES II-2 to II-10

Additional samples of photoreceptor were prepared in the same manner as in Example II-1 except that in place of Compound No. II-10, Compound Nos. II-8, II-13, II-18, II-31, II-35, II-41, II-42, II-43 and II-45 were used (respectively corresponding to Examples II-2 to II-10). The characteristics of these samples were evaluated in the same manner as in Example II-1. The results are shown in Table II-2 below.

TABLE II-2

| | After the first run | | After 20 runs | |
|---|---|---|---|---|
| Example | $V_{po}$ (volt) | $E_{1/2}$ (lux · sec) | $V_{po}$ (volt) | $E_{1/2}$ (lux · sec) |
| II-2 | 800 | 2.0 | 790 | 2.0 |
| II-3 | 790 | 1.8 | 780 | 1.8 |
| II-4 | 850 | 1.7 | 830 | 1.7 |
| II-5 | 815 | 1.6 | 800 | 1.6 |
| II-6 | 820 | 1.4 | 800 | 1.4 |
| II-7 | 790 | 1.7 | 770 | 1.7 |
| II-8 | 780 | 1.5 | 760 | 1.5 |
| II-9 | 840 | 1.0 | 820 | 1.0 |
| II-10 | 800 | 1.1 | 785 | 1.1 |

EXAMPLES II-11 to II-16

In order to demonstrate that the electrophotographic photoreceptor of the present invention has high sensitivity to light of long wavelength, the following measurement was conducted. The samples of photoreceptor obtained in Examples II-5 to II-10 (respectively corresponding to Examples II-11 to II-16) were electrically charged by corona discharge in the dark place and exposed with monochromatic light at 780 nm having an energy of 1 μW/cm$^2$ that was isolated by means of a monochromator. The time required for the initial surface potential on each sample to decrease by one half was measured to calculate the amount of exposure. The results are shown in Table II-3 below.

TABLE II-3

| Example | $E_{1/2}$ (780 nm), erg · cm$^2$ |
|---|---|
| II-11 | 5.1 |
| II-12 | 4.6 |
| II-13 | 5.2 |
| II-14 | 4.5 |
| II-15 | 3.3 |
| II-16 | 3.6 |

Comparative Examples II-1 to II-5

Comparative samples of photoreceptor were prepared in the same manner as in Example II-1 except that in place of Compound No. II-10, compounds having the following structural formulas (1), (2), (3), (4) and (5) were used (respectively corresponding to Comparative Examples II-1, II-2, II-3, II-4 and II-5). The characteristics of these samples were evaluated in the same manner as in Example II-1. The results are shown in Table II-4.

(1)
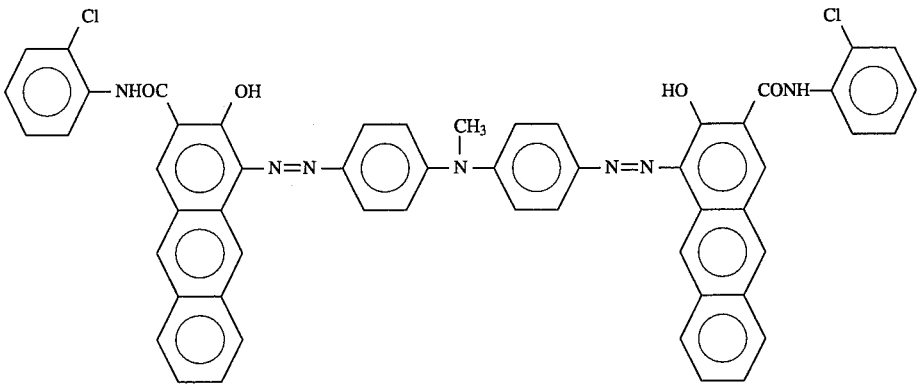
(2)
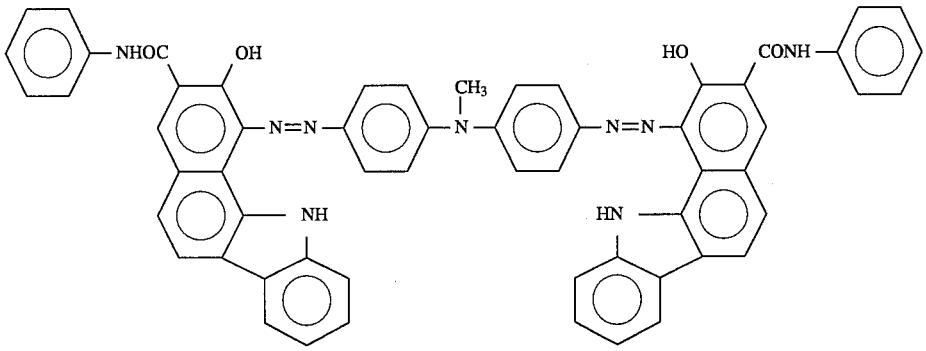
(3)
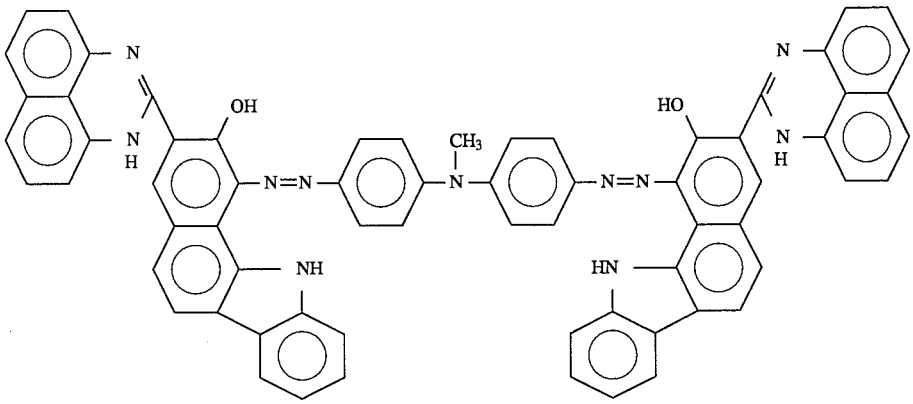

-continued
(4)
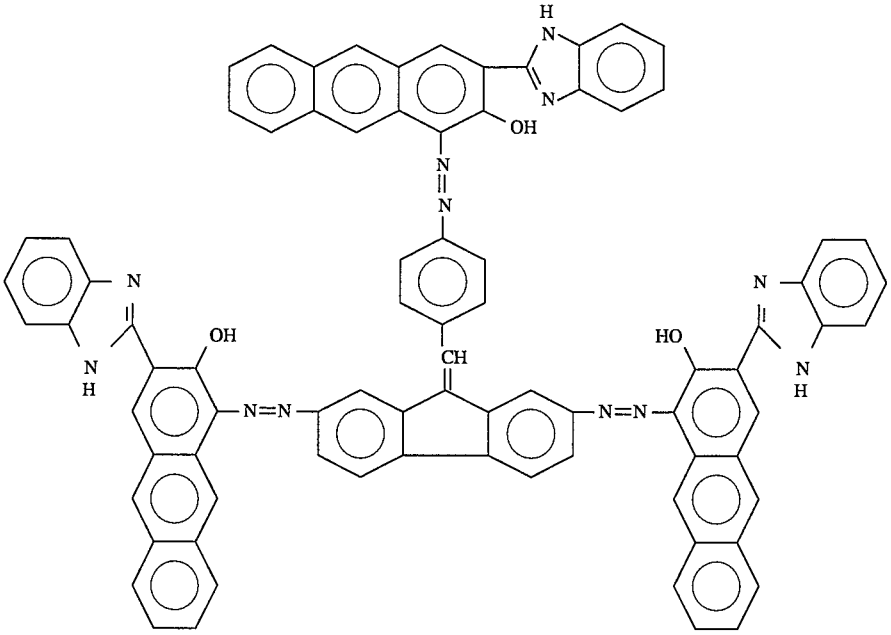
(5)
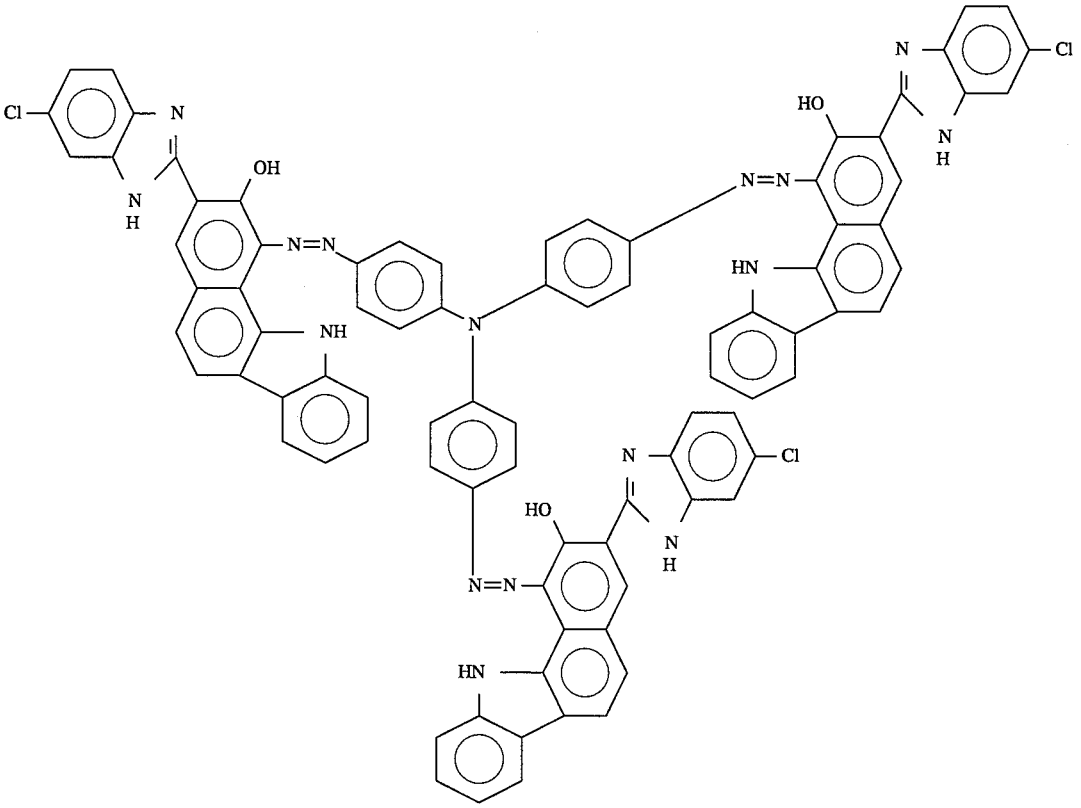
TABLE II-4
| Comparative Example | After the first run | | After 20 runs | |
|---|---|---|---|---|
| | $V_{po}$ (volt) | $E_{1/2}$ (lux · sec) | $V_{po}$ (volt) | $E_{1/2}$ (lux · sec) |
| II-1 | 780 | 6.6 | 750 | 6.3 |
| II-2 | 800 | 4.1 | 775 | 4.0 |
| II-3 | 845 | 5.7 | 810 | 5.5 |
| II-4 | 720 | 10.8 | 640 | 9.5 |
TABLE II-4-continued
| Comparative Example | After the first run | | After 20 runs | |
|---|---|---|---|---|
| | $V_{po}$ (volt) | $E_{1/2}$ (lux · sec) | $V_{po}$ (volt) | $E_{1/2}$ (lux · sec) |
| II-5 | 745 | 4.2 | 700 | 3.8 |

Comparative Examples II-6 to II-8

The photoreceptors of Comparative Examples II-2, 3 and 5 (respectively corresponding to Comparative Examples II-6 to II-8) were evaluated in the same manner as in Example II-11. The results are shown in Table II-5 below.

TABLE II-5

| Comparative Example | $E_{1/2}$ (780 nm), erg · cm$^2$ |
|---|---|
| II-6 | 35 |
| II-7 | 42 |
| II-8 | 33 |

The electrophotographic photoreceptor of the present invention which uses the bisazo compounds represented by formula (II-1) in the light-sensitive layer has higher sensitivity and durability than photoreceptors that use conventional organic photoconductive materials. Further, the photoreceptor has sufficiently good chargeability to exhibit high sensitivity to light in the spectral range of long wavelengths. Therefore, the electrophotographic photoreceptor of the present invention is applicable to various types of printers, microfilm readers, electrophotographic plate-making systems and other equipment that employ a wide range of light sources including semiconductor lasers.

EXAMPLE III-1

One part by weight of a polyvinyl butyral resin (BLX, the trade name of Sekisui Chemical Co., Ltd.) was dissolved in 40 parts by weight of cyclohexanone. The solution was mixed with 4 parts by weight of Compound No. III-1, which was thoroughly dispersed with a paint shaker. The resulting dispersion was coated onto an aluminum sheet with an applicator and dried to form a charge generating layer, which had a dry thickness of 0.2 μm.

A homogeneous solution was prepared from 1 part by weight of N,N'-diphenyl-N,N'-bis(3-methylphenyl)-(1,1'-biphenyl)-4,4'-diamine, 1 part by weight of a polycarbonate resin (PANLITE, the trade name of Teijin Ltd.) and 8 parts by weight of tetrahydrofuran. The solution was coated onto the charge generating layer with a bar coater and dried to form a charge transporting layer, which had a dry thickness of 20 μm.

The thus obtained electrophotographic photoreceptor was evaluated with respect to its characteristics in the same manner as in Example I-1 using a paper analyzer (SP-428 of Kawaguchi Electric Works Co., Ltd.).

The results are shown in Table III-1 below.

TABLE III-1

| | No. of runs | |
|---|---|---|
| | 1 | 20 |
| $V_{po}$ (volt) | 850 | 835 |
| $E_{1/2}$ (lux · sec) | 2.6 | 2.5 |

EXAMPLES III-2 to III-10

Additional samples of photoreceptor were prepared in the same manner as in Example III-1 except that in place of Compound No. III-1, Compound Nos. III-5, III-6, III-18, III-30, III-44, III-48, III-51, III-64 and III-70 were used (respectively corresponding to Examples III-2 to III-10). The characteristics of these samples were evaluated in the same manner as in Example III-1. The results are shown in Table III-2 below.

TABLE III-2

| | After the first run | | After 20 runs | |
|---|---|---|---|---|
| Example | $V_{po}$ (volt) | $E_{1/2}$ (lux · sec) | $V_{po}$ (volt) | $E_{1/2}$ (lux · sec) |
| III-2 | 800 | 2.1 | 790 | 2.1 |
| III-3 | 815 | 1.9 | 800 | 1.9 |
| III-4 | 790 | 1.5 | 770 | 1.5 |
| III-5 | 790 | 1.8 | 775 | 1.8 |
| III-6 | 840 | 1.6 | 820 | 1.6 |
| III-7 | 815 | 1.6 | 800 | 1.5 |
| III-8 | 780 | 1.7 | 765 | 1.7 |
| III-9 | 800 | 1.4 | 780 | 1.4 |
| III-10 | 845 | 1.0 | 830 | 1.0 |

Comparative Examples III-1 to III-5

Comparative samples of photoreceptor were obtained in the same manner as in Example III-1 except that in place of Compound No. III-1, compounds having the following structural formulas (1), (2), (3), (4) and (5) were used (respectively corresponding to Comparative Examples III-1, III-2, III-3, III-4 and III-5). The characteristics of these samples were evaluated in the same manner as in Example III-1. The results are shown in Table III-3.

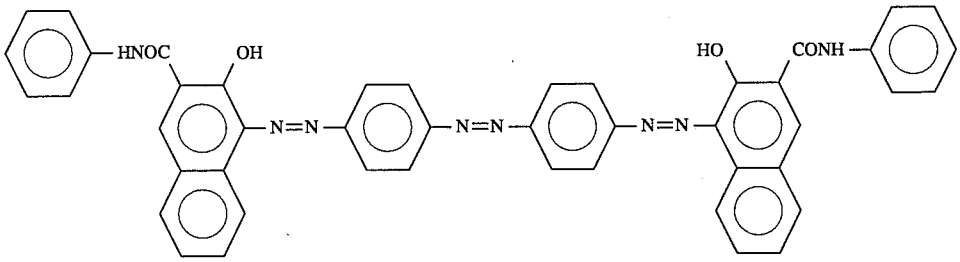

(1)

-continued
(2)
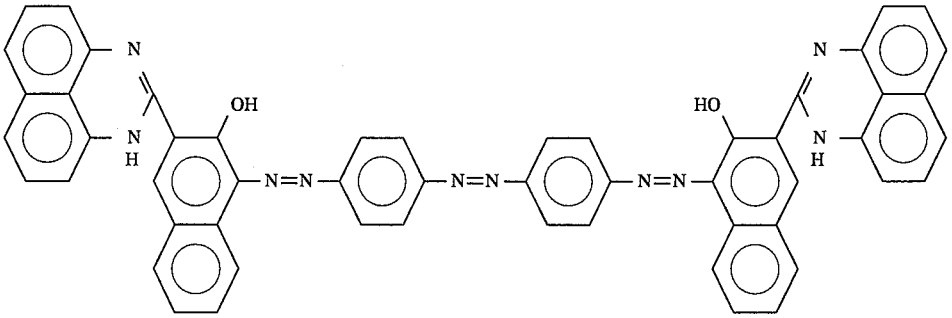
(3)
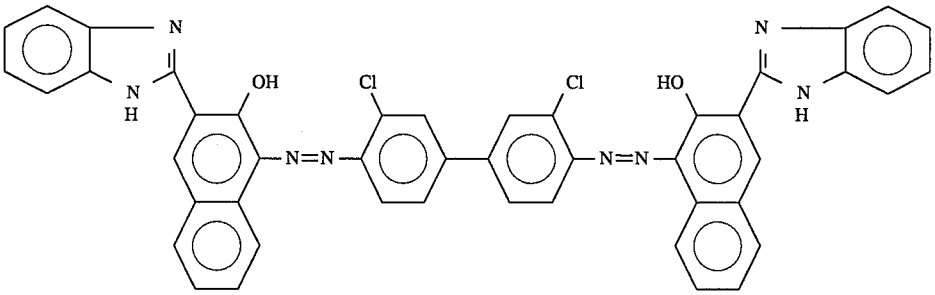
(4)
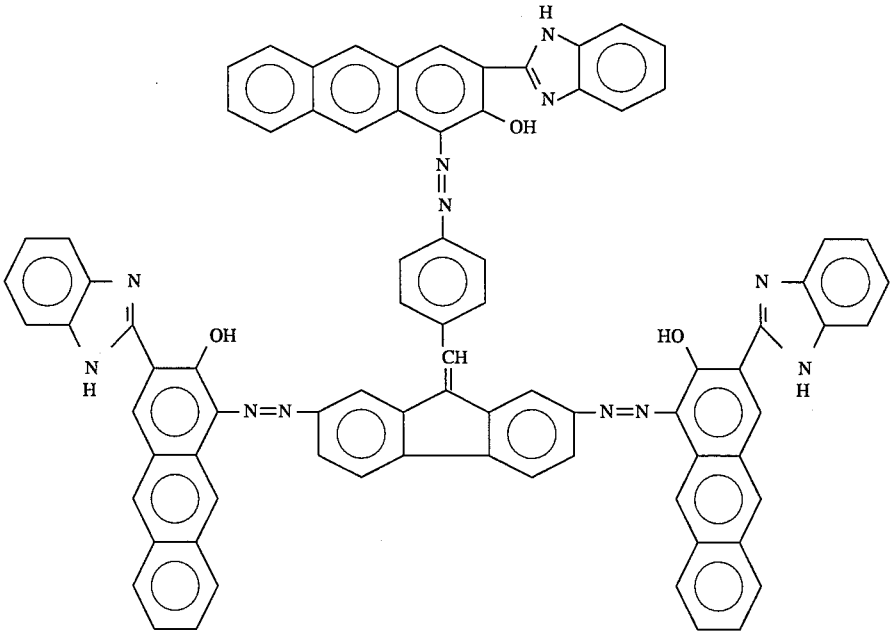

-continued (5)

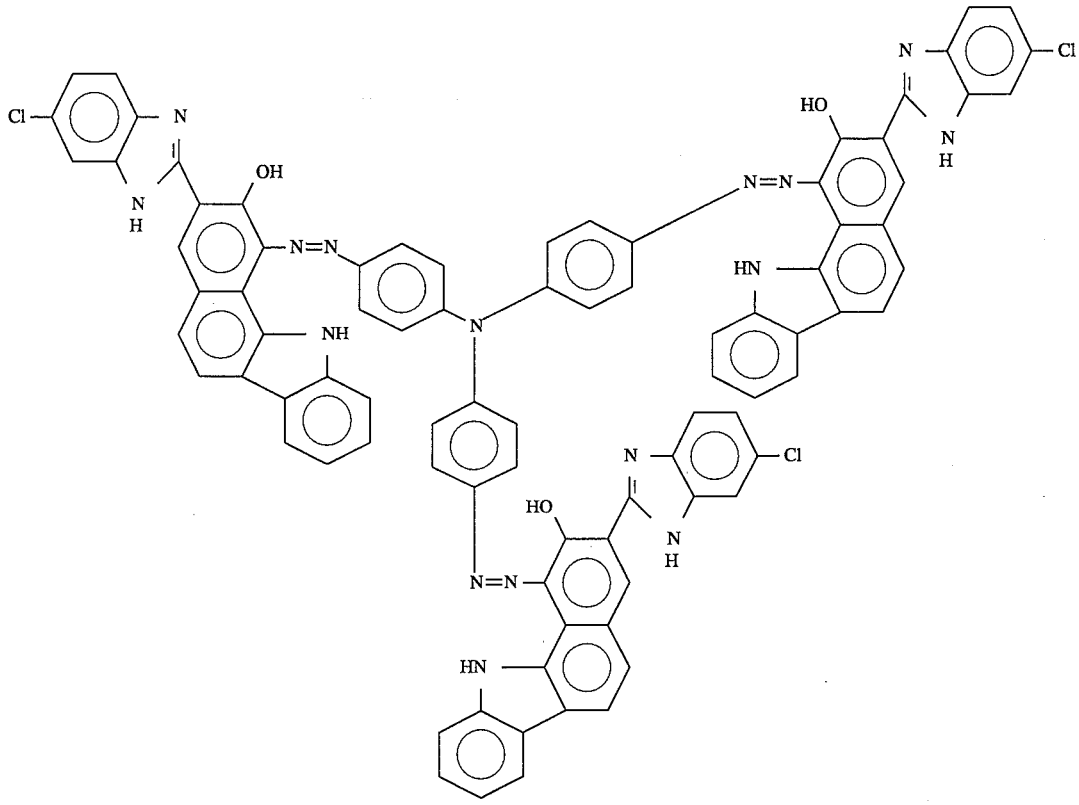

TABLE III-3

| Comparative Example | After the first run $V_{po}$ (volt) | After the first run $E_{1/2}$ (lux · sec) | After 20 runs $V_{po}$ (volt) | After 20 runs $E_{1/2}$ (lux · sec) |
|---|---|---|---|---|
| III-1 | 795 | 6.9 | 760 | 6.7 |
| III-2 | 790 | 4.8 | 760 | 4.7 |
| III-3 | 830 | 6.3 | 805 | 6.0 |
| III-4 | 720 | 10.8 | 640 | 9.5 |
| III-5 | 745 | 4.2 | 700 | 3.8 |

As is apparent from the results of Tables III-1, III-2 and III-3, use of the trisazo compounds represented by formula (III-1) exhibits better electrophotographic characteristics than use of the conventional azo pigments.

The electrophotographic photoreceptor of the present invention which uses these trisazo compounds in the light-sensitive layer has higher sensitivity and durability than photoreceptors that use conventional organic photoconductive materials.

EXAMPLE IV-1

One part by weight of a polyvinyl butyral resin (BLX, the trade name of Sekisui Chemical Co., Ltd.) was dissolved in 40 parts by weight of cyclohexanone. The solution was mixed with 4 parts by weight of Compound No. IV-1, which was thoroughly dispersed with a paint shaker. The resulting dispersion was coated onto an aluminum sheet with an applicator and dried to form a charge generating layer, which had a dry thickness of 0.2 μm.

A homogeneous solution was prepared from 1 part by weight of N,N'-diphenyl-N,N'-bis(3-methylphenyl)-(1,1'-biphenyl)-4,4'-diamine, 1 part by weight of a polycarbonate resin (PANLITE, the trade name of Teijin Ltd.) and 8 parts by weight of tetrahydrofuran. The solution was coated onto the charge generating layer with a bar coater and dried to form a charge transporting layer, which had a dry thickness of 20 μm.

The thus obtained electrophotographic photoreceptor was evaluated with respect to its characteristics in the same manner as in Example I-1 using a paper analyzer (SP-428 of Kawaguchi Electric Works Co., Ltd.).

The results are shown in Table IV-1 below.

TABLE IV-1

| | No. of runs 1 | No. of runs 20 |
|---|---|---|
| $V_{po}$ (volt) | 835 | 820 |
| $E_{1/2}$ (lux · sec) | 1.7 | 1.7 |

EXAMPLES IV-2 to IV-10

Additional samples of photoreceptor were prepared in the same manner as in Example IV-1 except that in place of Compound No. IV-1, Compound Nos. IV-4, IV-6, IV-12, IV-25, IV-29, IV-37, IV-51, IV-52 and IV-54 were used (respectively corresponding to Examples IV-2 to IV-10). The characteristics of these samples were evaluated in the same manner as in Example IV-1. The results are shown in Table IV-2 below.

TABLE IV-2

| Example | After the first run | | After 20 runs | |
|---|---|---|---|---|
| | $V_{po}$ (volts) | $E_{1/2}$ (lux · sec) | $V_{po}$ (volts) | $E_{1/2}$ (lux · sec) |
| IV-2 | 795 | 1.5 | 770 | 1.5 |
| IV-3 | 800 | 2.1 | 780 | 2.0 |
| IV-4 | 825 | 1.8 | 810 | 1.8 |
| IV-5 | 840 | 1.4 | 820 | 1.4 |
| IV-6 | 835 | 1.2 | 820 | 1.2 |
| IV-7 | 815 | 1.3 | 800 | 1.3 |
| IV-8 | 825 | 0.8 | 805 | 0.8 |
| IV-9 | 840 | 1.1 | 820 | 1.1 |
| IV-10 | 790 | 1.4 | 775 | 1.4 |

EXAMPLES IV-11 to IV-16

In order to demonstrate that the electrophotographic photoreceptor of the present invention has high sensitivity to light of long wavelength, the following measurement was conducted. The samples of photoreceptor obtained in Examples IV-5 to IV-10 (respectively corresponding to Examples IV-11 to IV-16) were electrically charged by corona discharge in the dark place and exposed with monochromatic light at 780 nm having an energy of 1 $\mu W/cm^2$ that was isolated by means of a monochromator. The time required for the initial surface potential on each sample to decrease by one half was measured to calculate the amount of exposure. The results are shown in Table IV-3 below.

TABLE IV-3

| Example | $E_{1/2}$ (780 nm), erg · $cm^2$ |
|---|---|
| IV-11 | 4.7 |
| IV-12 | 3.8 |
| IV-13 | 4.1 |
| IV-14 | 2.6 |
| IV-15 | 3.6 |
| IV-16 | 4.5 |

Comparative Examples IV-1 to IV-5

Comparative samples of photoreceptor were prepared as in Example IV-1 except that in place of Compound No. IV-1, compounds having the following structural formulas (1), (2), (3), (4) and (5) were used (respectively corresponding to Comparative Examples IV-1, IV-2, IV-3, IV-4 and IV-5). The characteristics of these samples were evaluated in the same manner as in Example IV-1. The results are shown in Table IV-4.

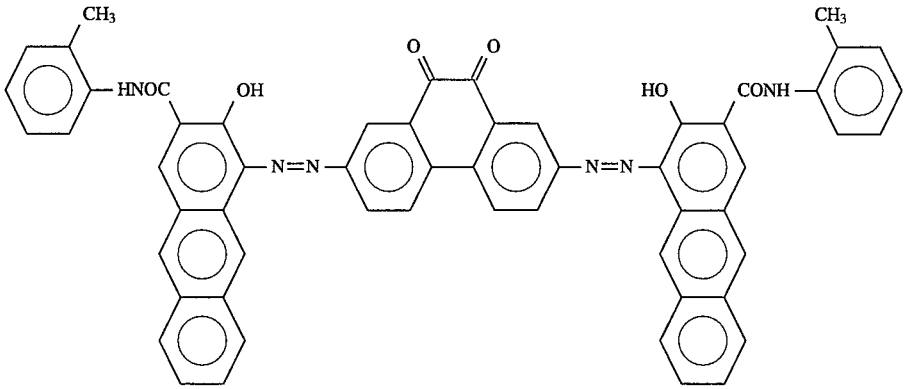

(1)

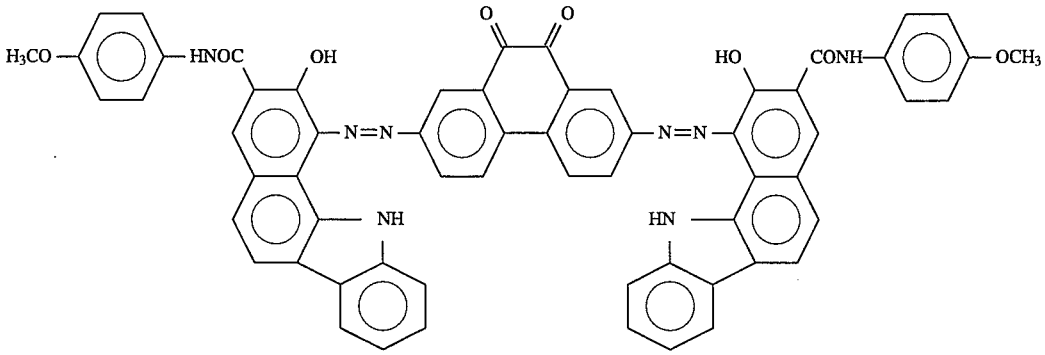

(2)

-continued
(3)
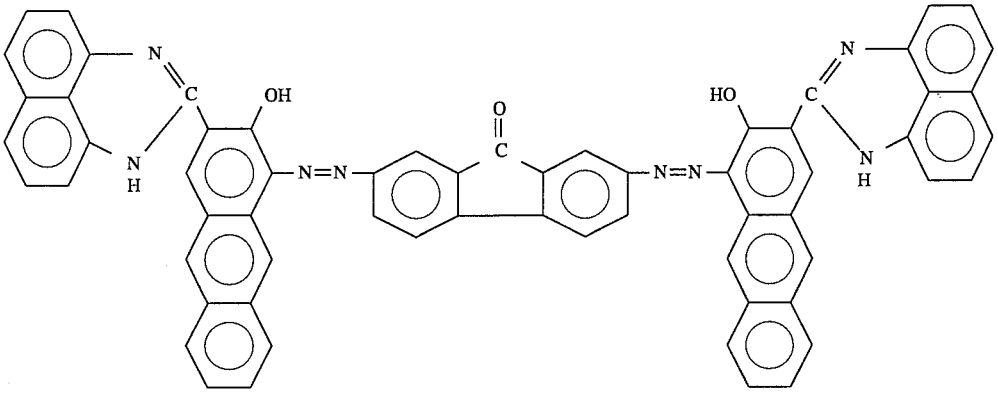
(4)
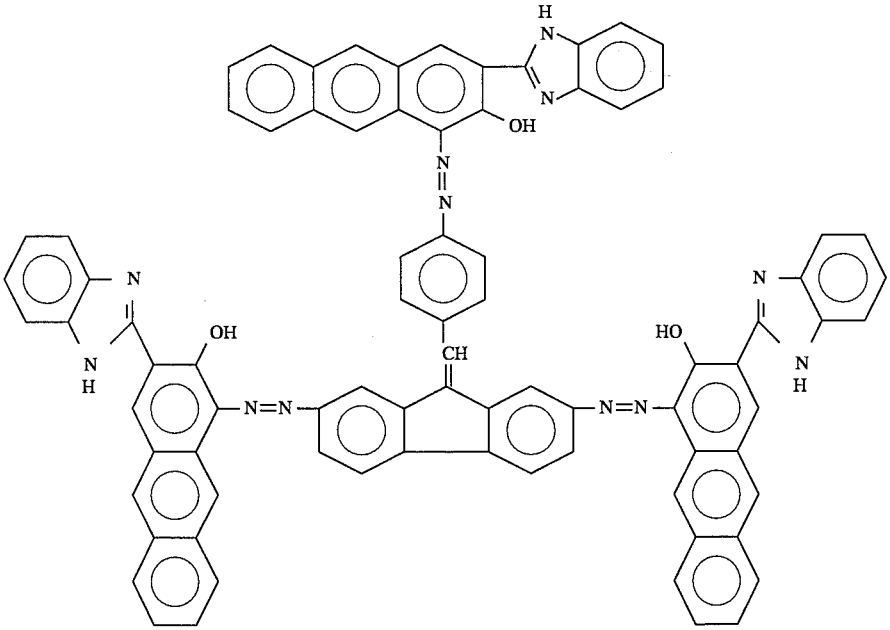

-continued (5)

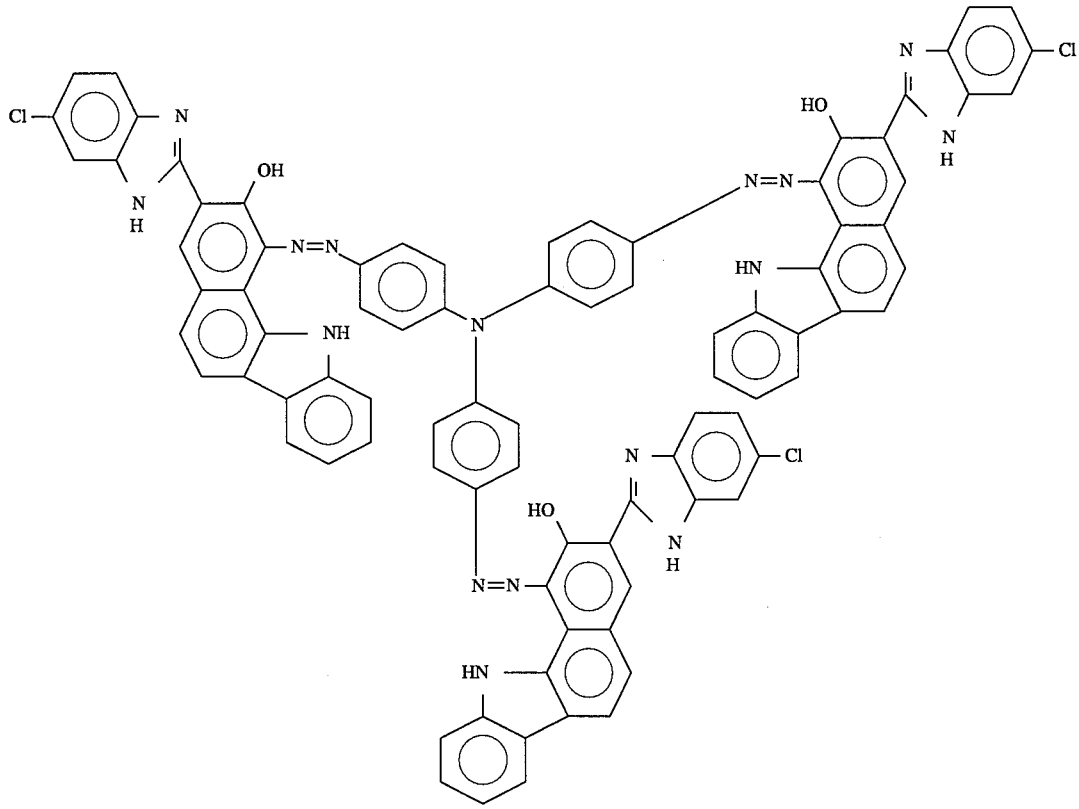

TABLE IV-4

| Comparative Example | After the first run $V_{po}$ (volt) | After the first run $E_{1/2}$ (lux · sec) | After 20 runs $V_{po}$ (volt) | After 20 runs $E_{1/2}$ (lux · sec) |
|---|---|---|---|---|
| IV-1 | 855 | 6.3 | 830 | 6.0 |
| IV-2 | 790 | 3.8 | 760 | 3.7 |
| IV-3 | 820 | 5.1 | 795 | 4.9 |
| IV-4 | 720 | 10.8 | 640 | 9.5 |
| IV-5 | 745 | 4.2 | 700 | 3.8 |

Comparative Examples IV-6 to IV-7

The photoreceptors of Comparative Examples IV-2 and IV-5 (respectively corresponding to Comparative Examples IV-6 and IV-7) were evaluated in the same manner as in Example IV-11. The results are shown in Table IV-5 below.

TABLE IV-5

| Comparative Example | $E_{1/2}$ (780 nm), erg · cm$^2$ |
|---|---|
| IV-6 | 23 |
| IV-7 | 33 |

The electrophotographic photoreceptor of the present invention which uses the bisazo compounds represented by formula (IV-1) in the light-sensitive layer has higher sensitivity and durability than photoreceptors that use conventional organic photoconductive materials. Further, the photoreceptor has sufficiently good chargeability to exhibit high sensitivity to light in the spectral range of long wavelengths. Therefore, the electrophotographic photoreceptor of the present invention is applicable to various types of printers, microfilm readers, electrophotographic plate-making systems and other equipment that employ a wide range of light sources including semiconductor lasers.

EXAMPLE V-1

One part by weight of a polyvinyl butyral resin (BLX, the trade name of Sekisui Chemical Co., Ltd.) was dissolved in 40 parts by weight of cyclohexanone. The solution was mixed with 4 parts by weight of Compound No. V-1, which was thoroughly dispersed with a paint shaker. The resulting dispersion was coated onto an aluminum sheet with an applicator and dried to form a charge generating layer, which had a dry thickness of 0.2 μm.

A homogeneous solution was prepared from 1 part by weight of N,N'-diphenyl-N,N'-bis(3-methylphenyl)-(1,1'-biphenyl)-4,4'-diamine, 1 part by weight of a polycarbonate resin (PANLITE, the trade name of Teijin Ltd.) and 8 parts by weight of tetrahydrofuran. The solution was coated onto the charge generating layer with a bar coater and dried to form a charge transporting layer, which had a dry thickness of 20 μm.

The thus obtained electrophotographic photoreceptor was evaluated with respect to its characteristics in the same manner as in Example I-1 using a paper analyzer (SP-428 of Kawaguchi Electric Works Co., Ltd.).

The results are shown in Table V-1 below.

TABLE V-1

| | No. of runs | |
|---|---|---|
| | 1 | 20 |
| $V_{po}$ (volt) | 810 | 790 |
| $E_{1/2}$ (lux · sec) | 1.8 | 1.8 |

EXAMPLES V-2 to V-10

Additional samples of photoreceptor were prepared in the same manner as in Example V-1 except that in place of Compound No. V-7, Compound Nos. V-5, V-10, V-27, V-31, V-45, V-50, V-52, V-64 and V-65 were used (respectively corresponding to Examples V-2 to V-10). The characteristics of these samples were evaluated in the same manner as in Example V-1. The results are shown in Table V-2 below.

TABLE V-2

| | After the first run | | After 20 runs | |
|---|---|---|---|---|
| Example | $V_{po}$ (volts) | $E_{1/2}$ (lux · sec) | $V_{po}$ (volts) | $E_{1/2}$ (lux · sec) |
| V-2 | 835 | 2.1 | 810 | 2.0 |

TABLE V-2-continued

| | After the first run | | After 20 runs | |
|---|---|---|---|---|
| Example | $V_{po}$ (volts) | $E_{1/2}$ (lux · sec) | $V_{po}$ (volts) | $E_{1/2}$ (lux · sec) |
| V-3 | 790 | 1.7 | 770 | 1.7 |
| V-4 | 850 | 1.3 | 830 | 1.3 |
| V-5 | 840 | 1.5 | 825 | 1.5 |
| V-6 | 780 | 1.5 | 765 | 1.5 |
| V-7 | 870 | 2.5 | 850 | 2.4 |
| V-8 | 840 | 1.9 | 820 | 1.8 |
| V-9 | 765 | 1.7 | 750 | 1.7 |
| V-10 | 810 | 1.5 | 785 | 1.5 |

Comparative Examples V-1 to V-5

Comparative samples of photoreceptor were prepared in the same manner as in Example V-1 except that in place of Compound No. V-7, compounds having the following structural formulas (1), (2), (3), (4) and (5) were used (respectively corresponding to Comparative Examples V-1, V-2, V-3, V-4 and V-5). The characteristics of these samples were evaluated in the same manner as in Example V-1. The results are shown in Table V-3.

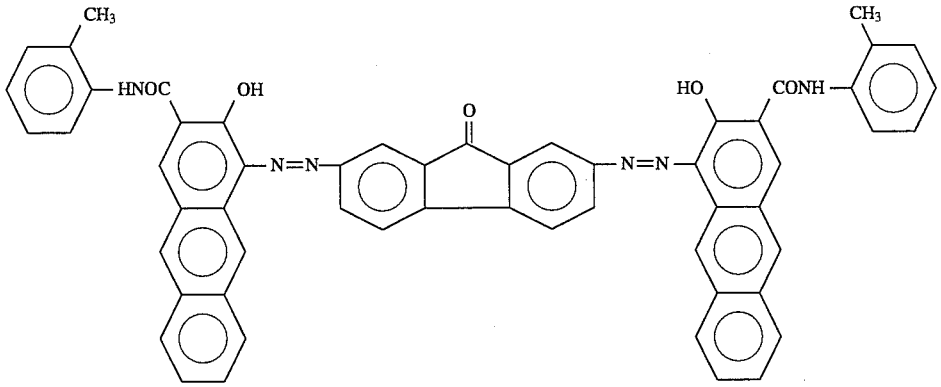

(1)

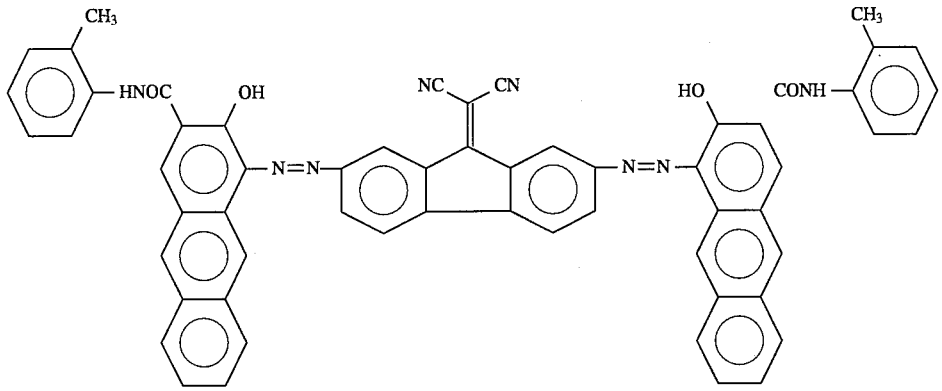

(2)

-continued (3)

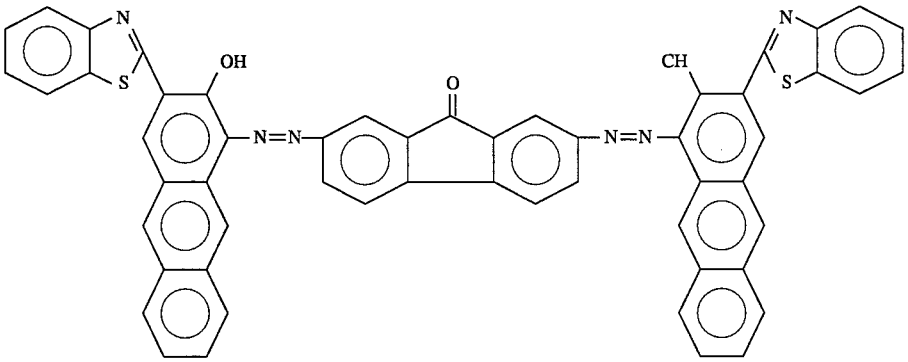

(4)

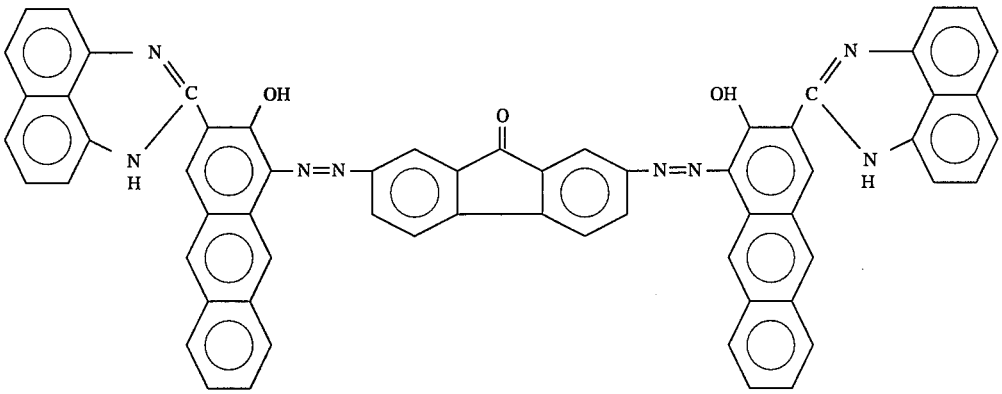

(5)

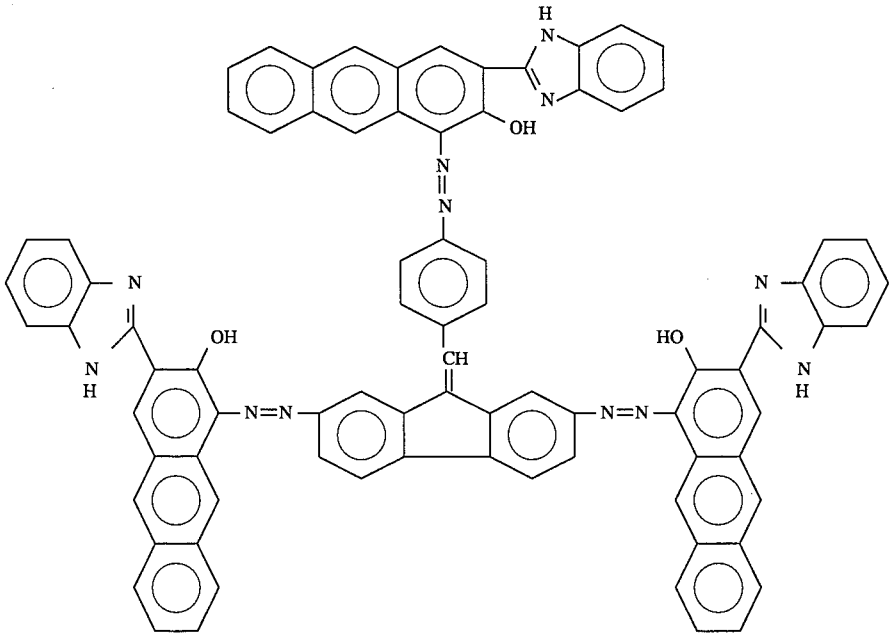

TABLE V-3

| Comparative Example | After the first run | | After 20 runs | |
|---|---|---|---|---|
| | $V_{po}$ (volt) | $E_{1/2}$ (lux · sec) | $V_{po}$ (volt) | $E_{1/2}$ (lux · sec) |
| V-1 | 865 | 6.7 | 840 | 6.5 |
| V-2 | 770 | 8.1 | 740 | 7.8 |
| V-3 | 780 | 4.9 | 750 | 4.8 |
| V-4 | 820 | 5.1 | 745 | 4.9 |
| V-5 | 720 | 10.8 | 640 | 9.6 |

As is apparent from the results of Tables V-1, V-2and V-3, use of bisazo compounds represented by formula (V-1) exhibits better electrophotographic characteristics than use of the conventional azo pigments.

The electrophotographic photoreceptor of the present invention which uses these bisazo compounds in the light-sensitive layer has higher sensitivity and durability than photoreceptors that use conventional organic photoconductive materials.

EXAMPLE VI-1

One part by weight of a polyvinyl butyral resin (BLX, the trade name of Sekisui Chemical Co., Ltd.) was dissolved in 40 parts by weight of cyclohexanone. The solution was mixed with 4 parts by weight of Compound No. VI-2, which was thoroughly dispersed with a paint shaker. The resulting dispersion was coated onto an aluminum sheet with an applicator and dried to form a charge generating layer, which had a dry thickness of 0.2 μm.

A homogeneous solution was prepared from 1 part by weight of N,N'-diphenyl-N,N'-bis(3-methylphenyl)-( 1,1'-biphenyl)-4,4'-diamine, 1 part by weight of a polycarbonate resin (PANLITE, the trade name of Teijin Ltd.) and 8 parts by weight of tetrahydrofuran. The solution was coated onto the charge generating layer with a bar coater and dried to form a charge transporting layer, which had a dry thickness of 20 μm.

The thus obtained electrophotographic photoreceptor was evaluated with respect to its characteristics in the same manner as in Example I-1 using a paper analyzer (SP-428 of Kawaguchi Electric Works Co., Ltd.).

The results are shown in Table VI-1 below.

TABLE VI-1

| | No. of runs | |
|---|---|---|
| | 1 | 20 |
| $V_{po}$ (volt) | 830 | 820 |
| $E_{1/2}$ (lux · sec) | 1.0 | 1.0 |

EXAMPLES VI-2 to VI-10

Additional samples of photoreceptor were prepared in the same manner as in Example VI-1 except that in place of Compound No. VI-2, Compound Nos. VI-1, VI-3, VI-6, VI-13, VI-14, VI-15, VI-17, VI-26 and VI-27 were used (respectively corresponding to Examples VI-2 to VI-10). The characteristics of these samples were evaluated in the same manner as in Example VI-1. The results are shown in Table VI-2 below.

TABLE VI-2

| | After the first run | | After 20 runs | |
|---|---|---|---|---|
| Example | $V_{po}$ (volts) | $E_{1/2}$ (lux · sec) | $V_{po}$ (volts) | $E_{1/2}$ (lux · sec) |
| VI-2 | 790 | 1.3 | 780 | 1.3 |
| VI-3 | 820 | 1.5 | 805 | 1.5 |
| VI-4 | 795 | 1.2 | 780 | 1.2 |
| VI-5 | 810 | 1.2 | 800 | 1.2 |
| VI-6 | 845 | 1.0 | 830 | 1.0 |
| VI-7 | 860 | 1.2 | 840 | 1.2 |
| VI-8 | 830 | 1.4 | 815 | 1.4 |
| VI-9 | 800 | 1.5 | 785 | 1.5 |
| VI-10 | 825 | 1.2 | 805 | 1.2 |

Comparative Examples VI-1 to VI-3

Comparative samples of photoreceptor were prepared in the same manner as in Example VI-1 except that in place of Compound No. VI-2, compounds having the following structural formulas (1), (2) and (3) were used (respectively corresponding to Comparative Examples VI-1, VI-2 and VI-3). The characteristics of these samples were evaluated in the same manner as in Example VI-1. The results are shown in Table VI-3.

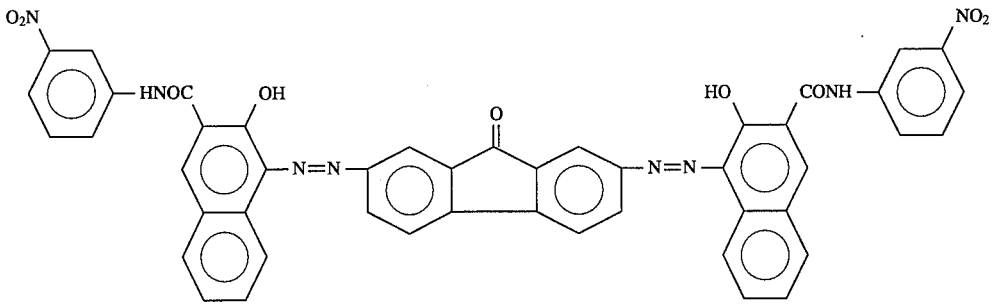

(1)

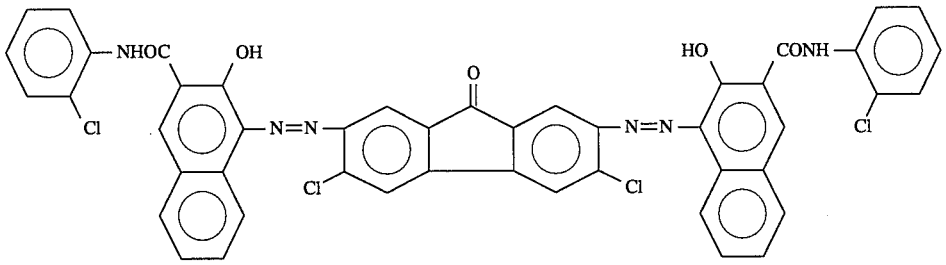

(2)

-continued

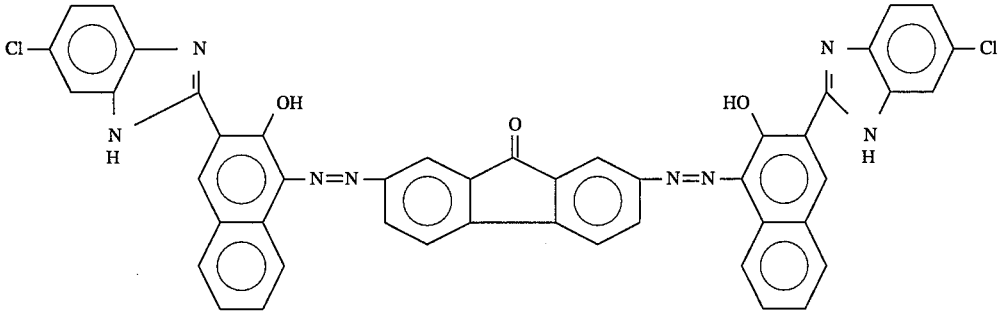

(3)

TABLE VI-3

| Comparative Example | After the first run $V_{po}$ (volt) | After the first run $E_{1/2}$ (lux · sec) | After 20 runs $V_{po}$ (volt) | After 20 runs $E_{1/2}$ (lux · sec) |
|---|---|---|---|---|
| VI-1 | 790 | 3.8 | 750 | 3.7 |
| VI-2 | 825 | 5.3 | 790 | 5.5 |
| VI-3 | 810 | 3.3 | 795 | 3.4 |

As is apparent from the results of Tables VI-1, VI-2 and VI-3, use of the bisazo compounds represented by formula (VI-1) exhibits better electrophotographic characteristics than use of the conventional azo pigments.

The electrophotographic photoreceptor of the present invention which uses these bisazo compounds in the light-sensitive layer has higher sensitivity and durability than photoreceptors that use conventional organic photoconductive materials.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor comprising a light-sensitive layer containing a bisazo or trisazo compound represented by formula (I-1), (II-1), (III-2), (III-3), (III-4), (IV-1), (V-1) or (VI-1)

(I-1)

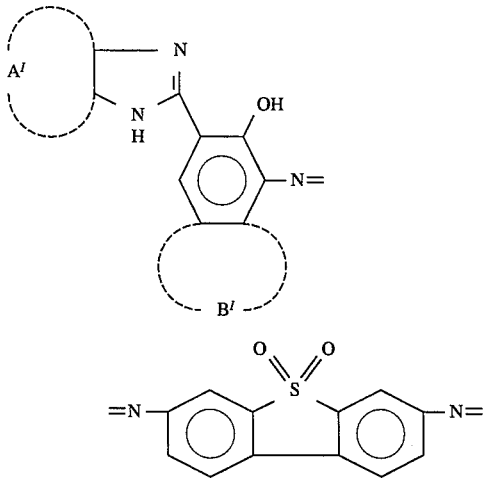

-continued

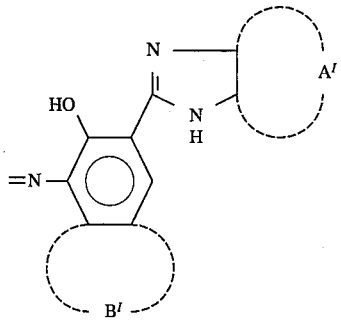

wherein $A^I$ represents the atomic group necessary to form an aromatic ring which may be substituted; and $B^I$ represents the atomic group necessary to form a naphthalene ring or a carbazole ring with the two carbon atoms of the hydroxy phenyl group of formula I-1, of which the carbazole ring may be substituted with one or more substituents selected from the group consisting of a halogen atom, an alkyl group, an alkoxy group and a nitro group;

(II-1)

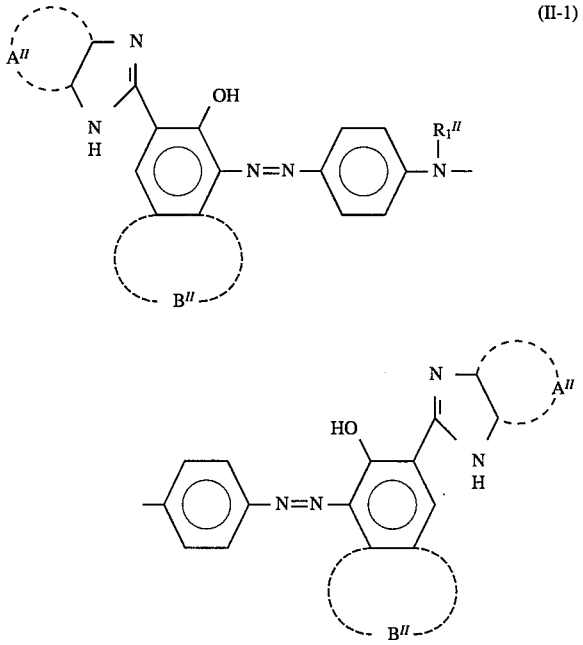

wherein $A^{II}$ represents the atomic group necessary to form an aromatic ring which may be substituted; $B^{II}$ represents the atomic group necessary to form a naphthalene ring or a carbazole ring with the two carbon atoms of the hydroxy phenyl group of formula II-1, of which the carbazole ring may be substituted with one or more substituents selected from the group consisting of a halogen atom, an alkyl group, an alkoxy group and a nitro group; and $R_1^{II}$ represents a hydrogen atom, an alkyl group or an aryl group;

(III-2)

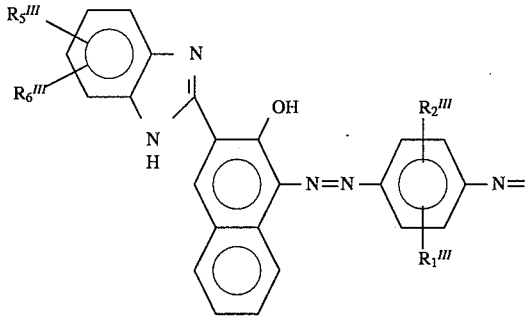

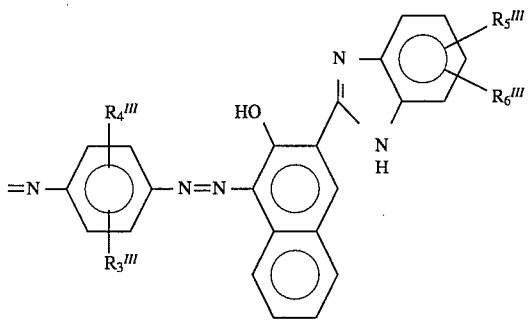

wherein $R_1^{III}$, $R_2^{III}$, $R_3^{III}$, and $R_4^{III}$, each represents a hydrogen atom, a halogen atom, an alkyl group, an alkoxy group or an alkenyl group, or $R_1^{III}$ and $R_2^{III}$ and $R_3^{III}$ and $R_4^{III}$ respectively represent the atomic groups necessary to form, in combination with each other, a naphthalene ting taken together with the benzene ring; $R_5^{III}$ and $R_6^{III}$ each represents a hydrogen atom, a halogen atom, an alkyl group, a nitro group, a cyano group or a β-dicyano-α-phenylvinyl group, or $R_5^{III}$ and $R_6^{III}$ respectively represent the atomic groups necessary to form, in combination with each other, a monocyclic or polycyclic hydrocarbon ring;

(III-3)

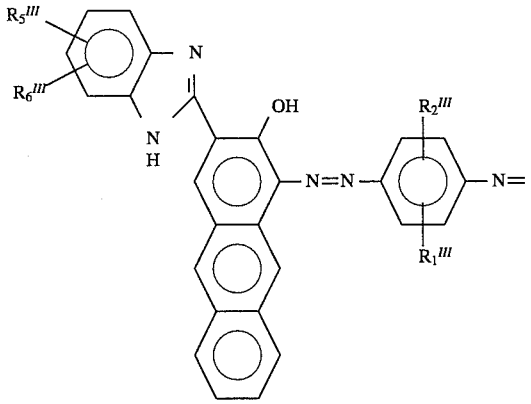

-continued

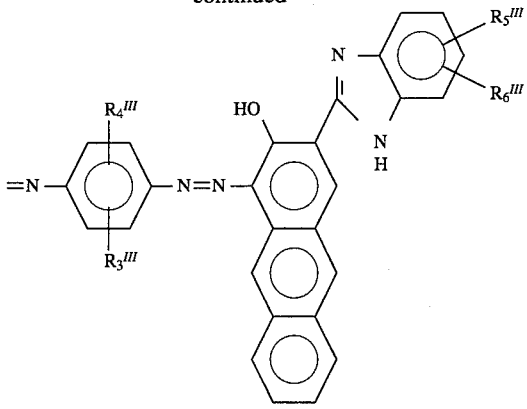

wherein $R_1^{III}$, $R_2^{III}$, $R_3^{III}$ and $R_4^{III}$ each represents a hydrogen atom, a halogen atom, an alkyl group, an alkoxy group or an alkenyl group, or $R_1^{III}$ and $R_2^{III}$ or $R_3^{III}$ and $R_4^{III}$ respectively represent the atomic groups necessary to form, in combination with each other, a naphthalene ring taken together with the benzene ring; $R_5^{III}$ and $R_6^{III}$ each represents a hydrogen atom, a halogen atom, an alkyl group, an alkenyl group, an aryl group or a β-dicyano-α-phenylvinyl group, or $R_5^{III}$ and $R_6^{III}$ respectively represent the atomic groups necessary to form, in combination with each other, a monocyclic or polycyclic hydrocarbon ring;

(III-4)

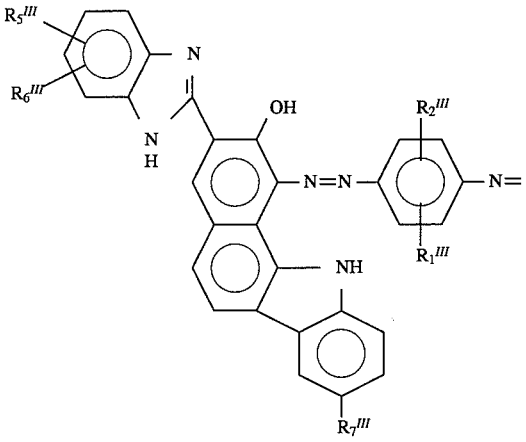

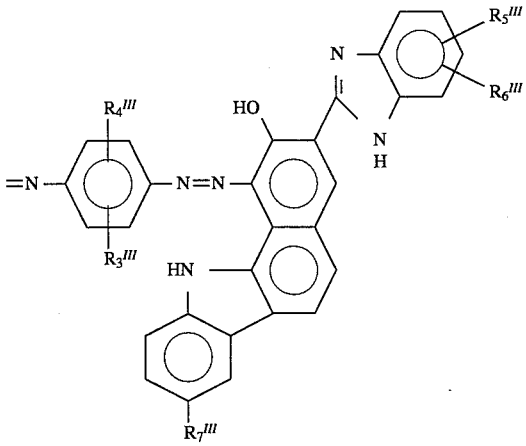

wherein $R_1^{III}$, $R_2^{III}$, $R_3^{III}$ and $R_4^{III}$ each represents a hydrogen atom, a halogen atom, an alkyl group, an alkoxy group or an alkenyl group, or $R_1^{III}$ and $R_2^{III}$ or $R_3^{III}$ and $R_4^{III}$ respectively represent the atomic groups necessary to form, in combination with each other, a naphthalene ring taken together with the benzene ring; $R_5^{III}$ and $R_6^{III}$ each represents a hydrogen atom, a halogen atom, an alkyl group, an alkenyl group, an aryl group, an alkoxy group, an acyl group, a nitro group, a cyano group or a β-dicyano-α-phenylvinyl group, or $R_5^{III}$ and $R_6^{III}$ respectively represent the atomic groups necessary to form, in combination with each other, a monocyclic or polycyclic hydrocarbon ring; and $R_7^{III}$ represents a hydrogen atom, a halogen atom, an alkyl group, an alkoxy group or a nitro group;

(IV-1)

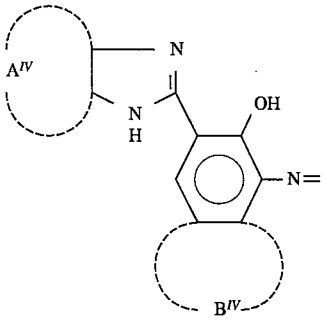

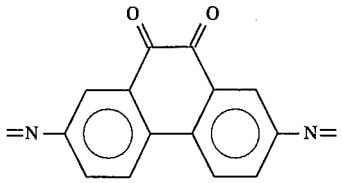

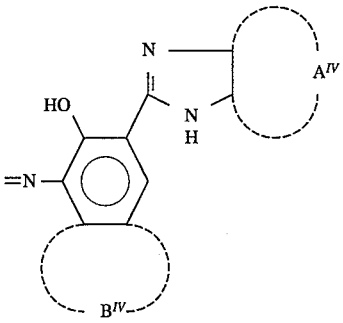

wherein $A^{IV}$ represents the atomic group necessary to form an aromatic ring or a hetero ring, of which the aromatic ring may be substituted; and $B^{IV}$ represents the atomic group necessary to form a naphthalene ring or a carbazole ring with the two carbon atoms of the hydroxy phenyl group of formula IV-1, of which the carbazole ring may be substituted with one or more substituents selected from the group consisting of a halogen atom, an alkyl group, an alkoxy group and a nitro group;

(V-1)

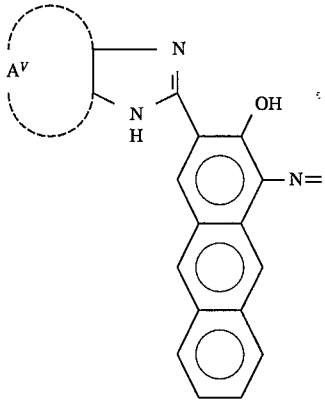

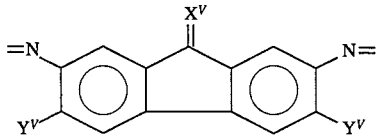

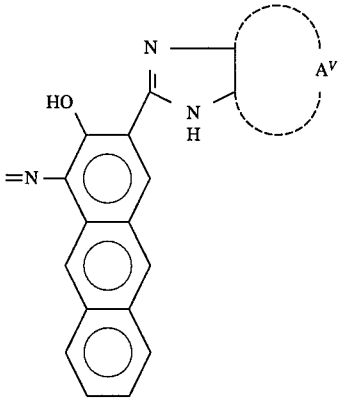

wherein $X^V$ represents an oxygen atom or a group

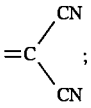

$Y^V$ represents a hydrogen atom or a halogen atom; and $A^V$ represents the atomic group necessary to form an aromatic ring or a hetero ring, of which the aromatic ring may be substituted;

(VI-1)

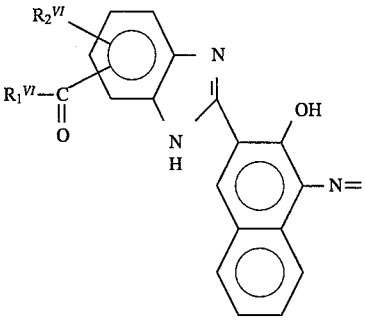

-continued

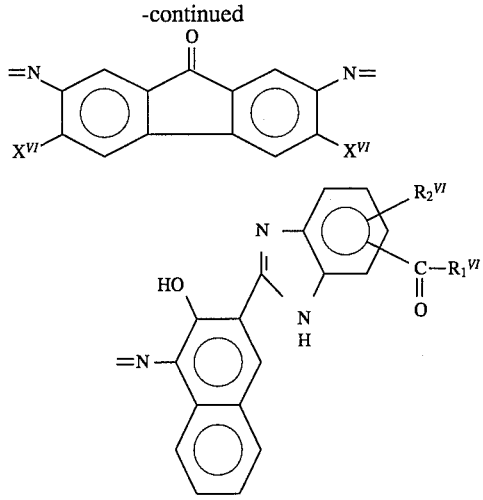

wherein $X^{VI}$ represents a hydrogen atom or a halogen atom; $R_1^{VI}$ represents an alkyl group or aryl group; $R_2^{VI}$ represents a hydrogen atom, a halogen atom, an alkyl group, an aryl group, an alkoxy group, an acyl group or a nitro group, or $R_1^{VI}$ and $R_2^{VI}$ may combine with each other to form a monocyclic or polycyclic hydrocarbon ring.

2. An electrophotographic photoreceptor as claimed in claim 1, wherein the bisazo compound represented by formula (I-1) is a compound represented by formula ( I-2):

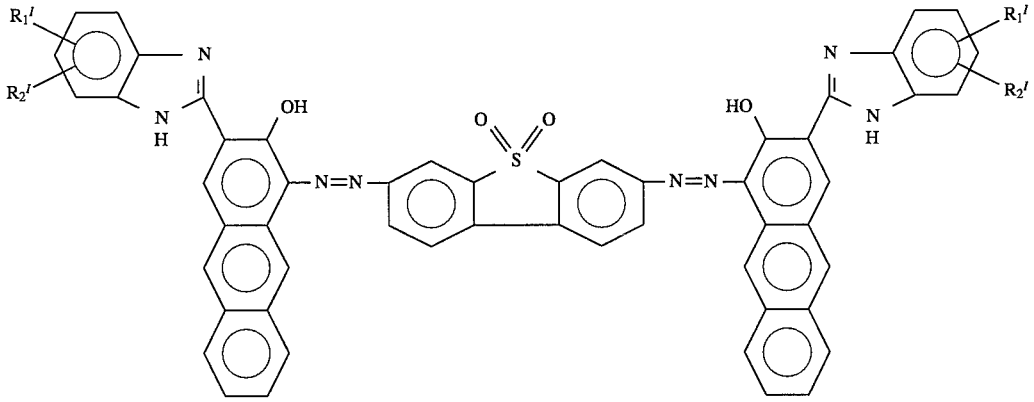

(I-2)

wherein $R_1^I$ and $R_2^I$ each represents a hydrogen atom, a halogen atom, an alkyl group, an alkenyl group, an aryl group, an alkoxy group, an acyl group, a nitro group, a cyano group or a β-dicyano-α-phenylvinyl group, or $R_1^I$ and $R_2^I$ represent atomic groups which, in combination with each other, form a monocyclic or polycyclic hydrocarbon ring any of which may be substituted.

3. An electrophotographic photoreceptor as claimed in claim 1, wherein the bisazo compound represented by formula (I-1) is a compound represented by formula ( I-3):

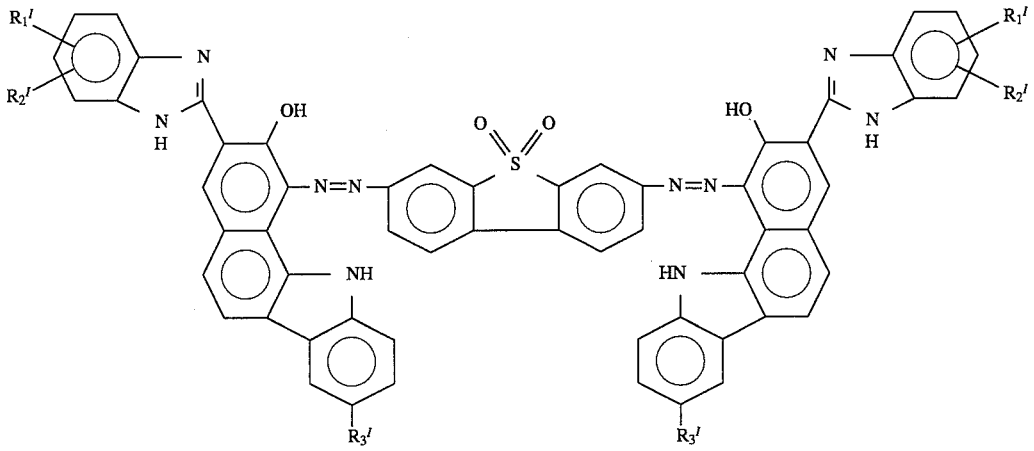

(I-3)

wherein $R_1^I$ and $R_2^I$ each represents a hydrogen atom, a halogen atom, an alkyl group, an alkenyl group, an aryl group, an alkoxy group, an acyl group, a nitro group, a cyano group or a β-dicyano-α-phenylvinyl group, or $R_1^I$ and $R_2^I$ represent atomic groups which, in combination with each other, form a monocyclic or polycyclic hydrocarbon ring any of which may be substituted; and $R_3^I$ represents a hydrogen atom, a halogen atom, an alkyl group, an alkoxy group or a nitro group.

4. An electrophotographic photoreceptor as claimed in claim 1, wherein the bisazo compound represented by formula (II-1) is a compound represented by formula (II-2):

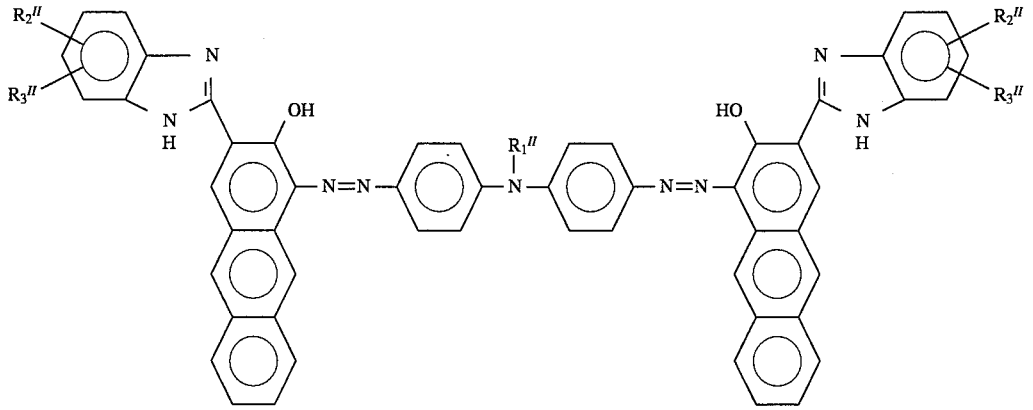

(II-2)

wherein $R_1^{II}$ represents a hydrogen atom, an alkyl group, or an aryl group; $R_2^{II}$ and $R_3^{II}$ each represents a hydrogen atom, a halogen atom, an alkyl group, an alkenyl group, an aryl group, an alkoxy group, an acyl group, a nitro group, a cyano group or a β-dicyano-α-phenylvinyl group, or $R_2^{II}$ and $R_3^{II}$ represent atomic groups which, in combination with each other, form a monocyclic or polycyclic hydrocarbon ring any of which may be substituted.

5. An electrophotographic photoreceptor as claimed in claim 1, wherein the bisazo compound represented by formula (II-1) is a compound represented by formula (II-3):

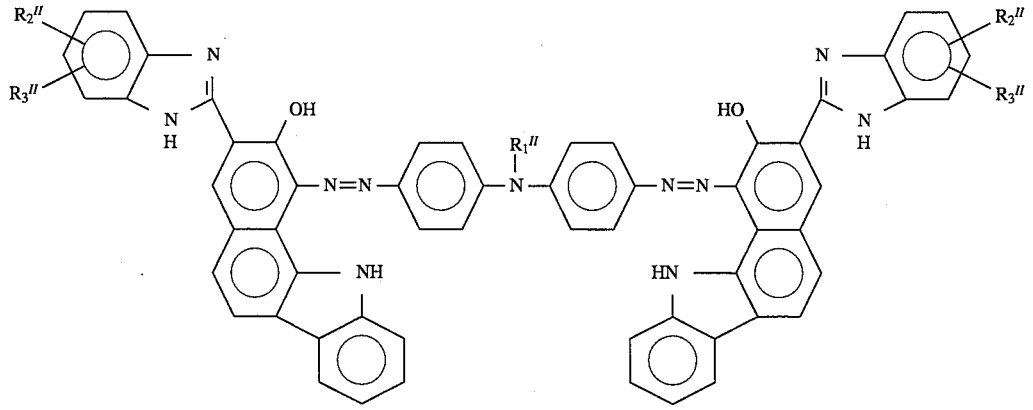

(II-3)

wherein $R_1^{II}$ represents a hydrogen atom, an alkyl group, or an aryl group; $R_2^{II}$ and $R_3^{II}$ each represents a hydrogen atom, a halogen atom, an alkyl group, an alkenyl group, an aryl group, an alkoxy group, an acyl group, a nitro group, a cyano group or a β-dicyano-α-phenylvinyl group, or $R_2^{II}$ and $R_3^{II}$ represent atomic groups which, in combination with each other, form a monocyclic or polycyclic hydrocarbon ring any of which may be substituted.

6. An electrophotographic photoreceptor as claimed in claim 1, wherein the bisazo compound represented by formula (IV-1) is a compound represented by formula (IV-2):

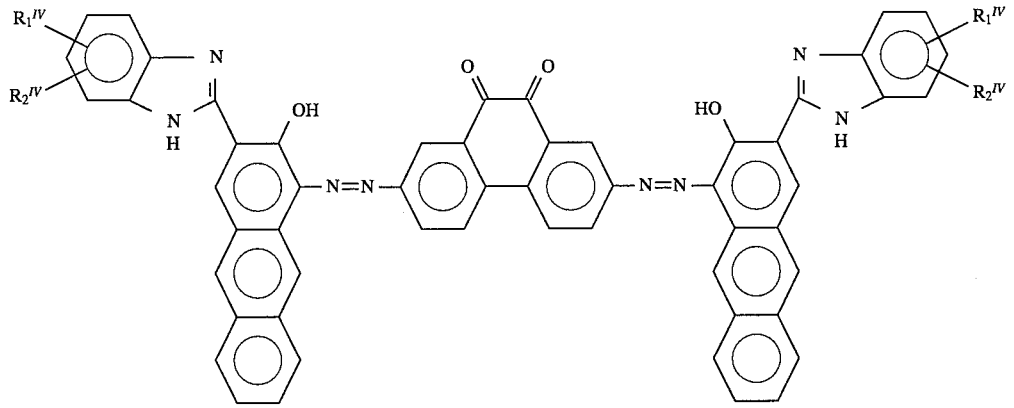

(IV-2)

wherein $R_1^{IV}$ and $R_2^{IV}$ each represents a hydrogen atom, a halogen atom, an alkyl group, an alkenyl group, an aryl group, an alkoxy group, an acyl group, a nitro group, a cyano group or a β-dicyano-α-phenylvinyl group, or $R_1^{IV}$ and $R_2^{IV}$ respectively represent the atomic groups which, in combination with each other, form a monocyclic or polycyclic hydrocarbon ring any of which may be substituted.

7. An electrophotographic photoreceptor as claimed in claim 1, wherein the bisazo compound represented by formula (IV-1) is a compound represented by formula (IV-3):

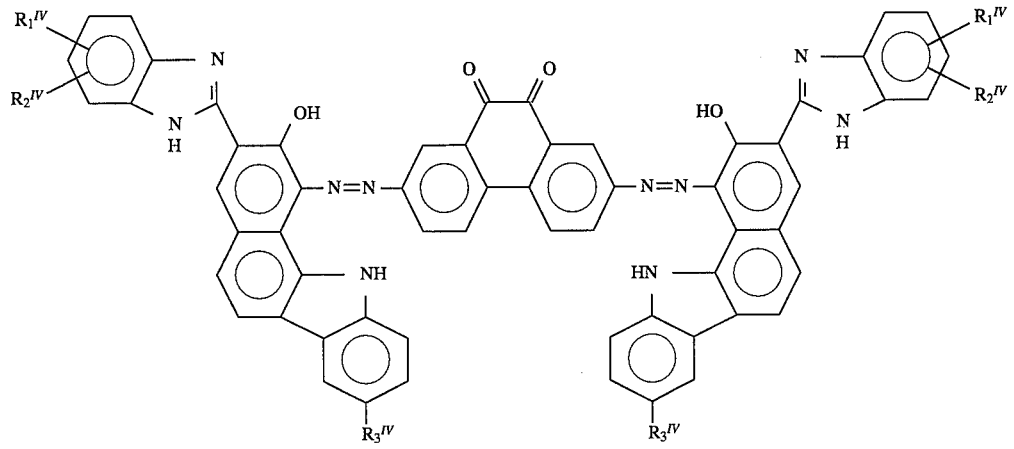

(IV-3)

wherein $R_1^{IV}$ and $R_2^{IV}$ each represents a hydrogen atom, a halogen atom, an alkyl group, an alkenyl group, an aryl group, an alkoxy group, an acyl group, a nitro group, a cyano group or a β-dicyano-α-phenylvinyl group, or $R_1^{IV}$ and $R_2^{IV}$ respectively represent the atomic groups which, in combination with each other, form a monocyclic or polycyclic hydrocarbon ring any of which may be substituted; and $R_3^{IV}$ represents a hydrogen atom, a halogen atom, an alkyl group, an alkoxy group or a nitro group.

8. An electrophotographic photoreceptor as claimed in claim 1, wherein the bisazo compound represented by formula (V-1) is a compound represented by formula (V-2):

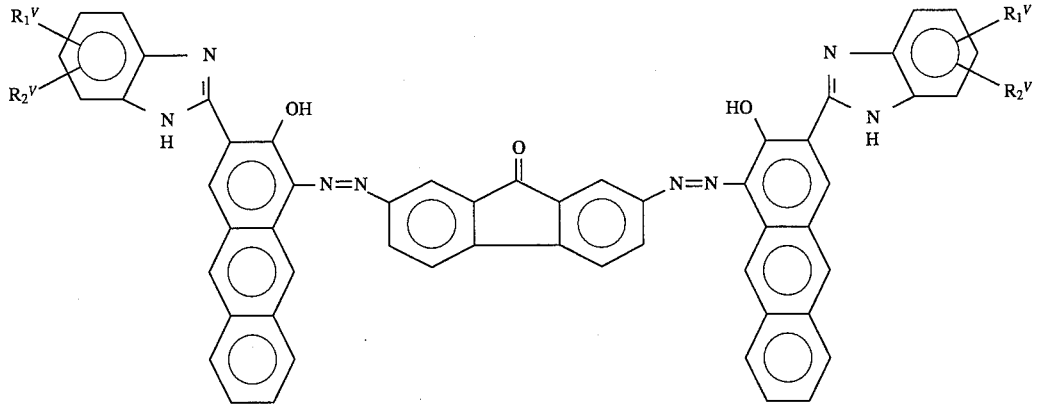

(V-2)

wherein $R_1^V$ and $R_2^V$ each represents a hydrogen atom, a halogen atom, an alkyl group, an alkenyl group, an aryl group, an alkoxy group, an acyl group, a nitro group, a cyano group or a β-dicyano-α-phenylvinyl group, or $R_1^V$ and $R_2^V$ respectively represent atomic groups that, in combination with each other, form a monocyclic or polycyclic hydrocarbon ring any of which may be substituted.

9. An electrophotographic photoreceptor as claimed in claim 1, wherein the bisazo compound represented by formula (V-1) is a compound represented by formula (V-3):

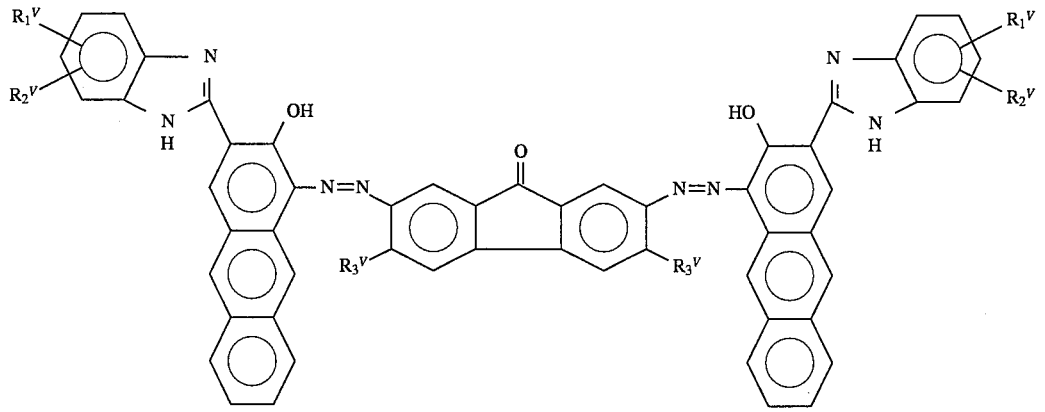

(V-3)

wherein $R_1^V$ and $R_2^V$ each represents a hydrogen atom, a halogen atom, an alkyl group, an alkenyl group, an aryl group, an alkoxy group, an acyl group, a nitro group, a cyano group or a β-dicyano-α-phenylvinyl group, or $R_1^V$ and $R_2^V$ respectively represent atomic groups that, in combination with each other, form a monocyclic or polycyclic hydrocarbon ring any of which may be substituted; and $R_3^V$ represents a hydrogen atom or a halogen atom.

10. An electrophotographic photoreceptor as claimed in claim 1, wherein the bisazo compound represented by formula (V-1) is a compound represented by formula (V-4):

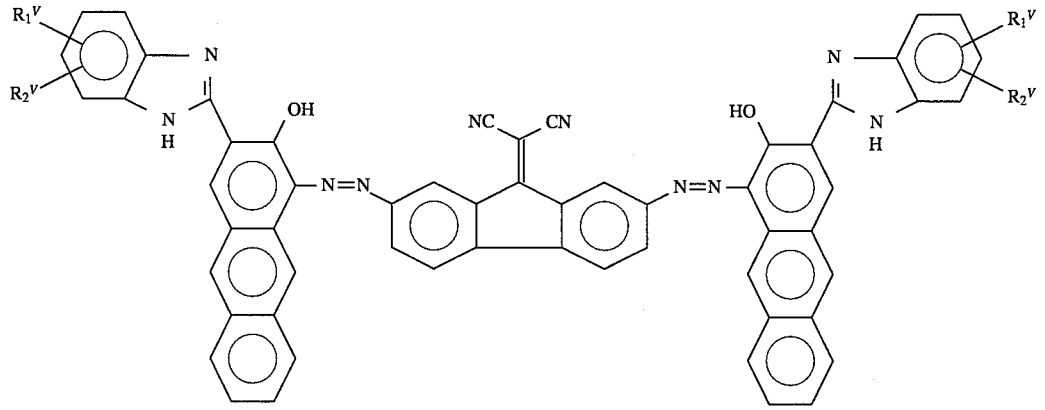

(V-4)

wherein $R_1^V$ and $R_2^V$ each represents a hydrogen atom, a halogen atom, an alkyl group, an alkenyl group, an aryl group, an alkoxy group, an acyl group, a nitro group, a cyano group or a β-dicyano-α-phenylvinyl group, or $R_1^V$ and $R_2^V$ respectively represent atomic groups that, in combination with each other, form a monocyclic or polycyclic hydrocarbon ring any of which may be substituted.

11. An electrophotographic photoreceptor as claimed in claim 1, wherein the bisazo compound represented by formula (V-1) is a compound represented by formula (V-5):

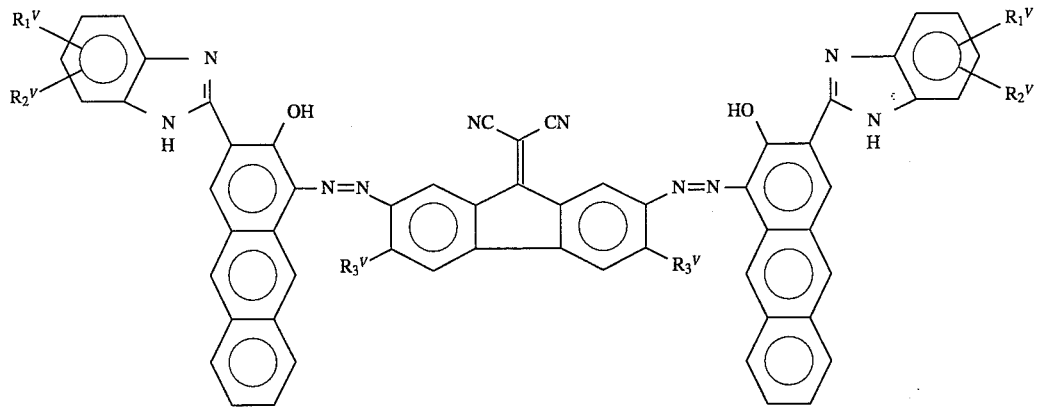

(V-5)

wherein $R_1^V$ and $R_2^V$ each represents a hydrogen atom, a halogen atom, an alkyl group, an alkenyl group, an aryl group, an alkoxy group, an acyl group, a nitro group, a cyano group or a β-dicyano-α-phenylvinyl group, or $R_1^V$ and $R_2^V$ respectively represent atomic groups that, in combination with each other, form a monocyclic or polycyclic hydrocarbon ring any of which may be substituted; and $R_3^V$ represents a hydrogen atom or a halogen atom.

12. An electrophotographic photoreceptor as claimed in claim 1, wherein the bisazo compound represented by formula (VI-1) is a compound represented by formula (VI-2):

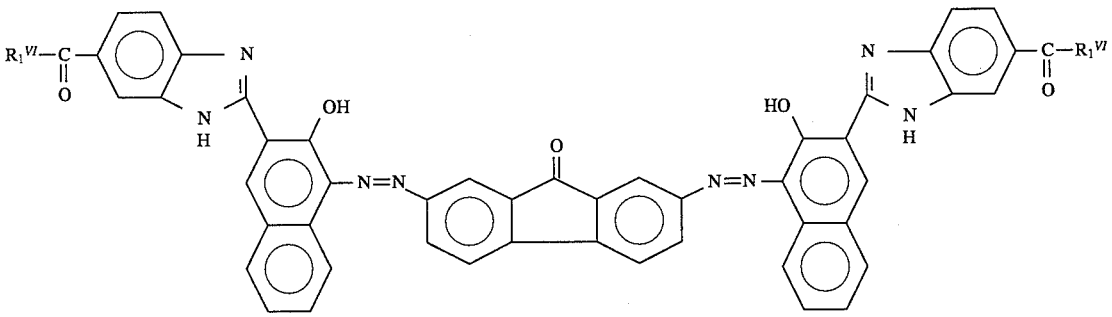

(VI-2)

wherein $R_1^{VI}$ represents a methyl group or a phenyl group.

13. An electrophotographic photoreceptor as claimed in claim 1, wherein the bisazo compound represented by formula (VI-1) is a compound represented formula (VI-3):

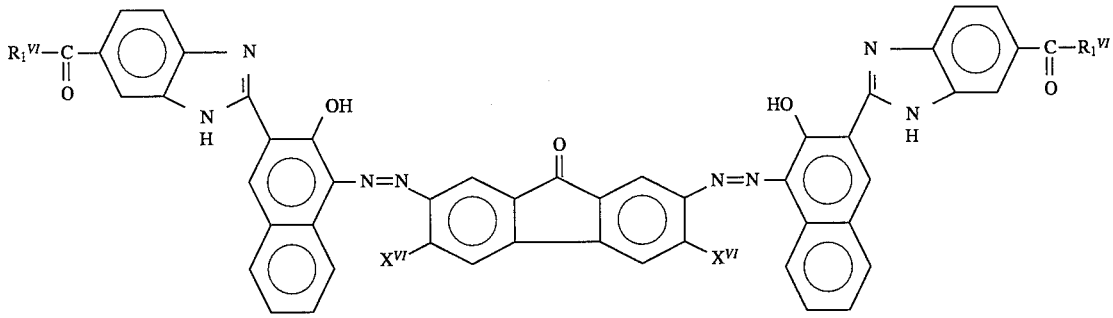

(VI-3)

wherein $X^{VI}$ represents a chlorine atom or a bromine atom; and $R_1^{VI}$ represents a methyl group or a phenyl group.

14. An electrophotographic photoreceptor as claimed in claim 1 wherein $A^I$ is a compound represented by the formula:

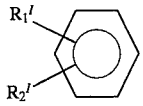

wherein $R_1^I$ and $R_2^I$ each represents a hydrogen atom, a halogen atom, an alkyl group, an alkenyl group, an aryl group, an alkoxy group, an acyl group, a nitro group, a cyano group or a β-dicyano-α-phenylvinyl group, or $R_1^I$ and $R_2^I$ represent atomic groups which, in combination with each other, form a monocyclic or polycyclic hydrocarbon ring.

15. An electrophotographic photoreceptor as claimed in claim 1, wherein $A^{II}$ is a compound represented by the formula:

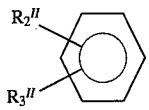

wherein $R_2^{II}$ and $R_3^{II}$ each represents a hydrogen atom, a halogen atom, an alkyl group, an alkenyl group, an aryl group, an alkoxy group, an acyl group, a nitro group, a cyano group or a β-dicyano-α-phenylvinyl group, or $R_2^{II}$ and $R_3^{II}$ represent atomic groups which, in combination with each other, form a monocyclic or polycyclic hydrocarbon ring.

16. An electrophotographic photoreceptor as claimed in claim 1, wherein $A^{IV}$ is a compound represented by the formula:

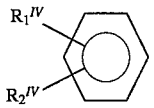

wherein $R_1^{IV}$ and $R_2^{IV}$ each represents a hydrogen atom, a halogen atom, an alkyl group, an alkenyl group, an aryl group, an alkoxy group, an acyl group, a nitro group, a cyano group or a β-dicyano-α-phenylvinyl group, or $R_1^{IV}$ and $R^{2IV}$ respectively represent the atomic groups which, in combination with each other, form a monocyclic or polycyclic hydrocarbon ring.

17. An electrophotographic photoreceptor as claimed in claim 1, wherein the $A^V$ is a compound represented by the formula:

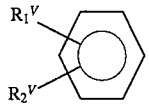

wherein $R_1^V$ and $R_2^V$ each represents a hydrogen atom, a halogen atom, an alkyl group, an alkenyl group, an aryl group, an alkoxy group, an acyl group, a nitro group, a cyano group or a β-dicyano-α-phenylvinyl group, or $R_1^V$ and $R_2^V$ respectively represent atomic groups that, in combination with each other, form a monocyclic or polycyclic hydrocarbon ring.

* * * * *